US008641840B2

(12) United States Patent
Branagan et al.

(10) Patent No.: US 8,641,840 B2
(45) **Date of Patent: *Feb. 4, 2014**

(54) METHOD OF MAKING NON-STAINLESS STEELS WITH HIGH STRENGTH AND HIGH DUCTILITY

(71) Applicant: The NanoSteel Company, Inc., Providence, RI (US)

(72) Inventors: Daniel James Branagan, Idaho Falls, ID (US); Brian E. Meacham, Idaho Falls, ID (US); Jason K. Walleser, Idaho Falls, ID (US); Andrew T. Ball, Ammon, ID (US); Grant G. Justice, Idaho Falls, ID (US); Brendan L. Nation, Idaho Falls, ID (US); Sheng Cheng, Idaho Falls, ID (US); Alla V. Sergueeva, Idaho Falls, ID (US)

(73) Assignee: The NanoSteel Company, Inc., Providence, RI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/863,911

(22) Filed: Apr. 16, 2013

(65) Prior Publication Data

US 2013/0233452 A1 Sep. 12, 2013

Related U.S. Application Data

(63) Continuation of application No. 13/862,825, filed on Apr. 15, 2013, which is a continuation of application No. 13/556,410, filed on Jul. 24, 2012, now Pat. No. 8,419,869.

(60) Provisional application No. 61/583,261, filed on Jan. 5, 2012, provisional application No. 61/604,837, filed on Feb. 29, 2012.

(51) Int. Cl.
*C21D 9/00* (2006.01)

(52) U.S. Cl.
USPC ..... 148/561; 148/540; 148/579; 148/648

(58) Field of Classification Search
USPC ..... 148/320, 328, 330, 333–337, 579, 648, 148/561, 540; 420/104, 117, 119
See application file for complete search history.

(56) References Cited

U.S. PATENT DOCUMENTS

| | | | | |
|---|---|---|---|---|
| 4,297,135 | A * | 10/1981 | Giessen et al. | 148/321 |
| 4,576,653 | A * | 3/1986 | Ray | 419/61 |
| 6,689,234 | B2 * | 2/2004 | Branagan | 148/660 |
| 7,323,071 | B1 * | 1/2008 | Branagan | 148/561 |
| 8,133,333 | B2 * | 3/2012 | Branagan et al. | 148/561 |
| 8,257,512 | B1 * | 9/2012 | Branagan et al. | 148/326 |
| 8,419,869 | B1 * | 4/2013 | Branagan et al. | 148/579 |

* cited by examiner

*Primary Examiner* — Deborah Yee
(74) *Attorney, Agent, or Firm* — Grossman, Tucker, Perreault & Pfleger, PLLC

(57) ABSTRACT

The present disclosure is directed and formulations and methods to provide non-stainless steel alloys having relative high strength and ductility. The alloys may be provided in sheet or pressed form and characterized by their particular alloy chemistries and identifiable crystalline grain size morphology. The alloys are such that they include boride pinning phases. In what is termed a Class 1 Steel the alloys indicate tensile strengths of 630 MPa to 1100 MPa and elongations of 10-40%. Class 2 Steel indicates tensile strengths of 875 MPa to 1590 MPa and elongations of 5-30%. Class 3 Steel indicates tensile strengths of 1000 MPa to 1750 MPa and elongations of 0.5-15%.

14 Claims, 74 Drawing Sheets

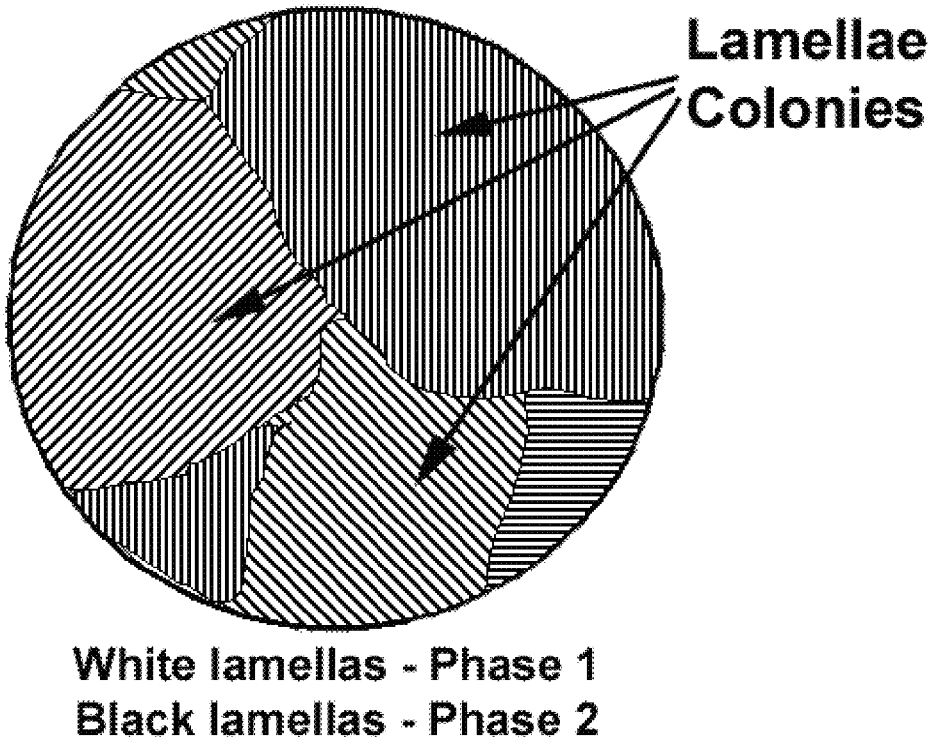
FIG. 6A Schematic illustration of lamellae structure.

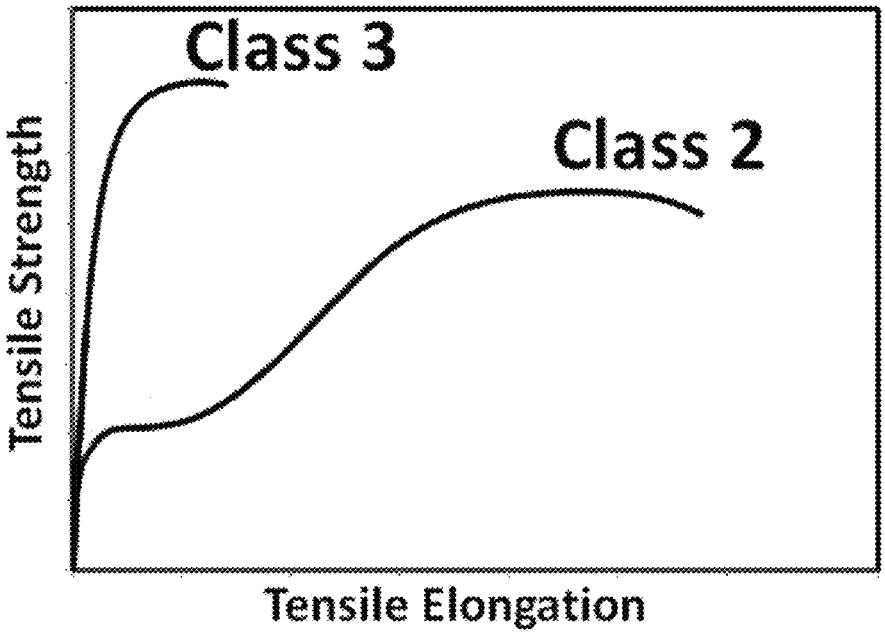
FIG. 6B Mechanical response of Class 3 steel upon tension at room temperature as compared to Class 2 steel.

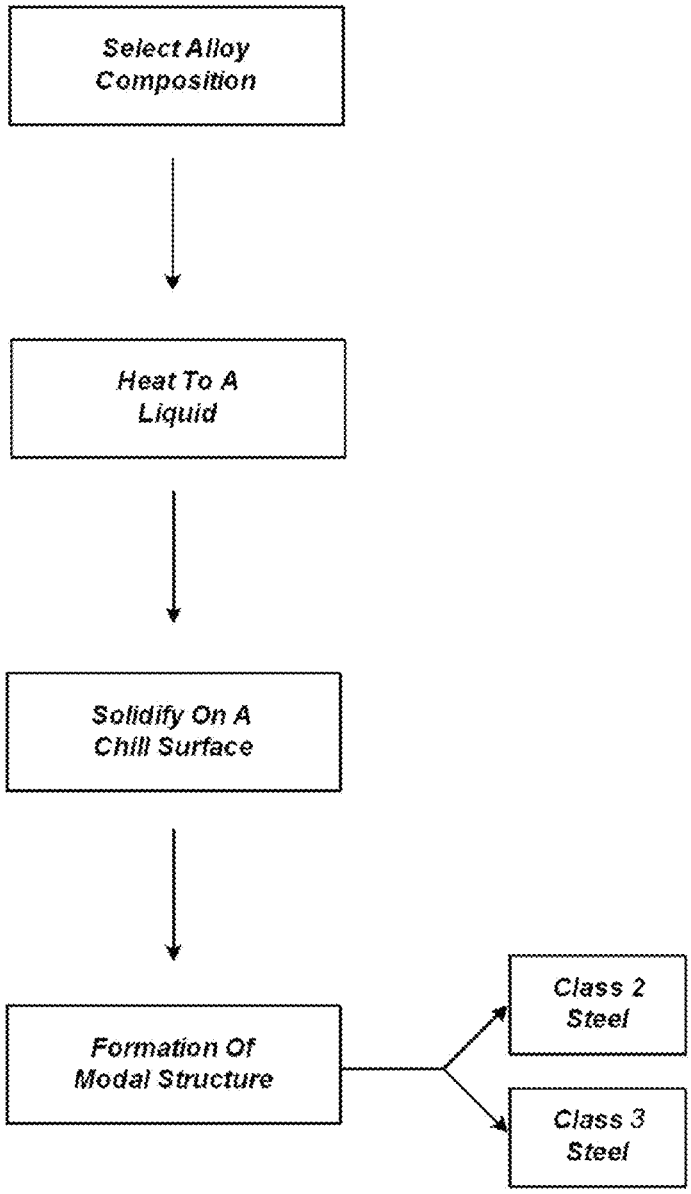
FIG. 7 Modal Structure formation is an initial step for Class 2 or Class 3 steel development depending of alloy chemistry and thermal mechanical treatment.

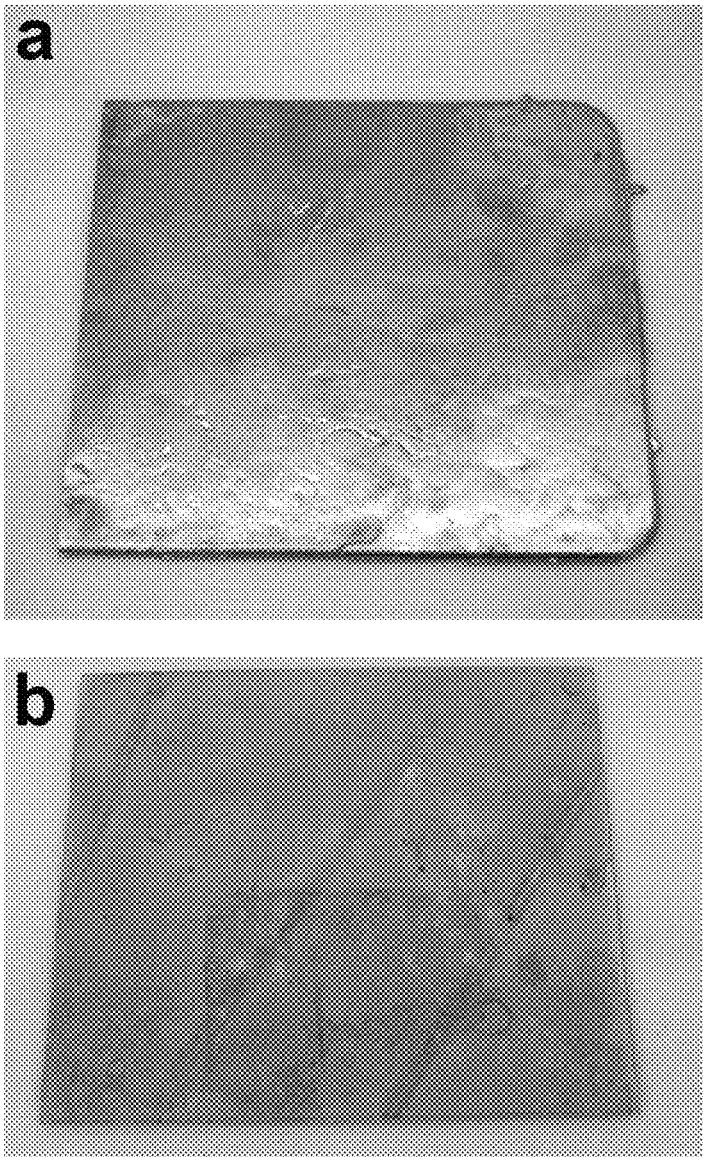
FIG. 8 Pictures of the Alloy 6 plate; a) As-cast, b) After HIP cycle C at 1100°C for 1 hour.

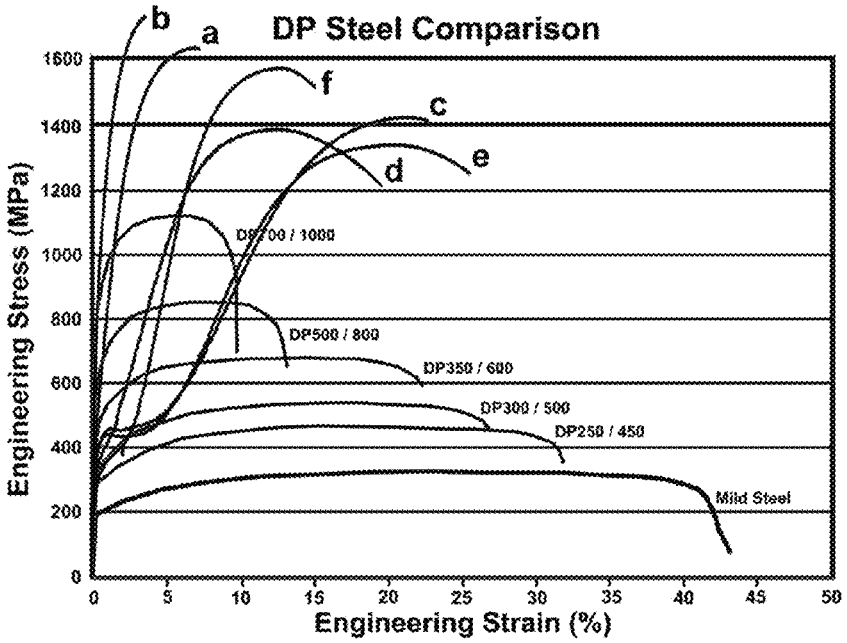
FIG. 9 Comparison of stress-strain curves of new non-stainless steel sheet types with existing Dual Phase (DP) steels.

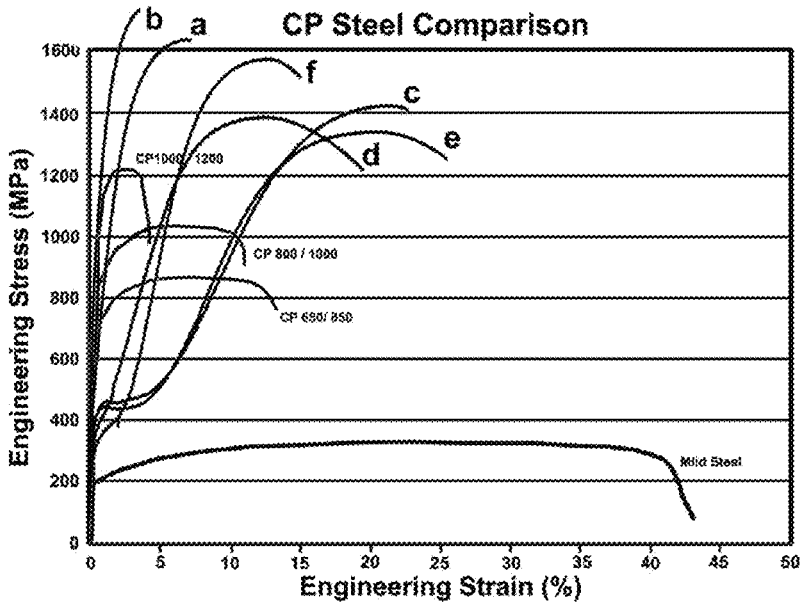
FIG. 10 Comparison of stress-strain curves of new non-stainless steel sheet types with existing Complex Phase (CP) steels.
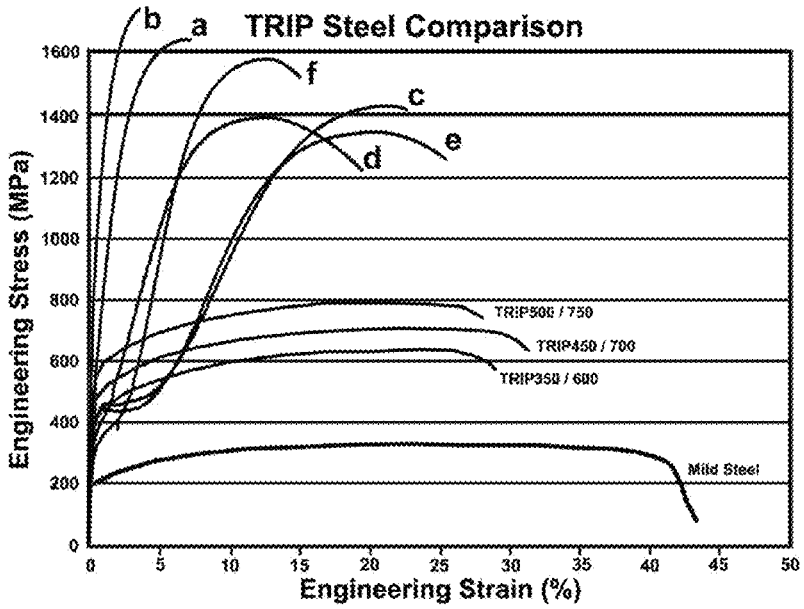
FIG. 11 Comparison of stress-strain curves of new non-stainless steel sheet types with existing Transformation Induced Plasticity (TRIP) steels.

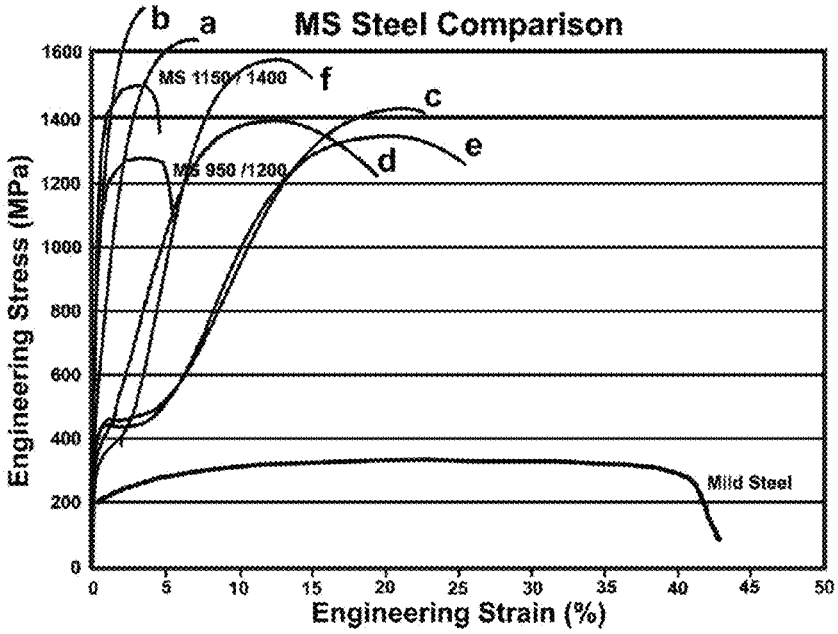
FIG. 12 Comparison of stress-strain curves of new non-stainless steel sheet types with existing Martensitic (MS) steels.

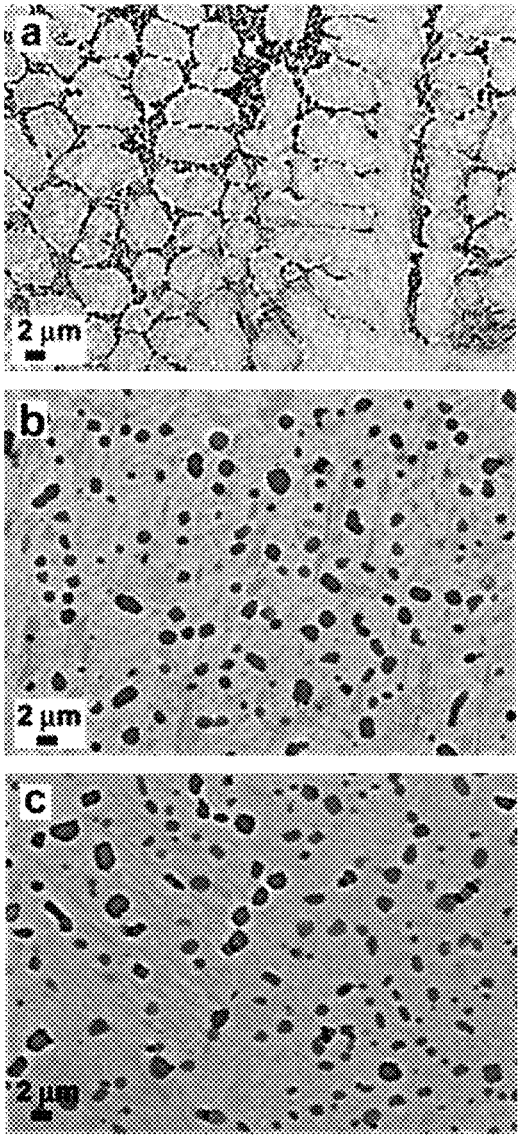
FIG. 13 SEM backscattered electron micrographs of the Alloy 51 plate sample; a) As-Cast, b) HIPed at 1100°C for 1 hour, and c) HIPed at 1100°C for 1 hour and heat treated at 700°C for 1 hour with air cooling.

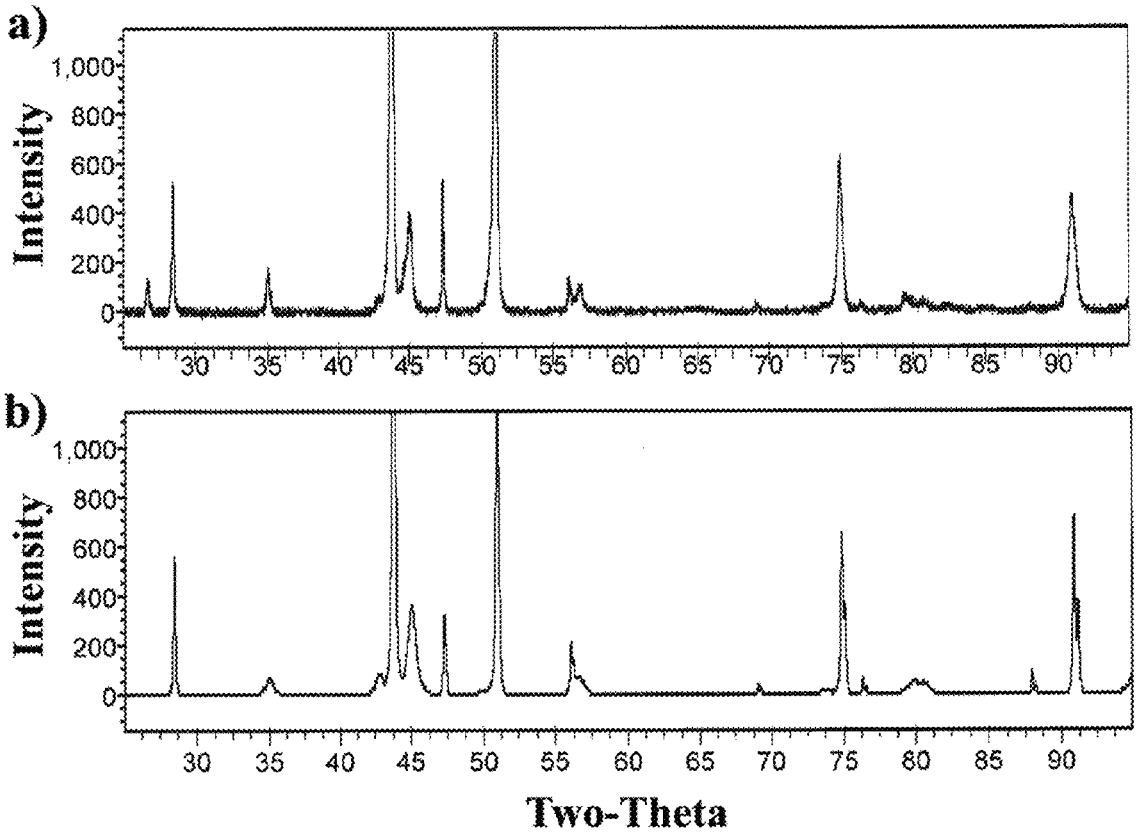
FIG. 14 X-ray diffraction data (intensity vs two-theta) for Alloy 51 plate in the as-cast condition; a) Measured pattern, b) Rietveld calculated pattern.

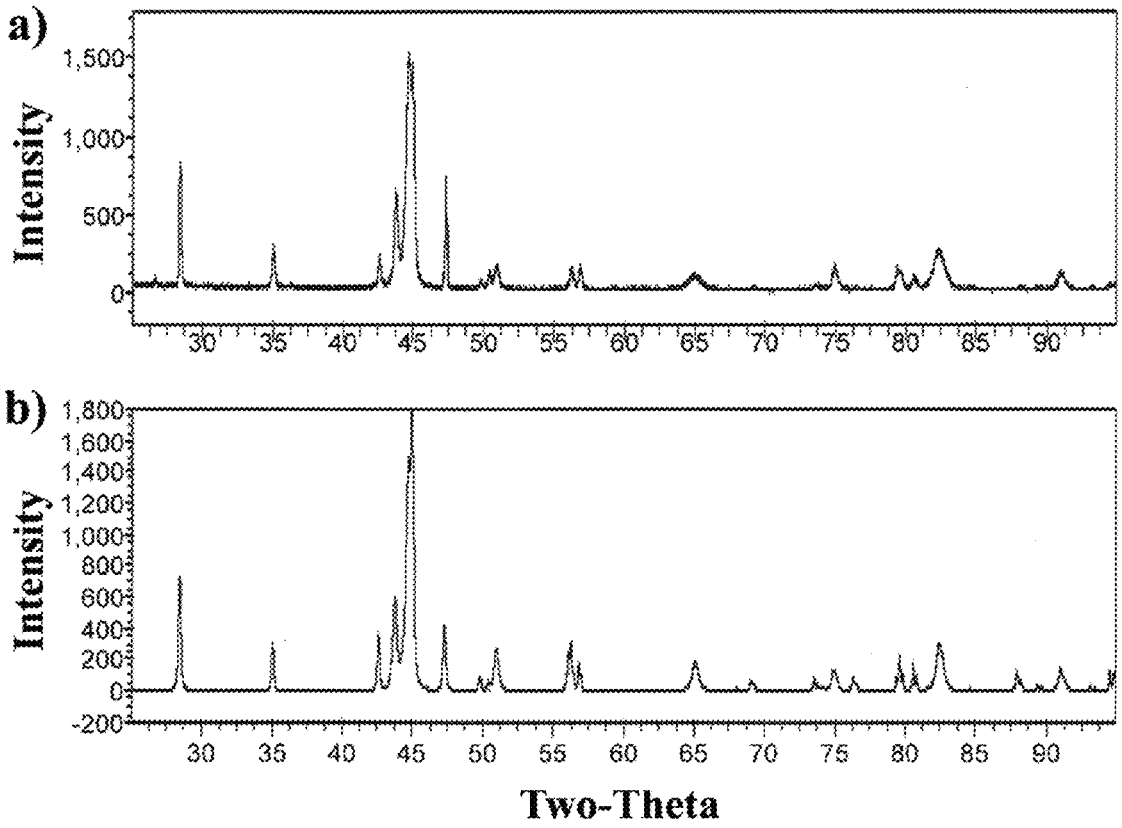
FIG. 15 X-ray diffraction data (intensity vs two-theta) for Alloy 51 plate in the HIPed condition (1100°C for 1 hour); a) Measured pattern, b) Rietveld calculated pattern with peaks identified.

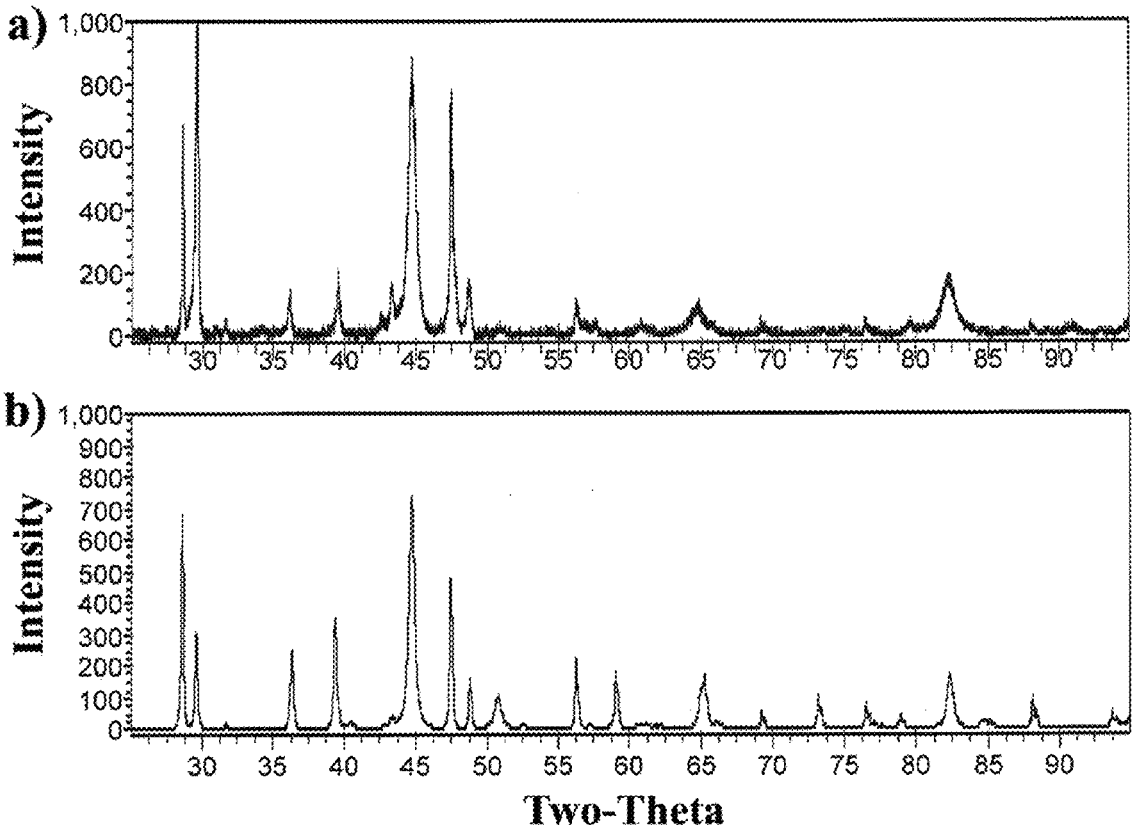
FIG. 16 X-ray diffraction data (intensity vs two-theta) for Alloy 51 plate in the HIPed (1100°C for 1 hour) and heat treated condition (700°C for 1 hour to room temperature); a) Measured pattern, b) Rietveld calculated pattern with peaks identified.

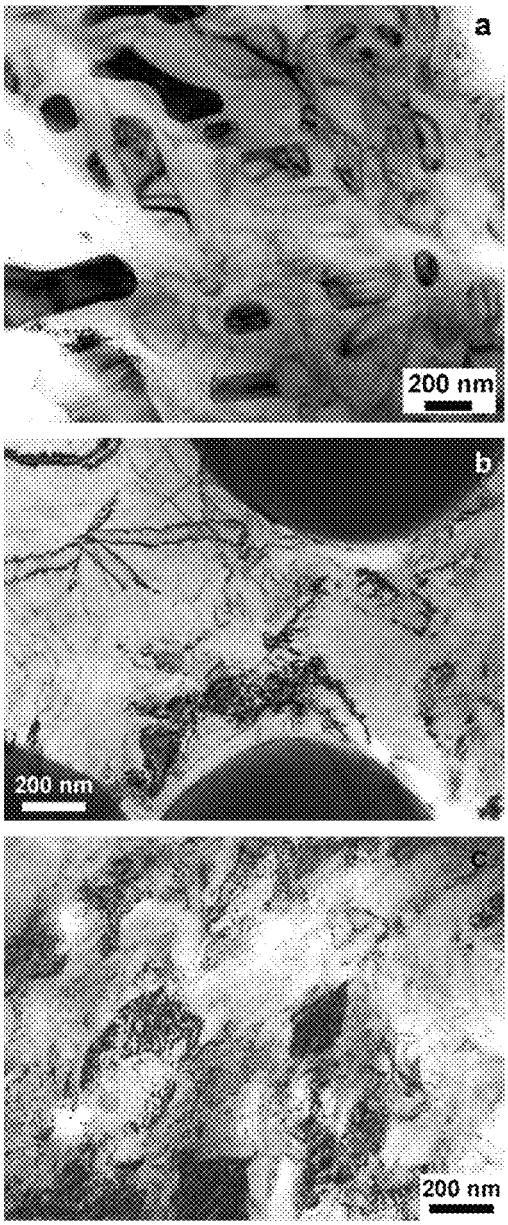
FIG. 17 TEM micrographs of the Alloy 51 plate sample; a) As-Cast, b) HIPed at 1100°C for 1 hour, and c) HIPed at 1100°C for 1 hour and heat treated at 700°C for 1 hour. Observations are consistent with SEM and X-ray diffraction analysis results.

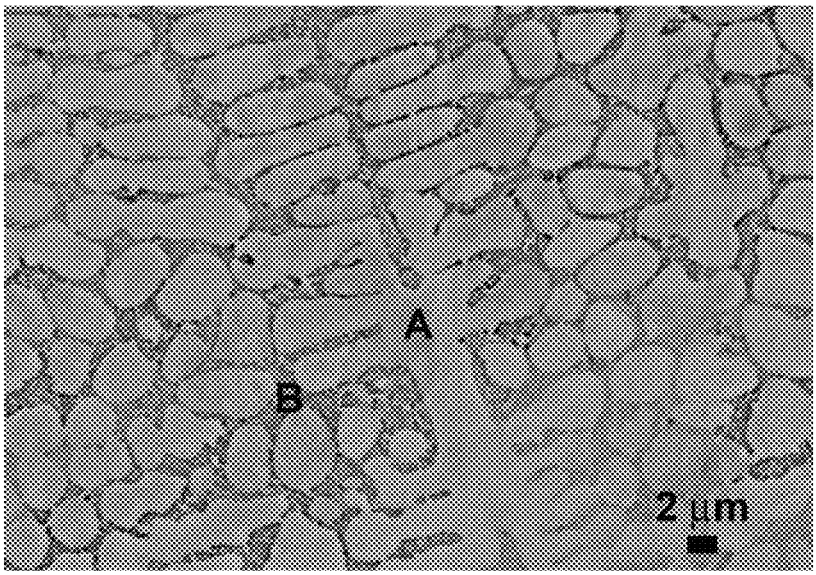
FIG. 18 The backscattered SEM micrograph of the microstructure in the as-cast Alloy 6 plate sample.

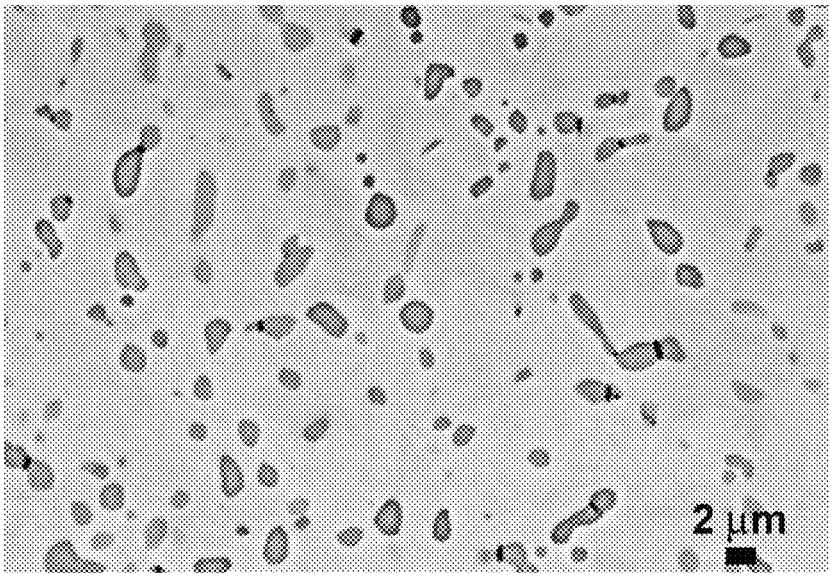
FIG. 19 The backscattered SEM micrograph of the microstructure in the Alloy 6 plate sample after HIP cycle at 1100°C for 1 hour.

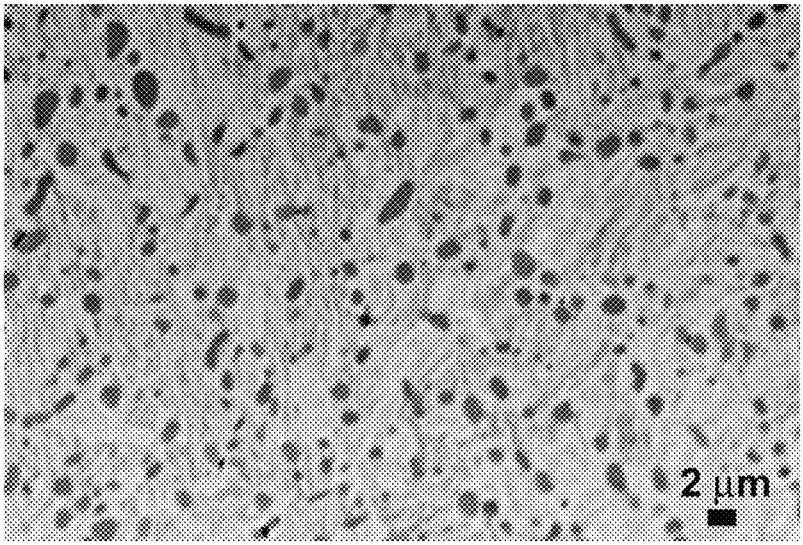
FIG. 20 The backscattered SEM micrograph of the microstructure in the Alloy 6 plate sample after HIP cycle at 1100°C for 1 hour and heat treated at 700°C for 60 minutes with slow furnace cooling.

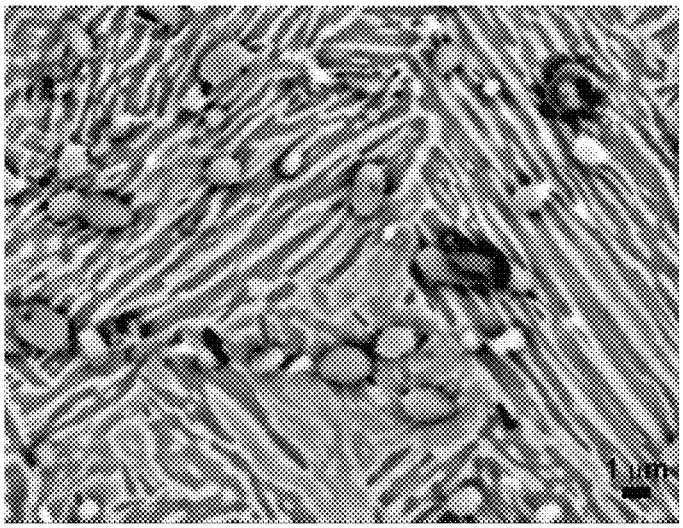
FIG. 21 The backscattered SEM micrograph of the microstructure in the etched Alloy 6 sample after at 1100°C for 1 hour and heat treated at 700°C for 60 minutes with slow furnace cooling at higher magnification.

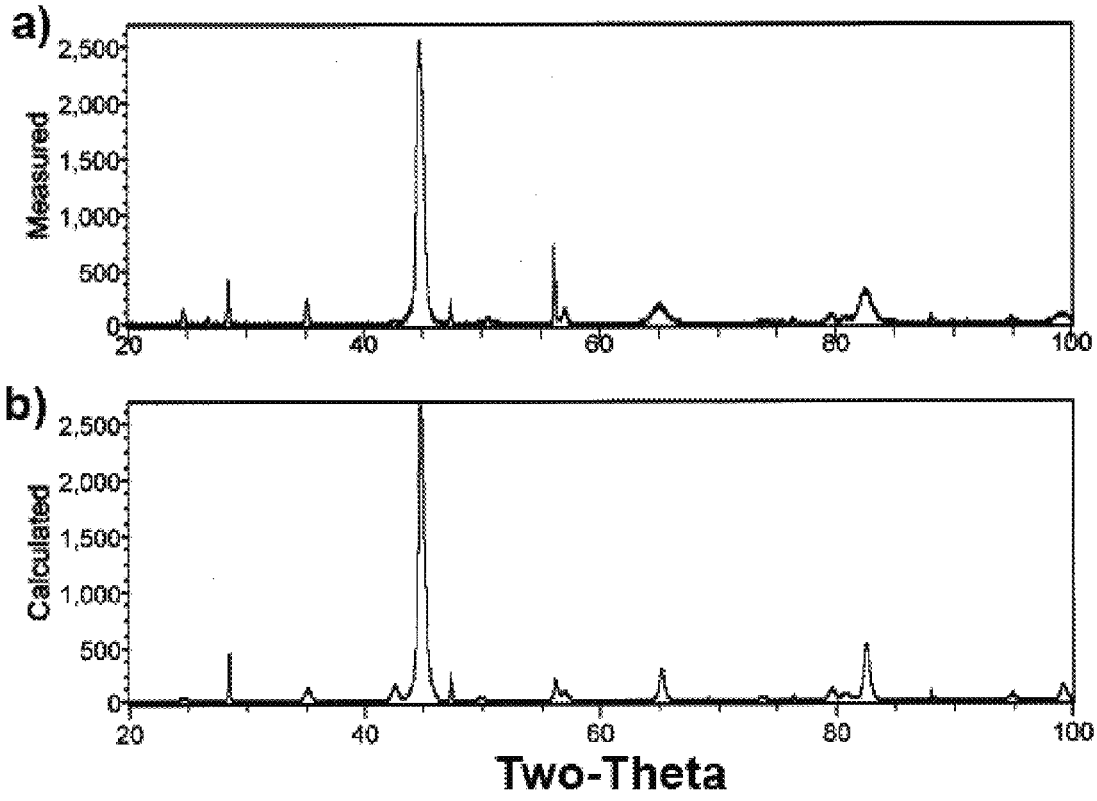
FIG. 22 X-ray diffraction data (intensity vs two-theta) for Alloy 6 plate in the as-cast condition; a) Measured pattern, b) Rietveld calculated pattern with peaks identified.

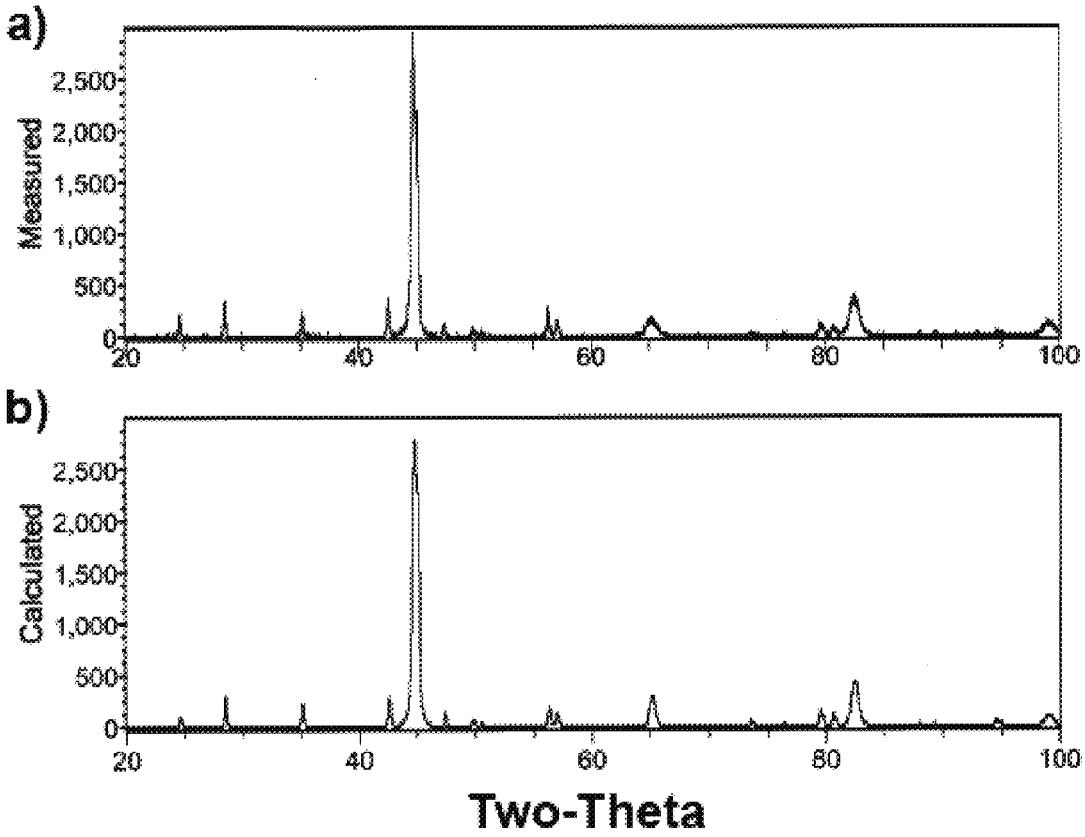
FIG. 23 X-ray diffraction data (intensity vs two-theta) for plate sample from the Alloy 6 in the HIPed condition (1100°C for 1 hour); a) Measured pattern, b) Rietveld calculated pattern with peaks identified.

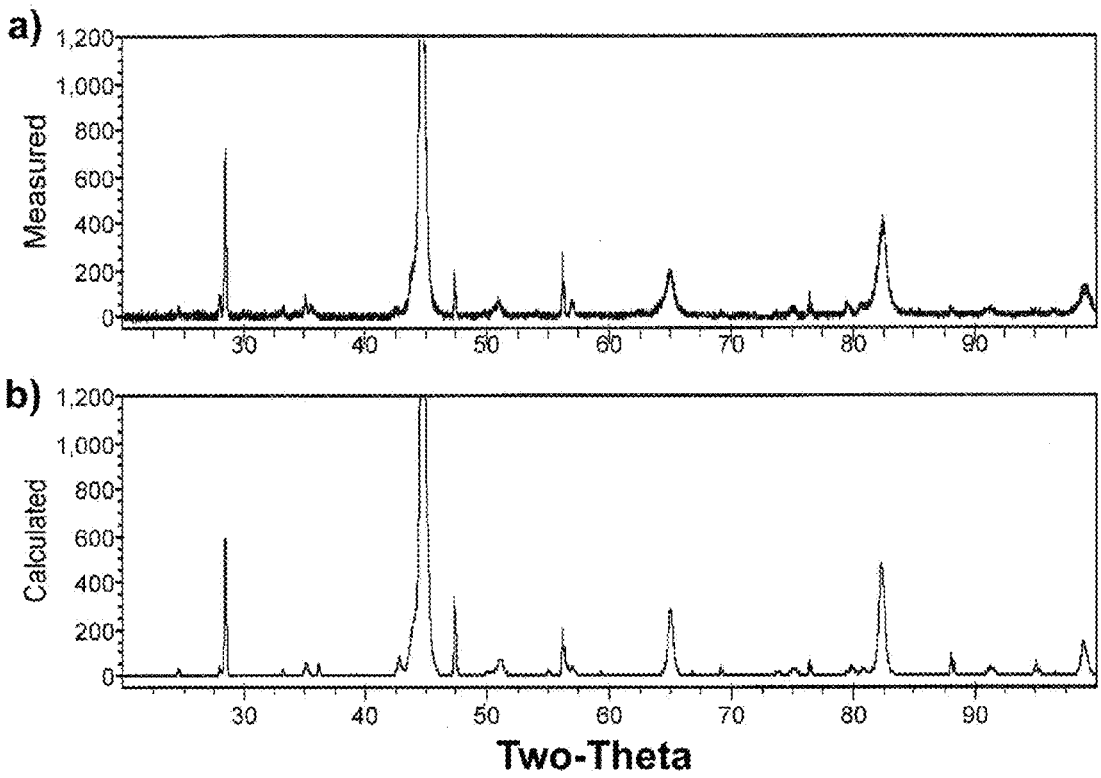
FIG. 24 X-ray diffraction data (intensity vs two-theta) for plate sample from the Alloy 6 in the HIPed (1100°C for 1 hour) and heat treated condition (700°C slow cool to room temperature (670 minute total time).); a) Measured pattern, b) Rietveld calculated pattern with peaks identified.

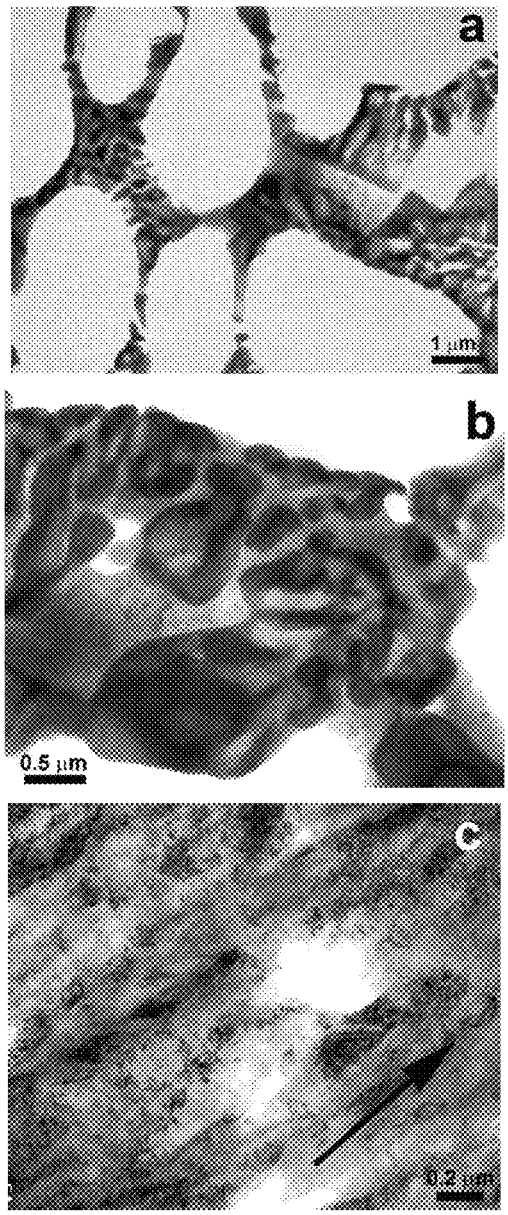

FIG. 25 TEM micrographs of microstructure in the plate sample from the as-cast Alloy 6. (a) The microstructure at the intergranular region in the as-cast sample (corresponding to the region B in FIG. 18); (b) Magnified image at the intergranular region showing the detailed structure of precipitates; (c) The microstructure of matrix grains, which are aligned in one direction indicated by the arrow.

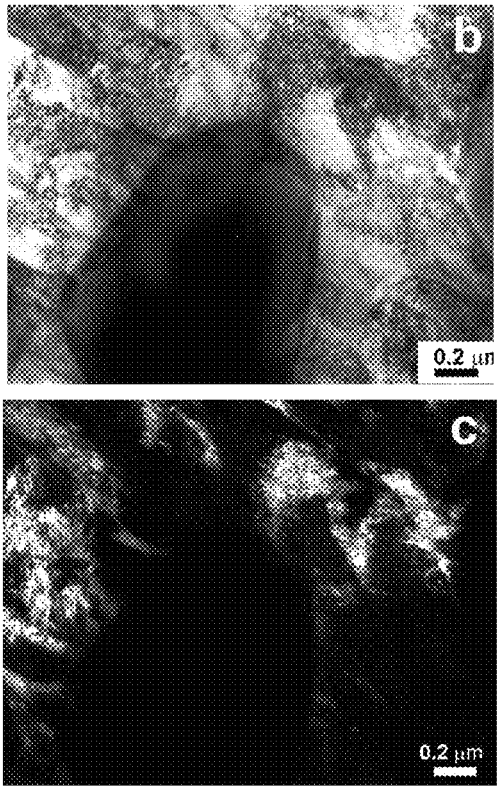
FIG. 26 The TEM micrographs of the microstructure in the Alloy 6 plate sample at 1100°C for 1 hour. (a) A number of precipitates formed and distributed homogeneously in the matrix with lath structure; (b) The detailed microstructure of the lath microstructure near precipitates. (c) Dark-field TEM image showing grains within lath structure.

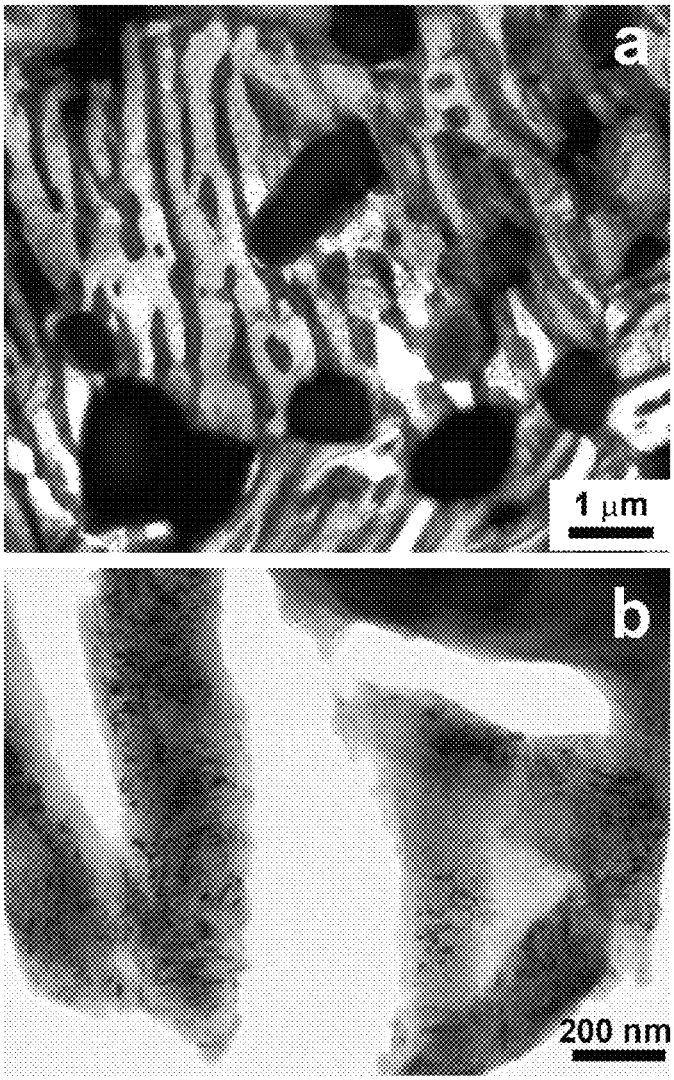
FIG. 27 The TEM micrographs of the microstructure in the Alloy 6 plate sample after HIP cycle at 1100°C for 1 hour and heat treatment at 700°C for 60 minutes with slow furnace cooling. (a) The precipitates grew slightly, but the lath structure in the matrix developed into lamellae structure. (b) A structure of the matrix at higher magnification.

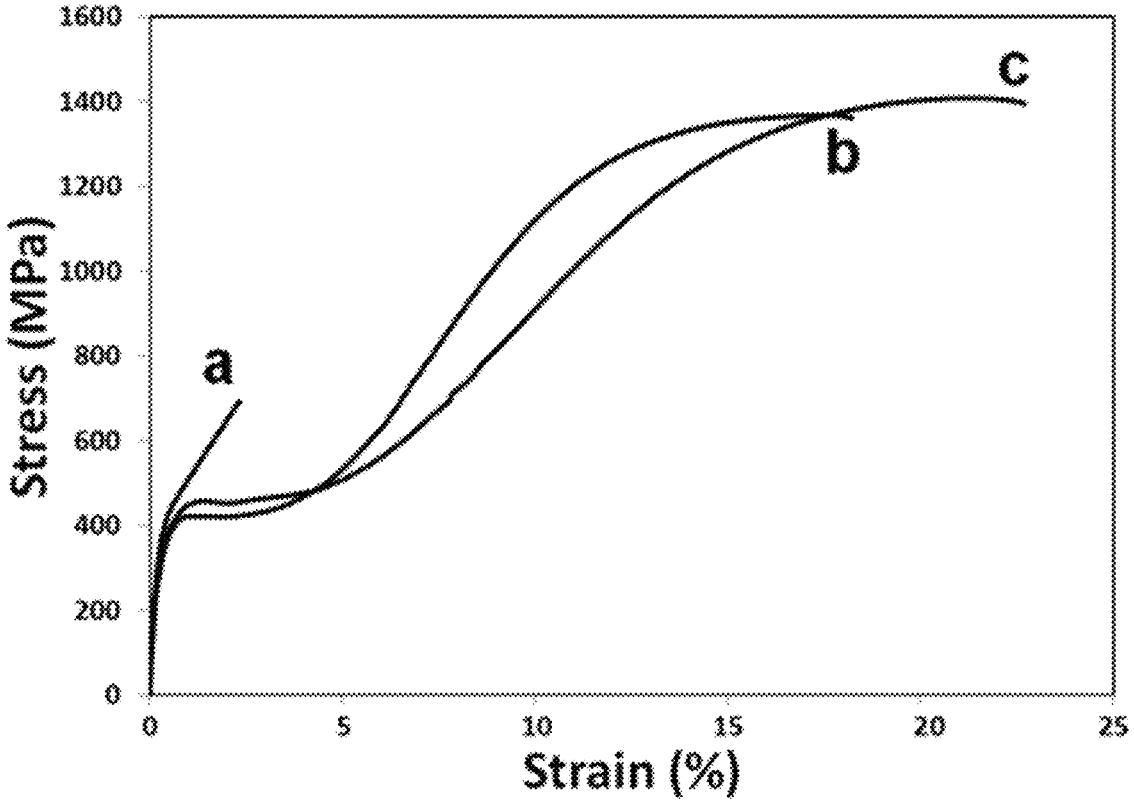
FIG. 28 Tensile properties of Alloy 51 plate in various conditions; a) As-cast, b) After HIP cycle at 1100°C for 1 hour and c) After HIP cycle at 1100°C for 1 hour and heat treating at 700°C for 1 hour.

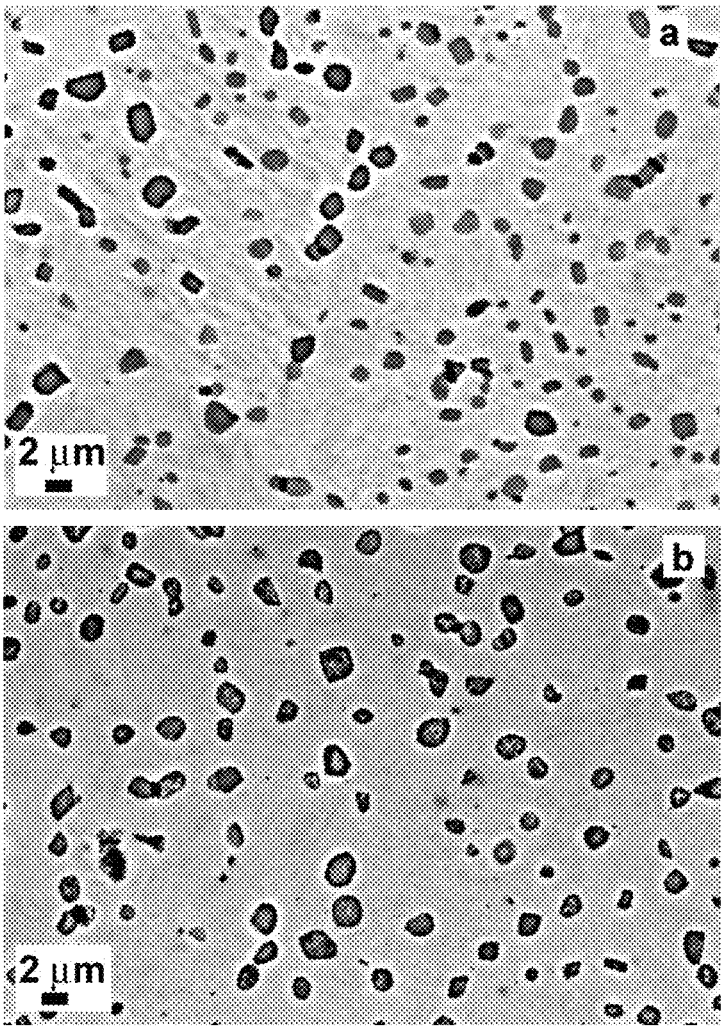
FIG. 29 SEM images of the microstructure in the specimen from the Alloy 51 after the HIP cycle at 1100°C for 1 hour, heat treatment at 700°C for 1 hour and deformation at room temperature (a) in a grip section and (b) in a gage section.

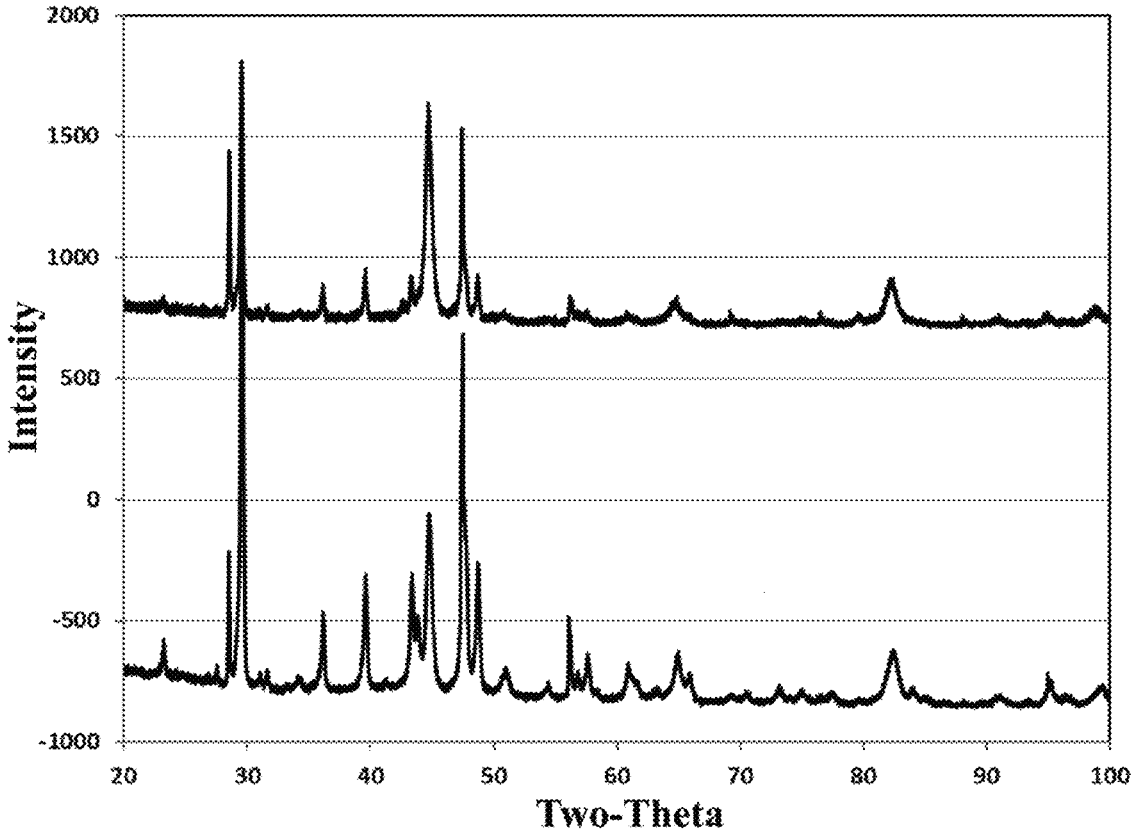
FIG. 30 Comparison between X-ray data for the specimen from the Alloy 51 plate after the HIP cycle at 1100°C for 1 hour and heat treatment at 700°C for 1 hour after tensile testing: 1) in a grip section (top curve) and 2) in a gage section (bottom curve).

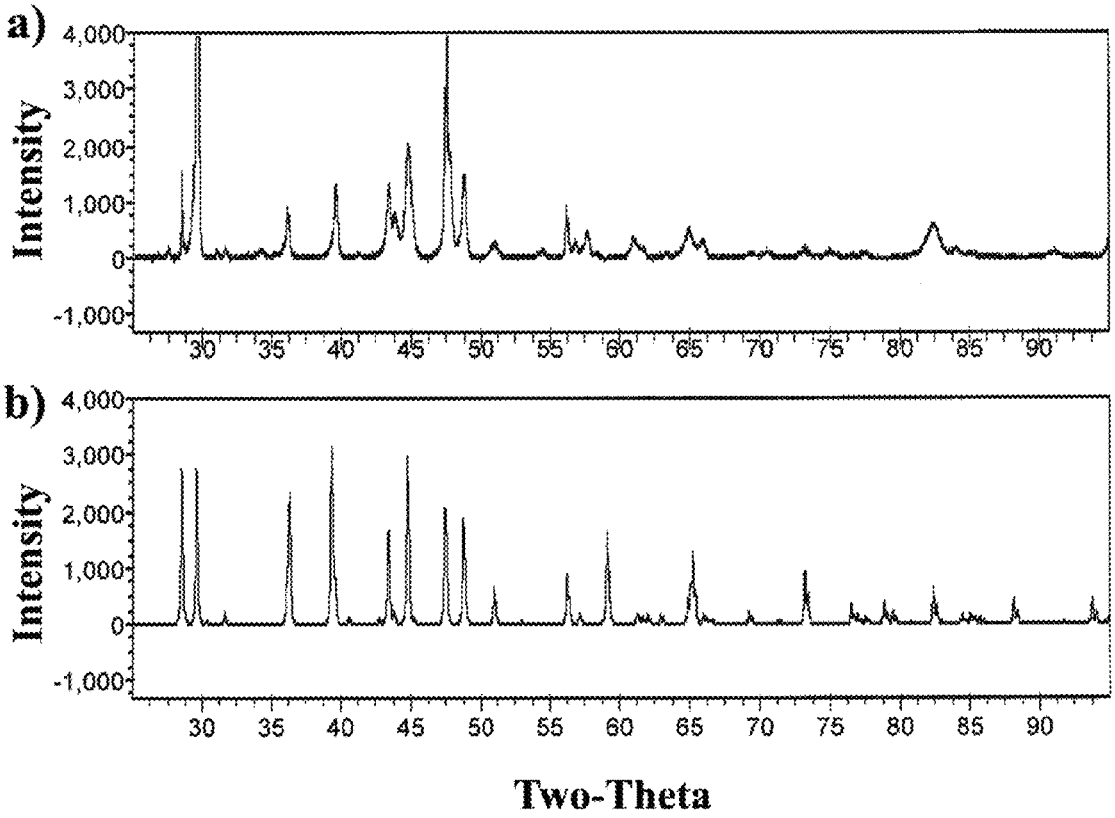
FIG. 31 X-ray diffraction data (intensity vs two-theta) for the gage section of tensile tested specimen from the Alloy 51 plate in the HIPed condition (1100°C for 1 hour) and heat treated at 700°C for 1 hour; a) Measured pattern, b) Rietveld calculated pattern with peaks identified.

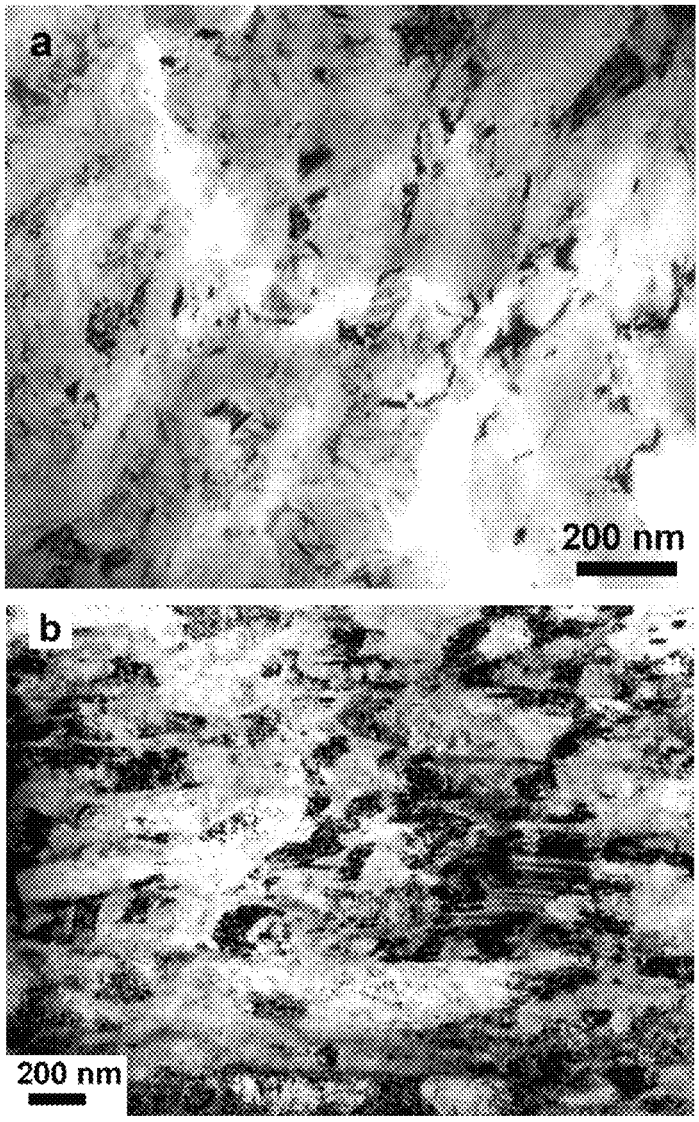
FIG. 32 TEM micrographs of microstructure in the specimen from the Alloy 51 plate HIPed at 1100°C for 1 hour and heat treated at 700°C for 1 hour; a) Before tensile testing; b) After tensile testing.

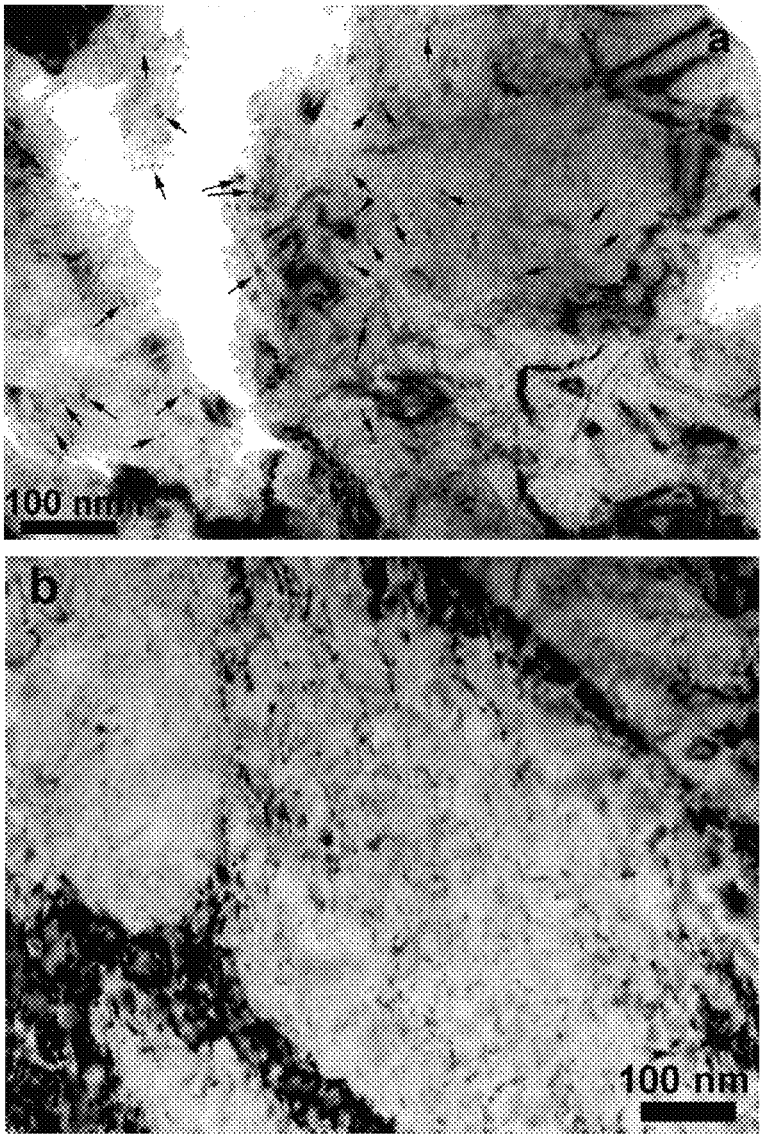
FIG. 33 TEM micrographs of microstructure in the specimen from the Alloy 51 plate HIPed at 1100°C for 1 hour and heat treated at 700°C for 1 hour; a) Before tensile testing, nano-precipitates are observed after heat treatment.; b) After tensile testing, dislocation pinning by the nano-precipitates is observed.

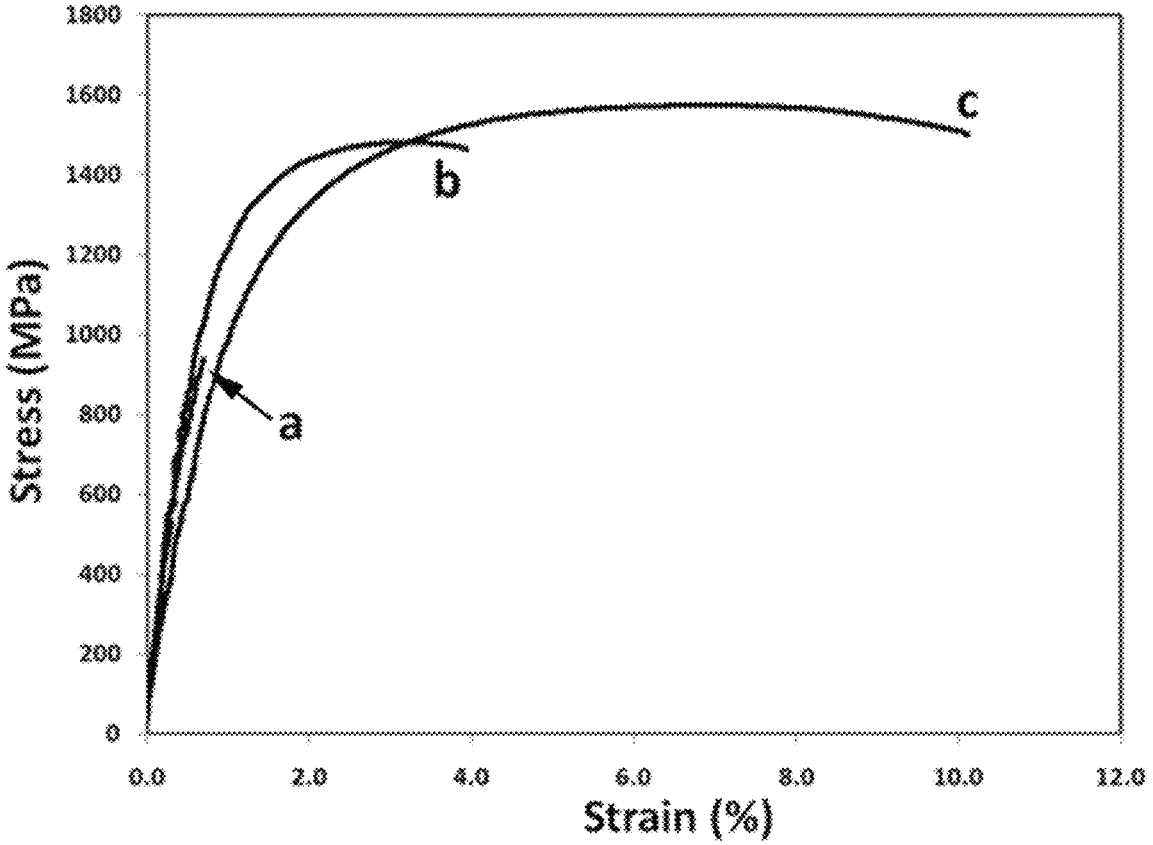
FIG. 34 Tensile properties of the specimens from the Alloy 6 plate in various conditions; a) As-cast, b) After HIP cycle at 1000°C for 1 hour, and c)After HIP cycle at 1100°C for 1 hour and heat treating at 700°C for 60 minutes with slow furnace cooling.

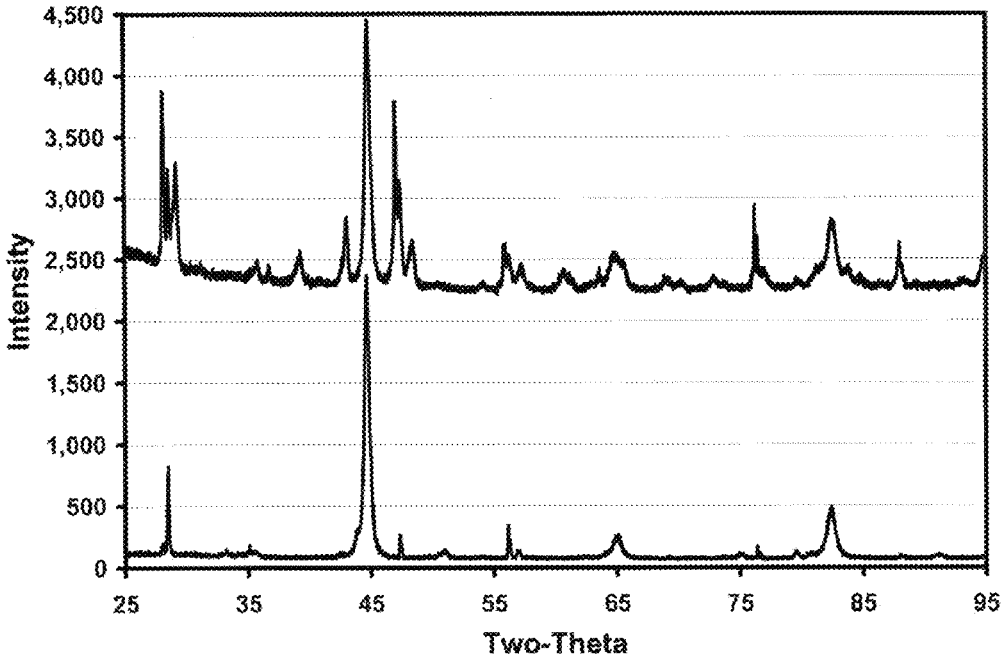
FIG. 35 Comparison between X-ray data for the Alloy 6 specimen after the HIP cycle at 1100°C for 1 hour and heat treating at 700°C slow cool to room temperature (670 minute total time): 1) in a gage section after tensile testing (top curve) and 2) in a grip section (bottom curve).

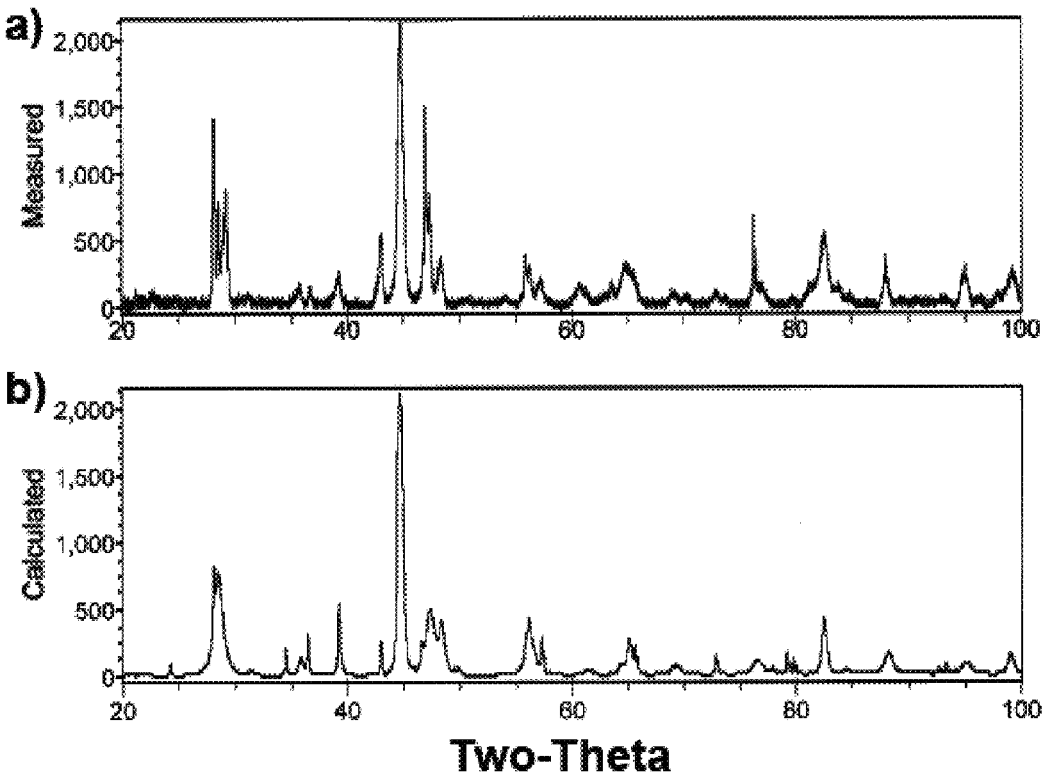
FIG. 36 X-ray diffraction data (intensity vs two-theta) for the gage section of tensile tested specimen from the Alloy 6 plate in the HIPed condition (1100°C for 1 hour): a) Measured pattern, b) Rietveld calculated pattern with peaks identified.

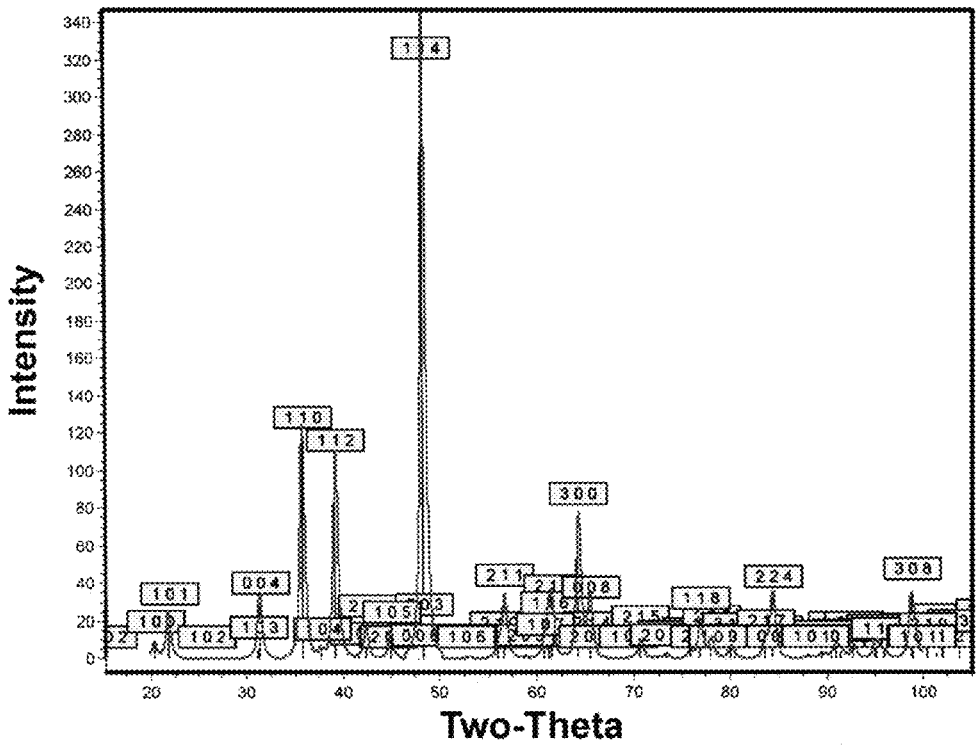

FIG. 37 Calculated X-ray diffraction pattern (intensity vs two-theta) for the newly identified hexagonal phase (space group #190) found in the gage section of tensile tested specimen from the Alloy 6 plate in the HIPed condition (1100°C for 1 hour) and heat treated at 700°C slow cool to room temperature (670 minute total time) condition. Note that the diffraction planes are listed in parenthesis.

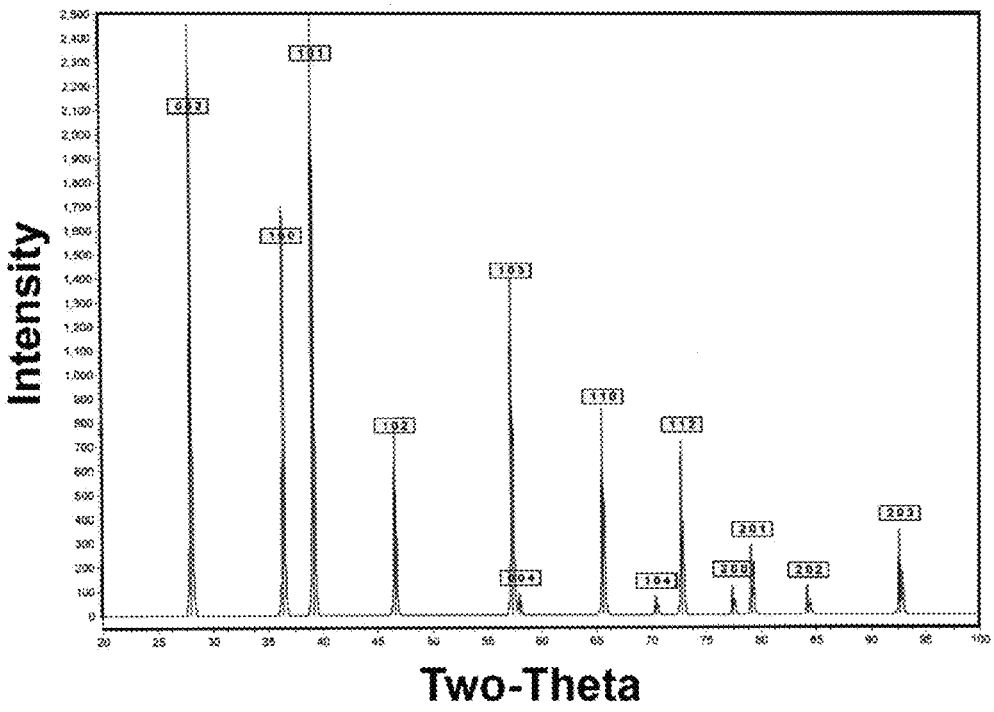

FIG. 38 Calculated X-ray diffraction pattern (intensity vs two-theta) for the newly identified hexagonal phase (space group #186) found in the gage section of tensile tested specimen from Alloy 6 plate in the HIPed condition (1100°C for 1 hour) and heat treated at 700°C slow cool to room temperature (670 minute total time) condition. Note that the diffraction planes are listed in parenthesis.

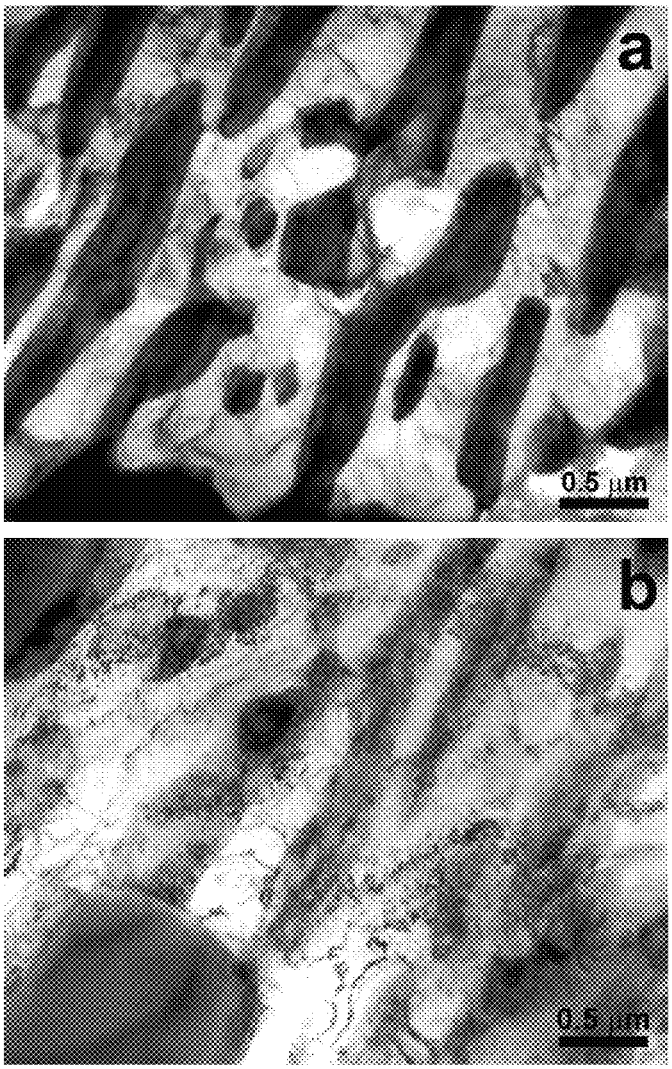
FIG. 39 TEM micrographs of the microstructure in the specimen from the Alloy 6 plate after HIP cycle at 1100°C for 1 hour and heat treatment at 700°C for 60 minutes with slow furnace cooling; a) Before tensile testing; b) After tensile testing.

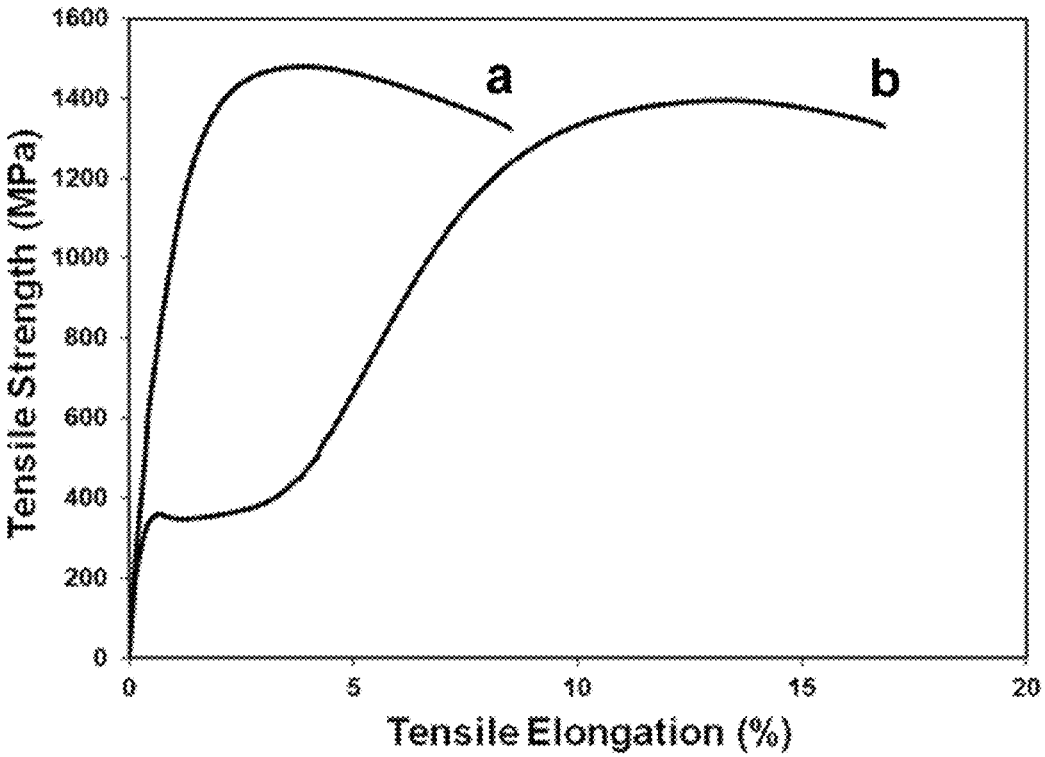
FIG. 40 Representative stress-strain curves for (a) Alloy 17 and (b) Alloy 27 specimens after same thermal mechanical treatment tested at room temperature.

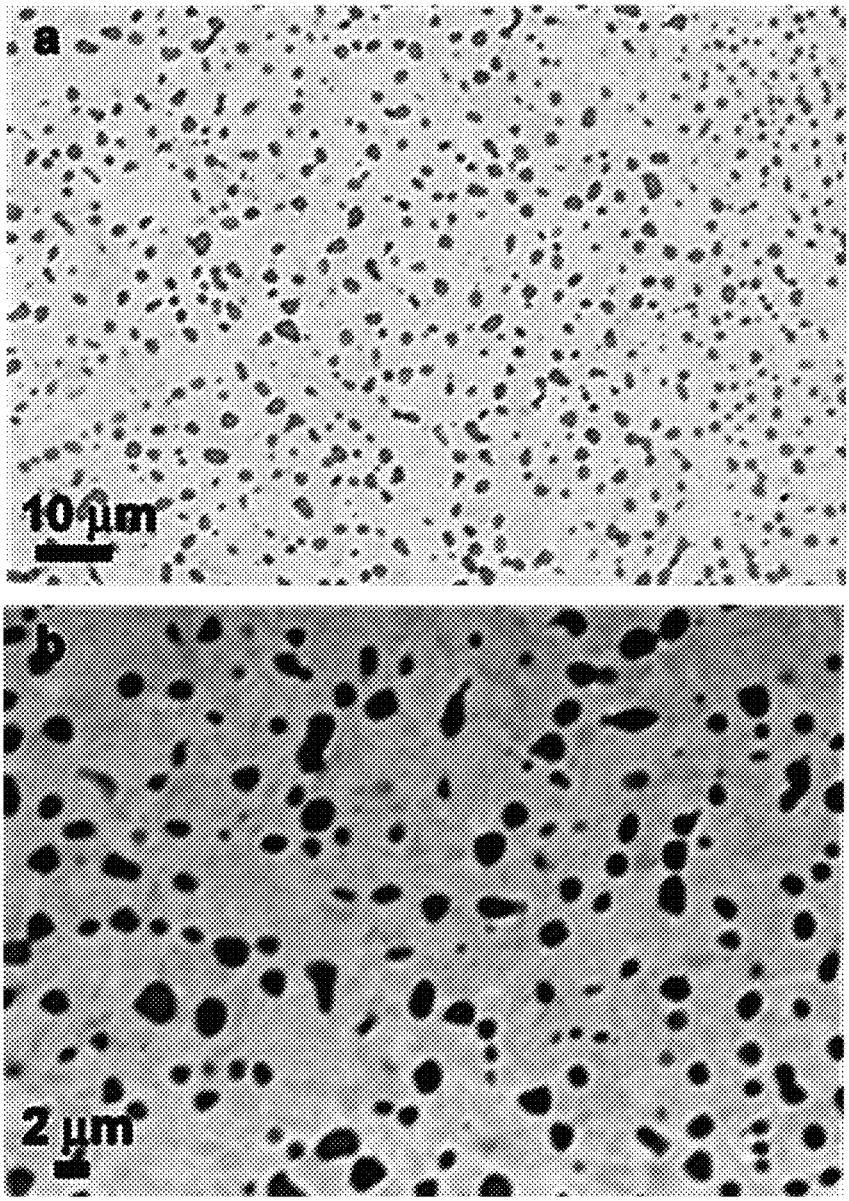
FIG. 41 The backscattered SEM images of the microstructure in the Alloy 17 specimen after HIP cycle at 1100°C for 1 hr and heat treatment at 700°C for 1 hr (prior deformation).

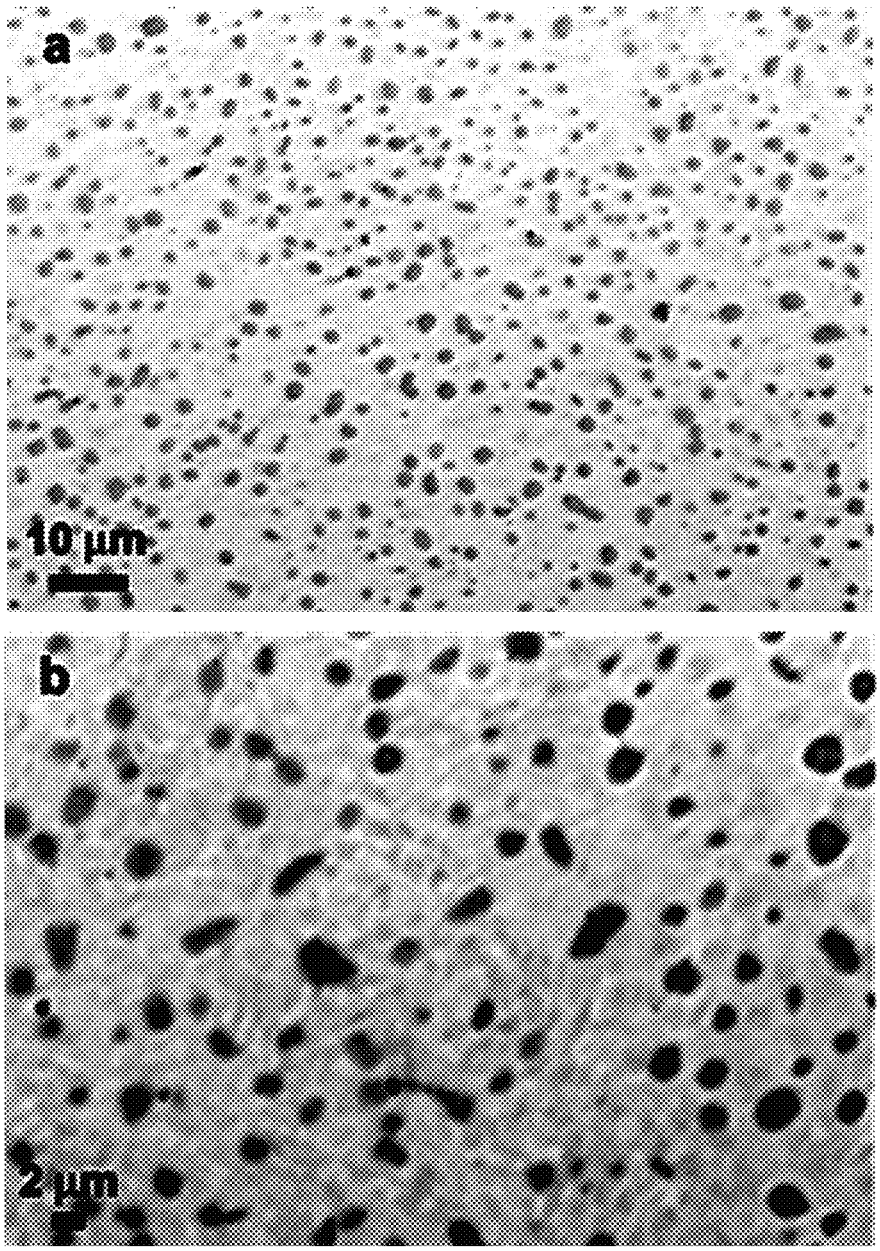
FIG. 42 The backscattered SEM images of the microstructure in the Alloy 27 specimen after HIP cycle at 1100°C for 1 hr and heat treatment at 700°C for 1 hr (prior deformation).

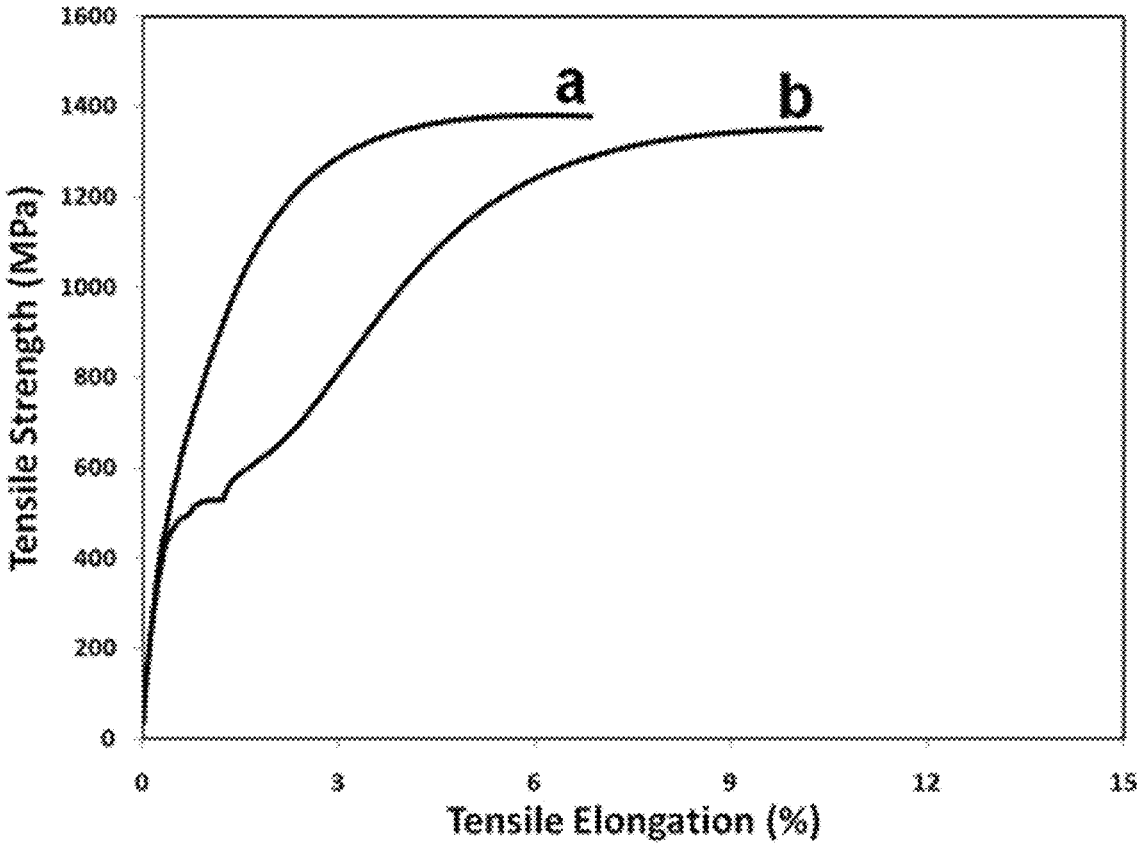
FIG. 43 Stress-strain curves recorded at tensile testing of specimens from the Alloy 2 plate after HIP cycle and heat treatment at 700°C for 1 with cooling (a) in air and (b) with furnace.

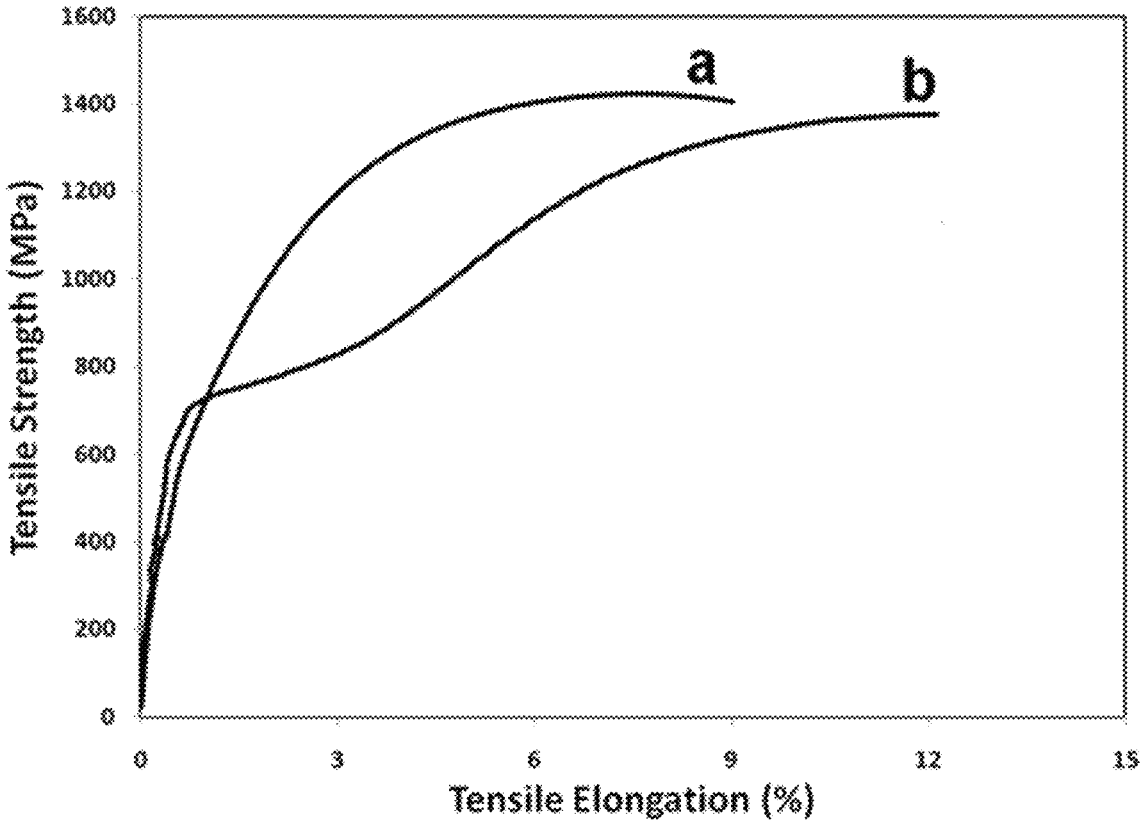
FIG. 44 Stress-strain curves recorded at tensile testing of specimens from the Alloy 5 plate after HIP cycle and heat treatment at 700 °C for 1 with cooling (a) in air and (b) with furnace.

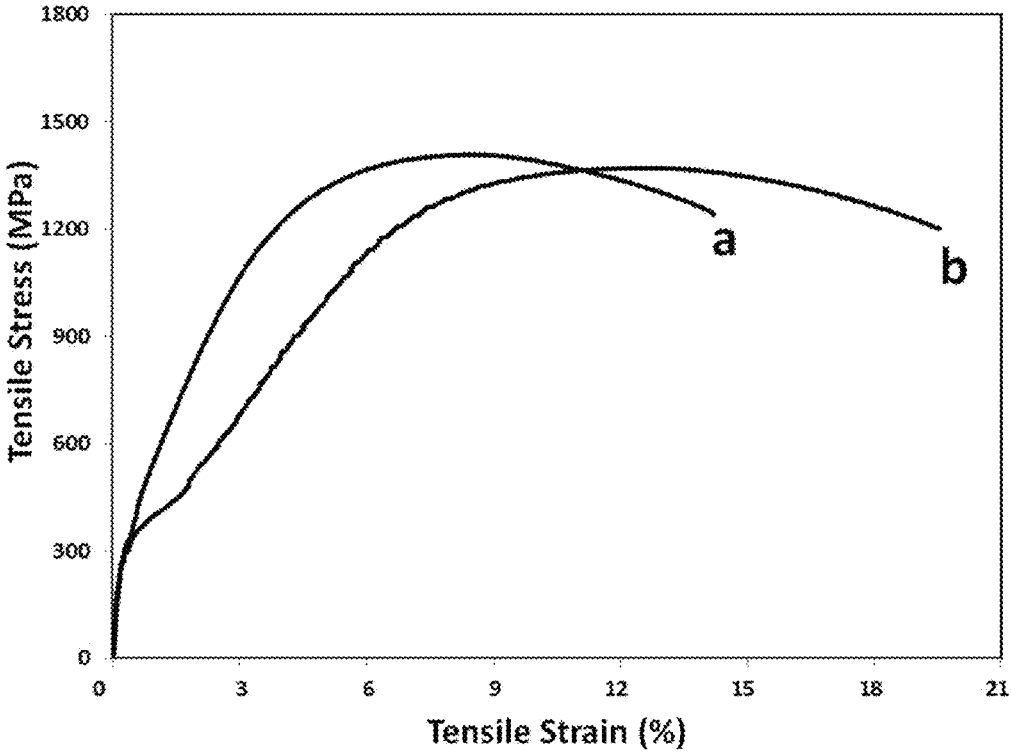
FIG. 45 Stress-strain curves recorded at tensile testing of specimens from the Alloy 52 plate after HIP cycle and heat treatment at (a) 850 °C for 1 with cooling in air and (b) 700 °C for 1 with slow cooling with furnace.

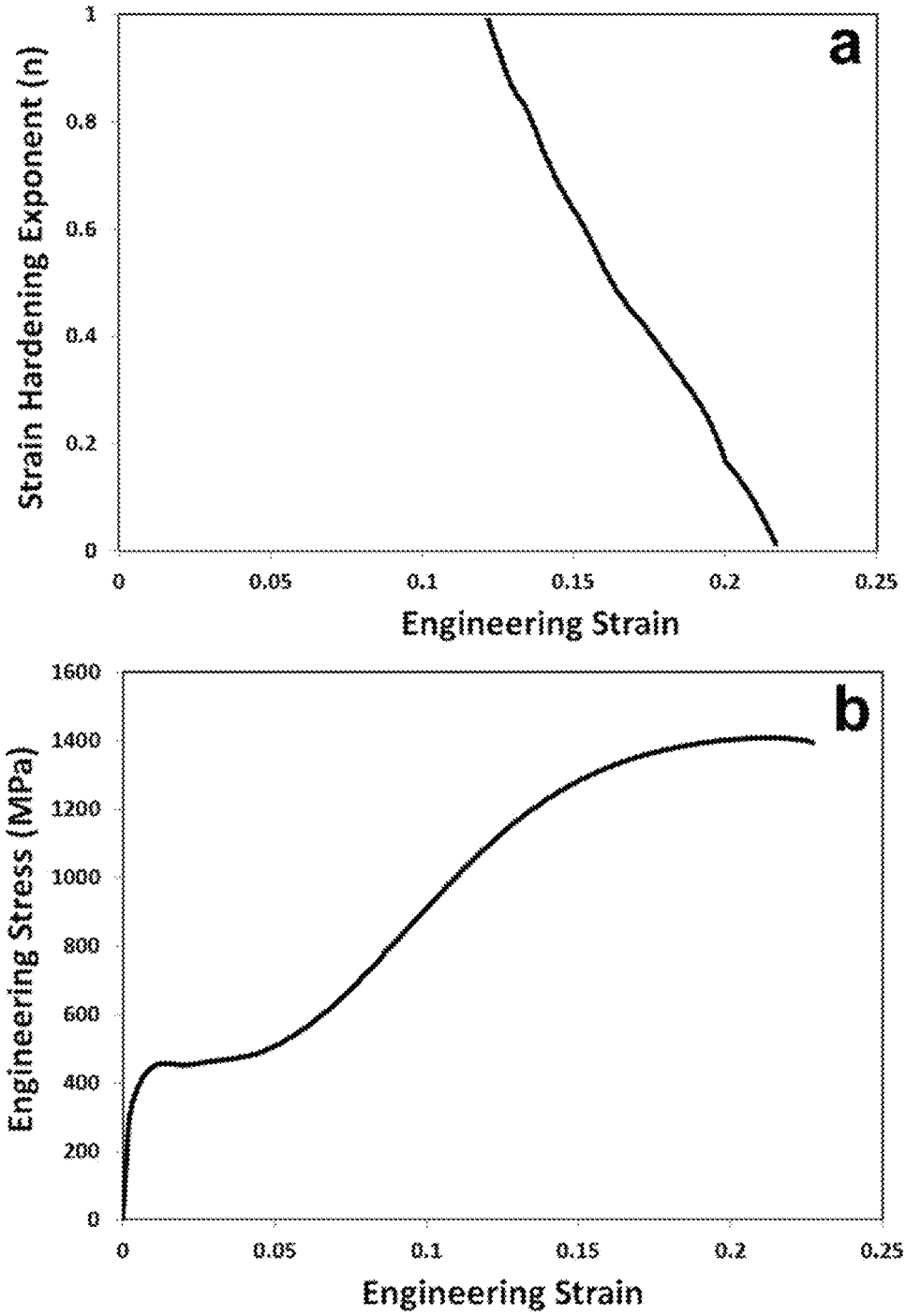
FIG. 46 (a) Strain hardening coefficient in the Alloy 51 as a function of strain; (b) Corresponding stress-strain curve.

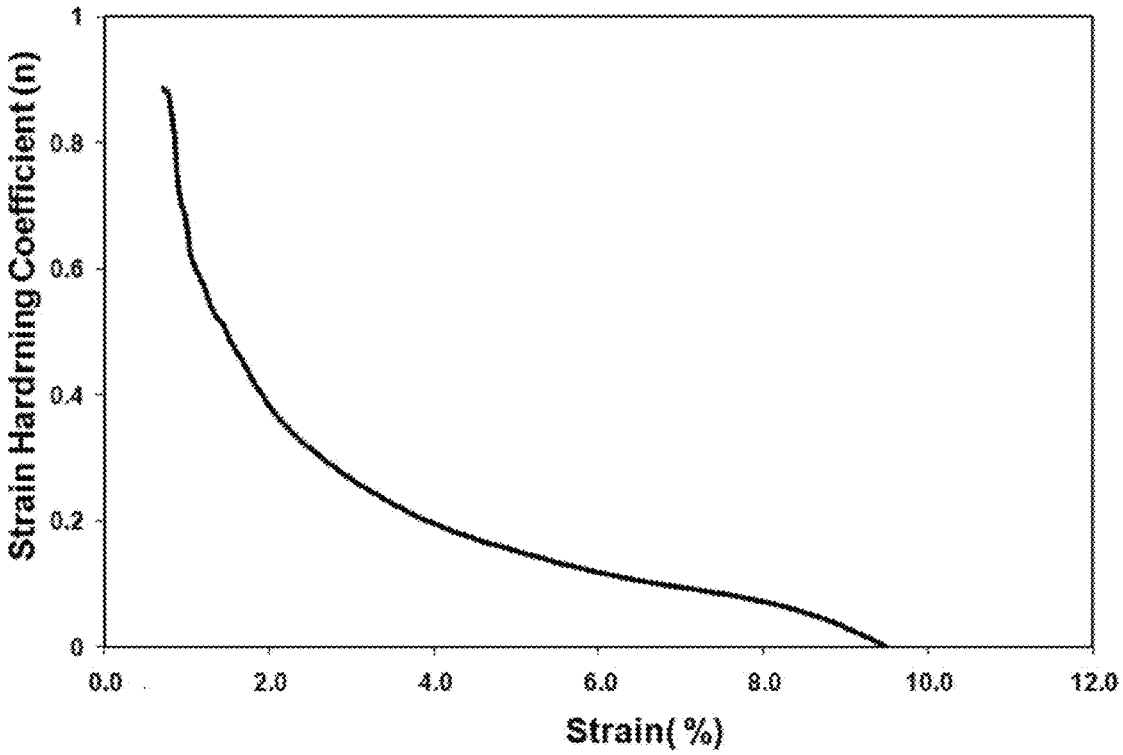
FIG. 47 Strain hardening in the specimen from the Alloy 6 as a function of strain.

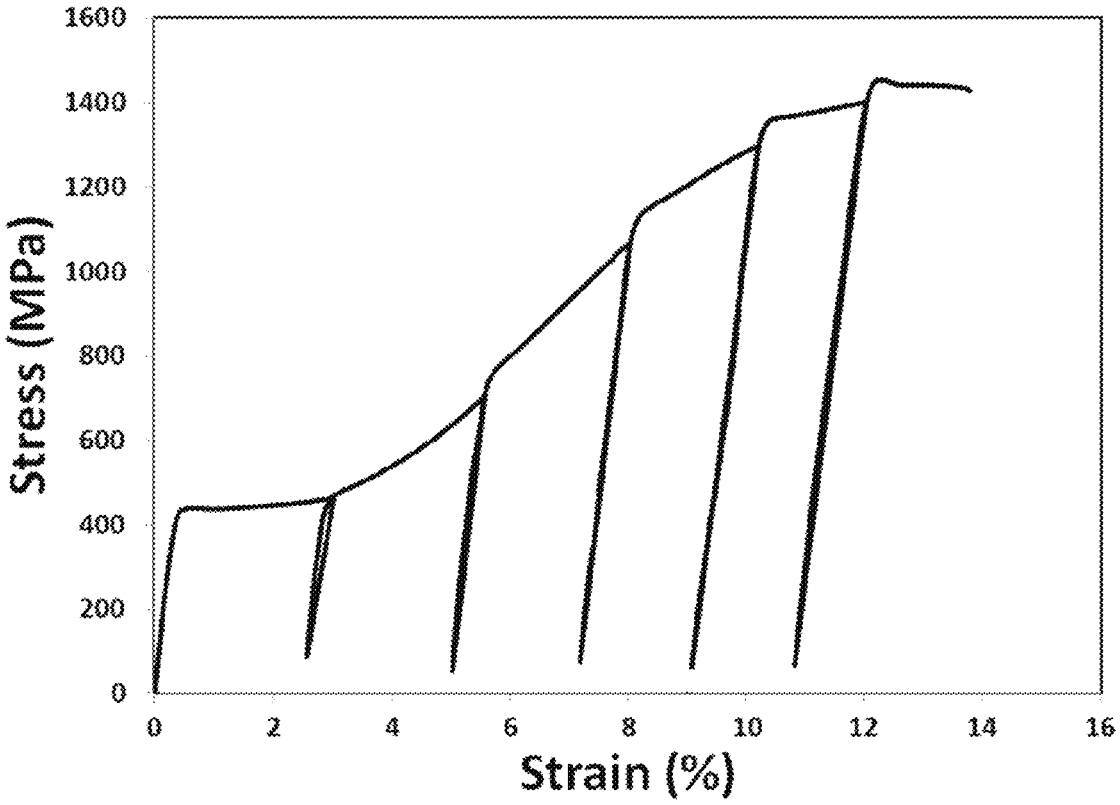
FIG. 48 Stress-strain curves for the Alloy 51 specimen tested in tension with incremental straining.

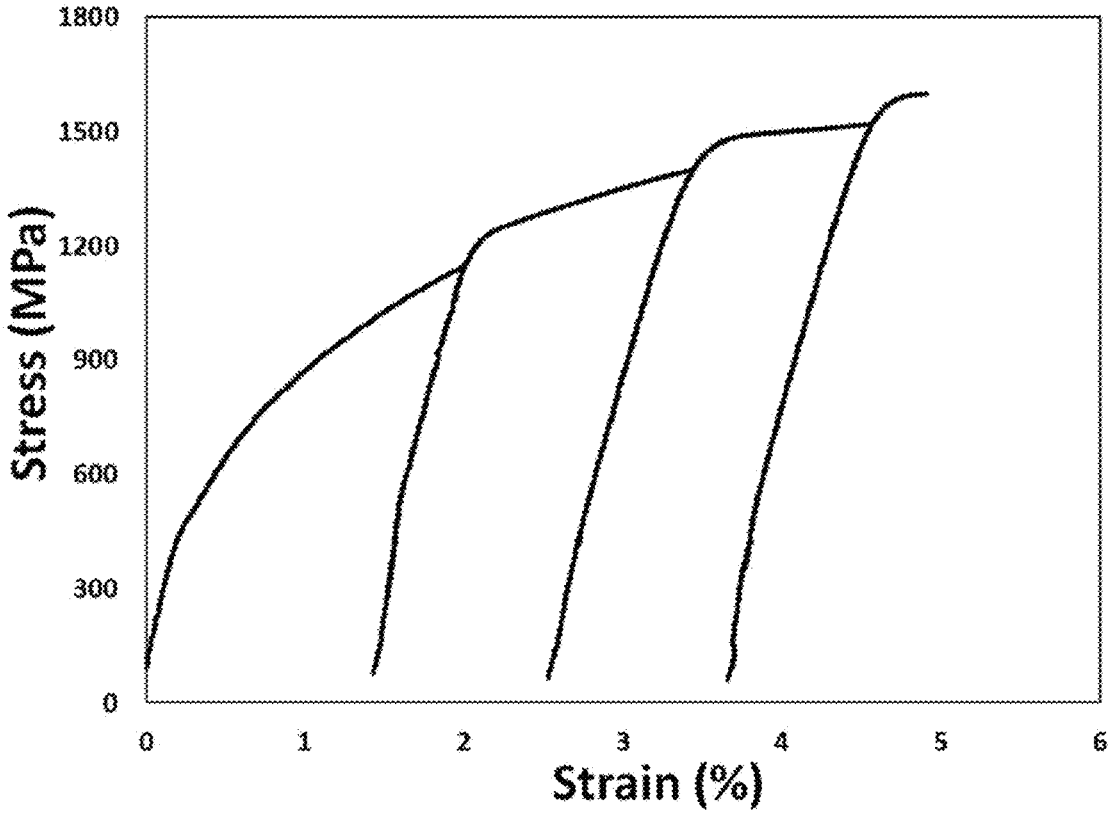
FIG. 49 Stress-strain curves for the Alloy 6 specimen tested in tension with incremental straining.

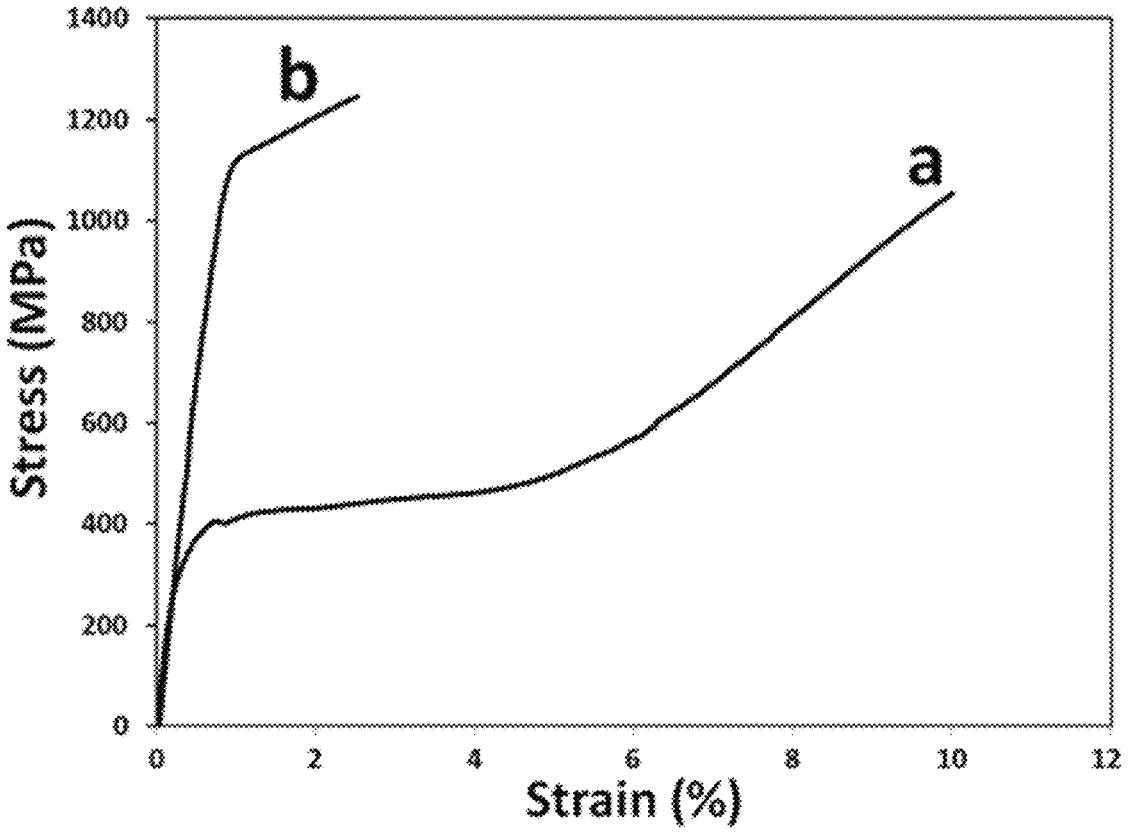
FIG. 50 Stress – strain curves for the Alloy 51 specimens (a) in initial state and (b) after pre-straining to 10% and tested to failure.

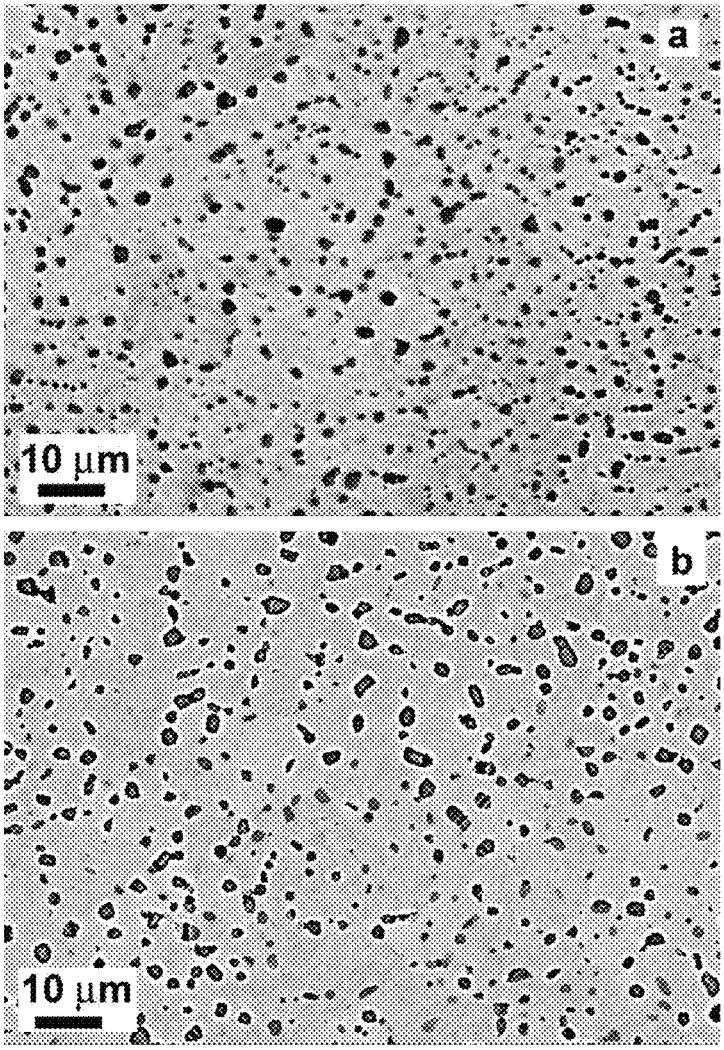
FIG. 51 SEM images of microstructure of the gage section of the tensile specimens from the Alloy 51 before and after pre-straining to 10%.

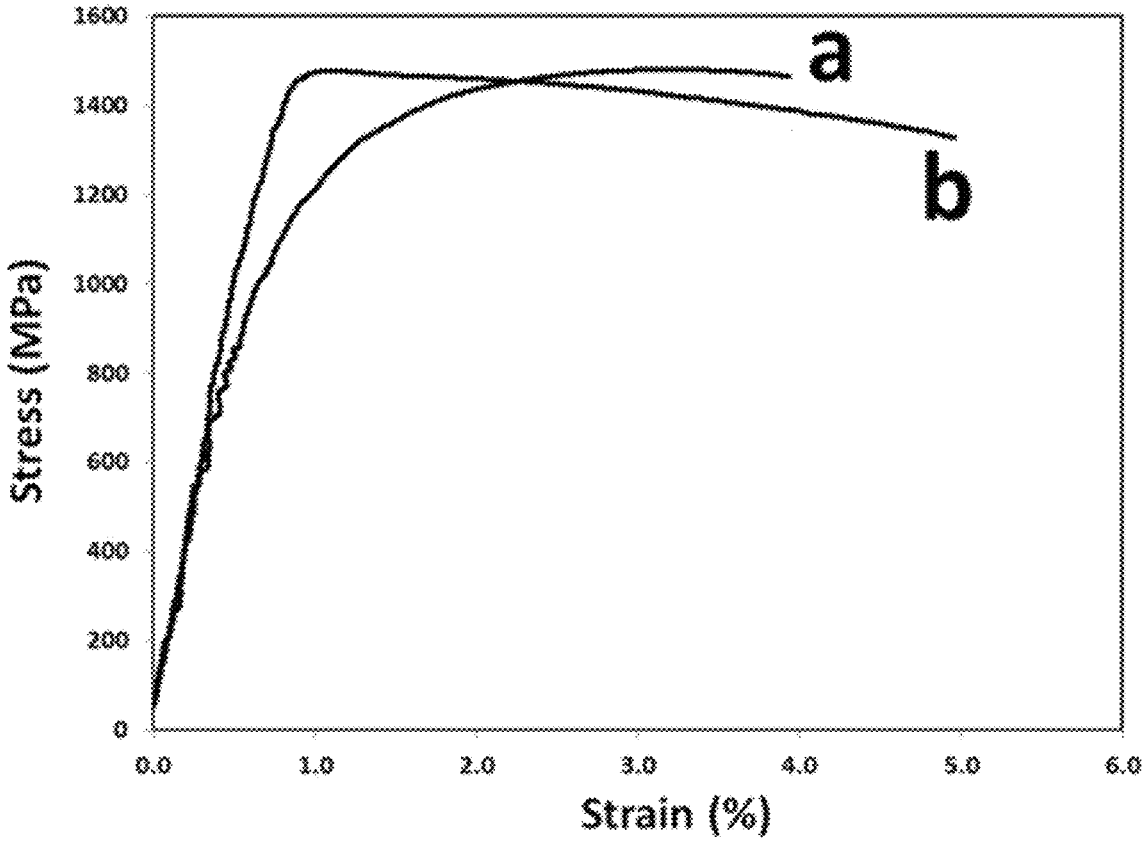
FIG. 52 Stress – strain curves for the Alloy 6 specimens tested (a) in initial state and (b) after pre-straining to 3% and tested to failure.

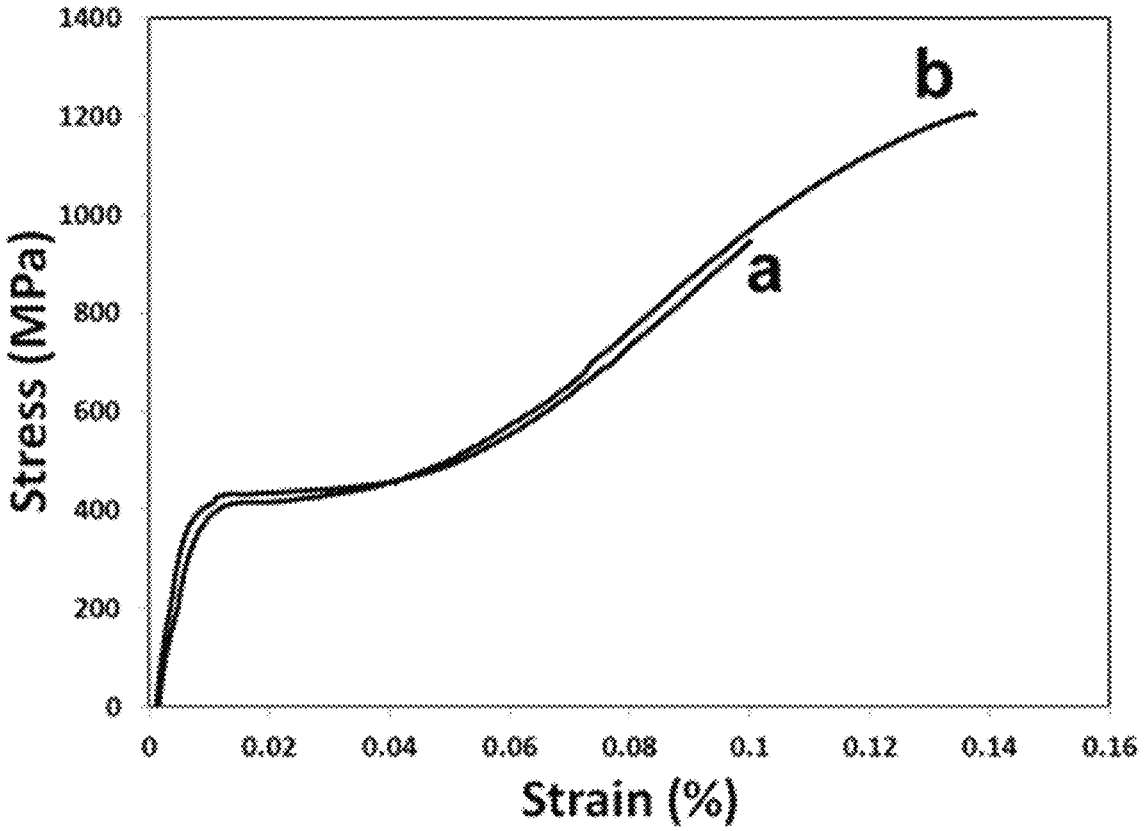
FIG. 53 Stress – strain curves for the Alloy 51 specimens (a) pre-straining to 10% and (b) after pre-straining to 10% and subsequent annealing at 1100 °C for 1 hour.

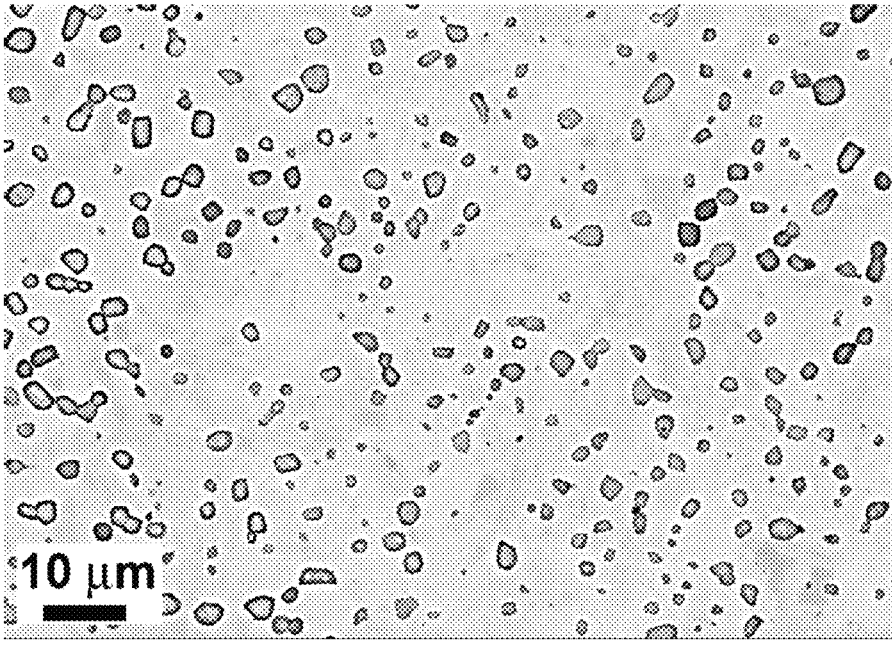
FIG. 54 A SEM image of microstructure of the gage section of the tensile specimens from the Alloy 51 after pre-straining to 10% and annealing at 1100°C for 1 hour.

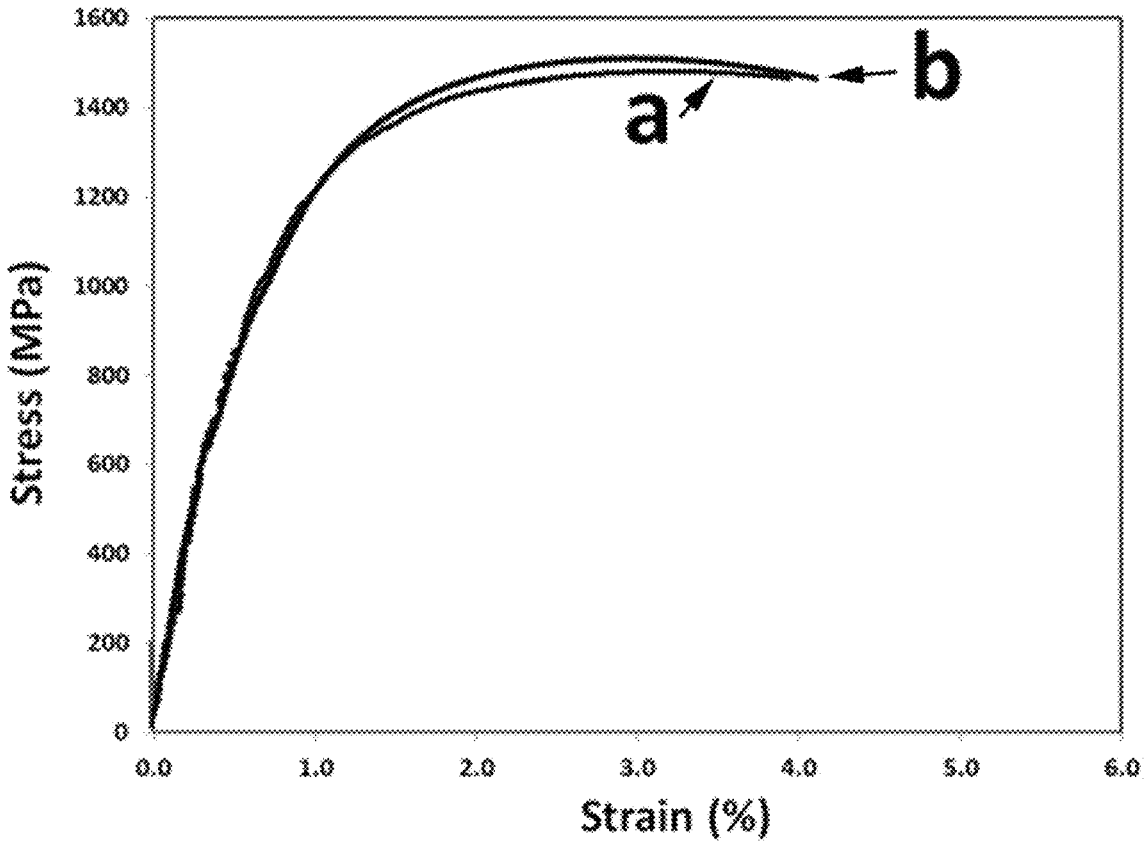
FIG. 55 Stress – strain curves for the Alloy 6 specimens tested (a) in initial state and (b) after pre-straining to 3% and subsequent annealing at 1100 °C for 1 hour.

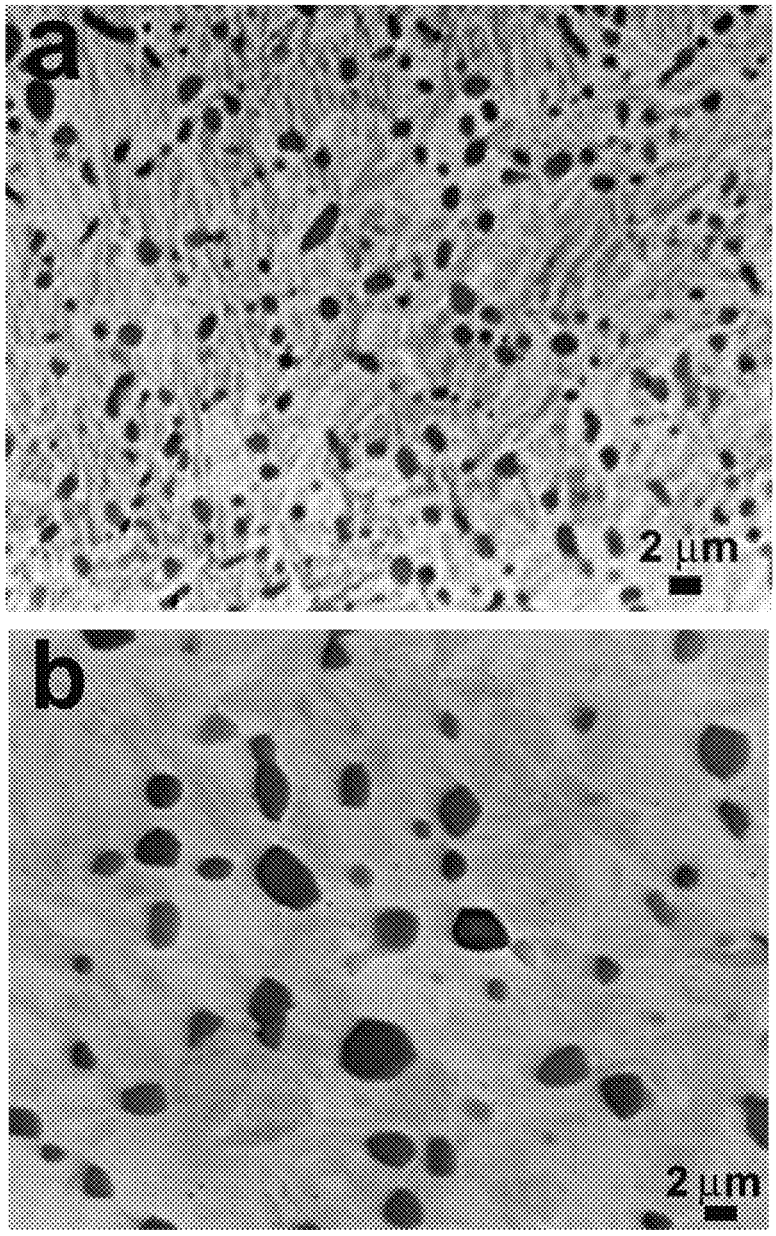
FIG. 56 SEM images of microstructure of the gage section of the tensile specimens from the Alloy 6 after pre-straining to 3% and annealing at 1100°C for 1 hour at different magnification.

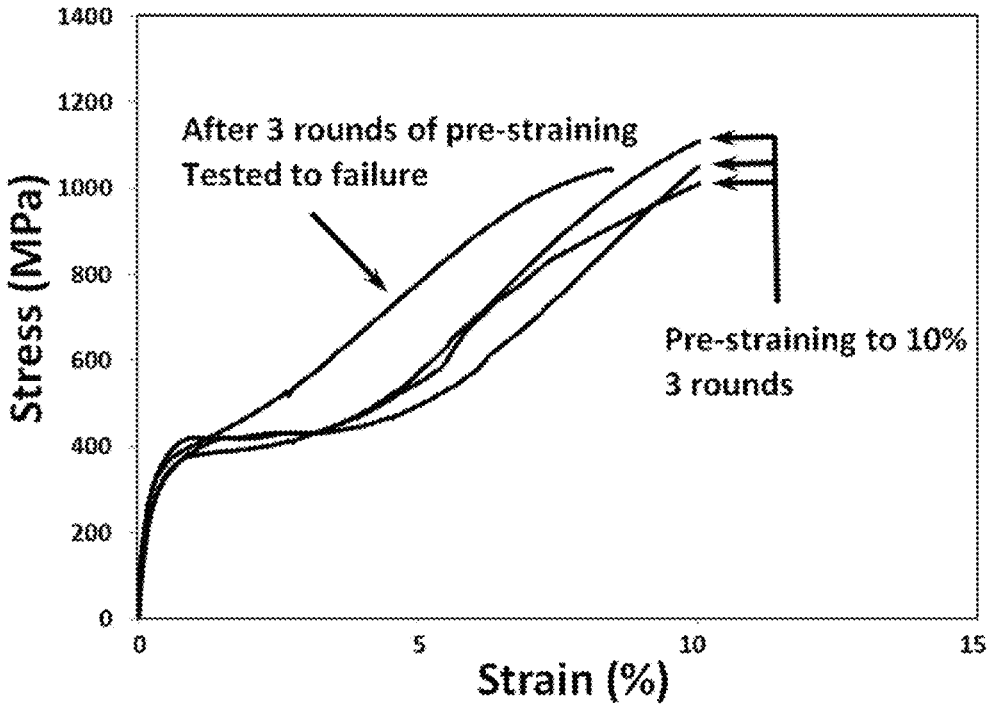
FIG. 57 Stress strain curves for the Alloy 51 specimen that has been subjected to 3 rounds of tensile testing to a 10% deformation followed by annealing between rounds and tested to failure.

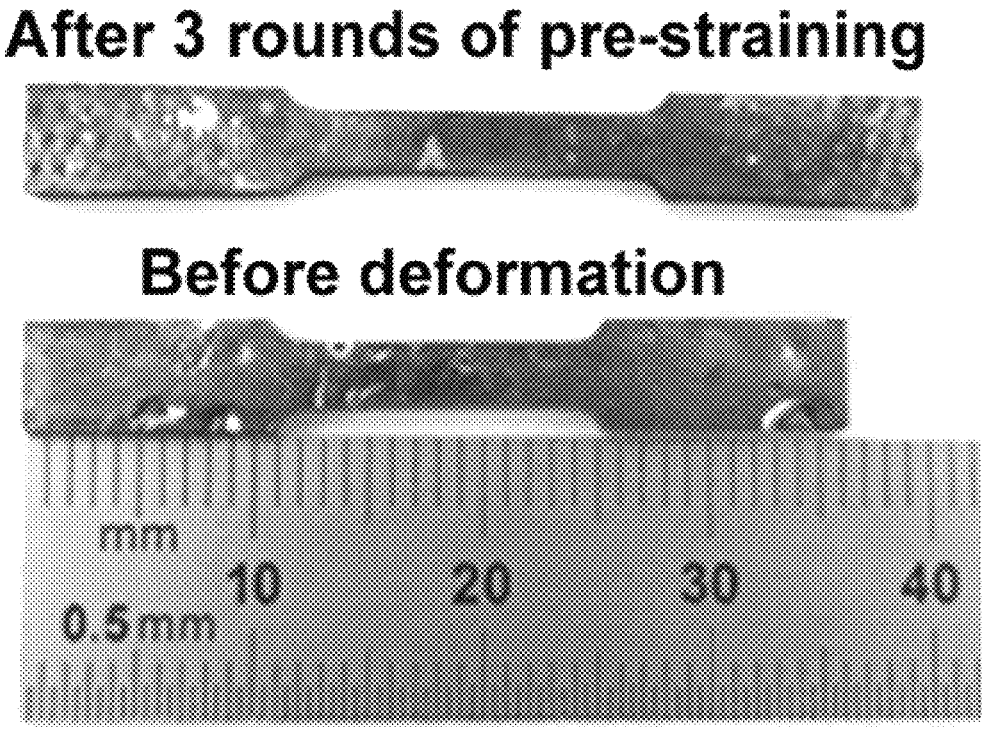
FIG. 58 View of the tensile specimen from the Alloy 51 before and after 3 rounds of deformation to 10 % with annealing between rounds.

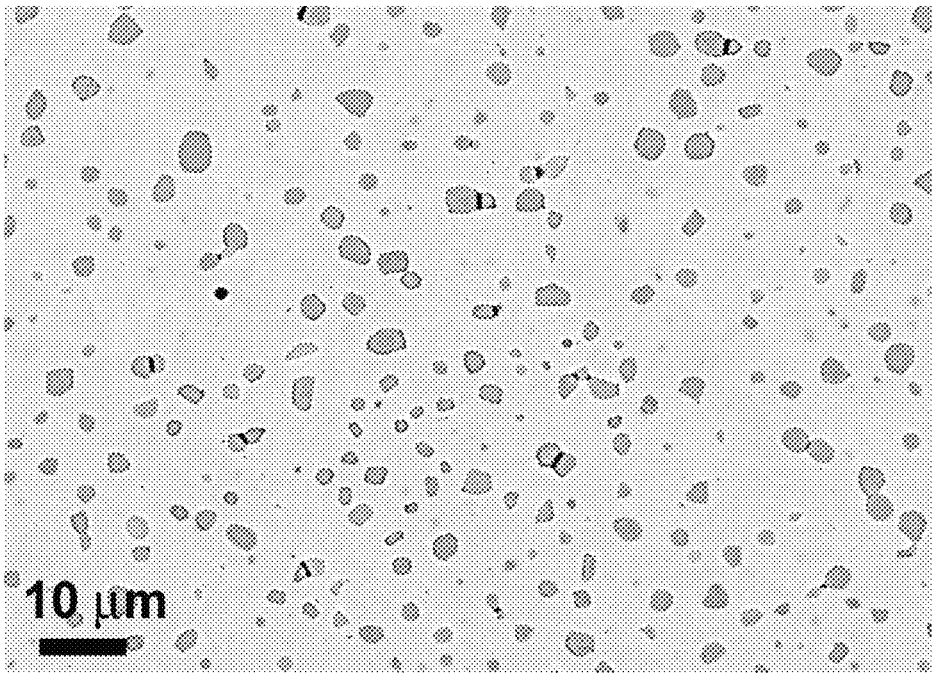
FIG. 59 A SEM image of the microstructure in the gage of the tensile specimen from the Alloy 51 after cycling deformation to 10% and annealing at 1100°C for 1 hour (3 times), then tested to failure.

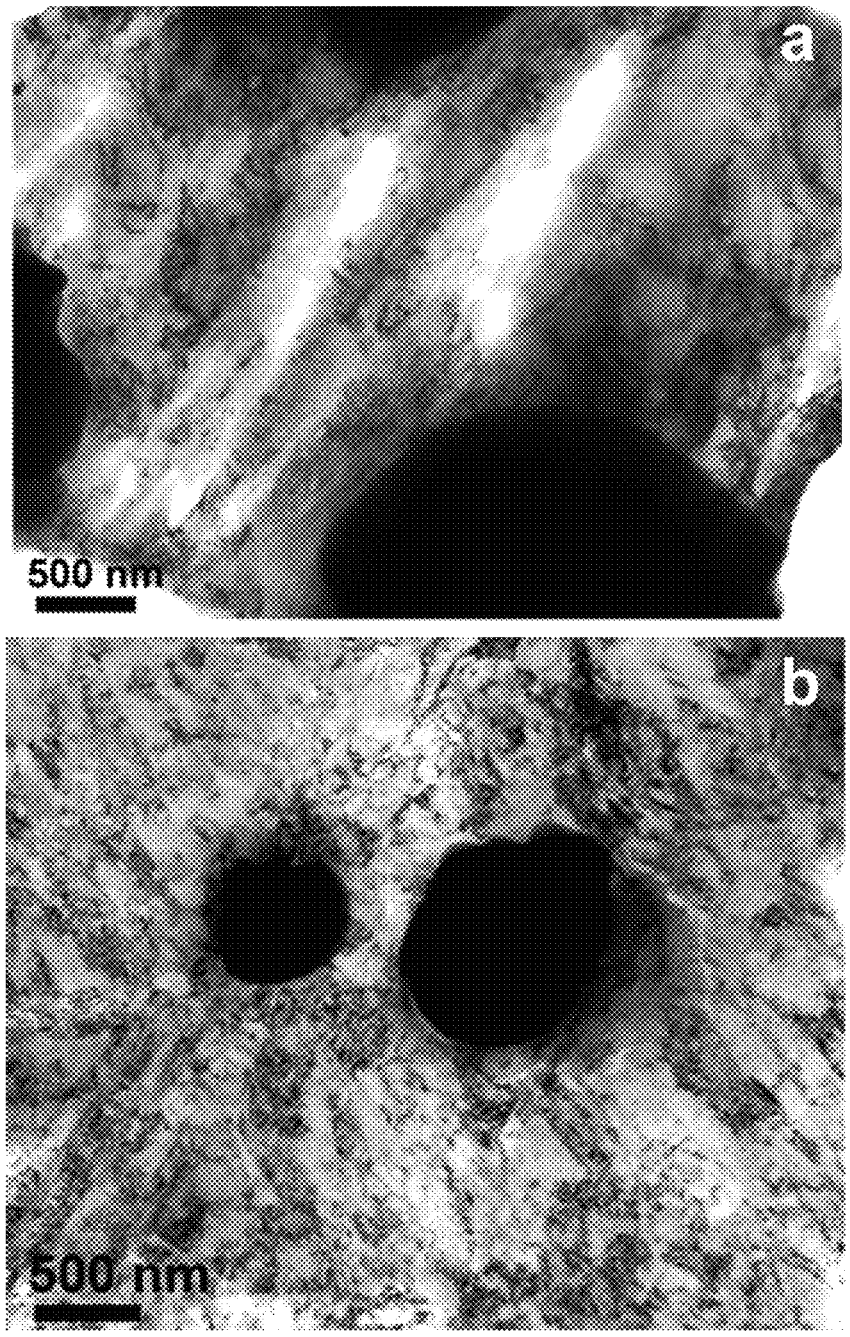
FIG. 60 TEM images of the microstructure in the tensile specimen from the Alloy 51 after cycling deformation to 10% and annealing at 1100°C for 1 hour (3 times), then tested to failure a) in the grip section and b) in the gage.

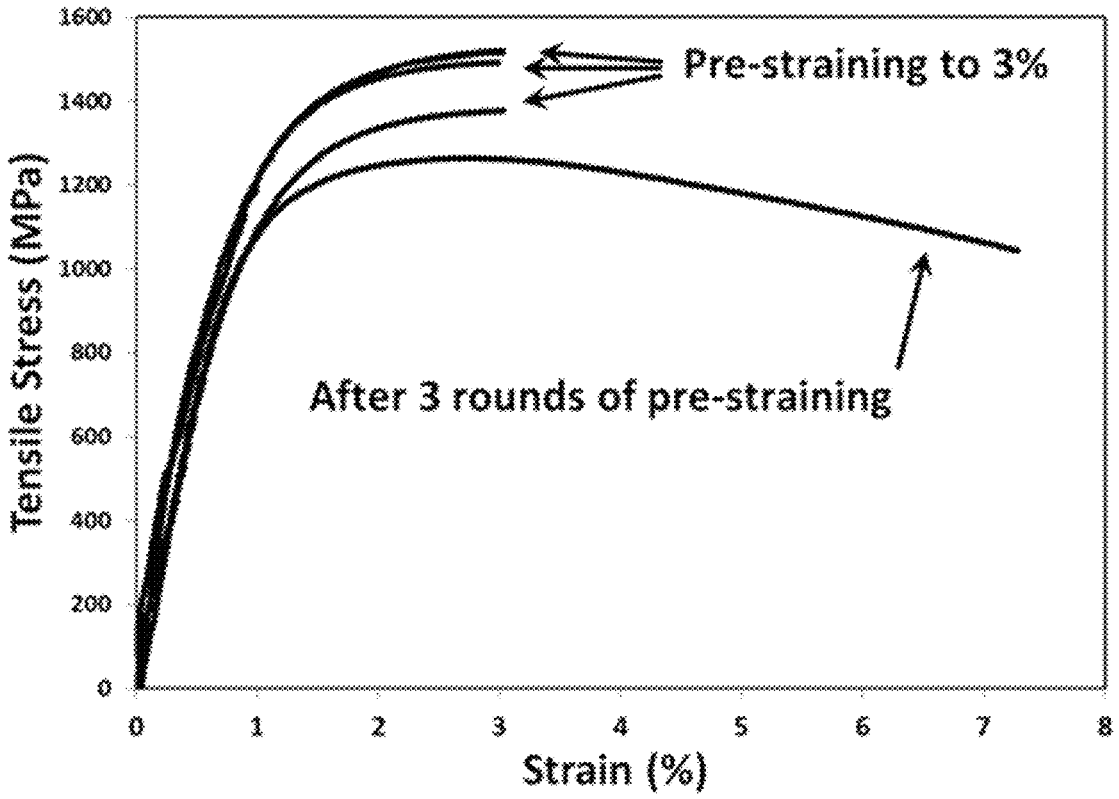
FIG. 61 Stress - strain curves for the Alloy 6 specimen that has been subjected to 3 rounds of tensile testing to a 3% deformation followed by annealing between steps and tested to failure.

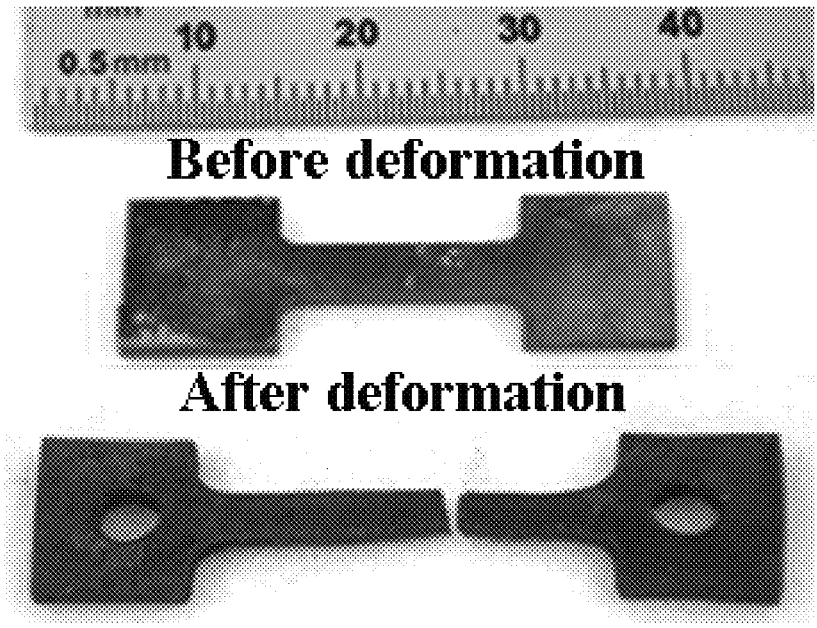
FIG.62 View of the Class 3 alloy specimen after HIP cycle and heat treatment before and after deformation to 57.5%.

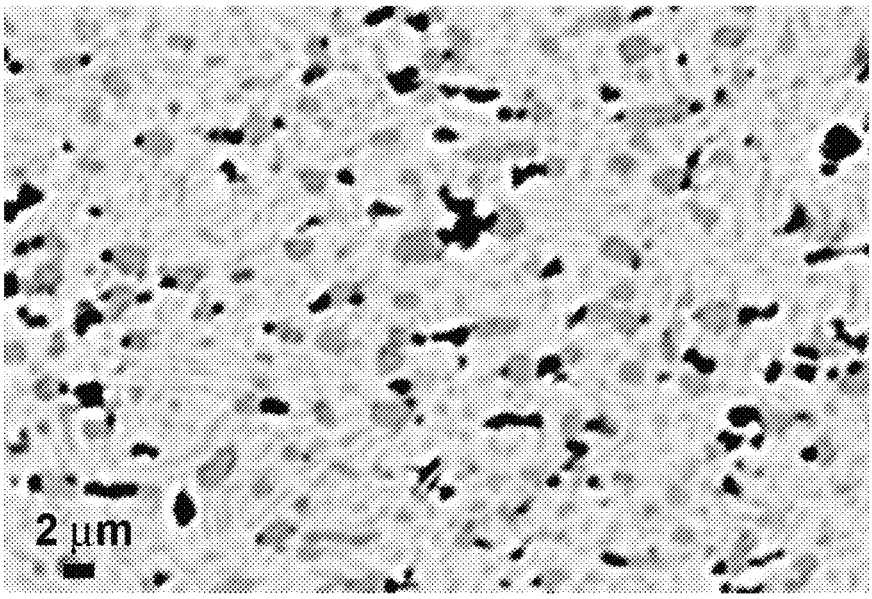
FIG. 63 The backscattered SEM micrograph of the gage microstructure of Alloy 20 specimen after tension at 700°C with tensile elongation of 88.5%.

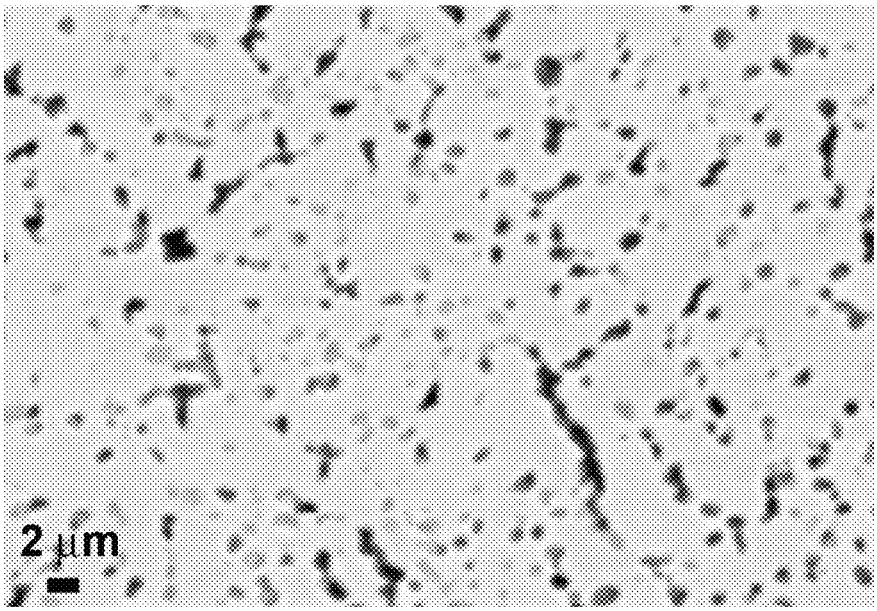
FIG. 64 The backscattered SEM micrograph of the gage microstructure of Alloy 20 specimen after tension at 850°C with tensile elongation of 23%.

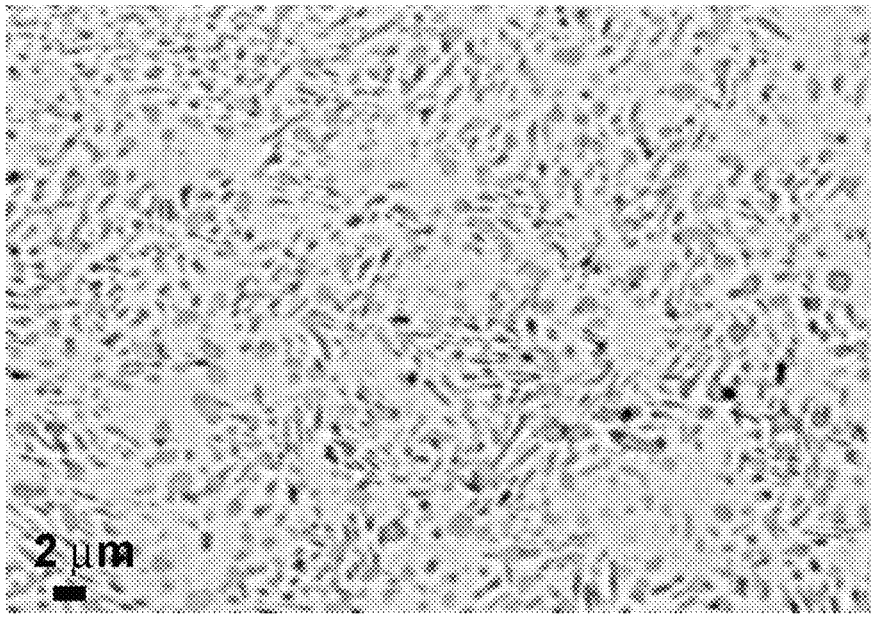
FIG. 65 The backscattered SEM micrograph of the gage microstructure of Alloy 22 specimen after tension at 700°C with tensile elongation of 34.5%.

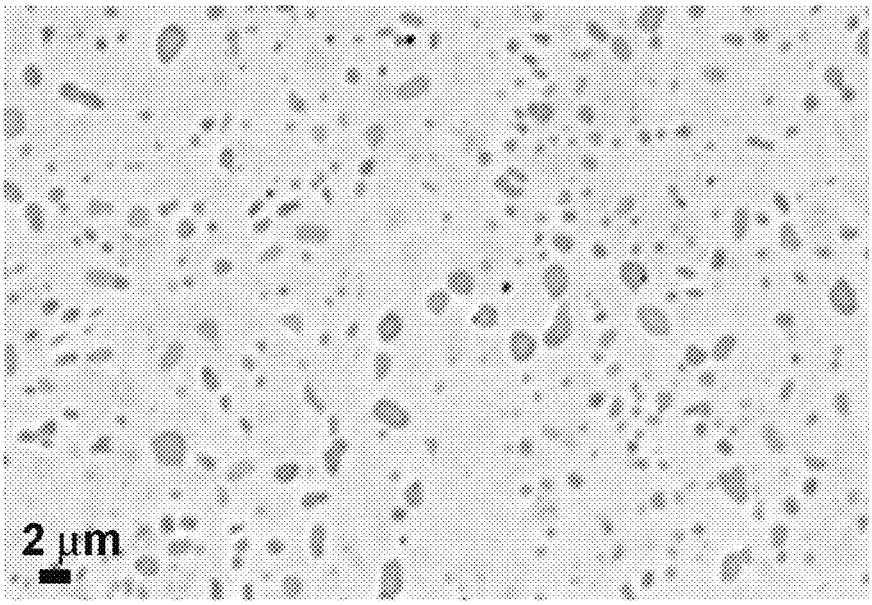
FIG. 66 The backscattered SEM micrograph of the gage microstructure of Alloy 22 specimen after tension at 850°C with tensile elongation of 13.5%.

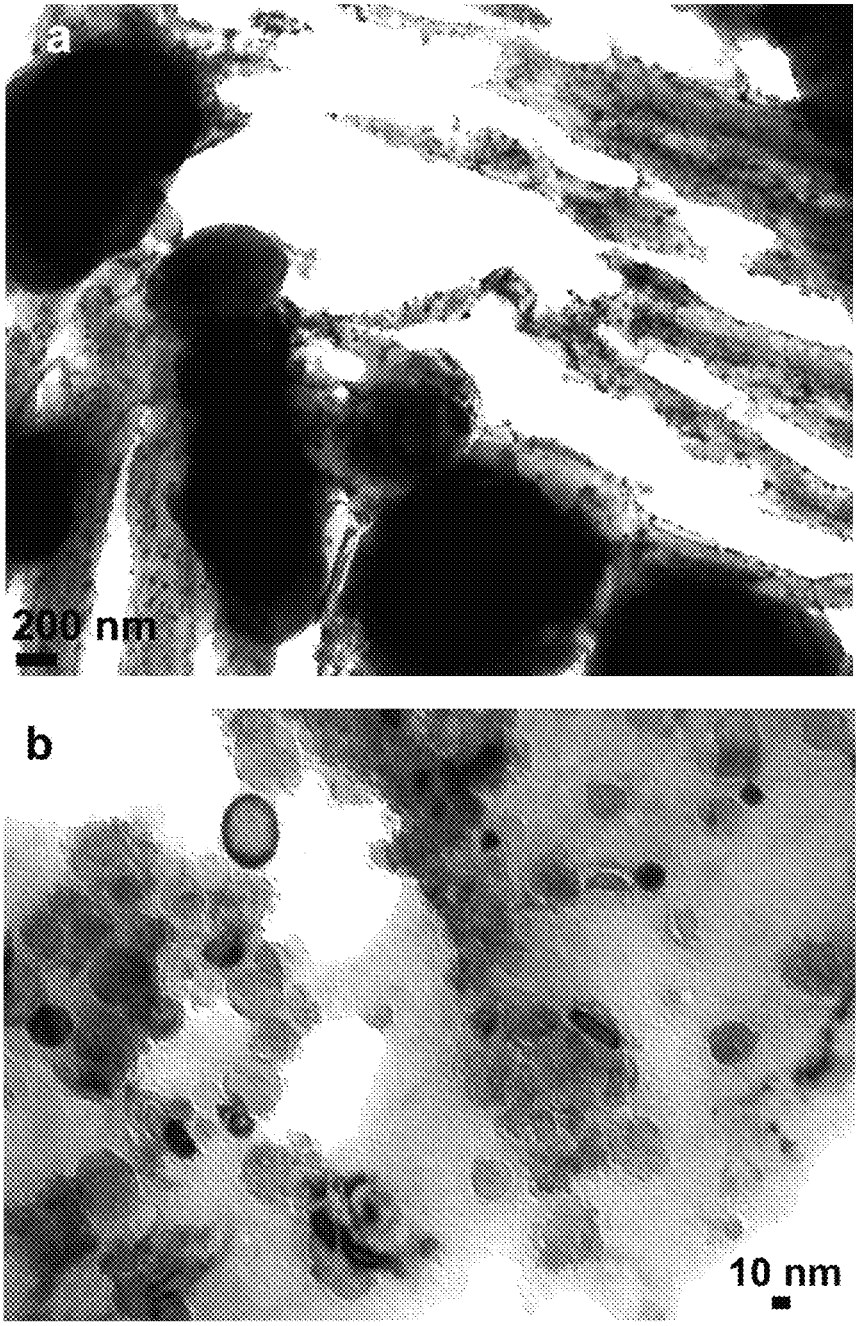
FIG. 67 The bright-field TEM micrographs of the microstructure in the Alloy 20 specimen gage after tension at 700°C with tensile elongation of 88.5%.

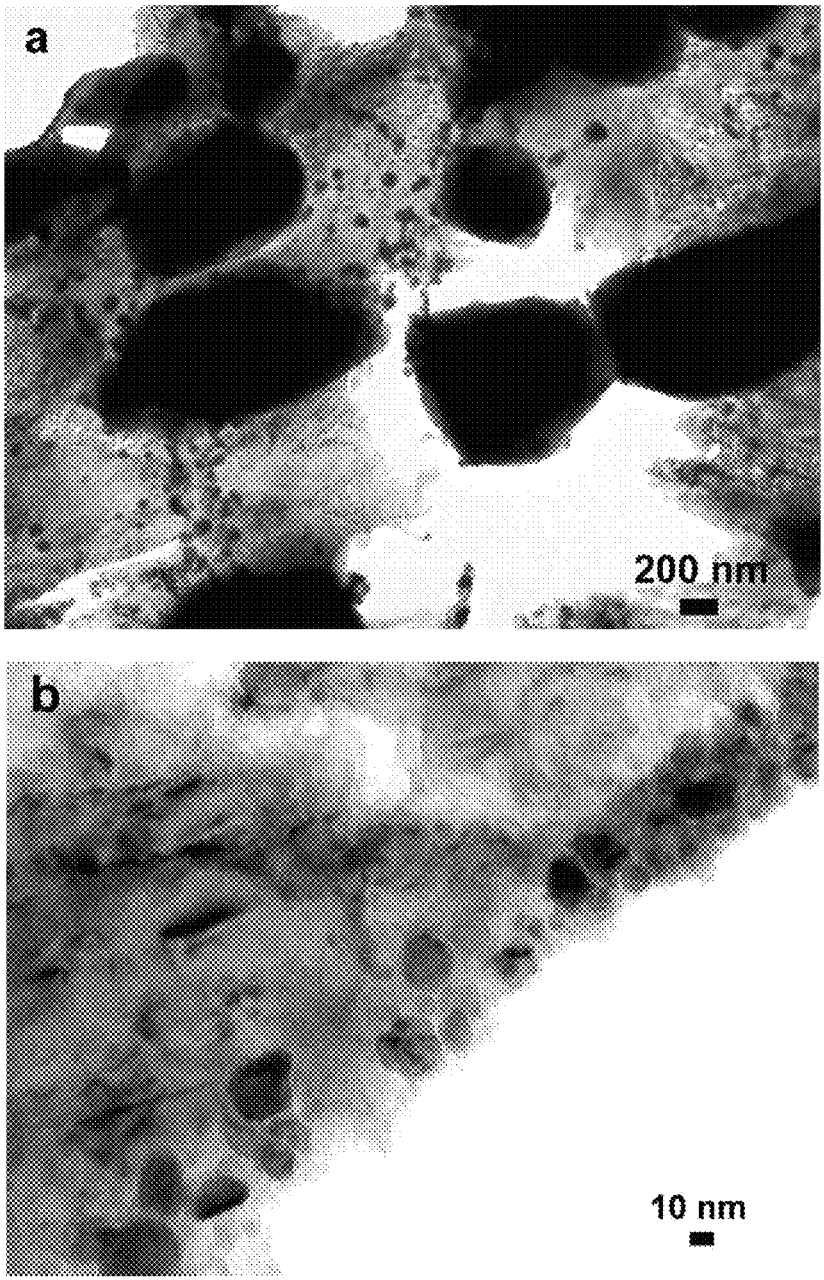
FIG. 68 The bright-field TEM micrographs of the microstructure in the Alloy 20 specimen gage after tension at 850°C with tensile elongation of 23%.

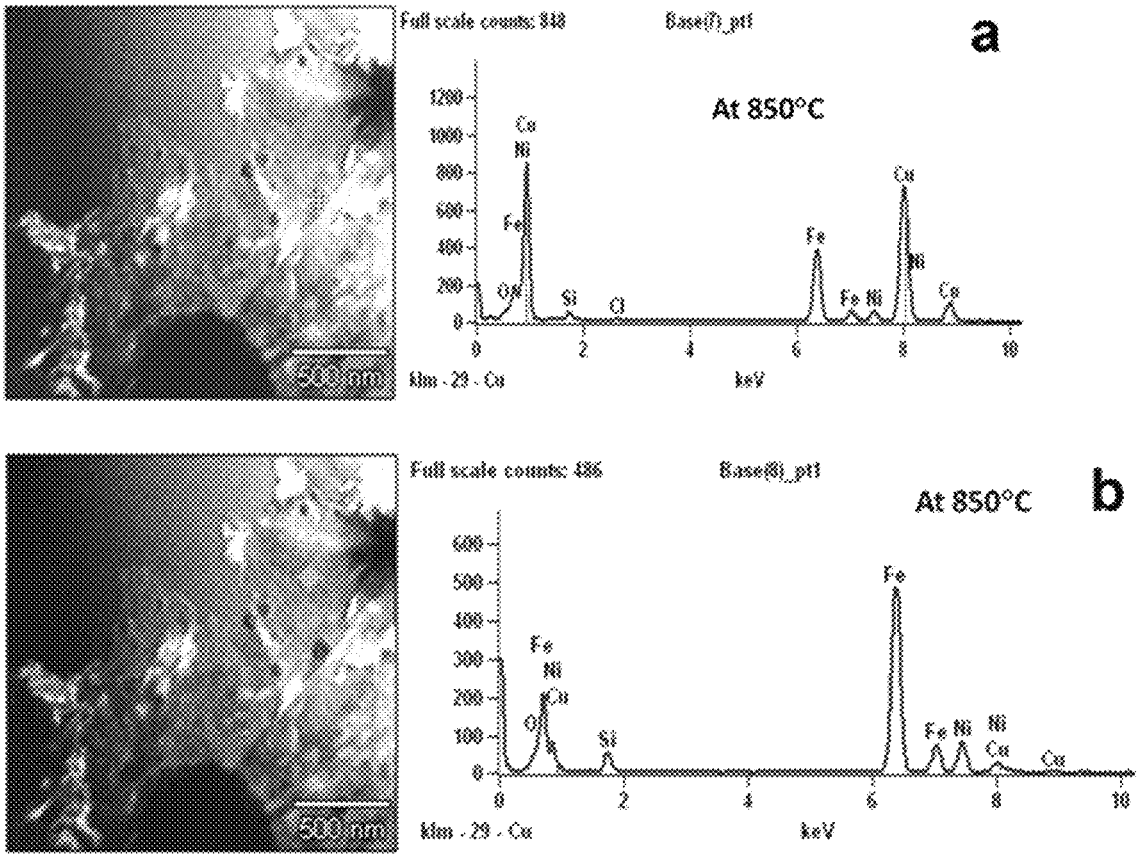
FIG. 69 TEM EDS analysis on the nano-precipitates formed in the Alloy 20 specimens.

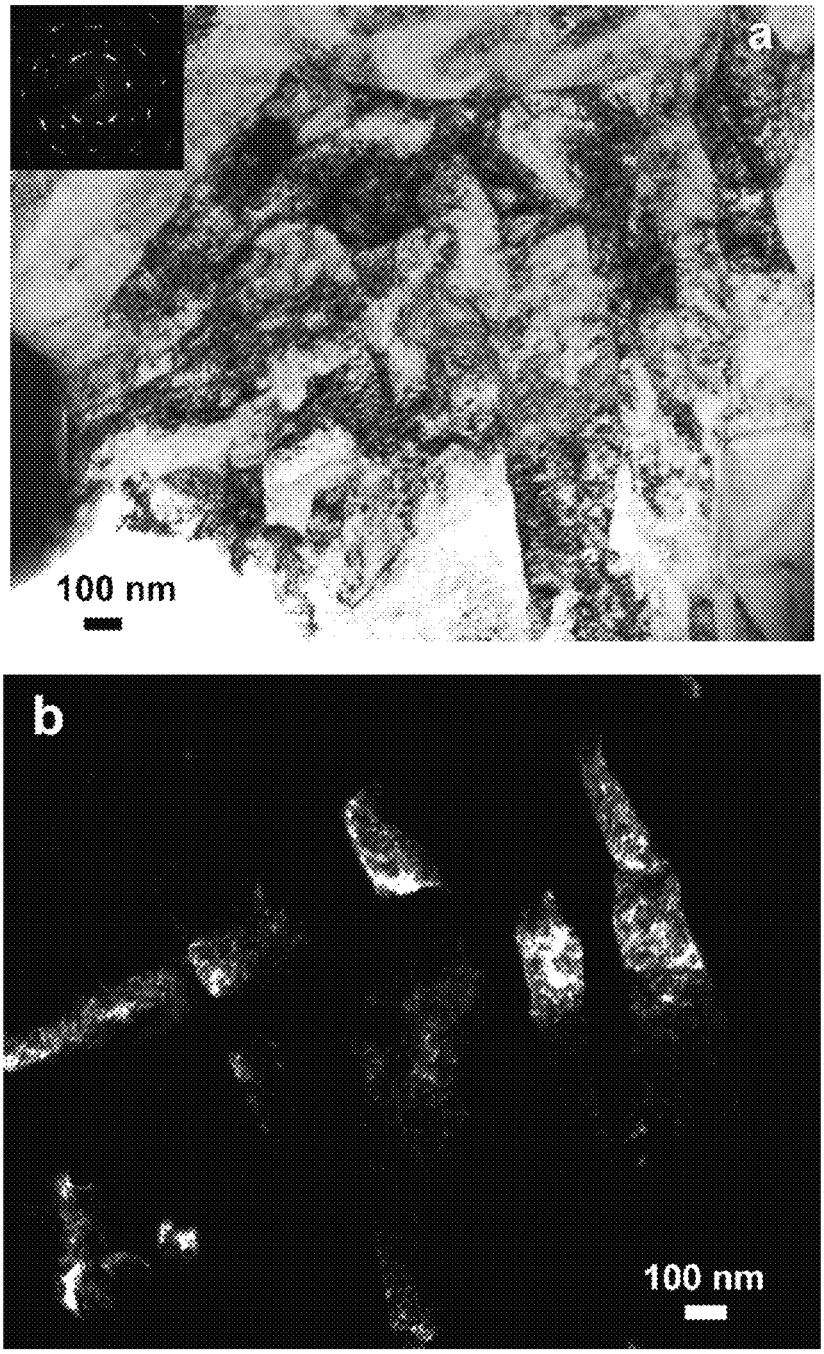
FIG. 70 The (a) bright-field and (b) dark field TEM micrographs of the microstructure in the Alloy 22 specimen gage after tension at 700°C with tensile elongation of 34.5%.

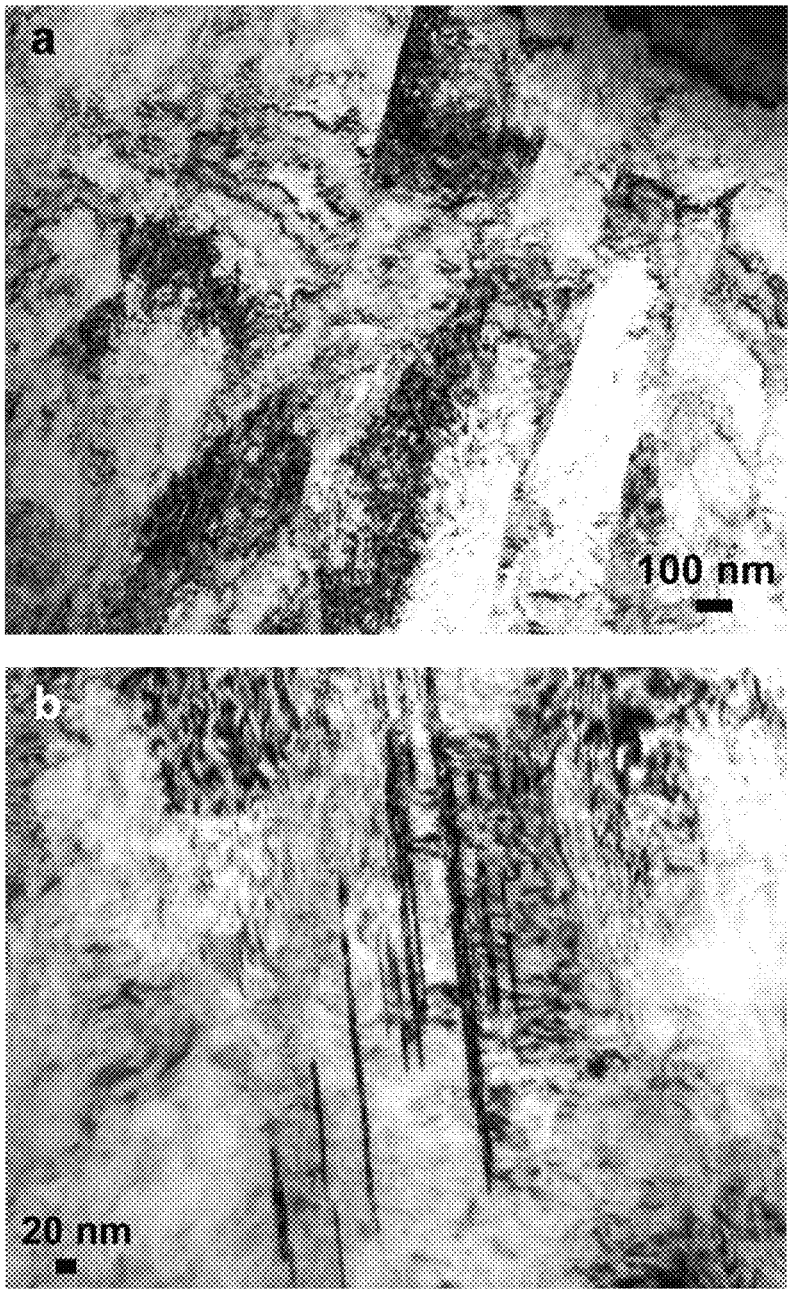
FIG. 71 The bright-field TEM micrographs of the microstructure in the Alloy 22 specimen gage after tension at 850°C with tensile elongation of 13.5%.

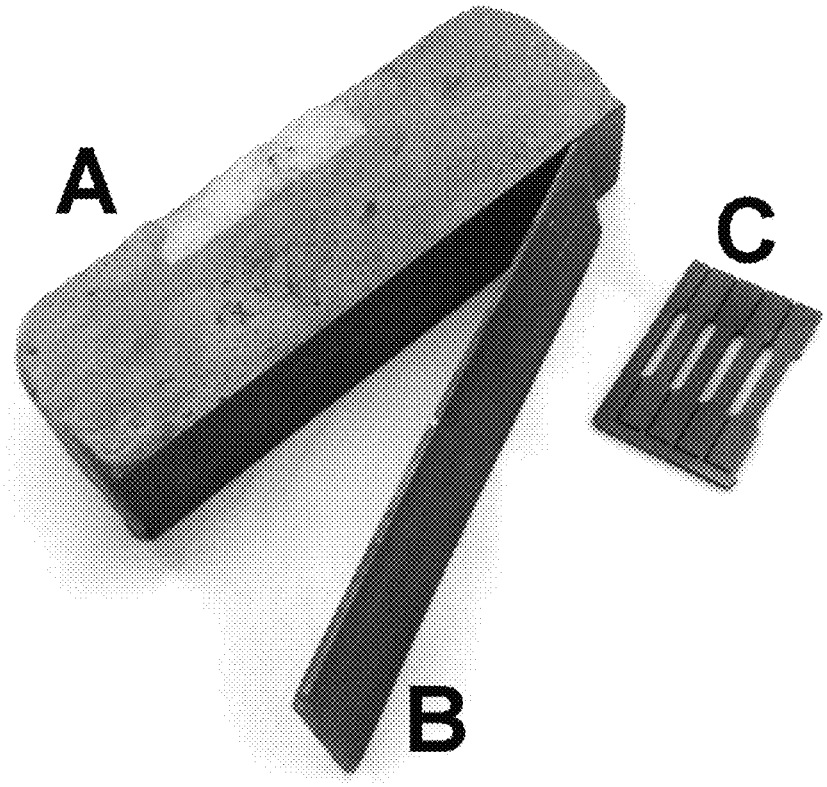
FIG. 72 As-cast plate with thickness of 1 inch (A), a thin sheet cut from the plate (B) and tensile specimens (C) from Alloy 6.

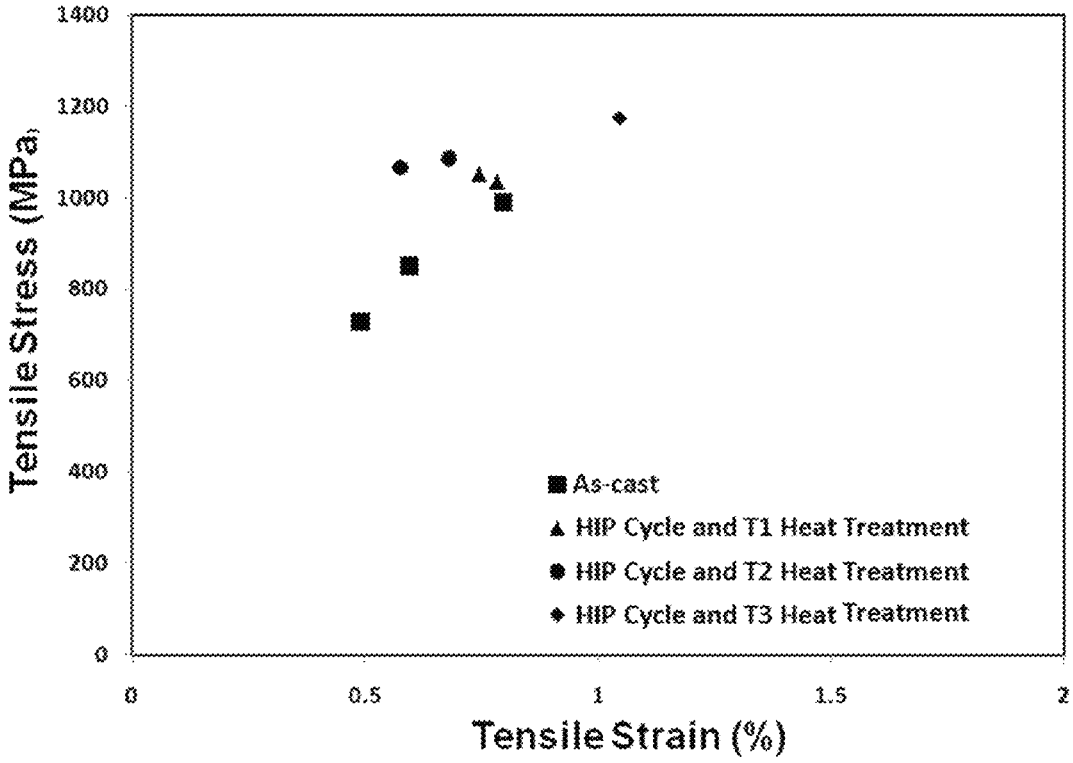
FIG. 73 Tensile properties of 1 inch thick plate from Alloy 6.

METHOD OF MAKING NON-STAINLESS STEELS WITH HIGH STRENGTH AND HIGH DUCTILITY

CROSS REFERENCE TO RELATED APPLICATIONS

This application is a continuation of U.S. application Ser. No. 13/862,825, filed Apr. 15, 2013, which is a continuation of U.S. application Ser. No. 13/556,410, filed Jul. 24, 2012 now U.S. Pat. No. 8,419,869, issued Apr. 16, 2013, which claims the benefit of U.S. Provisional Application Ser. No. 61/583,261 filed Jan. 5, 2012 and U.S. Provisional Application Ser. No. 61/604,837 filed Feb. 29, 2012.

FIELD OF INVENTION

This application deals with new class of non-stainless steel alloys with advanced property combination applicable to sheet production by methods such as chill surface processing.

BACKGROUND

Steels have been used by mankind for at least 3,000 years and are widely utilized in industry comprising over 80% by weight of all metallic alloys in industrial use. Existing steel technology is based on manipulating the eutectoid transformation. The first step is to heat up the alloy into the single phase region (austenite) and then cool or quench the steel at various cooling rates to form multiphase structures which are often combinations of ferrite, austenite, and cementite. Depending on cooling rate of the steel at solidification or thermal treatment, a wide variety of characteristic microstructures (i.e. pearlite, bainite, and martensite) can be obtained with a wide range of properties. This manipulation of the eutectoid transformation has resulted in the wide variety of steels available nowadays.

Non-stainless steels may be understood herein to contain less than 10.5% of chromium and are typically represented by plain carbon steel which is by far the most widely used kind of steel. The properties of carbon steel depend primarily on the amount of carbon it contains. With very low carbon content (below 0.05% C), these steels are relatively ductile and have properties similar to pure iron. They cannot be modified by heat treatment. They are inexpensive, but engineering applications may be restricted to non-critical components and general paneling work.

Pearlite structure formation in most alloy steels requires less carbon than in ordinary carbon steels. The majority of these alloy steels is low carbon material and alloyed with a variety of elements in total amounts of between 1.0% and 50% by weight to improve its mechanical properties. Lowering the carbon content to the range of 0.10% to 0.30%, along with some reduction in alloying elements increases the weldability and formability of the steel while maintaining its strength. Such alloys are classed as a high-strength low-alloy steels (HSLA) exhibiting tensile strengths from 270 to 700 MPa.

Advanced High-Strength Steels (AHSS) steels may have tensile strengths greater than 700 MPa and include types such as martensitic steels (MS), dual phase (DP) steels, transformation induced plasticity (TRIP) steels, and complex phase (CP) steels. As the strength level increases, the ductility of the steel generally decreases. For example, low-strength steel (LSS), high-strength steel (HSS) and AHSS may indicate tensile elongations at levels of 25%-55%, 10%-45% and 4%-30%, respectively.

Much higher strength (up to 2500 MPa) has been achieved in maraging steels which are carbon free iron-nickel alloys with additions of cobalt, molybdenum, titanium and aluminum. The term maraging is derived from the strengthening mechanism, which is transforming the alloy to martensite with subsequent age hardening. The common, non stainless grades of maraging steels contain 17% to 18% nickel, 8% to 12% cobalt, 3% to 5% molybdenum and 0.2% to 1.6% titanium. The relatively high price of maraging steels (they are several times more expensive than the high alloy tool steels produced by standard methods) significantly restricts their application in many areas (for example, automotive industry). They are highly sensitive to nonmetallic inclusions, which act as stress raisers and promote nucleation of voids and microcracks leading to a decrease in ductility and fracture toughness of the steel. To minimize the content of nonmetallic inclusions, the maraging steels are typically melted under vacuum resulting in high cost processing.

SUMMARY

The present disclosure relates to a method for producing a metallic alloy comprising a method comprising supplying a metal alloy comprising Fe at a level of 65.5 to 80.9 atomic percent, Ni at 1.7 to 15.1 atomic percent, B at 3.5 to 5.9 atomic percent, Si at 4.4 to 8.6 atomic percent. This may be followed by melting the alloy and solidifying to provide a matrix grain size of 500 nm to 20,000 nm and a boride grain size of 25 nm to 500 nm. One may then mechanical stress said alloy and/or heat to form at least one of the following grain size distributions and mechanical property profiles, wherein the boride grains provide pinning phases that resist coarsening of said matrix grains: (a) matrix grain size of 500 nm to 20,000 nm, boride grain size of 25 nm to 500 nm, precipitation grain size of 1 nm to 200 nm wherein the alloy indicates a yield strength of 300 MPa to 840 MPa, tensile strength of 630 MPa to 1100 MPa and tensile elongation of 10 to 40%; or (b) refined matrix grain size of 100 nm to 2000 nm, precipitation grain size of 1 nm to 200 nm, boride grain size of 200 nm to 2,500 nm where the alloy has a yield strength of 300 MPa to 600 MPa. The alloy having the refined grain size distribution (b) may be exposed to a stress that exceeds the yield strength of 300 MPa to 600 MPa wherein the refined grain size remains at 100 nm to 2000 nm, the boride grain size remains at 200 nm to 2500 nm, the precipitation grains remain at 1 nm to 200 nm, wherein said alloy indicates a yield strength of 300 MPa to 1400 MPa, tensile strength of 875 MPa to 1590 MPa and an elongation of 5% to 30%.

The present disclosure also relates to a method comprising supplying a metal alloy comprising Fe at a level of 65.5 to 80.9 atomic percent, Ni at 1.7 to 15.1 atomic percent, B at 3.5 to 5.9 atomic percent, Si at 4.4 to 8.6 atomic percent. One may then melt the alloy and solidify to provide a matrix grain size of 500 nm to 20,000 nm and a boride grain size of 100 nm to 2500 nm. This may then be followed by heating the alloy and forming lath structure including grains of 100 nm to 10,000 nm and boride grain size of 100 nm to 2500 nm wherein the alloy has a yield strength of 300 MPa to 1400 MPa, tensile strength of 350 MPa to 1600 MPa and elongation of 0-12%. One may then heat the aforementioned lath structure and form lamellae grains 100 nm to 10,000 nm thick, 0.1-5.0 microns in length and 100 nm to 1000 nm in width along with boride grains of 100 nm to 2500 nm and precipitation grains of 1 nm to 100 nm, wherein the alloy indicates a yield strength of 350 MPa to 1400 MPa. The aforementioned lamellae structure may undergo a stress and form an alloy having grains of 100 nm to 5000 nm, boride grains of 100 nm to 2500 nm, precipitation grains of 1 nm to 100 nm where the alloy has a yield strength of 350 MPa to 1400 MPa, a tensile strength of 1000 MPa to 1750 MPa and elongation of 0.5% to 15.0%.

The present disclosure further relates to metallic alloy comprising Fe at a level of 65.5 to 80.9 atomic percent; Ni at 1.7 to 15.1 atomic percent; B at 3.5 to 5.9 atomic percent; and Si at 4.4 to 8.6 atomic percent, wherein the alloy indicates a matrix grain size of 500 nm to 20,000 nm and boride grain size of 100 nm to 2500 nm. The alloy, upon a first exposure to heat forms a lath structure including grains of 100 nm to 10,000 nm and boride grain size of 100 nm to 2500 nm wherein the alloy has a yield strength of 400 MPa to 1400 MPa, tensile strength of 350 MPa to 1600 MPa and elongation of 0-12%. Upon a second exposure to heat followed by stress the alloy has grains of 100 nm to 5000 nm, boride grains of 100 nm to 2500 nm, precipitation grains of 1 nm to 100 nm and the alloy has a yield strength of 350 MPa to 1400 MPa, a tensile strength of 1000 MPa to 1750 MPa and elongation of 0.5% to 15.0%.

BRIEF DESCRIPTION OF THE DRAWINGS

The detailed description below may be better understood with reference to the accompanying figures which are provided for illustrative purposes and not to be considered as limiting any aspect of this invention.

FIG. 6A illustrates a lamellae structure.

FIG. 6B illustrates mechanical response of Class 3 steel upon tension at room temperature as compared to Class 2 steel.

FIG. 7 illustrates two classes of the alloys depending on their microstructural development from initially formed Modal Structure.

FIG. 8 illustrates pictures of Alloy 6 plate with a thickness of 1.8 mm (a) as cast; (b) after HIP cycle at 1100° C. for 1 hour.

FIG. 9 illustrates a comparison of stress-strain curves of indicated steel types as compared to Dual Phase (DP) steels.

FIG. 10 illustrates a comparison of stress-strain curves of indicated steel types as compared to Complex Phase (CP) steels.

FIG. 11 illustrates a comparison of stress-strain curves of indicated steel types as compared to Transformation Induced Plasticity (TRIP) steels.

FIG. 12 illustrates a comparison of stress-strain curves of indicated steel-types as compared to Martensitic (MS) steels.

FIG. 13 illustrates the backscattered SEM micrograph of the microstructure in the Class 2 alloy plate sample; a) As-Cast, b) HIPed at 1100° C. for 1 hour, and c) HIPed at 1100° C. for 1 hour and heat treated at 700° C. for 1 hour.

FIG. 14 illustrates X-ray diffraction data (intensity vs two-theta) for Class 2 alloy plate in the as-cast condition; a) Measured pattern, b) Rietveld calculated pattern.

FIG. 15 illustrates X-ray diffraction data (intensity vs two-theta) for Class 2 alloy plate in the HIPed condition (1100° C. for 1 hour); a) Measured pattern, b) Rietveld calculated pattern with peaks identified.

FIG. 16 illustrates X-ray diffraction data (intensity vs two-theta) for Class 2 alloy plate in the HIPed (1000° C. for 1 hour) and heat treated condition (350° C. for 20 minutes); a) Measured pattern, b) Rietveld calculated pattern with peaks identified.

FIG. 17 illustrates TEM micrographs of the Class 2 alloy plate sample; a) As-Cast, b) HIPed at 1100° C. for 1 hour, and c) HIPed at 1100° C. for 1 hour and heat treated at 700° C. for 1 hour.

FIG. 18 illustrates the backscattered SEM micrograph of the microstructure in the as-cast Alloy 6 plate.

FIG. 19 illustrates the backscattered SEM micrograph of the microstructure in the Class 3 alloy plate after HIP cycle at 1100° C. for 1 hour.

FIG. 20 illustrates the backscattered SEM micrograph of the microstructure in the Class 3 alloy plate after HIP cycle at 1100° C. for 1 hour and heat treated to 700° C. for 60 minutes with relatively slow furnace cooling.

FIG. 21 illustrates the backscattered SEM micrograph of the microstructure in the etched Class 3 alloy plate after HIP cycle at 1100° C. for 1 hour and heat treated at 700° C. for 60 minutes with relatively slow furnace cooling.

FIG. 22 illustrates X-ray diffraction data (intensity vs two theta) for Class 3 alloy plate in the as cast condition (a) measured pattern; (b) Rietveld calculated pattern with peaks identified.

FIG. 23 illustrates X-ray diffraction data (intensity vs two-theta) for Class 3 alloy plate in the HIPed condition (1100° C. for 1 hour); a) Measured pattern, b) Rietveld calculated pattern with peaks identified.

FIG. 24 illustrates X-ray diffraction data (intensity vs two-theta) for Class 3 alloy plate in the HIPed (1100° C. for 1 hour) and heat treated condition (700° C. slow cool to room temperature (670 minute total time).); a) Measured pattern, b) Rietveld calculated pattern with peaks identified.

FIG. 25 illustrates TEM micrographs of as-cast Class 3 alloy plate sample: (a) the microstructure at the intergranular region in the as-cast sample (corresponding to the region B in FIG. 6); (b) Magnified image at the intergranular region showing the detailed structure of precipitates; (c) the microstructure of matrix grains, which are aligned in one direction indicated by the arrow.

FIG. 26 illustrates the TEM micrographs of the microstructure in the Class 3 alloy plate sample at 1100° C. for 1 hour: (a) a number of precipitates formed and distributed homogeneously in the matrix with lath structure; (b) the detailed microstructure of the lath microstructure near precipitates; (c) dark-field TEM image showing grains within lath structure.

FIG. 27 illustrates the TEM micrographs of the microstructure in the Class 3 alloy plate sample after HIP cycle at 1100° C. for 1 hour and heat treatment at 700° C. for 60 minutes with relatively slow furnace cooling: (a) the precipitates grew slightly, but the lath structure in the matrix developed into lamellae structure. (b) a structure of the matrix at higher magnification.

FIG. 28 illustrates tensile properties of Class 2 alloy plate in various conditions; a) As-cast, b) After HIP cycle at 1100° C. for 1 hour and c) After HIP cycle at 1100° C. for 1 hour and heat treating at 700° C. for 1 hour.

FIG. 29 illustrates SEM images of the microstructure in the tensile specimen from Class 2 alloy plate after the HIP cycle at 1100° C. for 1 hour, heat treatment at 700° C. for 1 hour and deformation at room temperature (a) in a grip section and (b) in a gage section.

FIG. 30 illustrates comparison between X-ray data for the Class 2 alloy plate after the HIP cycle at 1100° C. for 1 hour and heat treatment at 700° C. for 1 hour: 1) specimen gage section after tensile testing (top curve) and 2) specimen grip section (bottom curve).

FIG. 31 illustrates X-ray diffraction data (intensity vs two-theta) for the gage section of tensile tested specimen from Class 2 alloy plate in the HIPed condition (1100° C. for 1 hour) and heat treated at 700° C. for 1 hour; a) Measured pattern, b) Rietveld calculated pattern with peaks identified.

FIG. 32 illustrates TEM micrographs of the Class 2 alloy plate HIPed at 1100° C. for 1 hour and heat treated at 700° C. for 1 hour; a) Before tensile testing; b) After tensile testing.

FIG. 33 illustrates TEM micrographs of the Class 2 alloy plate HIPed at 1100° C. for 1 hour and heat treated at 700° C. for 1 hour; a) Before tensile testing, nano-precipitates are observed after heat treatment; b) After tensile testing, dislocation pinning by the nano-precipitates is observed.

FIG. 34 is a stress versus strain curve showing the tensile properties of Class 3 alloy plate in various conditions: (a) as-cast; (b) after HIP cycle at 1000° C. for 1 hour; and (c) after HIP cycle at 1100° C. for 1 hour and heat treating at 700° C. for 60 minutes with relatively slow furnace cooling.

FIG. 35 is a comparison between X-ray data for the Class 3 alloy plate after the HIP cycle at 1100° C. for 1 hour and heat treating at 700° C. slow cool to room temperature (670 minute total time): (1) plate gage section after tensile testing (top curve); and (2) plate prior to tensile testing (bottom curve).

FIG. 36 is X-ray diffraction data (intensity vs two-theta) for the gage section of tensile tested specimen from Class 3 alloy plate in the HIPed condition (1100° C. for 1 hour): (a) measured pattern; (b) Rietveld calculated pattern with peaks identified.

FIG. 37 is the calculated X-ray diffraction pattern (intensity vs two-theta) for the newly identified hexagonal phase (space group #190) found in the gage section of tensile tested specimen from Class 3 alloy plate in the HIPed condition (1100° C. for 1 hour) and heat treated at 700° C. slow cool to room temperature (670 minute total time) condition. Note that the diffraction planes are listed in parenthesis.

FIG. 38 is the calculated X-ray diffraction pattern (intensity vs two-theta) for the newly identified hexagonal phase (space group #186) found in the gage section of tensile tested specimen from Class 3 alloy plate in the HIPed condition (1100° C. for 1 hour) and heat treated at 700° C. slow cool to room temperature (670 minute total time) condition. Note that the diffraction planes are listed in parenthesis.

FIG. 39 are TEM micrographs of the microstructure in the tensile specimen from Class 3 alloy plate after HIP cycle at 1100° C. for 1 hour and heat treatment at 700° C. for 60 minutes with relatively slow furnace cooling: (a) before tensile testing; (b) after tensile testing.

FIG. 40 are stress-strain curves for Alloy 17 and Alloy 27 after same thermal mechanical treatment tested at room temperature.

FIG. 41 are SEM images of the microstructure in the Alloy 17 plate after HIP cycle at 1100° C. for 1 hr and heat treatment at 700° C. for 1 hr (prior deformation).

FIG. 42 are SEM images of the microstructure in the Alloy 27 plate after HIP cycle at 1100° C. for 1 hr and heat treatment at 700° C. for 1 hr (prior deformation).

FIG. 43 are stress-strain curves recorded at tensile testing of Alloy 2 plate specimens after HIP cycle and heat treatment at 700° C. for 1 with cooling (a) in air and (b) with furnace.

FIG. 44 are stress-strain curves recorded at tensile testing of Alloy 5 plate specimens after HIP cycle C and heat treatment at 700° C. for 1 hr with cooling (a) in air and (b) with furnace.

FIG. 45 are stress-strain curves recorded at tensile testing of Alloy 52 plate specimens after HIP cycle and heat treatment at (a) 850° C. for 1 with cooling in air and (b) 700° C. for 1 with slow cooling with furnace.

FIG. 46 illustrates strain hardening coefficient in Class 2 alloy as a function of strain.

FIG. 47 illustrates strain hardening in Class 3 alloy as a function of strain.

FIG. 48 illustrates stress-strain curves for Class 2 alloy tested in tension with incremental straining.

FIG. 49 illustrates stress-strain curves for Class 3 alloy tested in tension with incremental straining.

FIG. 50 illustrates stress-strain curves for the Class 2 alloy (a) in initial state and (b) after pre-straining to 10% and tested to failure.

FIG. 51 illustrates SEM images of microstructure of the gage section of the tensile specimens from Class 2 alloy before and after pre-straining to 10%.

FIG. 52 illustrates stress-strain curves for the Class 3 alloy (a) in initial state and (b) after pre-straining to 3% and tested to failure.

FIG. 53 illustrates stress-strain curves for the Class 2 alloy plate after HIP cycle at 1100° C. for 1 hour (a) in initial state and (b) after pre-straining to 10% and subsequent annealing at 1100° C. for 1 hour.

FIG. 54 illustrates SEM image of microstructure of the gage section of the tensile specimens from Class 2 alloy plate after pre-straining to 10% and annealing at 1100° C. for 1 hour.

FIG. 55 are stress-strain curves for the Class 3 alloy plate after HIP cycle at 1100° C. for 1 hour and tested (a) in initial state and (b) after pre-straining to 3% and subsequent annealing at 1100° C. for 1 hour.

FIG. 56 illustrates SEM image of microstructure of the gage section of the tensile specimens from Class 3 alloy plate after pre-straining to 3% and annealing at 1100° C. for 1 hour.

FIG. 57 illustrates stress strain curves for Class 2 alloy plate specimen which has been subjected to 3 rounds of tensile testing to a 10% deformation followed by annealing between steps and tested to failure.

FIG. 58 illustrates the tensile specimen from Class 2 alloy plate before and after 3 rounds of deformation to 10% with annealing between rounds.

FIG. 59 illustrates a SEM image of the microstructure in the gage of the tensile specimen from Class 2 alloy plate before and after 3 rounds of deformation to 10% with annealing between rounds.

FIG. 60 illustrates TEM images of the microstructure in the tensile specimen from Class 2 alloy plate after cycling deformation to 10% and annealing at 1100° C. for 1 hour (3 times), then tested to failure a) in the grip section and b) in the gage.

FIG. 61 are stress-strain curves for Class 3 alloy plate after HIP cycle at 1100° C. for 1 hour and heat treatment at 700° C. for 1 hour with relatively slow furnace cooling, which has been subjected to 3 rounds of tensile testing to a 3% deformation followed by annealing between steps and tested to failure.

FIG. 62 illustrates significant tensile elongation of Alloy 20 (Class 3) specimen at 700° C.

FIG. 63 is a SEM image of the gage microstructure of Alloy 20 (Class 3) specimen after tension at 700° C. with tensile elongation of 88.5%.

FIG. 64 is a SEM image of the gage microstructure of Alloy 20 (Class 3) specimen after tension at 850° C. with tensile elongation of 23%.

FIG. 65 is a SEM image of the gage microstructure of Alloy 22 (Class 3) specimen after tension at 700° C. with tensile elongation of 34.5%.

FIG. 66 is a SEM image of the gage microstructure of Alloy 22 (Class 3) specimen after tension at 850° C. with tensile elongation of 13.5%.

FIG. 67 are TEM images of the gage microstructure of Alloy 20 (Class 3) specimen after tension at 700° C. with tensile elongation of 88.5%.

FIG. 68 are TEM images of the gage microstructure of Alloy 20 (Class 3) specimen after tension at 850° C. with tensile elongation of 23%.

FIG. 69 illustrates Cu-enrichment in nano-precipitates in Alloy 20 after deformation at elevated temperature.

FIG. 70 are TEM images of the gage microstructure of Alloy 22 (Class 3) specimen after tension at 700° C. with tensile elongation of 34.5%.

FIG. 71 are TEM images of the gage microstructure of Alloy 22 (Class 3) specimen after tension at 850° C. with tensile elongation of 13.5%.

FIG. 72 is a picture of as-cast plate with thickness of 1 inch (A), a thin plate cut from the plate (B), and tensile specimens (C) from Alloy 6.

FIG. 73 illustrates tensile properties of 1 inch thick plate from Alloy 6.

DETAILED DESCRIPTION

Steel Strip/Sheet Sizes

Through chill surface processing, steel sheet, as described in this application, with thickness in range of 0.3 mm to 150 mm can be produced with widths in the range of 100 to 5000 mm. These thickness ranges and width ranges may be adjusted in these ranges at 0.1 mm increments. Preferably, one may use twin roll casting which can provide sheet production at thicknesses from 0.3 to 5 mm and from 100 mm to 5000 mm in width. Preferably, one may also utilize thin slab casting which can provide sheet production at thicknesses from 0.5 to 150 mm and from 100 mm to 5000 mm in width. Cooling rates in the sheet would be dependent on the process but may vary from $11\times10^{3}$ to $4\times10^{-2}$ K/s. Cast parts through various chill surface methods with thickness up to 150 mm, or in the range of 1 mm to 150 mm are also contemplated herein from various methods including, permanent mold casting, investment casting, die casting, centrifugal casting etc. Also, powder metallurgy through either conventional press and sintering or through HIPing/forging is a contemplated route to make partially or fully dense parts and devices utilizing the chemistries, structures, and mechanisms described in this application (i.e. the Class 2 or Class 3 Steel described herein).

Production Routes

Twin Roll Casting Description

Figure 1:
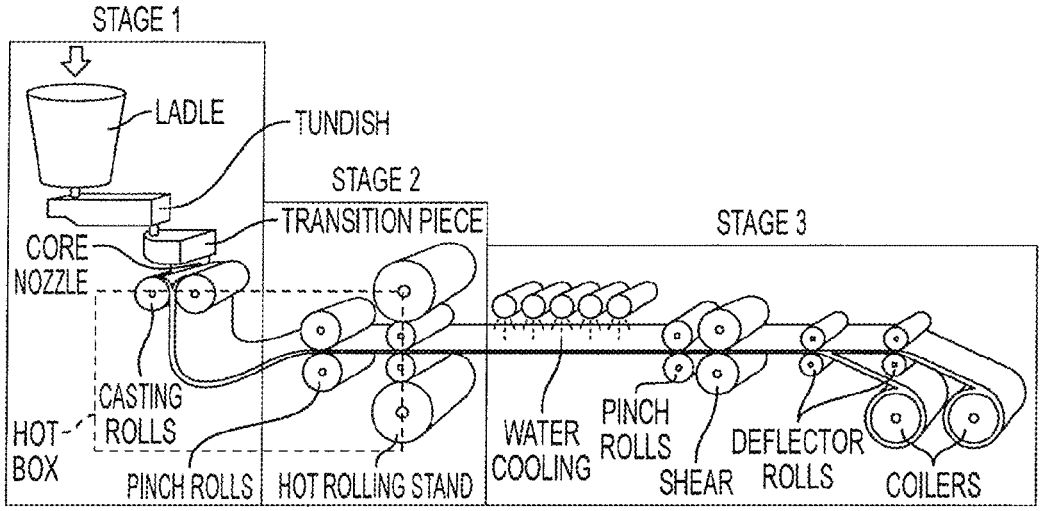
FIG. 1 illustrates an exemplary twin-roll process.

One of the examples of steel production by chill surface processing would be the twin roll process to produce steel sheet. A schematic of the Nucor/Castrip process is shown in FIG. 1. As shown, the process can be broken up into three stages; Stage 1—Casting, Stage 2—Hot Rolling, and Stage 3—Strip Coiling. During Stage 1, the sheet is formed as the solidifying metal is brought together in the roll nip between the rollers which are generally made out of copper or a copper alloy. Typical thickness of the steel at this stage is 1.7 to 1.8 mm in thickness but by changing the roll separation distance can be varied from 0.8 to 3.0 mm in thickness. During Stage 2, the as-produced sheet is hot rolled, typically from 700 to 1200° C. in order to eliminate macrodefects such as the formation of pores, dispersed shrinkage, blowholes, pinholes, slag inclusions etc. from the production process as well as allowing solutionizing of key alloying elements, austenitization, etc. The thickness of the hot rolled sheet can be varied depending on the targeted market but is generally in the range from 0.3 to 2.0 mm in thickness. During Stage 3, the temperature of the sheet and time at temperature which is typically from 300 to 700° C. can be controlled by adding water cooling and changing the length of the run-out of the sheet prior to coiling. Besides hot rolling, Stage 2 could also be done by alternate thermomechanical processing strategies such as hot isostatic processing, forging, sintering etc. Stage 3, besides controlling the thermal conditions during the strip coiling process, could also be done by post processing heat treating in order to control the final microstructure in the sheet.

Thin Slab Casting Description

Figure 2:
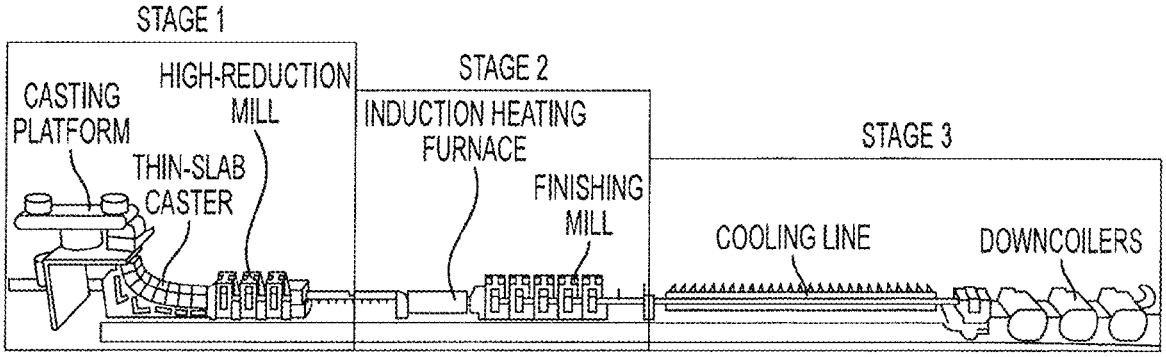
FIG. 2 illustrates an exemplary thin-slab casting process.

Another example of steel production by chill surface processing would be the thin slab casting process to produce steel sheet. A schematic of the Arvedi ESP process is shown in FIG. 2. In an analogous fashion to the twin roll process, the thin slab casting process can be separated into three stages. In Stage 1, the liquid steel is both cast and rolled in an almost simultaneous fashion. The solidification process begins by forcing the liquid melt through a copper or copper alloy mold to produce initial thickness typically from 50 to 110 mm in thickness but this can be varied (i.e. 20 to 150 mm) based on liquid metal processability and production speed. Almost immediately after leaving the mold and while the inner core of the steel sheet is still liquid, the sheet undergoes reduction using a multistep rolling stand which reduces the thickness significantly down to 10 mm depending on final sheet thickness targets. In Stage 2, the steel sheet is heated by going through one or two induction furnaces and during this stage the temperature profile and the metallurgical structure is homogenized. In Stage 3, the sheet is further rolled to the final gage thickness target which may be in the 0.5 to 15 mm thickness range. Immediately after rolling, the strip is cooled on a run-out table to control the development of the final microstructure of the sheet prior to coiling into a steel roll.

While the three stage process of forming sheet in either twin roll casting or thin slab casting is part of the process, the response of the alloys herein to these stages is unique based on the mechanisms and structure types described herein and the resulting novel combinations of properties.

New Class of Non-Stainless Steels

The non-stainless steel alloys herein are such that they are capable of formation of what is described herein as Class 1, Class 2 Steel or Class 3 Steel which are preferably crystalline (non-glassy) with identifiable crystalline grain size morphology. The ability of the alloys to form Class 2 or Class 3 Steels herein is described in detail herein. However, it is useful to first consider a description of the general features of Class 1, Class 2 and Class 3 Steels, which is now provided below.

Class 1 Steel

Figure 3A:
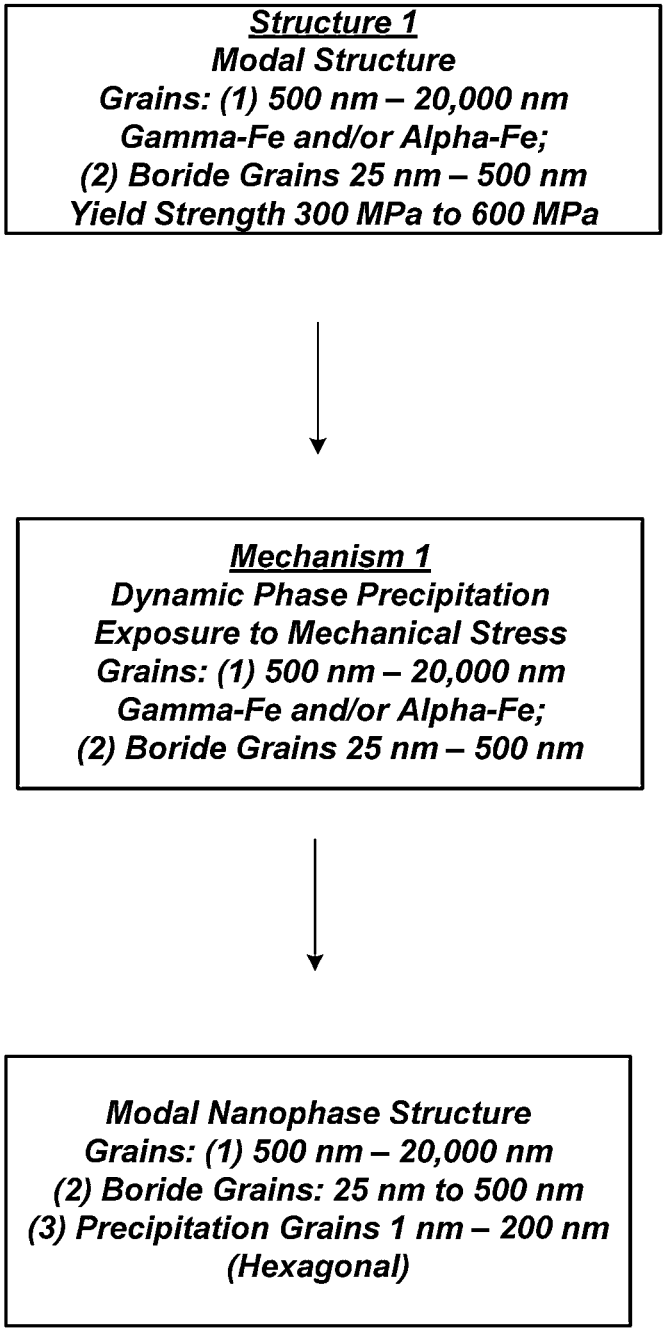
FIG. 3A illustrates structures and mechanisms regarding the formation of Class 1 Steel herein.

The formation of Class 1 Steel herein (non-stainless) is illustrated in FIG. 3A. Non-stainless steels may be understood herein to contain less than 10.5% of chromium. As shown therein, a modal structure is initially formed which modal structure is the result of starting with a liquid melt of the alloy and solidifying by cooling, which provides nucleation and growth of particular phases having particular grain sizes. Reference herein to modal may therefore be understood as a structure having at least two grain size distributions. Grain size herein may be understood as the size of a single crystal of a specific particular phase preferably identifiable by methods such as scanning electron microscopy or transmission electron microscopy. Accordingly, Structure 1 of the Class 1 Steel may be preferably achieved by processing through either laboratory scale procedures as shown and/or through industrial scale methods involving chill surface processing methodology such as twin roll processing or thin slab casting The modal structure of Class 1 Steel will therefore initially indicate, when cooled from the melt, the following grain sizes: (1) matrix grain size of 500 nm to 20,000 nm containing austenite and/or ferrite; (2) boride grain size of 25 nm to 500 nm (i.e. non-metallic grains such as $M_2B$ where M is the metal and is covalently bonded to B). The boride grains may also preferably be "pinning" type phases which is reference to the feature that the matrix grains will effectively be stabilized by the pinning phases which resist coarsening at elevated temperature. Note that the metal boride grains have been identified as exhibiting the $M_2B$ stoichiometry but other stoichiometries are possible and may provide pinning including $M_3B$, MB ($M_1B_1$), $M_{23}B_6$, and $M_7B_3$.

The modal structure of Class 1 Steel may be deformed by thermomechanical deformation and through heat treatment, resulting in some variation in properties, but the modal structure may be maintained.

Figure 4A:
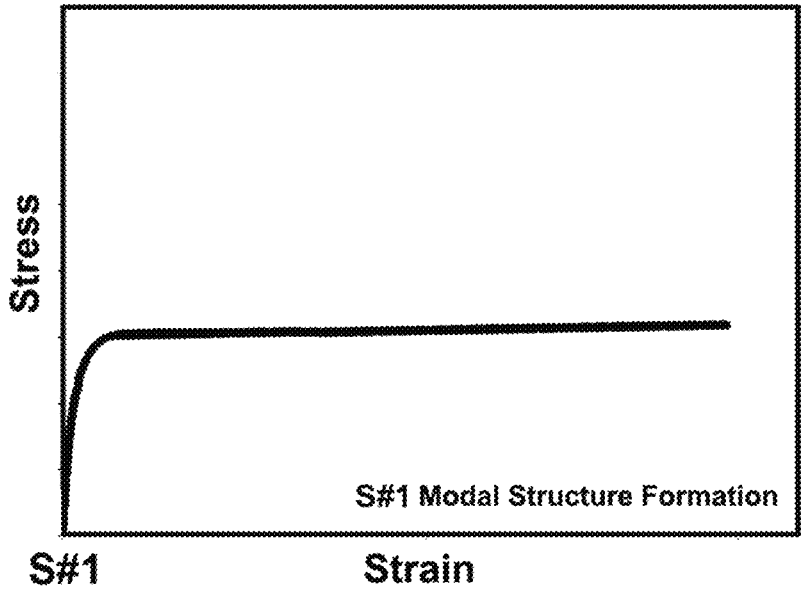
FIG. 4A illustrates a representative stress-strain curve of a material containing modal phase formation.

When the Class 1 Steel noted above is exposed to a mechanical stress, the observed stress versus strain diagram is illustrated in FIG. 4A. It is therefore observed that the modal structure undergoes what is identified as Dynamic Nanophase Precipitation leading to a second type structure for the Class 1 Steel. Such Dynamic Nanophase Precipitation is therefore triggered when the alloy experiences a yield under stress, and it has been found that the yield strength of Class 1 Steels which undergo Dynamic Nanophase Precipitation may preferably occur at 300 MPa to 840 MPa. Accordingly, it may be appreciated that Dynamic Nanophase Precipitation occurs due to the application of mechanical stress that exceeds such indicated yield strength. Dynamic Nanophase Precipitation itself may be understood as the formation of a further identifiable phase in the Class 1 Steel which is termed a precipitation phase with an associated grain size. That is, the result of such Dynamic Nanophase Precipitation is to form an alloy which still indicates identifiable matrix grain size of 500 nm to 20,000 nm, boride pinning grain size of 25 nm to 500 nm, along with the formation of precipitation grains which contain hexagonal phases and grains of 1.0 nm to 200 nm. As noted above, the grain sizes therefore do not coarsen when the alloy is stressed, but does lead to the development of the precipitation grains as noted.

Reference to the hexagonal phases may be understood as a dihexagonal pyramidal class hexagonal phase with a $P6_3mc$ space group (#186) and/or a ditrigonal dipyramidal class with a hexagonal P6bar2C space group (#190). In addition, the mechanical properties of such second type structure of the Class 1 Steel are such that the tensile strength is observed to fall in the range of 630 MPa to 1100 MPa, with an elongation of 10-40%. Furthermore, the second type structure of the Class 1 Steel is such that it exhibits a strain hardening coefficient between 0.1 to 0.4 that is nearly flat after undergoing the indicated yield. The strain hardening coefficient is reference to the value of n In the formula $\sigma = K\epsilon^n$, where $\sigma$ represents the applied stress on the material, $\epsilon$ is the strain and K is the strength coefficient. The value of the strain hardening exponent n lies between 0 and 1. A value of 0 means that the alloy is a perfectly plastic solid (i.e. the material undergoes non-reversible changes to applied force), while a value of 1 represents a 100% elastic solid (i.e. the material undergoes reversible changes to an applied force).

Table 1 below provides a comparison and performance summary for Class 1 Steel herein.

TABLE 1

Comparison of Structure and Performance for Class 1 Steel

| | Class 1 Steel | |
|---|---|---|
| Property/ Mechanism | Structure Type #1 Modal Structure | Structure Type #2 Modal Nanophase Structure |
| Structure Formation | Starting with a liquid melt, solidifying this liquid melt and forming directly | Dynamic Nanophase Precipitation occurring through the application of mechanical stress |
| Transformations | Liquid solidification followed by nucleation and growth | Stress induced transformation involving phase formation and precipitation |
| Enabling Phases | Austenite and/or ferrite with boride pinning | Austenite, optionally ferrite, boride pinning phases, and hexagonal phase(s) precipitation |
| Matrix Grain Size | 500 to 20,000 nm<br>Austenite and/or ferrite | 500 to 20,000 nm<br>Austenite optionally ferrite |
| Boride Grain Size | 25 to 500 nm<br>Non metallic (e.g. metal boride) | 25 to 500 nm<br>Non-metallic (e.g. metal boride) |
| Precipitation Grain Sizes | — | 1 nm to 200 nm<br>Hexagonal phase(s) |
| Tensile Response | Intermediate structure; transforms into Structure #2 when undergoing yield | Actual with properties achieved based on structure type #2 |
| Yield Strength | 300 to 600 MPa | 300 to 840 MPa |
| Tensile Strength | — | 630 to 1100 MPa |
| Total Elongation | — | 10 to 40% |
| Strain Hardening Response | — | Exhibits a strain hardening coefficient between 0.1 to 0.4 and a strain hardening coefficient as a function of strain which |

TABLE 1-continued

| Comparison of Structure and Performance for Class 1 Steel | | |
|---|---|---|
| | Class 1 Steel | |
| Property/ Mechanism | Structure Type #1 Modal Structure | Structure Type #2 Modal Nanophase Structure |
| | | is nearly flat or experiencing a slow increase until failure |

Class 2 Steel

Figure 3B:
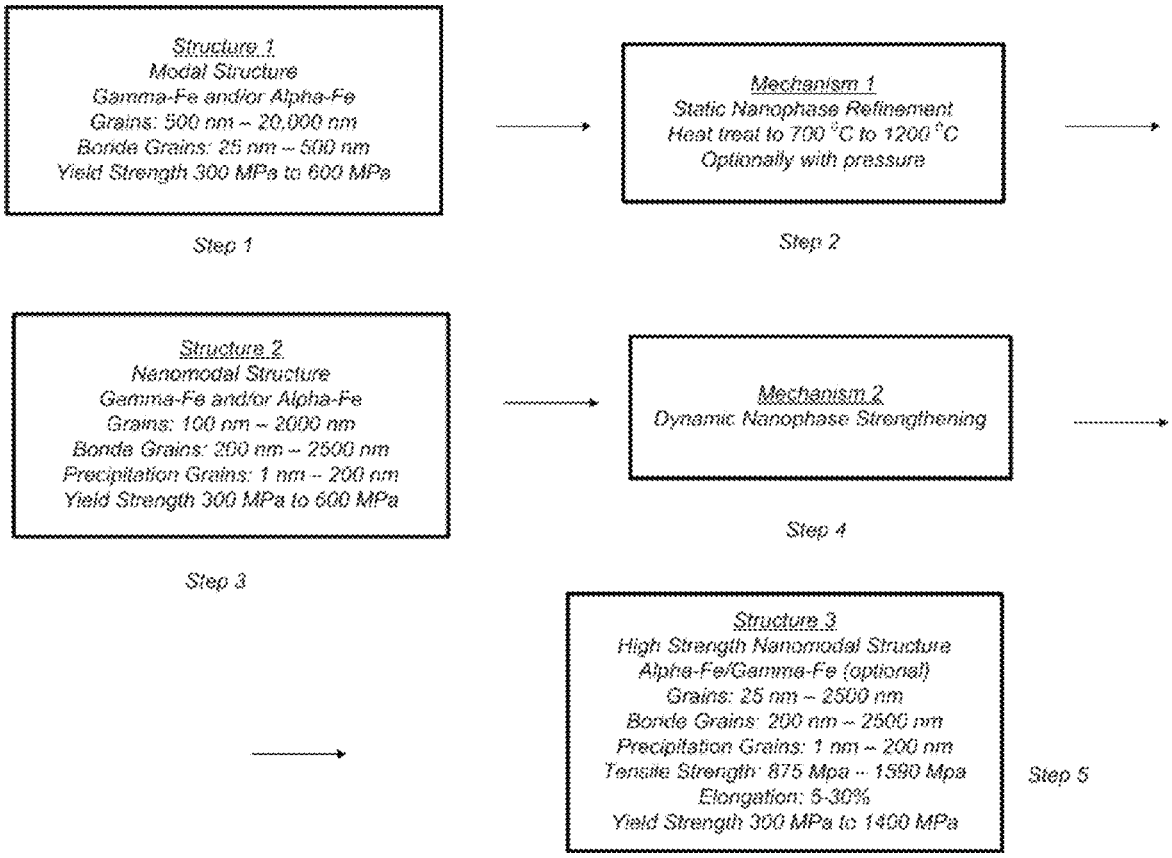
FIG. 3B illustrates structures and mechanism regarding the formation of Class 2 steel alloys herein.
Figure 4B:
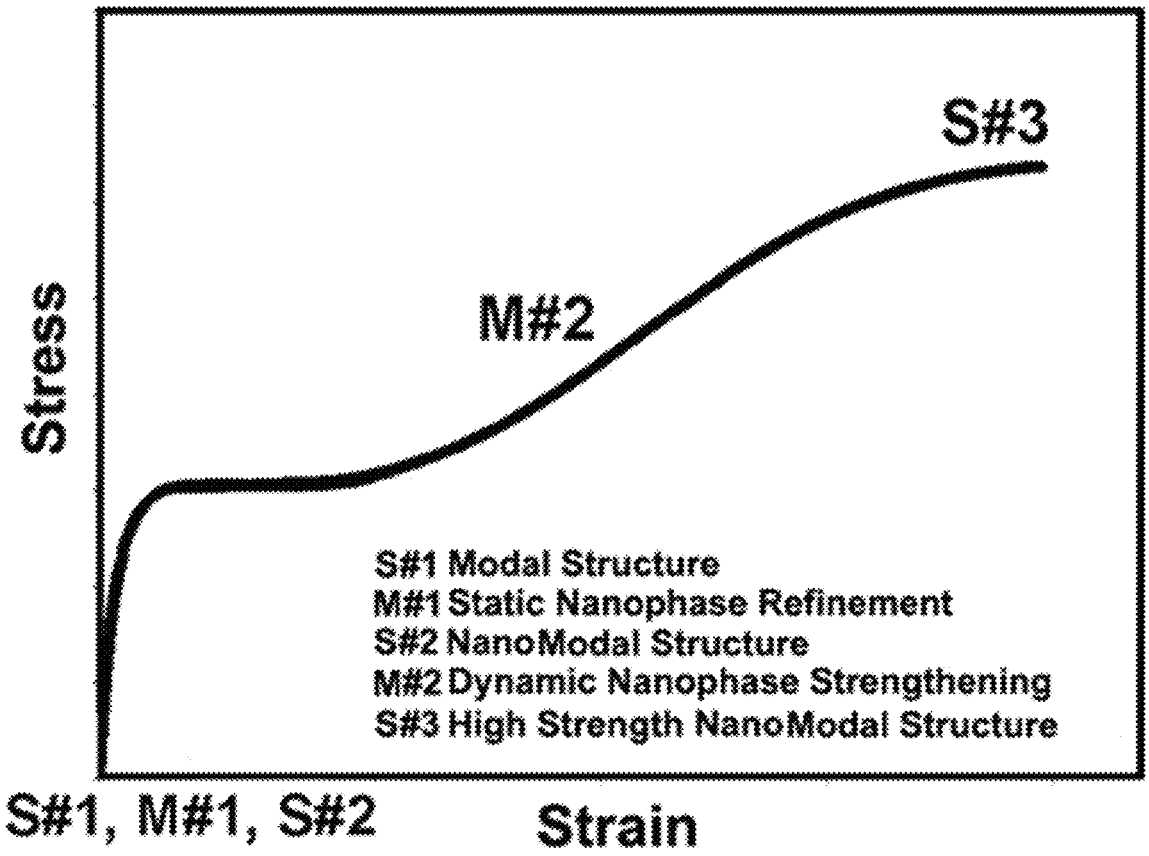
FIG. 4B illustrates a stress-strain curve for the indicated structures and associated mechanisms of formation.

The formation of Class 2 Steel herein (non-stainless) is illustrated in FIGS. 3B and 4B. Class 2 steel may also be formed herein from the identified alloys, which involves two new structure types after starting with Structure type #1, Modal Structure, followed by two new mechanisms identified herein as Static Nanophase Refinement and Dynamic Nanophase Strengthening. The new structure types for Class 2 Steel are described herein as NanoModal Structure and High Strength NanoModal Structure. Accordingly, Class 2 Steel herein may be characterized as follows: Structure #1—Modal Structure (Step #1), Mechanism #1—Static Nanophase Refinement (Step #2), Structure #2—NanoModal Structure (Step #3), Mechanism #2—Dynamic Nanophase Strengthening (Step #4), and Structure #3—High Strength NanoModal Structure (Step #5).

As shown therein, Structure #1 is initially formed in which Modal Structure is the result of starting with a liquid melt of the alloy and solidifying by cooling, which provides nucleation and growth of particular phases having particular grain sizes. Grain size herein may again be understood as the size of a single crystal of a specific particular phase preferably identifiable by methods such as scanning electron microscopy or transmission electron microscopy. Accordingly, Structure #1 of the Class 2 Steel may be preferably achieved by processing through either laboratory scale procedures as shown and/or through industrial scale methods involving chill surface processing methodology such as twin roll processing or thin slab casting.

The Modal Structure of Class 2 Steel will therefore initially indicate, when cooled from the melt, the following grain sizes: (1) matrix grain size of 500 nm to 20,000 nm containing austenite and/or ferrite; (2) boride grain size of 25 nm to 500 nm (i.e. non-metallic grains such as $M_2B$ where M is the metal and is covalently bonded to B). The boride grains may also preferably be "pinning" type phases which are referenced to the feature that the matrix grains will effectively be stabilized by the pinning phases which resist coarsening at elevated temperature. Note that the metal boride grains have been identified as exhibiting the $M_2B$ stoichiometry but other stoichiometries are possible and may provide pinning including $M_3B$, MB ($M_1B_1$), $M_{23}B_6$, and $M_7B_3$ and which are unaffected by Mechanisms #1 or #2 noted above). Reference to grain size is again to be understood as the size of a single crystal of a specific particular phase preferably identifiable by methods such as scanning electron microscopy or transmission electron microscopy. Furthermore, Structure #1 of Class 2 steel herein includes austenite and/or ferrite along with such boride phases.

In FIG. 4B, a stress strain curve is shown that represents the non-stainless steel alloys herein which undergo a deformation behavior of Class 2 steel. The Modal Structure is preferably first created (Structure #1) and then after the creation, the Modal Structure may now be uniquely refined through Mechanism #1, which is a Static Nanophase Refinement mechanism, leading to Structure #2. Static Nanophase Refinement is reference to the feature that the matrix grain sizes of Structure 1 which initially fall in the range of 500 nm to 20,000 nm are reduced in size to provide Structure 2 which has matrix grain sizes that typically fall in the range of 100 nm to 2000 nm. Note that the boride pinning phase can change size significantly in some alloys, while it is designed to resist matrix grain coarsening during the heat treatments. Due to the presence of these boride pinning sites, the motion of a grain boundaries leading to coarsening would be expected to be retarded by a process called Zener pinning or Zener drag. Thus, while grain growth of the matrix may be energetically favorable due to the reduction of total interfacial area, the presence of the boride pinning phase will counteract this driving force of coarsening due to the high interfacial energies of these phases.

Characteristic of the Static Nanophase Refinement Mechanism #1 in Class 2 steel, the micron scale austenite phase (gamma-Fe) which was noted as falling in the range of 500 nm to 20,000 nm is partially or completely transformed into new phases (e.g. ferrite or alpha-Fe). The volume fraction of ferrite (alpha-iron) initially present in the modal structure (Structure 1) of Class 2 steel is 0 to 45%. The volume fraction of ferrite (alpha-iron) in Structure #2 as a result of Static Nanophase Refinement Mechanism #2 is typically from 20 to 80%. The static transformation preferably occurs during elevated temperature heat treatment and thus involves a unique refinement mechanism since grain coarsening rather than grain refinement is the conventional material response at elevated temperature.

Accordingly, grain coarsening does not occur with the alloys of Class 2 Steel herein during the Static Nanophase Refinement mechanism. Structure #2 is uniquely able to transform to Structure #3 during Dynamic Nanophase Strengthening and as a result Structure #3 is formed and indicates tensile strength values in the range from 875 to 1590 MPa with 5 to 30% total elongation.

Depending on alloy chemistries, nano-scale precipitates can form during Static Nanophase Refinement and the subsequent thermal process in some of the non-stainless high-strength steels. The nano-precipitates are in the range of 1 nm to 200 nm, with the majority (>50%) of these phases 10~20 nm in size, which are much smaller than the boride pinning phase formed in Structure #1 for retarding matrix grain coarsening. Also, during Static Nanophase Refinement, the boride grain sizes grow larger to a range from 200 to 2500 nm in size.

Expanding upon the above, in the case of the alloys herein that provide Class 2 Steel, when such alloys exceed their yield point, plastic deformation at constant stress occurs followed by a dynamic phase transformation leading toward the creation of Structure #3. More specifically, after enough strain is induced, an inflection point occurs where the slope of the stress versus strain curve changes and increases (FIG. 4B) and the strength increases with strain indicating an activation of Mechanism #2 (Dynamic Nanophase Strengthening).

With further straining during Dynamic Nanophase Strengthening, the strength continues to increase but with a gradual decrease in strain hardening coefficient value up to nearly failure. Some strain softening occurs but only near the breaking point which may be due to reductions in localized cross sectional area at necking. Note that the strengthening transformation that occurs at the material straining under the stress generally defines Mechanism #2 as a dynamic process, leading to Structure #3. By dynamic, it is meant that the process may occur through the application of a stress which exceeds the yield point of the material. The tensile properties that can be achieved for alloys that achieve Structure 3 include tensile strength values in the range from 875 to 1590 MPa and 5 to 30% total elongation. The level of tensile properties achieved is also dependent on the amount of transformation occurring as the strain increases corresponding to the characteristic stress strain curve for a Class 2 steel.

Thus, depending on the level of transformation, tunable yield strength may also now be developed in Class 2 Steel herein depending on the level of deformation and in Structure #3 the yield strength can ultimately vary from 300 MPa to 1400 MPa. That is, conventional steels outside the scope of the alloys here exhibit only relatively low levels of strain hardening, thus their yield strengths can be varied only over small ranges (e.g., 100 to 200 MPa) depending on the prior deformation history. In Class 2 steels herein, the yield strength can be varied over a wide range (e.g. 300 to 1400 MPa) as applied to Structure #2 transformation into Structure #3, allowing tunable variations to enable both the designer and end users in a variety of applications, and utilize Structure #3 in various applications such as crash management in automobile body structures.

With regards to this dynamic mechanism shown in FIG. 3B, new and/or additional precipitation phase or phases are observed that indicates identifiable grain sizes of 1 nm to 200 nm. See Table 14. In addition, there is the further identification in said precipitation phase a dihexagonal pyramidal class hexagonal phase with a $P6_3mc$ space group (#186), a ditrigonal dipyramidal class with a hexagonal P6bar2C space group (#190), and/or a $M_3Si$ cubic phase with a Fm3m space group (#225). Accordingly, the dynamic transformation can occur partially or completely and results in the formation of a microstructure with novel nanoscale/near nanoscale phases providing relatively high strength in the material. That is, Structure #3 may be understood as a microstructure having matrix grains sized generally from 100 nm to 2000 nm which are pinned by boride phases which are in the range of 200 to 2500 nm and with precipitate phases which are in the range of 1 nm to 200 nm. The initial formation of the above referenced precipitation phase with grain sizes of 1 nm to 200 nm starts at Static Nanophase Refinement and continues during Dynamic Nanophase Strengthening leading to Structure 3 formation. The volume fraction of the precipitation phase with grain sizes of 1 nm to 200 nm in Structure 2 increases in Structure 3 and assists with the identified strengthening mechanism. It should also be noted that in Structure 3, the level of gamma-iron is optional and may be eliminated depending on the specific alloy chemistry and austenite stability.

Note that dynamic recrystallization is a known process but differs from Mechanism #2 (FIG. 3*b*) since it involves the formation of large grains from small grains so that it is not a refinement mechanism but a coarsening mechanism. Additionally, as new undeformed grains are replaced by deformed grains no phase changes occur in contrast to the mechanisms presented here and this also results in a corresponding reduction in strength in contrast to the strengthening mechanism here. Note also that metastable austenite in steels is known to transform to martensite under mechanical stress but, preferably, no evidence for martensite or body centered tetragonal iron phases are found in the new steel alloys described in this application. Table 2 below provides a comparison of the structure and performance features of Class 2 Steel herein.

TABLE 2

Comparison Of Structure and Performance of Class 2 Steel

| | Class 2 Steel | | |
|---|---|---|---|
| Property/ Mechanism | Structure Type #1 Modal Structure | Structure Type #2 NanoModal Structure | Structure Type #3 High Strength NanoModal Structure |
| Structure Formation | Starting with a liquid melt, solidifying this liquid melt and forming directly | Static Nanophase Refinement mechanism occurring during heat treatment | Dynamic Nanophase Strengthening mechanism occurring through application of mechanical stress |
| Transformations | Liquid solidification followed by nucleation and growth | Solid state phase transformation of supersaturated gamma iron | Stress induced transformation involving phase formation and precipitation |
| Enabling Phases | Austenite and/or ferrite with boride pinning phases | Ferrite, austenite, boride pinning phases, and hexagonal phase precipitation | Ferrite, optionally austenite, boride pinning phases, hexagonal and additional phases precipitation |
| Matrix Grain Size | 500 to 20000 nm Austenite | Grain Refinement (100 nm to 2000 nm) Austenite to ferrite and precipitation phase transformation | Grain size remains refined at 100 nm to 2000 nm/ Additional precipitation formation |
| Boride Grain Size | 25 to 500 nm borides (e.g. metal boride) | 200 to 2500 nm borides (e.g. metal boride) | 200 to 2500 nm borides (e.g. metal boride) |
| Precipitation Grain Sizes | — | 1 nm to 200 nm | 1 nm to 200 nm |
| Tensile Response | Actual with properties achieved based on structure type #1 | Intermediate structure; transforms into Structure #3 when undergoing yield | Actual with properties achieved based on formation of structure type |

TABLE 2-continued

| Comparison Of Structure and Performance of Class 2 Steel | | | |
|---|---|---|---|
| | Class 2 Steel | | |
| Property/ Mechanism | Structure Type #1 Modal Structure | Structure Type #2 NanoModal Structure | Structure Type #3 High Strength NanoModal Structure |
| | | | #3 and fraction of transformation. |
| Yield Strength | 300 to 600 MPa | 300 to 600 MPa | 300 to 1400 MPa |
| Tensile Strength | — | — | 875 to 1590 MPa |
| Total Elongation | — | — | 5 to 30% |
| Strain Hardening Response | — | After yield point, exhibit a strain softening at initial straining as a result of phase transformation, followed by a significant strain hardening effect leading to a distinct maxima | Strain hardening coefficient may vary from 0.2 to 1.0 depending on amount of deformation and transformation |

Class 3 Steel

Class 3 steel (non-stainless) is associated with formation of a High Strength Lamellae NanoModal Structure through a multi-step process as now described herein.

Figure 5:
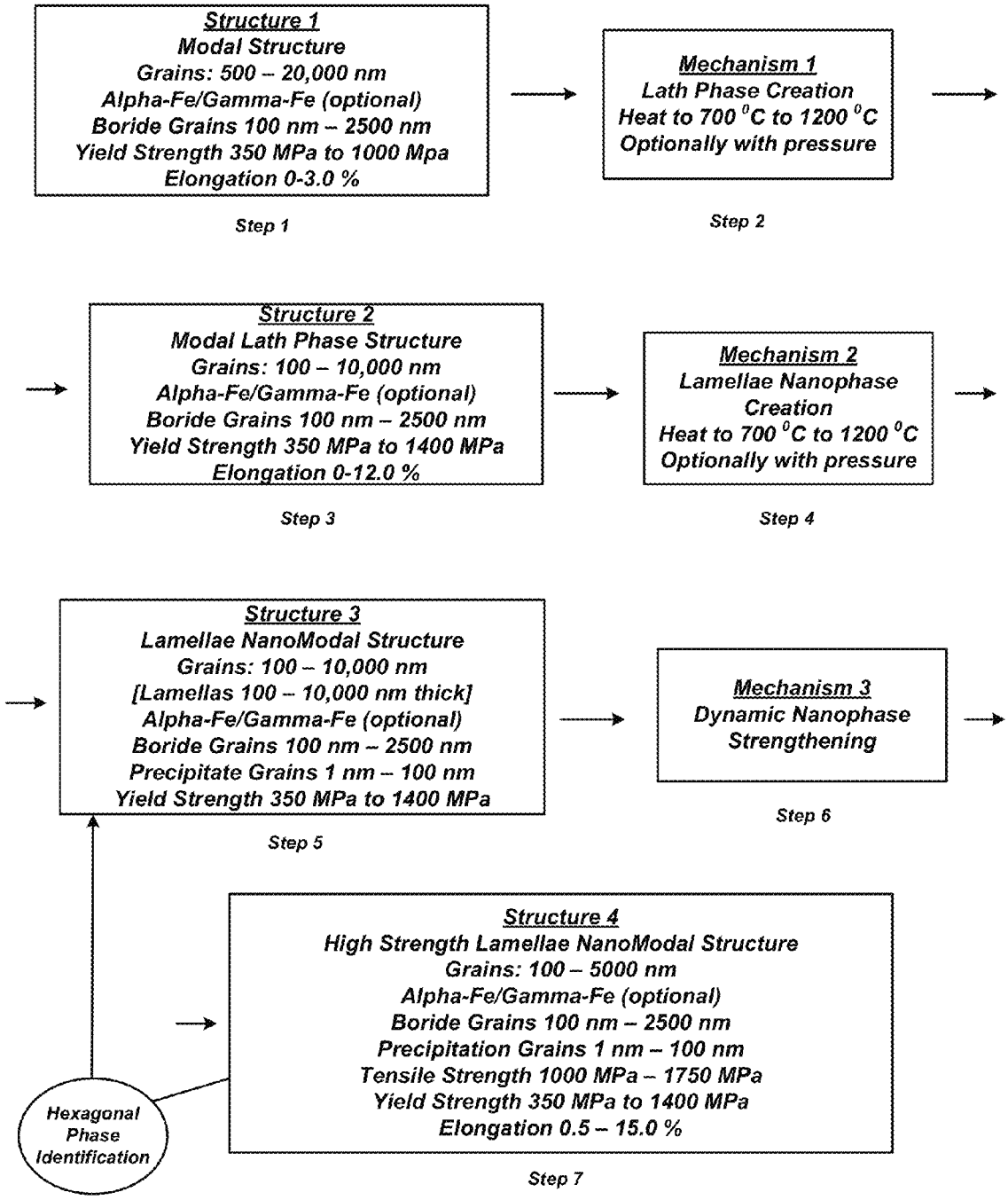
FIG. 5 illustrates structures and mechanism regarding the formation of Class 3 steel alloys herein.

In order to achieve a tensile response involving high strength with adequate ductility in non-stainless carbon-free steel alloys, a preferred seven-step process is now disclosed and shown in FIG. 5. Structure development starts from the Structure #1—Modal Structure (Step #1). However, Mechanism #1 in Class 3 steel is now related to Lath Phase Creation (Step #2) that leads to Structure #2—Modal Lath Phase Structure (Step #3), which through Mechanism #2—Lamellae Nanophase Creation (Step #4) transforms into Structure #3—Lamellae NanoModal Structure (Step #5). Deformation of Structure #3 results in activation of Mechanism #3—Dynamic Nanophase Strengthening (Step #6) which leads to formation of Structure #4—High Strength Lamellae NanoModal Structure (Step #7). Reference is also made to Table 3 below.

Structure #1 involving a formation of the Modal Structures (i.e. bi, tri, and higher order) may be achieved in the alloys with the referenced chemistries in this application by processing through the laboratory scale as shown and/or through industrial scale methods involving chill surface processing such as twin roll casting or thin slab casting. The Modal Structure of Class 3 Steel will therefore initially indicate, when cooled from the melt, the following grain sizes: (1) matrix grain size of 500 nm to 20,000 nm containing ferrite or alpha-Fe (required) and optionally austenite or gamma-Fe; and (2) boride grain size of 100 nm to 2500 nm (i.e. non-metallic grains such as $M_2B$ where M is the metal and is covalently bonded to B); (3) yield strengths of 350 to 1000 MPa; (4) tensile strengths of 200 to 1200 MPa; and total elongation of 0-3.0%. It will also indicate dendritic growth morphology of the matrix grains. The boride grains may also preferably be "pinning" type phases which is reference to the feature that the matrix grains will effectively be stabilized by the pinning phases which resist coarsening at elevated temperature. Note that the metal boride grains have been identified as exhibiting the $M_2B$ stoichiometry but other stoichiometries are possible and may provide pinning including $M_3B$, MB ($M_1B_1$), $M_{23}B_6$, and $M_7B_3$ and which are unaffected by Mechanism #1, #2 or #3 noted above). Reference to grain size is again to be understood as the size of a single crystal of a specific particular phase preferably identifiable by methods such as scanning electron microscopy or transmission electron microscopy. Accordingly, Structure #1 of Class 3 steel herein includes ferrite along with such boride phases.

Structure #2 involves the formation of the Modal Lath Phase Structure with uniformly distributed precipitates from Modal Structure (Structure 1) with dendritic morphology though Mechanism #1. Lath phase structure may be generally understood as a structure composed from plate-shaped crystal grains. Reference to "dendritic morphology" may be understood as tree-like and reference to "plate shaped" may be understood as sheet like. Lath structure formation preferably occurs at elevated temperature (e.g. at temperatures of 700° C. to 1200° C.) through plate-like crystal grain formation with: (1) lath structural grain sizes typically from 100 to 10,000 nm; (2) boride grain size of 100 nm to 2,500 nm; (3) yield strengths of 300 MPa to 1400 MPa; (4) tensile strengths of 350 MPa to 1600 MPa; (5) elongation of 0-12%. Structure #2 also contains alpha-Fe and gamma-Fe remains optional.

A second phase of boride precipitates with a size typically from 100 to 1000 nm may be found distributed in the lath matrix as isolated particles. The second phase of boride precipitates may be understood as non-metallic grains of different stoichiometry ($M_2B$, $M_3B$, MB ($M_1B_1$), $M_{23}B_6$, and $M_7B_3$) where M is the metal and is covalently bonded to Boron. These boride precipitates are distinguished from the boride grains in Structure #1 with little or no change in size.

Structure #3 (Lamellae NanoModal Structure) involves the formation of the lamellae morphology as a result of static transformation of ferrite into one or several phases through Mechanism #2 identified as Lamellae Nanophase Creation. Static transformation is a decomposition of the parent phase into new phase or several new phases due to alloying elements distribution by diffusion during elevated temperature heat treatment, which may preferably occur in the temperature range from 700° C. to 1200° C. Lamellae (or layered) structure is composed of alternating layers of two phases whereby individual lamellae exist within a colony connected in three dimensions. A schematic illustration of lamellae structure is shown in FIG. 6A to illustrate the structural make-up of this structure type. White lamellae are arbitrarily identified as Phase 1 and black lamellas are arbitrarily identified as Phase 2

In Class 3 alloys, Lamellae Nanomodal Structure contains: (1) lamellas of 100 nm to 1000 nm wide with a thickness in the range of 100 nm to 10,000 nm with a length of 0.1 to 5 microns; (2) boride grains of 100 nm to 2500 nm of different stoichiometry ($M_2B$, $M_3B$, MB ($M_1B_1$), $M_{23}B_6$, and $M_7B_3$)

where M is the metal and is covalently bonded to Boron, (3) precipitation grains of 1 nm to 100 nm; (4) yield strength of 350 MPa to 1400 MPa. The Lamellae Nanomodal Structure continues to contain alpha-Fe and gamma-Fe remains optional.

Lamellae NanoModal Structure (Structure #3) transforms into Structure #4 through Dynamic Nanophase Strengthening (Mechanism #3, exposure to mechanical stress) during plastic deformation (i.e. exceeding the yield stress for the material) displaying relatively high tensile strengths in the range of 1000 MPa to 1750 MPa. In FIG. 6B, a stress-strain curve is shown that represents the alloys with Structure #3 herein which undergo a deformation behavior of Class 3 steel as compared to that of Class 2. As illustrated in FIG. 6B, Structure 3, upon application of stress, provides the indicated curve, resulting in Structure 4 of Class 3 steel.

The strengthening during deformation is related to phase transformation that occurs as the material strains under stress and defines Mechanism #3 as a dynamic process. For the alloy to display high strength at the level described in this application, lamellae structure is preferably formed prior to deformation. Specific to this mechanism, the micron scale austenite phase is transformed into new phases with reductions in microstructural feature scales generally down to the nanoscale regime. Some fraction of austenite may initially form in some Class 3 alloys during casting and then may remain present in Structure #1 and Structure #2. During straining when stress is applied, new or additional phases are formed with nanograins typically in a range from 1 to 100 nm. See Table 15.

In the post-deformed Structure #4 (High Strength Lamellae NanoModal Structure), the ferrite grains contain alternating layers with nanostructure composed from new phases formed during deformation. Depending on the specific chemistry and the stability of the austenite, some austenite may be additionally present. In contrast with layers in Structure #3 where each layer represents a single or just few grains, in Structure #4, a large number of nanograins of different phases are present as a result of Dynamic NanoPhase Strengthening. Since nanoscale phase formation occurs during alloy deformation, it represents a stress induced transformation and defined as a dynamic process. Nanoscale phase precipitations during deformation are responsible for extensive strain hardening of the alloys.

The dynamic transformation can occur partially or completely and results in the formation of a microstructure with novel nanoscale/near nanoscale phases specified as High Strength Lamellae NanoModal Structure (Structure #4) that provides high strength in the material. Thus the Structure #4 can be formed with various levels of strengthening depending on specific chemistry and the amount of strengthening achieved by Mechanism #3. Table 2 below provides a comparison of the structure and performance features of Class 3 Steel herein.

TABLE 3

Comparison of Structure and Performance of New Structure Types

| | Class 3 Steel | | | |
|---|---|---|---|---|
| Property/ Mechanism | Structure Type #1 | Structure Type #2 | Structure Type #3 | Structure Type #4 |
| Structure Formation | Starting with a liquid melt, solidifying on a chill surface | As-cast structural homogenization and lath phase formation during high temperature heat treatment optionally with pressure | Lath phase dissolution and Lamellae NanoModal Structure creation during heat treatment | Nanoprecipitate phase formation and high strength structure formation through application of stress |
| Transformations | Liquid solidification followed by nucleation and growth | Morphology change (dendrites to laths) | Solid state phase transformation of supersaturated alpha iron | Stress induced transformation involving phase formation and precipitation |
| Enabling Phases | Ferrite, optionally austenite with boride pinning phases | Ferrite, optionally austenite with boride pinning phases | Ferrite, optionally austenite, boride, and additional phase precipitations | Ferrite, optionally austenite, boride, and additional phase precipitations |
| Matrix Grain Size | 500 to 20,000 nm | 100 to 10,000 nm | 100 to 10,000 nm thick lamellae, 0.1-5.0 microns in length and 100 nm-1000 nm in width | 100 to 5000 nm, non-uniform grains |
| Boride Grain Size | 100 to 2,500 nm | 100 to 2,500 nm | 100 to 2,500 nm | 100 to 2,500 nm |
| Precipitate Grains | N/A | N/A | 1 to 100 nm | 1 to 100 nm |
| Tensile Response | Actual with properties achieved based on structure type #1 | Actual with properties achieved based on structure type #2 | Intermediate structure; transforms into Structure #4 during tensile testing | Actual with properties achieved based on formation of structure type #3 and fraction of transformation |

TABLE 3-continued

| Comparison of Structure and Performance of New Structure Types | | | | |
|---|---|---|---|---|
| | Class 3 Steel | | | |
| Property/ Mechanism | Structure Type #1 | Structure Type #2 | Structure Type #3 | Structure Type #4 |
| Yield Strength | 350 to 1000 MPa | 300 to 1400 MPa | 350 to 1400 MPa | 350 to 1400 MPa |
| Tensile Strength | 200 to 1200 MPa | 350 to 1600 MPa | — | 1000 to 1750 MPa |
| Total Elongation | 0 to 3% | 0 to 12% | — | 0.5 to 15% |
| Strain Hardening Response | Exhibits limited hardening resulted in low ductility | Strain hardening coefficient may vary from 0.09 to 0.73 depending on alloy chemistry and level of structural formation | After yield point, exhibit a high strain hardening coefficient at initial straining and a strain hardening coefficient as a function of strain which is experiencing a decrease until failure | Strain hardening coefficient may vary from 0.1 to 0.9 depending on amount of deformation and transformation |

Mechanisms During Production

The formation of Modal Structure (MS) in either Class 2 or Class 3 Steel herein can be made to occur at various stages of the production process. For example, the MS of the sheet may form during Stage 1, 2, or 3 of either the above referenced twin roll or thin slab casting sheet production processes. Accordingly, the formation of MS may depend specifically on the solidification sequence and thermal cycles (i.e. temperatures and times) that the sheet is exposed to during the production process. The MS may be preferably formed by heating the alloys herein at temperatures in the range of above their melting point and in a range of 1100° C. to 2000° C. and cooling below the melting temperature of the alloy, which corresponds to preferably cooling in the range of $11\times10^3$ to $4\times10^{-2}$ K/s. FIG. 7 illustrates in general that starting with a particular chemical composition for the alloys herein, and heating to a liquid, and solidifying on a chill surface, and forming Modal Structure, one may then convert to either Class 2 Steel or Class 3 Steel as noted herein.

Class 2 Mechanisms

With respect to Class 2 Steel herein, Mechanism #1 which is the Static Nanophase Refinement (SNR) occurs after MS is formed and during further elevated temperature exposure. Accordingly, Static Nanophase Refinement may also occur during Stage 1, Stage 2 or Stage 3 (after MS formation) of either of the above referenced twin roll or thin slab casting sheet production process. It has been observed that Static Nanophase Refinement may preferably occur when the alloys are subjected to heating at a temperature in the range of 700° C. to 1200° C. The percentage level of SNR that occurs in the material may depend on the specific chemistry and involved thermal cycle that determines the volume fraction of Nano-Modal Structure (NMS) specified as Structure #2. However, preferably, the percentage level by volume of MS that is converted to NMS is in the range of 20 to 90%.

Mechanism #2 which is Dynamic Nanophase Strengthening (DNS) may also occur during Stage 1, Stage 2 or Stage 3 (after MS and/or NMS formation) of either of the above referenced twin roll or thin slab casting sheet production process. Dynamic Nanophase Strengthening may therefore occur in Class 2 Steel that has undergone Static Nanophase Refinement. Dynamic Nanophase Strengthening may therefore also occur during the production process of sheet but may also be done during any stage of post processing involving application of stresses exceeding the yield strength. The amount of DNS that occurs may depend on the volume fraction of Static Nanophase Refinement in the material prior to deformation and on stress level induced in the sheet. The strengthening may also occur during subsequent post processing into final parts involving hot or cold forming of the sheet. Thus Structure #3 herein (see FIG. 3 and Table 1 above) may occur at various processing stages in the sheet production or upon post processing and additionally may occur to different levels of strengthening depending on the alloy chemistry, deformation parameters and thermal cycle(s). Preferably, DNS may occur under the following range of conditions, after achieving Structure #2 and then exceeding the yield strength of the structure which may vary in the range of 300 to 1400 MPa.

Class 3 Mechanisms

With respect to Class 3 Steel herein, Mechanism #1 which is the Lath Phase Creation occurs during elevated temperature exposure of the initial Modal Structure #1 and can occur during Stage 1, Stage 2 or Stage 3 (after MS formation) of twin roll production or thin slab casting production. In some alloys, Lath Structure Creation can occur at solidification at Stage 1 of twin roll or thin slab casting production. Mechanism #1 results in formation of Modal Lath Phase Structure specified as Structure #2. The formation of Structure #2 is critical step in terms of further Lamellae NanoModal Structure (Structure #3) formation through Mechanism #2 specified as Lamellae Nanophase Creation by phase transformation. Mechanism #2 in the sheet alloys can occur during Stage 1, 2, or 3 of twin roll production or thin slab casting production or during post processing of the sheets. In some alloys, Structure #3 may also form at earlier Stages of casting production such as Stage 2 or Stage 3 of twin roll production or thin slab casting, as well as at post-processing treatment of produced sheet. Lamellae NanoModal Structure is responsible for high strength of the alloys of current application and has ability for strengthening during room temperature deformation through Mechanism #3 specified as Dynamic Nanophase Strengthening. The level of Dynamic Nanophase Strengthening that occurs will depend on the alloy chemistry and on a stress level induced into the sheet. The strengthening may also occur during subsequent post processing of sheets produced by twin roll production or thin slab casting into final parts involving hot or cold forming of the sheets. Thus, the resultant High Strength Lamellae NanoModal Structure specified as Structure #4 can occur at post-processing of produced sheets by methods that involve mechanical deformation to different levels of strengthening depending on the alloy chemistry, deformation parameters and post-deformation thermal cycle(s).

EXAMPLES

Preferred Alloy Chemistries and Sample Preparation

The chemical composition of the alloys studied is shown in Table 3 which provides the preferred atomic ratios utilized. These chemistries have been used for material processing through plate casting in a Pressure Vacuum Caster (PVC). Using high purity elements [>99 wt %], 35 g alloy feedstocks of the targeted alloys were weighed out according to the atomic ratios provided in Table 3. The feedstock material was then placed into the copper hearth of an arc-melting system. The feedstock was arc-melted into ingots using high purity argon as a shielding gas. The ingots were flipped several times and re-melted to ensure homogeneity. The resulting ingots were then placed in a PVC chamber, melted using RF induction and then ejected onto a copper die designed for casting 3 by 4 inches plates with thickness of 1.8 mm mimicking alloy solidification into a sheet with similar thickness between rolls at Stage 1 of Twin Roll Casting process.

TABLE 3

Chemical Composition of the Alloys

| Alloy | Fe | Cr | Ni | B | Si | Cu | Mn |
|---|---|---|---|---|---|---|---|
| Alloy 1 | 76.78 | — | 14.05 | 4.77 | 4.40 | — | — |
| Alloy 2 | 68.93 | 8.72 | 11.05 | 5.00 | 6.30 | — | — |
| Alloy 3 | 73.29 | 4.36 | 11.05 | 5.00 | 6.30 | — | — |
| Alloy 4 | 77.65 | — | 11.05 | 5.00 | 6.30 | — | — |
| Alloy 5 | 68.33 | 8.72 | 11.05 | 5.30 | 6.60 | — | — |
| Alloy 6 | 77.05 | — | 11.05 | 5.30 | 6.60 | — | — |
| Alloy 7 | 77.65 | — | 11.05 | 4.70 | 6.60 | — | — |
| Alloy 8 | 78.25 | — | 11.05 | 4.10 | 6.60 | — | — |
| Alloy 9 | 78.84 | — | 11.06 | 3.50 | 6.60 | — | — |
| Alloy 10 | 79.05 | — | 9.05 | 5.30 | 6.60 | — | — |
| Alloy 11 | 79.65 | — | 9.05 | 4.70 | 6.60 | — | — |
| Alloy 12 | 80.25 | — | 9.05 | 4.10 | 6.60 | — | — |
| Alloy 13 | 80.85 | — | 9.05 | 3.50 | 6.60 | — | — |
| Alloy 14 | 77.25 | — | 11.05 | 4.70 | 7.00 | — | — |
| Alloy 15 | 76.85 | — | 11.05 | 4.70 | 7.40 | — | — |
| Alloy 16 | 76.45 | — | 11.05 | 4.70 | 7.80 | — | — |
| Alloy 17 | 75.05 | — | 13.05 | 5.30 | 6.60 | — | — |
| Alloy 18 | 73.05 | — | 15.05 | 5.30 | 6.60 | — | — |
| Alloy 19 | 73.05 | — | 13.05 | 5.30 | 6.60 | 2.00 | — |
| Alloy 20 | 75.05 | — | 11.05 | 5.30 | 6.60 | 2.00 | — |
| Alloy 21 | 74.45 | — | 13.05 | 4.70 | 7.80 | — | — |
| Alloy 22 | 72.45 | — | 15.05 | 4.70 | 7.80 | — | — |
| Alloy 23 | 72.45 | — | 13.05 | 4.70 | 7.80 | 2.00 | — |
| Alloy 24 | 74.45 | — | 11.05 | 4.70 | 7.80 | 2.00 | — |
| Alloy 25 | 77.05 | — | 5.53 | 5.30 | 6.60 | — | 5.52 |
| Alloy 26 | 75.05 | — | 6.53 | 5.30 | 6.60 | — | 6.52 |
| Alloy 27 | 73.05 | — | 7.53 | 5.30 | 6.60 | — | 7.52 |
| Alloy 28 | 76.45 | — | 5.53 | 4.70 | 7.80 | — | 5.52 |
| Alloy 29 | 74.45 | — | 6.53 | 4.70 | 7.80 | — | 6.52 |
| Alloy 30 | 72.45 | — | 7.53 | 4.70 | 7.80 | — | 7.52 |
| Alloy 31 | 77.05 | — | 8.29 | 5.30 | 6.60 | — | 2.76 |
| Alloy 32 | 75.05 | — | 9.79 | 5.30 | 6.60 | — | 3.26 |
| Alloy 33 | 73.05 | — | 11.29 | 5.30 | 6.60 | — | 3.76 |
| Alloy 34 | 76.45 | — | 8.29 | 4.70 | 7.80 | — | 2.76 |
| Alloy 35 | 74.45 | — | 9.79 | 4.70 | 7.80 | — | 3.26 |
| Alloy 36 | 72.45 | — | 11.29 | 4.70 | 7.80 | — | 3.76 |
| Alloy 37 | 76.52 | — | 6.18 | 5.26 | 6.71 | — | 5.33 |
| Alloy 38 | 72.97 | 3.66 | 6.16 | 5.24 | 6.71 | — | 5.26 |
| Alloy 39 | 77.23 | 3.66 | 3.52 | 5.23 | 6.73 | — | 3.63 |
| Alloy 40 | 76.89 | 1.83 | 4.84 | 5.24 | 6.72 | — | 4.48 |
| Alloy 41 | 80.85 | — | 2.64 | 5.24 | 6.73 | — | 4.54 |
| Alloy 42 | 79.42 | 1.47 | 2.64 | 5.23 | 6.73 | — | 4.51 |
| Alloy 43 | 77.99 | 2.93 | 2.64 | 5.23 | 6.73 | — | 4.48 |
| Alloy 44 | 77.93 | 2.34 | 2.63 | 5.21 | 7.42 | — | 4.47 |
| Alloy 45 | 77.06 | 2.34 | 3.51 | 5.21 | 7.42 | — | 4.46 |

TABLE 3-continued

Chemical Composition of the Alloys

| Alloy | Fe | Cr | Ni | B | Si | Cu | Mn |
|---|---|---|---|---|---|---|---|
| Alloy 46 | 77.12 | 2.18 | 3.50 | 5.80 | 6.96 | — | 4.44 |
| Alloy 47 | 76.86 | 1.09 | 4.82 | 5.81 | 6.96 | — | 4.46 |
| Alloy 48 | 76.64 | — | 6.14 | 5.82 | 6.94 | — | 4.46 |
| Alloy 49 | 74.93 | — | 6.14 | 5.81 | 6.94 | — | 6.18 |
| Alloy 50 | 73.54 | 5.08 | 2.53 | 5.78 | 6.96 | — | 6.11 |
| Alloy 51 | 72.45 | 0.00 | 8.29 | 4.70 | 7.80 | — | 6.76 |
| Alloy 52 | 72.45 | 0.00 | 9.79 | 4.70 | 7.80 | — | 5.26 |
| Alloy 53 | 76.45 | 0.00 | 8.29 | 4.70 | 7.80 | — | 2.76 |
| Alloy 54 | 77.05 | 0.00 | 8.29 | 5.30 | 6.60 | — | 2.76 |
| Alloy 55 | 77.65 | 0.00 | 8.29 | 3.50 | 7.80 | — | 2.76 |
| Alloy 56 | 74.87 | 2.18 | 8.29 | 5.30 | 6.60 | — | 2.76 |
| Alloy 57 | 74.27 | 2.18 | 8.29 | 4.70 | 7.80 | — | 2.76 |
| Alloy 58 | 74.45 | — | 8.29 | 4.70 | 7.80 | — | 4.76 |
| Alloy 59 | 75.05 | — | 8.29 | 4.10 | 7.80 | — | 4.76 |
| Alloy 60 | 75.65 | — | 8.29 | 3.50 | 7.80 | — | 4.76 |
| Alloy 61 | 73.05 | — | 8.29 | 4.10 | 7.80 | — | 6.76 |
| Alloy 62 | 73.65 | — | 8.29 | 3.50 | 7.80 | — | 6.76 |
| Alloy 63 | 74.85 | — | 8.29 | 3.50 | 6.60 | — | 6.76 |
| Alloy 64 | 72.15 | — | 8.59 | 4.70 | 7.80 | — | 6.76 |
| Alloy 65 | 72.75 | — | 8.59 | 4.10 | 7.80 | — | 6.76 |
| Alloy 66 | 73.35 | — | 8.59 | 3.50 | 7.80 | — | 6.76 |
| Alloy 67 | 72.75 | — | 7.99 | 4.70 | 7.80 | — | 6.76 |
| Alloy 68 | 73.35 | — | 7.99 | 4.10 | 7.80 | — | 6.76 |
| Alloy 69 | 73.95 | — | 7.99 | 3.50 | 7.80 | — | 6.76 |
| Alloy 70 | 73.25 | — | 8.29 | 4.70 | 7.00 | — | 6.76 |
| Alloy 71 | 71.65 | — | 8.29 | 4.70 | 8.60 | — | 6.76 |
| Alloy 72 | 69.52 | 1.79 | 5.28 | 4.78 | 7.35 | — | 11.28 |
| Alloy 73 | 67.59 | 1.78 | 3.51 | 4.77 | 7.34 | — | 15.01 |
| Alloy 74 | 65.64 | 1.78 | 1.75 | 4.76 | 7.33 | — | 18.74 |
| Alloy 75 | 69.85 | 3.37 | 5.27 | 4.77 | 7.35 | — | 9.39 |
| Alloy 76 | 67.88 | 3.37 | 3.51 | 4.77 | 7.34 | — | 13.13 |
| Alloy 77 | 65.95 | 3.36 | 1.75 | 4.76 | 7.33 | — | 16.85 |
| Alloy 78 | 70.15 | 4.96 | 5.27 | 4.77 | 7.34 | — | 7.51 |
| Alloy 79 | 68.21 | 4.95 | 3.51 | 4.76 | 7.33 | — | 11.24 |
| Alloy 80 | 66.27 | 4.94 | 1.75 | 4.75 | 7.32 | — | 14.97 |
| Alloy 81 | 70.46 | 6.54 | 5.27 | 4.76 | 7.34 | — | 5.63 |
| Alloy 82 | 68.5 | 6.54 | 3.51 | 4.76 | 7.33 | — | 9.36 |
| Alloy 83 | 66.58 | 6.52 | 1.75 | 4.75 | 7.31 | — | 13.09 |
| Alloy 84 | 70.78 | 8.12 | 5.26 | 4.76 | 7.33 | — | 3.75 |
| Alloy 85 | 68.85 | 8.10 | 3.50 | 4.75 | 7.32 | — | 7.48 |
| Alloy 86 | 66.89 | 8.09 | 1.75 | 4.75 | 7.31 | — | 11.21 |

Accordingly, in the broad context of the present disclosure, the alloy chemistries that may preferably be suitable for the formation of the Class 1, Class 2 or Class 3 Steel herein, include the following whose atomic ratios add up to 100. That is, the alloys may include Fe, Ni, B and Si. The alloys may optionally include Cr, Cu and/or Mn. Preferably, with respect to atomic ratios, the alloys may contain Fe at 65.64 to 80.85, Ni at 1.75 to 15.05, B at 3.50 to 5.82 and Si at 4.40 to 8.60. Optionally, and again in atomic ratios, one may also include Cr at 0 to 8.72, Cu at 0 to 2.00 and Mn at 0-18.74. Accordingly, the levels of the particular elements may be adjusted to 100 as noted above. Impurities known/expected to be present include, but are not limited to, C, Al, Mo, Nb, Ti, S, O, N, P, W, Co, and Sn. Such impurities may be present at levels up to 10 atomic percent.

The atomic ratio of Fe present may therefore be 65.5, 65.6, 65.7, 65.8, 65.9, 66.0, 66.1, 66.2, 66.3, 66.4, 66.5, 66.6, 66.7, 66.8, 66.9, 67.0, 67.1, 67.2, 67.3, 67.4, 67.5, 67.6, 67.7, 67.8, 67.9, 68.0, 68.1, 68.2, 68.3, 68.4, 68.5, 68.6, 68.7, 68.8, 68.9, 69.0, 69.1, 69.2, 69.3, 69.4, 69.5, 69.6, 69.7, 69.8, 69.9, 70.0, 70.1, 70.2, 70.3, 70.4, 70.5, 70.6, 70.7, 70.8, 70.9, 71.0, 71.1, 71.2, 71.3, 71.4, 71.5, 71.6, 71.7, 71.8, 71.9, 72.0, 72.1, 72.2, 72.3, 72.4, 72.5, 72.6, 72.7, 72.8, 72.9, 80.0, 80.1, 80.2, 80.3, 80.4, 80.5, 80.6, 80.7, 80.8, 80.9. The atomic ratio of Ni may therefore be 1.7, 1.8, 1.9, 2.0, 2.1, 2.2, 2.3, 2.4, 2.5, 2.6 2.7, 2.8, 2.9 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, 5.0, 5.1, 5.2, 5.3, 5.4, 5.5, 5.6, 5.7, 5.8, 5.9, 6.0, 6.1, 6.2, 6.3, 6.4, 6.5, 6.6, 6.7, 6.8, 6.9, 7.0, 7.1, 7.2, 7.3, 7.4, 7.5, 7.6, 7.7, 7.8, 7.9, 8.0, 8.1, 8.2, 8.3, 8.4, 8.5, 8.6, 8.7, 8.8, 8.9, 9.0, 9.1, 9.2, 9.3, 9.4, 9.5, 9.6, 9.7, 9.8, 9.9, 10.0, 10.1, 10.2, 10.3, 10.4, 10.5, 10.6, 10.7, 10.8, 10.9, 11.0, 11.1, 11.2, 11.3, 11.4, 11.5, 11.6, 11.7, 11.8, 11.9, 12.0, 12.1, 12.2, 12.3, 12.4, 12.5, 12.6, 12.7, 12.8, 12.9, 13.0, 13.1, 13.2, 13.3, 13.4, 13.5, 13.6, 13.7, 13.8, 13.9. 14.0, 14.1, 14.2, 14.3, 14.4, 14.5, 14.6, 14.7, 14.8, 14.9, 15.0, 15.1. The atomic ratio of B may therefore be 3.5, 3.6, 3.7, 3.8, 3.9, 4.0, 4.1, 4.2, 4.3, 4.4, 4.5, 4.6, 4.7, 4.8, 4.9, 5.0, 5.1, 5.2, 5.3, 5.4, 5.5, 5.6, 5.7, 5.8, 5.9. The atomic ratio of Si may therefore be 4.4, 4.5, 4.6, 4.7, 4.8, 4.9, 5.0, 5.1, 5.2, 5.3, 5.4, 5.5, 5.6, 5.7, 5.8, 5.9, 6.0, 6.1, 6.2, 6.3, 6.4, 6.5, 6.6, 6.7, 6.8, 6.9, 7.0, 7.1, 7.2, 7.3, 7.4, 7.5, 7.6, 7.7, 7.8, 7.9, 8.0, 8.1, 8.2, 8.3, 8.4, 8.5, 8.6.

The atomic ratios of the optional elements such as Cr may therefore be 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, 5.0, 5.1, 5.2, 5.3, 5.4, 5.5, 5.6, 5.7, 5.8, 5.9, 6.0, 6.1, 6.2, 6.3, 6.4, 6.5, 6.6, 6.7, 6.8, 6.9, 7.0, 7.1, 7.2, 7.3, 7.4, 7., 7.6, 7.7, 7.8, 7.9, 8.0, 8.1, 8.2, 8.3, 8.4, 8.5, 8.6, 8.7, and 8.8. The atomic ratio of Cu if present may therefore be 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9 and 2.0. The atomic ratio of Mn if present may therefore be 0.1, 0.2, 0.3, 0.4, 0.5, 0.6, 0.7, 0.8, 0.9 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, 5.0, 5.1, 5.2, 5.3, 5.4, 5.5, 5.6, 5.7, 5.8, 5.9, 6.0, 6.1, 6.2, 6.3, 6.4, 6.5, 6.6, 6.7, 6.8, 6.9, 7.0, 7.1, 7.2, 7.3, 7.4, 7.5, 7.6, 7.7, 7.8, 7.9, 8.0, 8.1, 8.2, 8.3, 8.4, 8.5, 8.6, 8.7, 8.8, 8.9, 9.0, 9.1, 9.2, 9.3, 9.4, 9.5, 9.6, 9.7, 9.8, 9.9, 10.0, 10.1, 10.2, 10.3, 10.4, 10.5, 10.6, 10.7, 10.8, 10.9, 11.0, 11.1, 11.2, 11.3, 11.4, 11.5, 11.6, 11.7, 11.8, 11.9, 12.0, 12.1, 12.2, 12.3, 12.4, 12.5, 12.6, 12.7, 12.8, 12.9, 13.0, 13.1, 13.2, 13.3, 13.4, 13.5, 13.6, 13.7, 13.8, 13.9, 14.0, 14.1, 14.2, 14.3, 14.4, 14.5, 14.6, 14.7, 14.8, 14.9, 15.0, 15.1, 15.2, 15.3, 15.4, 15.5, 15.6, 15.7, 15.8, 15.9, 16.0, 16.1, 16.2, 16.3, 16.4, 16.5, 16.6, 16.7, 16.8, 16.9, 17.0, 17.1, 17.2, 17.3, 17.4, 17.5, 17.6, 17.7, 17.8, 17.9, 18.0, 18.1, 18.2, 18.3, 18.4, 18.5, 18.6, 18.7 and 18.8.

The alloys may herein also be more broadly described as an Fe based alloy (greater than 50.00 atomic percent) and including B, Ni and Si and capable of forming the indicated structures (Class 1, Class 2 and/or Class 3 Steel) and/or undergoing the indicated transformations upon exposure to mechanical stress and/or mechanical stress in the presence of heat treatment/thermal exposure. Such alloys may be further defined by the mechanical properties that are achieved for the identified structures with respect to tensile strength and tensile elongation characteristics.

Alloy Properties

Thermal analysis was done on the as-solidified cast plate samples on a NETZSCH DSC 404F3 PEGASUS V5 system. Differential thermal analysis (DTA) and differential scanning calorimetry (DSC) were performed at a heating rate of 10° C./minute with samples protected from oxidation through the use of flowing ultra-high purity argon. In Table 4, elevated temperature DTA results are shown indicating the melting behavior for the alloys shown in Table 3. As can be seen from the tabulated results in Table 4, the melting occurs in 1, 2, 3 or 4 stages with initial melting observed from ~1108° C. depending on alloy chemistry. Final melting temperature is up to ~1400° C. Variations in melting behavior may also reflect complex phase formation at chill surface processing of the alloys depending on their chemistry.

TABLE 4

Differential Thermal Analysis Data for Melting Behavior

| Alloy | Onset (° C.) | Peak #1 (° C.) | Peak #2 (° C.) | Peak #3 (° C.) | Peak #4 (° C.) |
|---|---|---|---|---|---|
| Alloy 1 | 1123 | 1139 | 1216 | — | — |
| Alloy 2 | 1168 | 1204 | — | — | — |
| Alloy 3 | 1151 | 1176 | — | — | — |
| Alloy 4 | 1124 | 1136 | 1231 | — | — |
| Alloy 5 | 1175 | 1206 | 1325 | — | — |
| Alloy 6 | 1124 | 1137 | 1235 | — | — |
| Alloy 7 | 1125 | 1140 | — | — | — |
| Alloy 8 | 1127 | 1137 | — | — | — |
| Alloy 9 | 1130 | 1140 | — | — | — |
| Alloy 10 | 1133 | 1146 | — | — | — |
| Alloy 11 | 1133 | 1145 | — | — | — |
| Alloy 12 | 1134 | 1146 | — | — | — |
| Alloy 13 | 1134 | 1145 | — | — | — |
| Alloy 14 | 1127 | 1137 | — | — | — |
| Alloy 15 | 1123 | 1138 | — | — | — |
| Alloy 16 | 1119 | 1136 | — | — | — |
| Alloy 17 | 1133 | 1144 | 1333 | — | — |
| Alloy 18 | 1128 | 1140 | 1330 | — | — |
| Alloy 19 | 1131 | 1145 | 1323 | — | — |
| Alloy 20 | 1138 | 1153 | 1331 | — | — |
| Alloy 21 | 1125 | 1140 | 1331 | — | — |
| Alloy 22 | 1120 | 1136 | 1329 | — | — |
| Alloy 23 | 1125 | 1142 | 1320 | — | — |
| Alloy 24 | 1133 | 1146 | 1333 | — | — |
| Alloy 25 | 1143 | 1161 | 1353 | — | — |
| Alloy 26 | 1140 | 1156 | 1341 | — | — |
| Alloy 27 | 1136 | 1151 | 1341 | — | — |
| Alloy 28 | 1139 | 1155 | 1346 | — | — |
| Alloy 29 | 1132 | 1148 | 1337 | — | — |
| Alloy 30 | 1128 | 1145 | 1331 | — | — |
| Alloy 31 | 1143 | 1160 | 1351 | — | — |
| Alloy 32 | 1137 | 1154 | 1343 | — | — |
| Alloy 33 | 1134 | 1151 | 1338 | — | — |
| Alloy 34 | 1139 | 1154 | 1348 | — | — |
| Alloy 35 | 1132 | 1149 | 1324 | — | — |
| Alloy 36 | 1126 | 1142 | 1339 | — | — |
| Alloy 37 | 1135 | 1156 | 1333 | — | — |
| Alloy 38 | 1162 | 1187 | 1319 | — | — |
| Alloy 39 | 1171 | 1194 | 1353 | — | — |
| Alloy 40 | 1152 | 1173 | 1350 | — | — |
| Alloy 41 | 1150 | 1165 | 1296 | 1352 | — |
| Alloy 42 | 1157 | 1177 | 1350 | — | — |
| Alloy 43 | 1152 | 1179 | 1351 | — | — |
| Alloy 44 | 1156 | 1178 | 1212 | 1344 | — |
| Alloy 45 | 1161 | 1181 | 1216 | 1319 | 1342 |
| Alloy 46 | 1153 | 1176 | 1214 | 1330 | — |
| Alloy 47 | 1150 | 1170 | 1315 | 1333 | — |
| Alloy 48 | 1138 | 1158 | 1332 | — | — |
| Alloy 49 | 1130 | 1152 | 1212 | 1304 | 1317 |
| Alloy 50 | 1167 | 1197 | 1311 | — | — |
| Alloy 51 | 1120 | 1151 | 1292 | 1332 | — |
| Alloy 52 | 1220 | 1144 | 1340 | — | — |
| Alloy 53 | 1135 | 1154 | 1353 | — | — |
| Alloy 54 | 1138 | 1160 | 1370 | — | — |
| Alloy 55 | 1136 | 1157 | 1383 | — | — |
| Alloy 56 | 1151 | 1181 | 1350 | — | — |
| Alloy 57 | 1145 | 1168 | 1342 | — | — |
| Alloy 58 | 1136 | 1159 | 1350 | — | — |
| Alloy 59 | 1129 | 1153 | 1379 | — | — |
| Alloy 60 | 1127 | 1150 | 1373 | — | — |
| Alloy 61 | 1126 | 1150 | 1352 | — | — |
| Alloy 62 | 1123 | 1144 | 1357 | — | — |
| Alloy 63 | 1128 | 1152 | 1390 | — | — |
| Alloy 64 | 1120 | 1149 | 1332 | — | — |
| Alloy 65 | 1108 | 1144 | 1353 | — | — |
| Alloy 66 | 1114 | 1144 | 1359 | — | — |
| Alloy 67 | 1121 | 1148 | 1349 | — | — |
| Alloy 68 | 1121 | 1151 | 1361 | — | — |
| Alloy 69 | 1121 | 1148 | 1366 | — | — |
| Alloy 70 | 1129 | 1156 | 1338 | — | — |
| Alloy 71 | 1130 | 1152 | 1238 | 1363 | — |

TABLE 4-continued

| Differential Thermal Analysis Data for Melting Behavior | | | | | |
|---|---|---|---|---|---|
| Alloy | Onset (° C.) | Peak #1 (° C.) | Peak #2 (° C.) | Peak #3 (° C.) | Peak #4 (° C.) |
| Alloy 72 | 1142 | 1169 | 1290 | — | — |
| Alloy 73 | 1140 | 1168 | — | — | — |
| Alloy 74 | 1142 | 1162 | 1291 | — | — |
| Alloy 75 | 1154 | 1181 | 1320 | — | — |
| Alloy 76 | 1155 | 1181 | 1343 | — | — |
| Alloy 77 | 1159 | 1182 | 1312 | — | — |
| Alloy 78 | 1162 | 1201 | 1339 | — | — |
| Alloy 79 | 1166 | 1194 | 1315 | — | — |
| Alloy 80 | 1164 | 1201 | 1318 | — | — |
| Alloy 81 | 1176 | 1211 | 1342 | — | — |
| Alloy 82 | 1175 | 1199 | 1320 | — | — |
| Alloy 83 | 1181 | 1205 | 1293 | — | — |
| Alloy 84 | 1192 | 1228 | 1345 | — | — |
| Alloy 85 | 1189 | 1225 | 1363 | — | — |
| Alloy 86 | 1193 | 1229 | 1337 | — | — |

The density of the alloys was measured on arc-melt ingots using the Archimedes method in a specially constructed balance allowing weighing in both air and distilled water. The density of each alloy is tabulated in Table 5 and was found to vary from 7.48 g/cm$^3$ to 7.71 g/cm$^3$. Experimental results have revealed that the accuracy of this technique is ±0.01 g/cm$^3$.

TABLE 5

| Summary of Density Results (g/cm$^3$) | |
|---|---|
| Alloy | Density (avg) |
| Alloy 1 | 7.71 |
| Alloy 2 | 7.60 |
| Alloy 3 | 7.60 |
| Alloy 4 | 7.63 |
| Alloy 5 | 7.58 |
| Alloy 6 | 7.60 |
| Alloy 7 | 7.62 |
| Alloy 8 | 7.64 |
| Alloy 9 | 7.65 |
| Alloy 10 | 7.61 |
| Alloy 11 | 7.63 |
| Alloy 12 | 7.63 |
| Alloy 13 | 7.65 |
| Alloy 14 | 7.61 |
| Alloy 15 | 7.60 |
| Alloy 16 | 7.59 |
| Alloy 17 | 7.63 |
| Alloy 18 | 7.66 |
| Alloy 19 | 7.65 |
| Alloy 20 | 7.63 |
| Alloy 21 | 7.61 |
| Alloy 22 | 7.62 |
| Alloy 23 | 7.61 |
| Alloy 24 | 7.60 |
| Alloy 25 | 7.50 |
| Alloy 26 | 7.56 |
| Alloy 27 | 7.59 |
| Alloy 28 | 7.51 |
| Alloy 29 | 7.54 |
| Alloy 30 | 7.56 |
| Alloy 31 | 7.57 |
| Alloy 32 | 7.58 |
| Alloy 33 | 7.60 |
| Alloy 34 | 7.53 |
| Alloy 35 | 7.56 |
| Alloy 36 | 7.56 |
| Alloy 37 | 7.55 |
| Alloy 38 | 7.52 |
| Alloy 39 | 7.51 |
| Alloy 40 | 7.52 |
| Alloy 41 | 7.52 |
| Alloy 42 | 7.52 |

TABLE 5-continued

| Summary of Density Results (g/cm$^3$) | |
|---|---|
| Alloy | Density (avg) |
| Alloy 43 | 7.51 |
| Alloy 44 | 7.50 |
| Alloy 45 | 7.49 |
| Alloy 46 | 7.50 |
| Alloy 47 | 7.52 |
| Alloy 48 | 7.52 |
| Alloy 49 | 7.55 |
| Alloy 50 | 7.48 |
| Alloy 51 | 7.58 |
| Alloy 52 | 7.58 |
| Alloy 53 | 7.55 |
| Alloy 54 | 7.58 |
| Alloy 55 | 7.57 |
| Alloy 56 | 7.57 |
| Alloy 57 | 7.54 |
| Alloy 58 | 7.55 |
| Alloy 59 | 7.56 |
| Alloy 60 | 7.56 |
| Alloy 61 | 7.57 |
| Alloy 62 | 7.58 |
| Alloy 63 | 7.62 |
| Alloy 64 | 7.54 |
| Alloy 65 | 7.57 |
| Alloy 66 | 7.58 |
| Alloy 67 | 7.54 |
| Alloy 68 | 7.58 |
| Alloy 69 | 7.58 |
| Alloy 70 | 7.60 |
| Alloy 71 | 7.55 |
| Alloy 72 | 7.62 |
| Alloy 73 | 7.61 |
| Alloy 74 | 7.57 |
| Alloy 75 | 7.62 |
| Alloy 76 | 7.59 |
| Alloy 77 | 7.58 |
| Alloy 78 | 7.58 |
| Alloy 79 | 7.61 |
| Alloy 80 | 7.59 |
| Alloy 81 | 7.55 |
| Alloy 82 | 7.61 |
| Alloy 83 | 7.59 |
| Alloy 84 | 7.51 |
| Alloy 85 | 7.56 |
| Alloy 86 | 7.58 |

The tensile specimens were cut from selected plates using wire electrical discharge machining (EDM). The tensile properties were measured on an Instron mechanical testing frame (Model 3369), utilizing Instron's Bluehill control and analysis software. All tests were run at room temperature in displacement control with the bottom fixture held ridged and the top fixture moving; the load cell is attached to the top fixture. Video extensometer was utilized for strain measurements. In Table 6, a summary of the tensile test results including total tensile elongation (strain), yield stress, and ultimate strength are listed for selected as-cast plates. The mechanical characteristic values strongly depend on alloy chemistry and processing condition as will be showed later. As can be seen, the tensile strength values in these selected alloys vary from 350 to 1196 MPa. The total elongation value varied from 0.22 to 2.80% indicating limited ductility of alloys in as-cast state. In some specimens, failure occurred in elastic region at stress as low as 200 MPa and yielding was not reached.

Properties in Table 6 are related to the formation of the Structure #1 (FIG. 3 and FIG. 5) both in Class 2 and Class 3 alloys upon solidification of the melt at casting process.

TABLE 6

Summary on Tensile Test Results for As-Cast Plates

| | Yield Stress (MPa) | Ultimate Strength (MPa) | Tensile Elongation (%) |
|---|---|---|---|
| Alloy 1 | 674 | 702 | 0.55 |
| | 797 | 821 | 0.63 |
| Alloy 2 | 477 | 508 | 0.42 |
| | 416 | 697 | 1.71 |
| Alloy 3 | 708 | 910 | 0.61 |
| | 634 | 1012 | 1.24 |
| Alloy 4 | 714 | 801 | 0.60 |
| | 928 | 952 | 0.73 |
| Alloy 5 | 378 | 835 | 2.80 |
| | 350 | 650 | 1.63 |
| Alloy 6 | 893 | 941 | 0.42 |
| | 689 | 768 | 0.47 |
| Alloy 7 | 465 | 757 | 0.33 |
| | 488 | 747 | 0.49 |
| Alloy 8 | 685 | 767 | 0.63 |
| | N/A | 579 | 0.22 |
| Alloy 9 | 529 | 617 | 0.50 |
| Alloy 10 | 515 | 742 | 0.48 |
| Alloy 11 | 559 | 623 | 0.73 |
| | 610 | 910 | 0.78 |
| | 564 | 821 | 0.54 |
| Alloy 13 | 498 | 750 | 0.44 |
| | 957 | 962 | 0.66 |
| Alloy 15 | N/A | 850 | 0.57 |
| Alloy 16 | N/A | 620 | 0.26 |
| | N/A | 757 | 0.33 |
| Alloy 17 | 887 | 1038 | 0.43 |
| | 710 | 995 | 0.89 |
| Alloy 18 | N/A | 746 | 0.24 |
| | 586 | 874 | 1.50 |
| Alloy 19 | 845 | 927 | 0.60 |
| | 866 | 1092 | 1.20 |
| | 855 | 1065 | 1.02 |
| Alloy 20 | N/A | 654 | 0.23 |
| | 928 | 934 | 0.42 |
| Alloy 21 | N/A | 884 | 0.49 |
| | 908 | 945 | 0.71 |
| | 517 | 820 | 0.74 |
| Alloy 22 | N/A | 620 | 0.46 |
| | N/A | 505 | 0.34 |
| | N/A | 524 | 0.33 |
| Alloy 23 | 395 | 968 | 0.99 |
| | 557 | 1052 | 1.15 |
| | 851 | 945 | 0.83 |
| Alloy 24 | N/A | 695 | 0.40 |
| | N/A | 855 | 0.41 |
| | 668 | 847 | 0.50 |
| Alloy 25 | 810 | 868 | 0.72 |
| Alloy 26 | 345 | 493 | 0.39 |
| Alloy 27 | 687 | 933 | 1.13 |
| Alloy 28 | 424 | 599 | 0.41 |
| Alloy 29 | 770 | 999 | 1.02 |
| Alloy 30 | 548 | 864 | 1.49 |
| Alloy 31 | 942 | 960 | 0.73 |
| Alloy 32 | 876 | 886 | 0.76 |
| Alloy 33 | 672 | 698 | 0.66 |
| Alloy 34 | 677 | 863 | 0.62 |
| Alloy 35 | 428 | 435 | 0.49 |
| Alloy 36 | 846 | 1196 | 1.46 |

Alloy Properties after Thermal Mechanical Treatment

Each plate from each alloy was subjected to Hot Isostatic Pressing (HIP) using an American Isostatic Press Model 645 machine with a molybdenum furnace and with a furnace chamber size of 4 inch diameter by 5 inch height. The plates were heated at 10° C./min until the target temperature was reached and were exposed to gas pressure for specified time which was held at 1 hour for these studies. HIP cycle parameters are listed in Table 7. The key aspect of the HIP cycle was to remove macrodefects such as pores and small inclusions by mimicking hot rolling at Stage 2 of Twin Roll Casting process or at Stage 1 or Stage 2 of Thin Slab Casting process. An example of a plate before and after HIP cycle is shown in FIG. 8. As it can be seen, the HIP cycle which is a thermomechanical deformation process allows the elimination of some fraction of internal and external macrodefects while smoothing the surface of the plate.

TABLE 7

HIP Cycle Parameters

| HIP Cycle ID | HIP Cycle Temperature [° C.] | HIP Cycle Pressure [psi] | HIP Cycle Time [hr] |
|---|---|---|---|
| A | 950 | 30,000 | 1 |
| B | 1000 | 30,000 | 1 |
| C | 1050 | 30,000 | 1 |
| D | 1100 | 30,000 | 1 |
| E | 1150 | 30,000 | 1 |

The tensile specimens were cut from the plates after HIP cycle using wire electrical discharge machining (EDM). The tensile properties were measured on an Instron mechanical testing frame (Model 3369), utilizing Instron's Bluehill control and analysis software. All tests were run at room temperature in displacement control with the bottom fixture held ridged and the top fixture moving with the load cell attached to the top fixture. In Table 8, a summary of the tensile test results including total tensile elongation (strain), yield stress, and ultimate tensile strength are shown for the cast plates after HIP cycle. Additional column is added that specifies the alloy mechanical response in correspondence with the class of behavior (FIG. 6). Mechanical characteristic values strongly depend on alloy chemistry and HIP cycle parameters. As can be seen, the majority of the alloys after HIP cycle had demonstrated Class 3 behavior while some of them did show Class 2 behavior with corresponding shape of stress-stain curve (FIG. 6). The tensile strength values for tested alloys varied from 1030 to 1696 MPa. The total elongation value varied from 0.45 to 20.80%. Some alloys still can fail at low stress (down to 300 MPa) in elastic region with zero plastic deformation.

Properties of the alloys that demonstrated Class 3 behavior in Table 8 are related to the formation of the Structure #2 (FIG. 5) upon Lath Structure Creation mainly at Stage 2 of twin roll production or thin slab casting production. In some alloys, Lath Structure Creation can occur at Stage 1 of both casting processes. Depending on alloy chemistry, HIP cycle correlated to thermal mechanical treatment conditions at Stage 2 of twin roll production or thin slab casting production can also result in formation of Structure #3 which is a Lamellae NanoModal Structure. This structure is typically responsible for higher strength in Class 3 alloys.

Properties of the alloys that demonstrated Class 2 behavior in Table 8 are related to the formation of the Structure #2 (FIG. 3) defined as a NanoModal Structure which undergoes a Dynamic Nanophase Strengthening (Mechanism #2) during deformation responsible for Class 2 behavior observed in tested alloys.

TABLE 8

Summary on Tensile Test Results for Cast Plates after HIP Cycle

| Alloy | HIP Cycle | Yield Stress (MPa) | Ultimate Strength (MPa) | Tensile Elongation (%) | Curve Type |
|---|---|---|---|---|---|
| Alloy 1 | B | 551 | 1385 | 3.02 | Class 3 |
| | | 886 | 1329 | 2.35 | Class 3 |
| | | 1020 | 1347 | 4.22 | Class 3 |
| | D | 922 | 1277 | 7.80 | Class 3 |
| | | 952 | 1294 | 7.88 | Class 3 |
| Alloy 2 | B | 750 | 1427 | 3.98 | Class 3 |
| | | 722 | 1422 | 3.69 | Class 3 |
| | | 356 | 1078 | 2.90 | Class 3 |
| | | 389 | 1188 | 3.34 | Class 3 |
| | D | 742 | 1396 | 2.88 | Class 3 |
| | | 649 | 1484 | 7.54 | Class 3 |
| | E | 437 | 1407 | 5.09 | Class 3 |
| | | 562 | 1386 | 6.83 | Class 3 |
| | | 941 | 1456 | 8.67 | Class 3 |
| Alloy 3 | B | 947 | 1472 | 3.19 | Class 3 |
| | | 1023 | 1477 | 3.46 | Class 3 |
| | | 1240 | 1491 | 7.11 | Class 3 |
| | D | 991 | 1532 | 5.68 | Class 3 |
| | | 1051 | 1516 | 6.69 | Class 3 |
| | | 1050 | 1500 | 3.66 | Class 3 |
| Alloy 4 | B | 971 | 1318 | 1.42 | Class 3 |
| | | 681 | 1480 | 6.08 | Class 3 |
| | D | 964 | 1371 | 2.65 | Class 3 |
| | | 1081 | 1514 | 4.50 | Class 3 |
| Alloy 5 | B | 730 | 1515 | 6.95 | Class 3 |
| | | 688 | 1528 | 6.12 | Class 3 |
| | | 1240 | 1538 | 4.84 | Class 3 |
| | D | 730 | 1431 | 4.16 | Class 3 |
| | | 704 | 1458 | 5.92 | Class 3 |
| | | 588 | 1460 | 5.19 | Class 3 |
| Alloy 6 | B | 1089 | 1562 | 4.37 | Class 3 |
| | | 957 | 1561 | 4.39 | Class 3 |
| | | 1082 | 1574 | 4.55 | Class 3 |
| | D | 1101 | 1498 | 2.91 | Class 3 |
| | | 891 | 1481 | 3.98 | Class 3 |
| Alloy 7 | B | 1007 | 1532 | 3.12 | Class 3 |
| | | 1136 | 1516 | 3.30 | Class 3 |
| | | 1037 | 1525 | 4.09 | Class 3 |
| | D | 1156 | 1506 | 6.34 | Class 3 |
| | | 1144 | 1492 | 4.22 | Class 3 |
| Alloy 8 | B | 1064 | 1485 | 4.33 | Class 3 |
| | | 997 | 1530 | 3.50 | Class 3 |
| | | 1040 | 1512 | 3.47 | Class 3 |
| | D | 1051 | 1443 | 7.49 | Class 3 |
| | | 1061 | 1439 | 7.20 | Class 3 |
| | | 1145 | 1513 | 6.09 | Class 3 |
| Alloy 9 | B | 965 | 1319 | 4.84 | Class 3 |
| | | 947 | 1444 | 3.03 | Class 3 |
| | D | 1052 | 1390 | 6.80 | Class 3 |
| | | 909 | 1382 | 4.05 | Class 3 |
| | | 902 | 1398 | 6.57 | Class 3 |
| Alloy 10 | B | 1129 | 1573 | 3.60 | Class 3 |
| | | 1007 | 1524 | 2.42 | Class 3 |
| | D | 1015 | 1500 | 5.76 | Class 3 |
| | | 1044 | 1470 | 3.12 | Class 3 |
| | | 1023 | 1453 | 2.61 | Class 3 |
| Alloy 11 | B | 1006 | 1474 | 2.85 | Class 3 |
| | | 906 | 1464 | 2.63 | Class 3 |
| | D | 1142 | 1484 | 2.58 | Class 3 |
| | | 980 | 1417 | 2.29 | Class 3 |
| Alloy 12 | B | 896 | 1440 | 5.39 | Class 3 |
| | | 1048 | 1537 | 4.73 | Class 3 |
| | | 994 | 1443 | 4.21 | Class 3 |
| | D | 964 | 1373 | 3.85 | Class 3 |
| | | 959 | 1381 | 3.08 | Class 3 |
| | | 934 | 1403 | 3.89 | Class 3 |
| Alloy 13 | B | 973 | 1472 | 4.05 | Class 3 |
| | | 918 | 1383 | 6.66 | Class 3 |
| | | 1056 | 1471 | 4.37 | Class 3 |
| | D | 898 | 1343 | 5.78 | Class 3 |
| | | 964 | 1368 | 9.46 | Class 3 |
| | | 1128 | 1341 | 10.09 | Class 3 |
| Alloy 14 | B | 1079 | 1531 | 4.14 | Class 3 |
| | | 1042 | 1520 | 2.46 | Class 3 |

TABLE 8-continued

Summary on Tensile Test Results for Cast Plates after HIP Cycle

| Alloy | HIP Cycle | Yield Stress (MPa) | Ultimate Strength (MPa) | Tensile Elongation (%) | Curve Type |
|---|---|---|---|---|---|
| | | 1009 | 1536 | 4.60 | Class 3 |
| | D | 1031 | 1545 | 5.04 | Class 3 |
| | | 979 | 1544 | 10.33 | Class 3 |
| Alloy 15 | B | 1080 | 1553 | 5.56 | Class 3 |
| | | 1091 | 1557 | 4.47 | Class 3 |
| | | 949 | 1553 | 3.35 | Class 3 |
| Alloy 16 | B | 1189 | 1609 | 5.32 | Class 3 |
| | | 1118 | 1544 | 3.18 | Class 3 |
| Alloy 17 | B | 976 | 1444 | 1.86 | Class 3 |
| | | 880 | 1266 | 1.95 | Class 3 |
| | D | 930 | 1539 | 3.03 | Class 3 |
| | | 1054 | 1634 | 4.77 | Class 3 |
| | A | 1082 | 1530 | 3.84 | Class 3 |
| | | 1097 | 1494 | 2.17 | Class 3 |
| Alloy 18 | B | 1019 | 1414 | 3.62 | Class 3 |
| | | 1263 | 1577 | 5.48 | Class 3 |
| | A | 820 | 1300 | 1.50 | Class 3 |
| | | 1398 | 1497 | 5.26 | Class 3 |
| | | 797 | 1598 | 3.87 | Class 3 |
| Alloy 19 | D | 918 | 1473 | 2.31 | Class 3 |
| | | 1175 | 1416 | 4.58 | Class 3 |
| | A | 677 | 1538 | 2.87 | Class 3 |
| | | 701 | 1044 | 1.17 | Class 3 |
| Alloy 20 | B | 1107 | 1582 | 5.47 | Class 3 |
| | | 801 | 1155 | 1.07 | Class 3 |
| | A | 1268 | 1408 | 1.47 | Class 3 |
| Alloy 21 | B | 1131 | 1199 | 0.85 | Class 3 |
| | D | 1078 | 1358 | 1.40 | Class 3 |
| | | 1012 | 1230 | 3.81 | Class 3 |
| | A | 1022 | 1696 | 3.26 | Class 3 |
| | | 1062 | 1467 | 1.53 | Class 3 |
| | | 862 | 1081 | 0.93 | Class 3 |
| Alloy 22 | B | 1320 | 1542 | 5.64 | Class 3 |
| | | 839 | 1475 | 2.72 | Class 3 |
| | D | 951 | 1486 | 11.44 | Class 3 |
| | A | 901 | 1555 | 4.37 | Class 3 |
| | | 1030 | 1565 | 7.61 | Class 3 |
| Alloy 23 | D | 859 | 1623 | 3.31 | Class 3 |
| | | 1244 | 1462 | 1.64 | Class 3 |
| | | 1088 | 1608 | 8.20 | Class 3 |
| | | 1055 | 1560 | 8.99 | Class 3 |
| | A | 938 | 1621 | 5.84 | Class 3 |
| | | 1000 | 1659 | 3.21 | Class 3 |
| | | 947 | 1590 | 3.19 | Class 3 |
| Alloy 24 | B | 1252 | 1591 | 4.45 | Class 3 |
| | | 1158 | 1444 | 1.40 | Class 3 |
| | D | 992 | 1557 | 2.98 | Class 3 |
| | | 1233 | 1464 | 1.72 | Class 3 |
| | A | 1058 | 1628 | 3.18 | Class 3 |
| | | 1062 | 1566 | 2.56 | Class 3 |
| | | 1158 | 1483 | 1.59 | Class 3 |
| Alloy 25 | B | 719 | 1420 | 1.90 | Class 3 |
| | D | 979 | 1474 | 8.17 | Class 3 |
| | | 1009 | 1439 | 5.14 | Class 3 |
| | A | 1055 | 1519 | 5.54 | Class 3 |
| Alloy 26 | B | 867 | 1443 | 3.98 | Class 3 |
| | | 831 | 1460 | 5.36 | Class 3 |
| | D | 873 | 1430 | 3.71 | Class 3 |
| | | 850 | 1505 | 5.12 | Class 3 |
| | | 890 | 1387 | 2.38 | Class 3 |
| | A | 711 | 1244 | 1.90 | Class 3 |
| Alloy 27 | B | 348 | 1332 | 10.05 | Class 2 |
| | | 362 | 1373 | 13.43 | Class 2 |
| | D | 349 | 1320 | 10.00 | Class 2 |
| | | 359 | 1295 | 10.19 | Class 2 |
| | A | 514 | 1262 | 4.71 | Class 2 |
| | | 433 | 1097 | 4.89 | Class 2 |
| Alloy 28 | B | 1179 | 1481 | 2.59 | Class 3 |
| | D | 812 | 1014 | 0.82 | Class 3 |
| Alloy 29 | B | 824 | 1269 | 1.91 | Class 3 |
| | | 799 | 1352 | 2.31 | Class 3 |
| | D | 837 | 1517 | 6.19 | Class 3 |
| | A | 554 | 1489 | 4.38 | Class 3 |

TABLE 8-continued

Summary on Tensile Test Results for Cast Plates after HIP Cycle

| Alloy | HIP Cycle | Yield Stress (MPa) | Ultimate Strength (MPa) | Tensile Elongation (%) | Curve Type |
|---|---|---|---|---|---|
| Alloy 30 | A | 455 | 1111 | 9.24 | Class 2 |
| | | 381 | 1143 | 9.45 | Class 2 |
| Alloy 31 | B | 981 | 1464 | 6.52 | Class 3 |
| | D | 920 | 1393 | 2.80 | Class 3 |
| | A | 1118 | 1514 | 2.97 | Class 3 |
| | | 1092 | 1414 | 1.57 | Class 3 |
| Alloy 32 | B | 660 | 1411 | 2.82 | Class 3 |
| | | 965 | 1236 | 1.38 | Class 3 |
| | | 1041 | 1342 | 1.80 | Class 3 |
| | | 973 | 1404 | 2.56 | Class 3 |
| | D | 768 | 1527 | 5.67 | Class 3 |
| | | 441 | 1440 | 7.16 | Class 3 |
| | A | 1347 | 1497 | 5.63 | Class 3 |
| | | 1045 | 1456 | 2.45 | Class 3 |
| Alloy 33 | B | 653 | 1326 | 3.29 | Class 3 |
| | D | 767 | 1409 | 9.10 | Class 3 |
| | | 731 | 1348 | 6.06 | Class 3 |
| | A | 841 | 1459 | 5.21 | Class 3 |
| Alloy 34 | B | 967 | 1126 | 1.03 | Class 3 |
| | | 981 | 1551 | 2.97 | Class 3 |
| | D | 1059 | 1496 | 7.06 | Class 3 |
| | | 587 | 1497 | 5.12 | Class 3 |
| | | 1329 | 1466 | 2.81 | Class 3 |
| | A | 1126 | 1445 | 1.75 | Class 3 |
| | | 1147 | 1396 | 1.69 | Class 3 |
| | | 1136 | 1483 | 2.87 | Class 3 |
| Alloy 35 | B | 1054 | 1055 | 1.01 | Class 3 |
| | | 1020 | 1427 | 2.15 | Class 3 |
| | D | 978 | 1451 | 8.00 | Class 3 |
| | A | 993 | 1518 | 5.25 | Class 3 |
| | | 1009 | 1515 | 4.88 | Class 3 |
| Alloy 36 | B | 579 | 1433 | 4.72 | Class 3 |
| | | 969 | 1438 | 2.26 | Class 3 |
| | | 862 | 1478 | 3.33 | Class 3 |
| | D | 777 | 1181 | 2.40 | Class 3 |
| | | 794 | 1457 | 6.24 | Class 3 |
| | | 819 | 1412 | 9.33 | Class 3 |
| Alloy 37 | B | 842 | 1531 | 4.86 | Class 3 |
| | | 878 | 1531 | 5.37 | Class 3 |
| | | 895 | 1528 | 5.97 | Class 3 |
| | D | 779 | 1443 | 3.22 | Class 3 |
| | | 995 | 1363 | 2.30 | Class 3 |
| | | 943 | 1448 | 7.37 | Class 3 |
| Alloy 38 | B | 903 | 1513 | 3.72 | Class 3 |
| | | 841 | 1441 | 2.79 | Class 3 |
| | | 732 | 1485 | 3.29 | Class 3 |
| | D | 628 | 1277 | 2.58 | Class 3 |
| | | 689 | 1474 | 6.39 | Class 3 |
| Alloy 39 | B | 1100 | 1468 | 3.08 | Class 3 |
| | | 1164 | 1405 | 1.87 | Class 3 |
| | D | 1110 | 1419 | 1.55 | Class 3 |
| | | 1079 | 1433 | 1.61 | Class 3 |
| | | 1038 | 1431 | 2.79 | Class 3 |
| Alloy 40 | D | 1103 | 1405 | 2.29 | Class 3 |
| | | 1096 | 1473 | 4.74 | Class 3 |
| Alloy 41 | B | 1016 | 1426 | 2.38 | Class 3 |
| | | 1096 | 1243 | 1.26 | Class 3 |
| | D | 1137 | 1416 | 3.96 | Class 3 |
| | | 1013 | 1430 | 3.62 | Class 3 |
| Alloy 42 | B | 1184 | 1540 | 2.14 | Class 3 |
| | | 1116 | 1491 | 4.36 | Class 3 |
| | D | 1108 | 1454 | 2.43 | Class 3 |
| Alloy 43 | B | 1095 | 1325 | 1.08 | Class 3 |
| | | 1135 | 1509 | 2.22 | Class 3 |
| | | 1046 | 1333 | 1.31 | Class 3 |
| | D | 1096 | 1231 | 1.10 | Class 3 |
| Alloy 44 | B | 1006 | 1390 | 1.79 | Class 3 |
| | | 1237 | 1539 | 3.58 | Class 3 |
| Alloy 45 | B | 1154 | 1499 | 3.81 | Class 3 |
| | D | 1126 | 1498 | 2.42 | Class 3 |
| | | 1059 | 1077 | 0.83 | Class 3 |
| Alloy 46 | B | 1188 | 1463 | 5.76 | Class 3 |
| | | 874 | 1193 | 0.78 | Class 3 |
| | | 1047 | 1382 | 1.70 | Class 3 |

TABLE 8-continued

Summary on Tensile Test Results for Cast Plates after HIP Cycle

| Alloy | HIP Cycle | Yield Stress (MPa) | Ultimate Strength (MPa) | Tensile Elongation (%) | Curve Type |
|---|---|---|---|---|---|
| | D | 976 | 1550 | 3.23 | Class 3 |
| | | 1071 | 1342 | 1.16 | Class 3 |
| | | 1128 | 1478 | 1.97 | Class 3 |
| Alloy 47 | B | 1090 | 1484 | 3.66 | Class 3 |
| | D | 1082 | 1503 | 5.30 | Class 3 |
| Alloy 48 | B | 1090 | 1527 | 4.55 | Class 3 |
| | | 923 | 1525 | 4.42 | Class 3 |
| | | 882 | 1345 | 1.69 | Class 3 |
| | D | 1115 | 1459 | 2.72 | Class 3 |
| | | 1004 | 1387 | 2.06 | Class 3 |
| Alloy 49 | B | 832 | 1519 | 4.95 | Class 3 |
| | | 826 | 1505 | 5.23 | Class 3 |
| Alloy 50 | B | 849 | 1132 | 1.11 | Class 3 |
| | | 893 | 1303 | 1.48 | Class 2 |
| | D | 802 | 1240 | 1.45 | Class 3 |
| | | 869 | 1458 | 2.14 | Class 3 |
| Alloy 51 | B | 416 | 1061 | 10.90 | Class 2 |
| | | 379 | 1375 | 17.70 | Class 2 |
| | D | 370 | 1360 | 17.30 | Class 2 |
| | | 347 | 1368 | 18.20 | Class 2 |
| | | 387 | 1333 | 15.10 | Class 2 |
| | | 365 | 1353 | 16.90 | Class 2 |
| | | 421 | 1172 | 12.60 | Class 2 |
| | | 368 | 1208 | 12.60 | Class 2 |
| Alloy 52 | B | 394 | 1201 | 8.90 | Class 2 |
| | | 447 | 1434 | 10.50 | Class 2 |
| | | 416 | 1174 | 6.30 | Class 2 |
| | D | 703 | 1418 | 4.10 | Class 2 |
| | | 748 | 1482 | 9.30 | Class 3 |
| | | 679 | 1479 | 11.50 | Class 3 |
| | | 732 | 1477 | 10.70 | Class 3 |
| | | 726 | 1469 | 9.90 | Class 3 |
| Alloy 53 | B | 748 | 1413 | 1.90 | Class 3 |
| | | 919 | 1030 | 0.90 | Class 3 |
| | | 796 | 1300 | 1.30 | Class 3 |
| | | 1043 | 1550 | 4.80 | Class 3 |
| | | 1043 | 1549 | 8.10 | Class 3 |
| | D | 1004 | 1492 | 3.90 | Class 3 |
| | | 905 | 1238 | 1.00 | Class 3 |
| | | 1049 | 1501 | 6.90 | Class 3 |
| | | 985 | 1481 | 8.70 | Class 3 |
| Alloy 54 | B | 1120 | 1513 | 5.80 | Class 3 |
| | | 1381 | 1508 | 6.90 | Class 3 |
| | | 1067 | 1516 | 3.30 | Class 3 |
| | | 990 | 1131 | 1.00 | Class 3 |
| | | 1058 | 1467 | 2.10 | Class 3 |
| | | 918 | 1462 | 2.00 | Class 3 |
| | D | 1226 | 1401 | 4.30 | Class 3 |
| | | 867 | 1287 | 2.50 | Class 3 |
| | | 823 | 1426 | 6.80 | Class 3 |
| | | 1076 | 1491 | 2.10 | Class 3 |
| | | 1071 | 1469 | 8.10 | Class 3 |
| | | 932 | 1397 | 4.50 | Class 3 |
| Alloy 55 | B | 1006 | 1467 | 7.30 | Class 3 |
| | D | 1076 | 1419 | 4.00 | Class 3 |
| | | 1009 | 1437 | 6.00 | Class 3 |
| | | 914 | 1449 | 10.70 | Class 3 |
| | | 1024 | 1486 | 11.30 | Class 3 |
| Alloy 56 | B | 909 | 1471 | 2.60 | Class 3 |
| | | 926 | 1159 | 1.10 | Class 3 |
| | | 951 | 1388 | 1.50 | Class 3 |
| | | 1009 | 1260 | 1.20 | Class 3 |
| | D | 940 | 1465 | 5.70 | Class 3 |
| | | 902 | 1438 | 7.10 | Class 3 |
| | | 401 | 1458 | 7.50 | Class 3 |
| Alloy 57 | B | 976 | 1471 | 2.50 | Class 3 |
| | | 924 | 1245 | 1.80 | Class 3 |
| | D | 1101 | 1469 | 2.40 | Class 3 |
| | | 1117 | 1500 | 4.10 | Class 3 |
| Alloy 58 | B | 689 | 1555 | 7.20 | Class 3 |
| | | 708 | 1537 | 4.40 | Class 3 |
| | D | 731 | 1458 | 4.60 | Class 3 |
| | | 744 | 1457 | 10.70 | Class 3 |
| | | 707 | 1260 | 2.30 | Class 3 |

TABLE 8-continued

Summary on Tensile Test Results for Cast Plates after HIP Cycle

| Alloy | HIP Cycle | Yield Stress (MPa) | Ultimate Strength (MPa) | Tensile Elongation (%) | Curve Type |
|---|---|---|---|---|---|
| Alloy 59 | B | 763 | 1476 | 6.70 | Class 3 |
| | | 687 | 1493 | 6.20 | Class 3 |
| | | 706 | 1489 | 6.30 | Class 3 |
| | D | 796 | 1419 | 4.10 | Class 3 |
| | | 837 | 1397 | 3.30 | Class 3 |
| Alloy 60 | B | 823 | 1319 | 2.40 | Class 3 |
| | D | 712 | 1330 | 3.20 | Class 3 |
| | | 802 | 1398 | 4.60 | Class 3 |
| Alloy 61 | B | 373 | 1274 | 11.90 | Class 2 |
| | | 369 | 1030 | 8.50 | Class 2 |
| | D | 328 | 1339 | 19.80 | Class 2 |
| | | 327 | 1311 | 20.80 | Class 2 |
| | | 331 | 1323 | 17.40 | Class 2 |
| Alloy 62 | B | 375 | 1161 | 10.10 | Class 2 |
| | | 348 | 1263 | 10.10 | Class 2 |
| | D | 304 | 1364 | 13.80 | Class 2 |
| | | 324 | 1385 | 18.20 | Class 2 |
| Alloy 63 | B | 323 | 1285 | 10.90 | Class 2 |
| | D | 349 | 1239 | 6.20 | Class 2 |
| | | 357 | 1371 | 8.80 | Class 2 |
| Alloy 64 | B | 371 | 1191 | 13.40 | Class 2 |
| Alloy 65 | B | 345 | 1106 | 13.00 | Class 2 |
| | | 412 | 1263 | 14.50 | Class 2 |
| | | 365 | 1148 | 13.10 | Class 2 |
| | D | 335 | 1309 | 15.20 | Class 2 |
| | | 351 | 1358 | 20.70 | Class 2 |
| Alloy 66 | B | 344 | 1231 | 12.40 | Class 2 |
| | D | 334 | 1088 | 12.10 | Class 2 |
| | | 319 | 1205 | 12.90 | Class 2 |
| Alloy 67 | B | 366 | 1101 | 9.40 | Class 2 |
| | D | 374 | 1417 | 18.80 | Class 2 |
| | | 381 | 1373 | 15.40 | Class 2 |
| Alloy 68 | B | 374 | 1130 | 11.20 | Class 2 |
| | D | 326 | 1377 | 16.80 | Class 2 |
| Alloy 69 | B | 319 | 1283 | 11.10 | Class 2 |
| | | 341 | 1304 | 11.10 | Class 2 |
| | D | 327 | 1362 | 11.30 | Class 2 |
| | | 314 | 1093 | 8.80 | Class 2 |
| Alloy 70 | B | 365 | 1360 | 15.50 | Class 2 |
| | | 363 | 1262 | 12.40 | Class 2 |
| | D | 353 | 1216 | 11.00 | Class 2 |
| | | 357 | 1335 | 14.90 | Class 2 |
| Alloy 71 | B | 382 | 1260 | 12.90 | Class 2 |
| | | 386 | 1059 | 10.50 | Class 2 |
| | D | 364 | 1168 | 11.80 | Class 2 |
| Alloy 75 | D | 389 | 1054 | 14.67 | Class 2 |
| | | 415 | 1111 | 15.63 | Class 2 |
| Alloy 78 | D | 414 | 1162 | 12.03 | Class 2 |
| | E | 405 | 1332 | 14.67 | Class 2 |
| | | 416 | 1340 | 14.98 | Class 2 |
| Alloy 81 | D | 396 | 1367 | 4.43 | Class 2 |
| | | 275 | 1083 | 4.01 | Class 2 |
| | E | 305 | 1513 | 8.71 | Class 2 |
| | | 306 | 1538 | 9.20 | Class 2 |
| | | 291 | 1316 | 6.43 | Class 2 |
| Alloy 82 | D | 390 | 1122 | 9.40 | Class 2 |
| | | 379 | 1182 | 11.13 | Class 2 |
| Alloy 84 | D | 515 | 1426 | 2.48 | Class 3 |
| | | 518 | 1607 | 4.22 | Class 3 |

After HIP cycle, the plate material was heat treated in a box furnace at parameters specified in Table 9. The aspect of the heat treatment after HIP cycle was to estimate thermal stability and property changes of the alloys by mimicking Stage 3 of the Twin Roll Casting process and also Stage 3 of the Thin Slab Casting process. In a case of air cooling, the specimens were held at the target temperature for a target period of time, removed from the furnace and cooled down in air. In a case of slow cooling, the specimens were heated to the target temperature and then cooled with the furnace at cooling rate of 1° C./min.

TABLE 9

Heat Treatment Parameters

| Heat Treatment (ID) | Temperature (° C.) | Dwell Time (min) | Cooling |
|---|---|---|---|
| T1 | 700 | 60 | In air |
| T2 | 700 | N/A | Slow cooling |
| T3 | 850 | 60 | In air |
| T4 | 900 | 60 | In air |

The tensile specimens were cut from the plates after HIP cycle and heat treatment using wire electrical discharge machining (EDM). Tensile properties were measured on an Instron mechanical testing frame (Model 3369), utilizing Instron's Bluehill control and analysis software. All tests were run at room temperature in displacement control with the bottom fixture held ridged and the top fixture moving; the load cell is attached to the top fixture. In Table 10, a summary of the tensile test results including total tensile elongation (strain), yield stress, and ultimate tensile strength are shown for the cast plates after HIP cycle and heat treatment. Additional column is added that specifies the alloy mechanical response in correspondence with the class of behavior (FIG. 6). As can be seen in Table 10, the tested alloys have shown both Class 2 and Class 3 depending on alloy chemistry. Moreover, in some cases both type of curves (Class 2 and Class 3) were observed for same alloy depending on thermal mechanical treatment parameters.

In the case of Class 2 behavior, the tensile strength of the alloys (Structure 3 in Table 2) varies from 875 to 1590 MPa. The total elongation value varies from 5.0 to 30.0% providing superior high strength/high ductility property combination. Such property combination related to the formation of the Structure #3 (FIG. 3B) defined as a High Strength Nano-Modal Structure results from prior a Dynamic Nanophase Strengthening (Mechanism #2) of Structure 2 (Nanomodal Structure) and is responsible for Class 2 behavior observed in tested alloys.

In a case of Class 3 behavior, the tensile strength of the alloys is equal to or higher than 1000 MPa and the data varies from 1004 to 1749 MPa. The total elongation values for the sample alloys vary from 0.5 to 14.5%. High strength of the alloys in Table 10 with Class 3 behavior related to the formation of Structure #3 (FIG. 5) specified as Lamellae Nano-Modal Structure prior to the tensile testing that can occur at any stage of twin roll production or thin slab casting production but mainly at Stage 3 for most alloys in this application. Tensile deformation of Structure #3 leads to its transformation into Structure #4 specified as High Strength Lamellae NanoModal Structure through Dynamic Nanophase Strengthening resulting in high strength characteristics recorded.

TABLE 10

Summary on Tensile Test Results for Cast Plates after HIP Cycle and Heat Treatment

| Alloy | HIP Cycle | Heat Treatment | Yield Stress (MPa) | Ultimate Strength (MPa) | Tensile Elongation (%) | Curve Type |
|---|---|---|---|---|---|---|
| Alloy 1 | B | T1 | 919 | 1408 | 3.11 | Class 3 |
| | | | 891 | 1390 | 2.54 | Class 3 |
| | | | 966 | 1424 | 3.08 | Class 3 |
| | | T2 | 916 | 1452 | 2.98 | Class 3 |
| | | | 839 | 1473 | 4.39 | Class 3 |

TABLE 10-continued

Summary on Tensile Test Results for Cast Plates after HIP Cycle and Heat Treatment

| Alloy | HIP Cycle | Heat Treatment | Yield Stress (MPa) | Ultimate Strength (MPa) | Tensile Elongation (%) | Curve Type |
|---|---|---|---|---|---|---|
| | D | T1 | 902 | 1315 | 9.71 | Class 3 |
| | | | 955 | 1330 | 5.86 | Class 3 |
| | | T2 | 872 | 1355 | 5.05 | Class 3 |
| | | | 946 | 1345 | 5.44 | Class 3 |
| | | T2 | 877 | 1357 | 5.29 | Class 3 |
| Alloy 2 | B | T1 | 571 | 1442 | 7.10 | Class 3 |
| | | | 511 | 1452 | 7.73 | Class 3 |
| | | T2 | 671 | 1206 | 6.61 | Class 2 |
| | | T3 | 570 | 1430 | 6.21 | Class 3 |
| | | | 649 | 1365 | 3.33 | Class 3 |
| | D | T1 | 416 | 1365 | 5.23 | Class 3 |
| | | | 481 | 1402 | 6.55 | Class 3 |
| | | T2 | 585 | 1367 | 9.73 | Class 2 |
| | | | 579 | 1356 | 9.52 | Class 2 |
| | | | 553 | 1334 | 8.66 | Class 2 |
| | | T3 | 535 | 1429 | 7.39 | Class 3 |
| | | | 464 | 1414 | 4.84 | Class 3 |
| | | | 414 | 1399 | 4.44 | Class 3 |
| | E | T1 | 522 | 1382 | 5.79 | Class 3 |
| | | | 504 | 1370 | 5.84 | Class 3 |
| | | | 628 | 1381 | 6.91 | Class 3 |
| | | T2 | 482 | 1363 | 9.29 | Class 2 |
| | | | 468 | 1352 | 10.41 | Class 2 |
| | | T3 | 370 | 1454 | 7.79 | Class 3 |
| | | | 463 | 1448 | 8.77 | Class 3 |
| | | | 503 | 1396 | 4.19 | Class 3 |
| Alloy 3 | B | T1 | 840 | 1520 | 3.58 | Class 3 |
| | | | 1076 | 1474 | 4.68 | Class 3 |
| | | T2 | 829 | 1520 | 6.19 | Class 3 |
| | | | 971 | 1536 | 5.20 | Class 3 |
| | | T3 | 813 | 1472 | 5.62 | Class 3 |
| | | | 973 | 1478 | 7.00 | Class 3 |
| | | | 1048 | 1476 | 5.95 | Class 3 |
| | D | T1 | 712 | 1504 | 5.08 | Class 3 |
| | | | 779 | 1522 | 6.57 | Class 3 |
| | | T2 | 816 | 1453 | 5.57 | Class 3 |
| | | | 913 | 1446 | 4.30 | Class 3 |
| | | | 798 | 1434 | 4.09 | Class 3 |
| | E | T3 | 970 | 1475 | 3.34 | Class 3 |
| | | | 1006 | 1488 | 3.34 | Class 3 |
| Alloy 4 | B | T1 | 972 | 1443 | 2.17 | Class 3 |
| | | | 941 | 1463 | 2.28 | Class 3 |
| | | T2 | 823 | 1425 | 2.54 | Class 3 |
| | | | 706 | 1310 | 1.70 | Class 3 |
| | | T3 | 1015 | 1455 | 5.99 | Class 3 |
| | | | 979 | 1426 | 4.75 | Class 3 |
| | | | 1212 | 1430 | 5.89 | Class 3 |
| | D | T1 | 829 | 1507 | 4.53 | Class 3 |
| | | | 1008 | 1404 | 2.04 | Class 3 |
| | | | 934 | 1474 | 2.89 | Class 3 |
| | | T2 | 770 | 1499 | 3.72 | Class 3 |
| | | | 716 | 1437 | 2.67 | Class 3 |
| | | T3 | 905 | 1464 | 9.01 | Class 3 |
| | | | 352 | 1426 | 6.38 | Class 3 |
| | | | 1061 | 1305 | 3.79 | Class 3 |
| Alloy 5 | B | T1 | 524 | 1516 | 8.21 | Class 3 |
| | | | 621 | 1544 | 9.16 | Class 3 |
| | | | 453 | 1507 | 4.22 | Class 3 |
| | | T2 | 744 | 1429 | 9.81 | Class 3 |
| | | T3 | 576 | 1341 | 2.77 | Class 3 |
| | | | 439 | 1556 | 7.41 | Class 3 |
| | | | 507 | 1510 | 5.29 | Class 3 |
| | D | T1 | 491 | 1382 | 5.31 | Class 3 |
| | | | 539 | 1423 | 9.05 | Class 3 |
| | | T2 | 655 | 1377 | 12.13 | Class 2 |
| | | T3 | 613 | 1424 | 6.43 | Class 3 |
| | | | 560 | 1429 | 6.82 | Class 3 |
| Alloy 6 | B | T1 | 1053 | 1583 | 5.13 | Class 3 |
| | | | 1001 | 1571 | 5.76 | Class 3 |
| | | T2 | 889 | 1550 | 3.62 | Class 3 |
| | | | 679 | 1597 | 5.61 | Class 3 |
| | | T3 | 1246 | 1517 | 6.01 | Class 3 |
| | | | 1078 | 1522 | 4.54 | Class 3 |

TABLE 10-continued

Summary on Tensile Test Results for Cast Plates after HIP Cycle and Heat Treatment

| Alloy | HIP Cycle | Heat Treatment | Yield Stress (MPa) | Ultimate Strength (MPa) | Tensile Elongation (%) | Curve Type |
|---|---|---|---|---|---|---|
| | D | T1 | 981 | 1496 | 3.69 | Class 3 |
| | | | 976 | 1523 | 7.63 | Class 3 |
| | | T2 | 873 | 1574 | 10.14 | Class 3 |
| | | | 613 | 1567 | 7.35 | Class 3 |
| | | | 812 | 1577 | 8.65 | Class 3 |
| | | T3 | 1067 | 1400 | 2.06 | Class 3 |
| Alloy 7 | B | T1 | 893 | 1512 | 4.31 | Class 3 |
| | | | 957 | 1541 | 3.12 | Class 3 |
| | | T2 | 1143 | 1490 | 3.02 | Class 3 |
| | | T3 | 943 | 1471 | 2.91 | Class 3 |
| | | | 1007 | 1373 | 1.41 | Class 3 |
| | | | 1099 | 1461 | 6.17 | Class 3 |
| | D | T1 | 942 | 1509 | 4.42 | Class 3 |
| | | | 936 | 1514 | 7.37 | Class 3 |
| | | T2 | 868 | 1474 | 3.75 | Class 3 |
| | | | 762 | 1532 | 10.53 | Class 3 |
| | | | 831 | 1407 | 2.94 | Class 3 |
| | | T3 | 956 | 1091 | 1.93 | Class 3 |
| | | | 1086 | 1468 | 6.79 | Class 3 |
| Alloy 8 | B | T1 | 926 | 1531 | 5.59 | Class 3 |
| | | | 1092 | 1460 | 3.11 | Class 3 |
| | | T2 | 822 | 1532 | 7.89 | Class 3 |
| | | | 638 | 1460 | 4.49 | Class 3 |
| | | | 830 | 1481 | 4.61 | Class 3 |
| | | T3 | 1022 | 1494 | 3.49 | Class 3 |
| | | | 929 | 1382 | 1.67 | Class 3 |
| | D | T1 | 966 | 1424 | 3.60 | Class 3 |
| | | | 1046 | 1480 | 6.79 | Class 3 |
| | | T2 | 813 | 1440 | 4.85 | Class 3 |
| | | | 793 | 1378 | 3.17 | Class 3 |
| | | | 806 | 1462 | 7.30 | Class 3 |
| | | T3 | 940 | 1374 | 8.43 | Class 3 |
| | | | 1084 | 1351 | 3.92 | Class 3 |
| Alloy 9 | B | T1 | 960 | 1425 | 7.38 | Class 3 |
| | | | 954 | 1395 | 7.43 | Class 3 |
| | | | 954 | 1413 | 8.17 | Class 3 |
| | | T2 | 827 | 1467 | 8.42 | Class 3 |
| | | | 870 | 1446 | 10.61 | Class 3 |
| | | T3 | 1057 | 1416 | 11.20 | Class 3 |
| | | | 1012 | 1390 | 5.24 | Class 3 |
| | | | 1002 | 1367 | 5.22 | Class 3 |
| | D | T1 | 967 | 1396 | 9.71 | Class 3 |
| | | | 862 | 1419 | 3.11 | Class 3 |
| | | T2 | 806 | 1452 | 6.65 | Class 3 |
| | | | 810 | 1493 | 5.42 | Class 3 |
| | | T3 | 959 | 1363 | 2.97 | Class 3 |
| | | | 908 | 1367 | 9.87 | Class 3 |
| Alloy 10 | B | T1 | 935 | 1394 | 2.64 | Class 3 |
| | | T2 | 747 | 1366 | 3.71 | Class 3 |
| | | T3 | 1064 | 1503 | 2.88 | Class 3 |
| | | | 963 | 1524 | 2.98 | Class 3 |
| | D | T1 | 879 | 1421 | 3.47 | Class 3 |
| | | | 956 | 1424 | 6.28 | Class 3 |
| | | | 836 | 1434 | 4.41 | Class 3 |
| | | T2 | 846 | 1344 | 3.21 | Class 3 |
| | | | 826 | 1413 | 5.15 | Class 3 |
| | | | 846 | 1402 | 4.46 | Class 3 |
| | | T3 | 1115 | 1439 | 4.50 | Class 3 |
| | | | 968 | 1418 | 2.94 | Class 3 |
| | | | 1251 | 1442 | 7.02 | Class 3 |
| Alloy 11 | B | T1 | 976 | 1407 | 2.82 | Class 3 |
| | | | 974 | 1363 | 2.18 | Class 3 |
| | | T2 | 859 | 1374 | 3.78 | Class 3 |
| | | T3 | 1111 | 1406 | 1.73 | Class 3 |
| | D | T1 | 857 | 1162 | 1.31 | Class 3 |
| | | T2 | 847 | 1416 | 7.53 | Class 3 |
| | | | 861 | 1423 | 1.32 | Class 3 |
| | | T3 | 904 | 1407 | 4.72 | Class 3 |
| | | | 954 | 1392 | 2.52 | Class 3 |
| | | | 998 | 1393 | 2.93 | Class 3 |
| Alloy 12 | B | T1 | 825 | 1415 | 6.42 | Class 3 |
| | | | 897 | 1445 | 5.42 | Class 3 |
| | | | 883 | 1436 | 4.29 | Class 3 |

TABLE 10-continued

Summary on Tensile Test Results for Cast Plates after HIP Cycle and Heat Treatment

| Alloy | HIP Cycle | Heat Treatment | Yield Stress (MPa) | Ultimate Strength (MPa) | Tensile Elongation (%) | Curve Type |
|---|---|---|---|---|---|---|
| | | T2 | 841 | 1401 | 6.07 | Class 3 |
| | | | 864 | 1376 | 7.15 | Class 3 |
| | | T3 | 1025 | 1428 | 2.70 | Class 3 |
| | | | 1039 | 1390 | 2.32 | Class 3 |
| | | | 1037 | 1492 | 4.78 | Class 3 |
| | D | T1 | 944 | 1386 | 7.44 | Class 3 |
| | | | 940 | 1345 | 3.76 | Class 3 |
| | | T2 | 850 | 1352 | 6.34 | Class 3 |
| | | T3 | 821 | 1426 | 3.06 | Class 3 |
| | | | 1072 | 1469 | 6.71 | Class 3 |
| Alloy 13 | B | T1 | 836 | 1413 | 6.12 | Class 3 |
| | | | 814 | 1361 | 3.21 | Class 3 |
| | | | 853 | 1392 | 6.53 | Class 3 |
| | | T2 | 790 | 1314 | 7.11 | Class 3 |
| | | | 807 | 1361 | 7.61 | Class 3 |
| | | | 785 | 1085 | 1.76 | Class 3 |
| | | T3 | 1028 | 1361 | 2.26 | Class 3 |
| | | | 1073 | 1404 | 1.75 | Class 3 |
| | | | 881 | 1494 | 6.12 | Class 3 |
| | D | T1 | 998 | 1320 | 8.81 | Class 3 |
| | | | 749 | 1310 | 11.55 | Class 3 |
| | | T2 | 807 | 1316 | 7.38 | Class 3 |
| | | T3 | 896 | 1312 | 11.68 | Class 3 |
| Alloy 14 | B | T1 | 1041 | 1540 | 7.58 | Class 3 |
| | | | 935 | 1474 | 2.99 | Class 3 |
| | | T2 | 810 | 1573 | 7.78 | Class 3 |
| | | | 614 | 1585 | 5.66 | Class 3 |
| | | | 911 | 1391 | 2.65 | Class 3 |
| | | T3 | 1130 | 1516 | 3.29 | Class 3 |
| | | | 1365 | 1469 | 4.04 | Class 3 |
| | | | 1088 | 1475 | 6.52 | Class 3 |
| | D | T1 | 982 | 1542 | 7.03 | Class 3 |
| | | | 994 | 1550 | 3.98 | Class 3 |
| | | T2 | 605 | 1323 | 2.40 | Class 3 |
| | | | 901 | 1575 | 7.36 | Class 3 |
| | | T3 | 1023 | 1489 | 5.16 | Class 3 |
| | | | 1150 | 1496 | 5.96 | Class 3 |
| | | | 1060 | 1477 | 4.66 | Class 3 |
| Alloy 15 | B | T1 | 945 | 1521 | 7.81 | Class 3 |
| | | T2 | 873 | 1527 | 4.65 | Class 3 |
| | | | 850 | 1408 | 2.65 | Class 3 |
| | | | 910 | 1445 | 2.69 | Class 3 |
| | | T3 | 1068 | 1471 | 2.51 | Class 3 |
| | | | 1082 | 1495 | 8.37 | Class 3 |
| Alloy 16 | B | T1 | 930 | 1605 | 7.02 | Class 3 |
| | | | 717 | 1526 | 3.60 | Class 3 |
| | | T2 | 756 | 1571 | 6.19 | Class 3 |
| | | | 710 | 1495 | 3.61 | Class 3 |
| | | | 828 | 1346 | 2.52 | Class 3 |
| | | T3 | 1096 | 1559 | 3.27 | Class 3 |
| | | | 1076 | 1508 | 2.10 | Class 3 |
| Alloy 17 | B | T1 | 981 | 1584 | 3.57 | Class 3 |
| | | | 994 | 1614 | 9.33 | Class 3 |
| | | | 898 | 1578 | 2.92 | Class 3 |
| | | T2 | 497 | 1443 | 4.54 | Class 3 |
| | | | 515 | 1464 | 4.96 | Class 3 |
| | | | 528 | 1393 | 2.64 | Class 3 |
| | | T3 | 959 | 1450 | 2.65 | Class 3 |
| | | | 1021 | 1451 | 3.43 | Class 3 |
| | D | T1 | 842 | 1539 | 6.55 | Class 3 |
| | | | 929 | 1559 | 5.21 | Class 3 |
| | | T2 | 735 | 1555 | 3.03 | Class 3 |
| | | | 484 | 1331 | 3.53 | Class 3 |
| | | T3 | 964 | 1445 | 10.51 | Class 3 |
| | | | 924 | 1475 | 3.48 | Class 3 |
| | A | T1 | 820 | 1549 | 3.14 | Class 3 |
| | | T2 | 932 | 1564 | 4.14 | Class 3 |
| | | T3 | 1004 | 1384 | 2.07 | Class 3 |
| Alloy 18 | B | T1 | 907 | 1576 | 7.46 | Class 3 |
| | | | 884 | 1550 | 5.46 | Class 3 |
| | | T2 | 546 | 1621 | 7.31 | Class 3 |
| | | | 463 | 1479 | 3.91 | Class 3 |
| | | T3 | 1019 | 1471 | 3.76 | Class 3 |

TABLE 10-continued

Summary on Tensile Test Results for Cast Plates after HIP Cycle and Heat Treatment

| Alloy | HIP Cycle | Heat Treatment | Yield Stress (MPa) | Ultimate Strength (MPa) | Tensile Elongation (%) | Curve Type |
|---|---|---|---|---|---|---|
| | | | 901 | 1459 | 3.61 | Class 3 |
| | | | 939 | 1345 | 2.09 | Class 3 |
| | D | T1 | 866 | 1479 | 8.56 | Class 3 |
| | | | 795 | 1510 | 4.66 | Class 3 |
| | | T2 | 558 | 1585 | 4.74 | Class 3 |
| | | | 495 | 1581 | 6.93 | Class 3 |
| | | | 468 | 1518 | 6.82 | Class 3 |
| | | T3 | 919 | 1401 | 7.70 | Class 3 |
| | | | 892 | 1409 | 6.12 | Class 3 |
| | A | T1 | 598 | 1582 | 4.40 | Class 3 |
| | | T2 | 604 | 1595 | 4.95 | Class 3 |
| | | | 614 | 1546 | 3.46 | Class 3 |
| | | T3 | 944 | 1496 | 7.03 | Class 3 |
| | | | 882 | 1516 | 5.49 | Class 3 |
| | | | 992 | 1456 | 6.25 | Class 3 |
| Alloy 19 | B | T1 | 905 | 1416 | 1.89 | Class 3 |
| | | T2 | 608 | 1213 | 3.70 | Class 2 |
| | | T3 | 963 | 1397 | 2.61 | Class 3 |
| | | | 964 | 1407 | 4.63 | Class 3 |
| | | | 915 | 1438 | 7.30 | Class 3 |
| | D | T1 | 1460 | 1578 | 4.20 | Class 3 |
| | | | 918 | 1503 | 3.58 | Class 3 |
| | | T3 | 821 | 1482 | 7.81 | Class 3 |
| | | | 932 | 1489 | 10.81 | Class 3 |
| | | | 493 | 1495 | 7.53 | Class 3 |
| | A | T1 | 1000 | 1345 | 1.39 | Class 3 |
| | | | 944 | 1548 | 2.16 | Class 3 |
| | | T3 | 990 | 1501 | 8.83 | Class 3 |
| | | | 879 | 1434 | 2.56 | Class 3 |
| Alloy 20 | B | T1 | 956 | 1749 | 3.25 | Class 3 |
| | | | 1120 | 1613 | 4.59 | Class 3 |
| | | T2 | 762 | 1617 | 7.06 | Class 3 |
| | | T3 | 1065 | 1533 | 3.40 | Class 3 |
| | | | 988 | 1525 | 6.18 | Class 3 |
| | D | T1 | 889 | 1637 | 2.80 | Class 3 |
| | | | 833 | 1571 | 3.49 | Class 3 |
| | | | 834 | 1538 | 2.30 | Class 3 |
| | | T2 | 982 | 1449 | 7.19 | Class 2 |
| | | | 823 | 1479 | 7.19 | Class 2 |
| | | | 801 | 1387 | 5.65 | Class 2 |
| | | T3 | 1065 | 1553 | 7.43 | Class 3 |
| | | | 850 | 1642 | 4.34 | Class 3 |
| | | | 1145 | 1565 | 4.39 | Class 3 |
| | A | T1 | 1072 | 1596 | 4.03 | Class 3 |
| | | T2 | 756 | 1334 | 3.22 | Class 3 |
| | | T3 | 774 | 1436 | 2.68 | Class 3 |
| Alloy 21 | B | T1 | 886 | 1604 | 2.57 | Class 3 |
| | | | 956 | 1648 | 3.31 | Class 3 |
| | | T2 | 638 | 1481 | 4.12 | Class 3 |
| | | | 625 | 1694 | 6.27 | Class 3 |
| | | | 618 | 1608 | 5.12 | Class 3 |
| | | T3 | 747 | 1540 | 7.05 | Class 3 |
| | | | 1043 | 1615 | 3.12 | Class 3 |
| | | | 1106 | 1562 | 2.55 | Class 3 |
| | D | T1 | 831 | 1638 | 4.90 | Class 3 |
| | | | 778 | 1580 | 5.47 | Class 3 |
| | | | 924 | 1657 | 5.84 | Class 3 |
| | | T2 | 701 | 1280 | 3.96 | Class 3 |
| | | | 694 | 1614 | 8.93 | Class 3 |
| | | T3 | 1063 | 1507 | 6.56 | Class 3 |
| | | | 1105 | 1482 | 6.18 | Class 3 |
| | | | 1135 | 1499 | 6.82 | Class 3 |
| | A | T1 | 884 | 1548 | 2.43 | Class 3 |
| | | | 753 | 1531 | 2.60 | Class 3 |
| | | T2 | 830 | 1576 | 7.41 | Class 2 |
| | | | 730 | 1570 | 7.41 | Class 2 |
| | | | 915 | 1437 | 5.85 | Class 2 |
| Alloy 22 | B | T1 | 865 | 1601 | 4.46 | Class 3 |
| | | | 795 | 1450 | 2.54 | Class 3 |
| | | T3 | 844 | 1528 | 5.26 | Class 3 |
| | D | T1 | 806 | 1501 | 4.14 | Class 3 |
| | | | 840 | 1521 | 7.91 | Class 3 |
| | | | 850 | 1534 | 12.10 | Class 3 |

TABLE 10-continued

Summary on Tensile Test Results for Cast Plates after HIP Cycle and Heat Treatment

| Alloy | HIP Cycle | Heat Treatment | Yield Stress (MPa) | Ultimate Strength (MPa) | Tensile Elongation (%) | Curve Type |
|---|---|---|---|---|---|---|
| | | T2 | 650 | 1541 | 13.94 | Class 2 |
| | | | 799 | 1590 | 14.81 | Class 2 |
| | | T3 | 989 | 1423 | 9.84 | Class 3 |
| | | | 890 | 1457 | 7.68 | Class 3 |
| | | | 863 | 1445 | 6.90 | Class 3 |
| | A | T1 | 879 | 1593 | 5.18 | Class 3 |
| | | | 887 | 1598 | 5.65 | Class 3 |
| | | T2 | 655 | 1534 | 8.09 | Class 2 |
| | | | 668 | 1544 | 7.28 | Class 2 |
| | | | 751 | 1540 | 8.08 | Class 2 |
| | | T3 | 1100 | 1489 | 5.61 | Class 3 |
| | | | 696 | 1441 | 6.12 | Class 3 |
| Alloy 23 | B | T1 | 715 | 1641 | 3.36 | Class 3 |
| | | | 631 | 1577 | 3.38 | Class 3 |
| | | T3 | 1082 | 1528 | 3.72 | Class 3 |
| | | | 1004 | 1474 | 2.07 | Class 3 |
| | | | 729 | 1004 | 0.50 | Class 3 |
| | | | 934 | 1507 | 2.36 | Class 3 |
| | D | T1 | 1169 | 1557 | 6.54 | Class 3 |
| | | | 900 | 1587 | 9.62 | Class 3 |
| | | | 841 | 1550 | 7.96 | Class 3 |
| | | T2 | 894 | 1384 | 6.06 | Class 3 |
| | | | 1043 | 1369 | 3.90 | Class 3 |
| | | T3 | 949 | 1489 | 9.74 | Class 3 |
| | | | 1087 | 1398 | 2.01 | Class 3 |
| | A | T1 | 809 | 1573 | 3.03 | Class 3 |
| | | | 769 | 1488 | 2.42 | Class 3 |
| | | T2 | 1253 | 1591 | 4.89 | Class 3 |
| | | T3 | 991 | 1571 | 6.76 | Class 3 |
| Alloy 24 | B | T1 | 828 | 1564 | 2.22 | Class 3 |
| | | | 931 | 1584 | 2.20 | Class 3 |
| | | | 903 | 1541 | 1.51 | Class 3 |
| | | T2 | 1048 | 1478 | 4.07 | Class 3 |
| | | T3 | 1062 | 1647 | 3.50 | Class 3 |
| | | | 1008 | 1659 | 5.42 | Class 3 |
| | D | T1 | 952 | 1447 | 1.78 | Class 3 |
| | | | 859 | 1366 | 1.56 | Class 3 |
| | | | 1004 | 1717 | 3.68 | Class 3 |
| | | T2 | 1124 | 1454 | 4.04 | Class 3 |
| | | | 990 | 1356 | 3.40 | Class 3 |
| | | T3 | 1017 | 1506 | 3.63 | Class 3 |
| | | | 1102 | 1563 | 4.22 | Class 3 |
| | | | 504 | 1613 | 7.86 | Class 3 |
| | | | 1191 | 1646 | 2.29 | Class 3 |
| | | | 873 | 1436 | 1.80 | Class 3 |
| | A | T1 | 1000 | 1630 | 5.49 | Class 3 |
| | | | 1181 | 1302 | 1.17 | Class 3 |
| | | | 1079 | 1634 | 3.79 | Class 3 |
| | | T2 | 1000 | 1226 | 1.30 | Class 3 |
| | | T3 | 1187 | 1555 | 2.73 | Class 3 |
| Alloy 25 | B | T3 | 1150 | 1487 | 4.49 | Class 3 |
| | | | 1020 | 1501 | 5.77 | Class 3 |
| | | | 1116 | 1475 | 5.20 | Class 3 |
| | D | T1 | 501 | 1337 | 4.80 | Class 3 |
| | | | 500 | 1422 | 7.95 | Class 3 |
| | | T3 | 996 | 1380 | 9.51 | Class 3 |
| | | | 892 | 1393 | 6.04 | Class 3 |
| | | | 834 | 1375 | 7.82 | Class 3 |
| | A | T1 | 438 | 1414 | 4.72 | Class 3 |
| | | | 430.8 | 1358 | 4.04 | Class 3 |
| | | T3 | 1007 | 1485 | 3.00 | Class 3 |
| | | | 1069 | 1504 | 4.43 | Class 3 |
| | | | 938 | 1469 | 2.59 | Class 3 |
| Alloy 26 | B | T3 | 900 | 1437 | 7.82 | Class 3 |
| | | | 903 | 1435 | 5.92 | Class 3 |
| | | | 938 | 1410 | 4.39 | Class 3 |
| | D | T1 | 430 | 1256 | 5.65 | Class 2 |
| | | | 437 | 1436 | 7.45 | Class 2 |
| | | T3 | 755 | 1434 | 6.63 | Class 3 |
| | | | 747 | 1438 | 7.07 | Class 3 |
| | | | 718 | 1447 | 9.41 | Class 3 |

TABLE 10-continued

Summary on Tensile Test Results for Cast Plates after HIP Cycle and Heat Treatment

| Alloy | HIP Cycle | Heat Treatment | Yield Stress (MPa) | Ultimate Strength (MPa) | Tensile Elongation (%) | Curve Type |
|---|---|---|---|---|---|---|
| | A | T1 | 405 | 1267 | 5.42 | Class 2 |
| | | T3 | 738 | 1550 | 4.54 | Class 3 |
| | | | 501 | 1442 | 5.97 | Class 3 |
| Alloy 27 | B | T1 | 368 | 1388 | 11.40 | Class 2 |
| | | T2 | 409 | 1409 | 13.59 | Class 2 |
| | | | 411 | 1337 | 10.97 | Class 2 |
| | | T3 | 323 | 1346 | 14.11 | Class 2 |
| | | | 328 | 1350 | 14.16 | Class 2 |
| | | | 346 | 1363 | 13.06 | Class 2 |
| | D | T1 | 349 | 1396 | 14.40 | Class 2 |
| | | | 310 | 1390 | 12.62 | Class 2 |
| | | | 322 | 1395 | 16.87 | Class 2 |
| | | T2 | 370 | 1301 | 11.19 | Class 2 |
| | | T3 | 320 | 1370 | 11.51 | Class 2 |
| | | | 305 | 1366 | 11.25 | Class 2 |
| | A | T1 | 448 | 1351 | 9.03 | Class 2 |
| | | T3 | 381 | 1223 | 6.20 | Class 2 |
| Alloy 28 | B | T2 | 939 | 1313 | 2.41 | Class 3 |
| | | T3 | 877 | 1537 | 4.43 | Class 3 |
| | | | 799 | 1472 | 2.41 | Class 3 |
| | D | T3 | 797 | 1427 | 7.30 | Class 3 |
| | | | 893 | 1388 | 3.56 | Class 3 |
| | | | 975 | 1427 | 5.47 | Class 3 |
| | A | T1 | 744 | 1498 | 3.06 | Class 3 |
| Alloy 29 | B | T3 | 634 | 1322 | 2.56 | Class 3 |
| | | | 616 | 1464 | 5.33 | Class 3 |
| | | | 668 | 1444 | 3.89 | Class 3 |
| | D | T3 | 749 | 1464 | 9.00 | Class 3 |
| | | | 738 | 1489 | 6.85 | Class 3 |
| | A | T3 | 716 | 1590 | 9.02 | Class 3 |
| | | | 735 | 1490 | 7.79 | Class 3 |
| Alloy 30 | B | T2 | 381 | 1278 | 10.06 | Class 2 |
| | | | 390 | 1258 | 9.94 | Class 2 |
| | D | T1 | 339 | 1433 | 16.26 | Class 2 |
| | | T3 | 359 | 1394 | 13.77 | Class 2 |
| | | | 342 | 1385 | 13.39 | Class 2 |
| Alloy 31 | B | T1 | 829 | 1337 | 1.70 | Class 3 |
| | | | 663 | 1437 | 2.75 | Class 3 |
| | | T2 | 960 | 1315 | 2.26 | Class 3 |
| | | T3 | 950 | 1374 | 2.31 | Class 3 |
| | | | 989 | 1396 | 7.84 | Class 3 |
| | | | 991 | 1393 | 4.45 | Class 3 |
| | D | T1 | 850 | 1548 | 5.25 | Class 3 |
| | | T3 | 979 | 1339 | 1.75 | Class 3 |
| | | | 1080 | 1481 | 7.52 | Class 3 |
| | A | T1 | 841 | 1522 | 4.76 | Class 3 |
| | | | 807 | 1259 | 1.13 | Class 3 |
| | | | 724 | 1471 | 2.73 | Class 3 |
| | | T2 | 1215 | 1575 | 3.66 | Class 3 |
| | | T3 | 1041 | 1404 | 3.26 | Class 3 |
| | | | 1095 | 1382 | 2.63 | Class 3 |
| Alloy 32 | B | T1 | 660 | 1402 | 2.33 | Class 3 |
| | | | 644 | 1537 | 2.95 | Class 3 |
| | | | 630 | 1353 | 2.25 | Class 3 |
| | | T3 | 901 | 1440 | 7.54 | Class 3 |
| | | | 813 | 1498 | 7.53 | Class 3 |
| | | | 890 | 1448 | 6.41 | Class 3 |
| | D | T1 | 732 | 1428 | 4.93 | Class 3 |
| | | | 647 | 1441 | 4.34 | Class 3 |
| | | T3 | 939 | 1380 | 7.17 | Class 3 |
| | | | 980 | 1328 | 2.47 | Class 3 |
| | | | 924 | 1371 | 5.05 | Class 3 |
| | A | T1 | 718 | 1430 | 2.55 | Class 3 |
| | | | 780 | 1504 | 2.94 | Class 3 |
| | | T3 | 620 | 1488 | 6.48 | Class 3 |
| | | | 906 | 1464 | 3.79 | Class 3 |
| | | | 1073 | 1489 | 6.62 | Class 3 |
| Alloy 33 | B | T1 | 500 | 1425 | 5.34 | Class 3 |
| | | | 515 | 1451 | 7.27 | Class 3 |
| | D | T1 | 531 | 1429 | 7.60 | Class 3 |
| | | | 470 | 1445 | 8.54 | Class 3 |
| | | | 399 | 1418 | 7.44 | Class 3 |

TABLE 10-continued

Summary on Tensile Test Results for Cast Plates after HIP Cycle and Heat Treatment

| Alloy | HIP Cycle | Heat Treatment | Yield Stress (MPa) | Ultimate Strength (MPa) | Tensile Elongation (%) | Curve Type |
|---|---|---|---|---|---|---|
| | | T3 | 714 | 1347 | 4.64 | Class 3 |
| | | | 658 | 1361 | 5.78 | Class 3 |
| | | | 730 | 1325 | 9.48 | Class 3 |
| | A | T1 | 449 | 1395 | 3.87 | Class 3 |
| Alloy 34 | B | T1 | 379 | 1565 | 4.98 | Class 3 |
| | | | 548 | 1416 | 2.76 | Class 3 |
| | | | 742 | 1335 | 2.14 | Class 3 |
| | | | 692 | 1353 | 2.24 | Class 3 |
| | | T3 | 967 | 1453 | 5.03 | Class 3 |
| | | | 1000 | 1476 | 3.97 | Class 3 |
| | | | 1008 | 1455 | 3.05 | Class 3 |
| | D | T1 | 805 | 1541 | 5.33 | Class 3 |
| | | | 683 | 1463 | 3.24 | Class 3 |
| | | T2 | 1325 | 1446 | 1.48 | Class 3 |
| | | | 1300 | 1334 | 1.16 | Class 3 |
| | | | 1336 | 1404 | 1.12 | Class 3 |
| | | T3 | 1093 | 1376 | 2.45 | Class 3 |
| | | | 889 | 1437 | 3.11 | Class 3 |
| | | | 1162 | 1459 | 5.13 | Class 3 |
| | A | T1 | 1090 | 1451 | 2.41 | Class 3 |
| | | | 805 | 1471 | 2.61 | Class 3 |
| | | T2 | 1255 | 1425 | 1.17 | Class 3 |
| | | T3 | 1134 | 1505 | 6.03 | Class 3 |
| | | | 1137 | 1502 | 3.39 | Class 3 |
| | | | 1097 | 1493 | 2.71 | Class 3 |
| | | | 1251 | 1498 | 3.48 | Class 3 |
| Alloy 35 | B | T3 | 843 | 1349 | 3.00 | Class 3 |
| | | | 861 | 1388 | 3.84 | Class 3 |
| | D | T1 | 595 | 1550 | 6.67 | Class 3 |
| | | | 705 | 1526 | 6.39 | Class 3 |
| | | T2 | 1348 | 1500 | 1.58 | Class 3 |
| | | T3 | 952 | 1442 | 8.01 | Class 3 |
| | A | T1 | 528 | 1527 | 5.19 | Class 3 |
| | | | 657 | 1454 | 3.46 | Class 3 |
| | | T3 | 784 | 1343 | 1.98 | Class 3 |
| | | | 794 | 1466 | 4.75 | Class 3 |
| Alloy 36 | B | T1 | 432 | 1511 | 7.96 | Class 3 |
| | | | 379 | 1376 | 5.65 | Class 3 |
| | | T3 | 500 | 1481 | 6.11 | Class 3 |
| | | | 534 | 1432 | 5.65 | Class 3 |
| | D | T1 | 471 | 1409 | 4.43 | Class 3 |
| | | T2 | 824 | 1388 | 11.16 | Class 3 |
| | | | 743 | 1382 | 14.52 | Class 3 |
| | | T3 | 700 | 1353 | 9.77 | Class 3 |
| | | | 732 | 1380 | 10.98 | Class 3 |
| Alloy 37 | B | T1 | 379 | 1381 | 5.65 | Class 2 |
| | | | 373 | 1441 | 6.43 | Class 2 |
| | | T3 | 854 | 1488 | 3.71 | Class 3 |
| | | | 802 | 1481 | 6.77 | Class 3 |
| | | | 754 | 1461 | 4.88 | Class 3 |
| | D | T1 | 475 | 1469 | 8.73 | Class 3 |
| | | T3 | 950 | 1409 | 8.27 | Class 3 |
| | | | 920 | 1381 | 5.28 | Class 3 |
| Alloy 38 | B | T1 | 525 | 1436 | 8.23 | Class 2 |
| | | T3 | 526 | 1487 | 5.11 | Class 3 |
| | | | 563 | 1404 | 3.32 | Class 3 |
| | | | 471 | 1372 | 3.13 | Class 3 |
| | D | T1 | 346 | 1466 | 10.51 | Class 3 |
| | | | 344 | 1365 | 6.88 | Class 2 |
| | | T3 | 622 | 1497 | 7.31 | Class 3 |
| | | | 563 | 1490 | 6.23 | Class 3 |
| | | | 590 | 1420 | 3.58 | Class 3 |
| Alloy 39 | B | T3 | 1142 | 1450 | 3.20 | Class 3 |
| | D | T2 | 1041 | 1223 | 6.32 | Class 2 |
| | | T3 | 1025 | 1443 | 6.86 | Class 3 |
| | | | 1113 | 1453 | 6.09 | Class 3 |
| | | | 1067 | 1432 | 3.59 | Class 3 |
| Alloy 40 | B | T3 | 1420 | 1650 | 3.14 | Class 3 |
| | | | 1281 | 1532 | 2.02 | Class 3 |
| | D | T1 | 447 | 1419 | 6.60 | Class 3 |
| | | T2 | 1000 | 1214 | 5.73 | Class 2 |
| | | T3 | 1097 | 1421 | 3.80 | Class 3 |
| | | | 977 | 1405 | 2.57 | Class 3 |

TABLE 10-continued

Summary on Tensile Test Results for Cast Plates after HIP Cycle and Heat Treatment

| Alloy | HIP Cycle | Heat Treatment | Yield Stress (MPa) | Ultimate Strength (MPa) | Tensile Elongation (%) | Curve Type |
|---|---|---|---|---|---|---|
| Alloy 41 | B | T3 | 892 | 1348 | 2.02 | Class 3 |
| | | T3 | 1101 | 1401 | 3.30 | Class 3 |
| | | | 821 | 1320 | 3.00 | Class 3 |
| Alloy 42 | D | T1 | 772 | 1337 | 7.98 | Class 2 |
| | | T3 | 911 | 1474 | 4.63 | Class 3 |
| | | | 1193 | 1491 | 4.53 | Class 3 |
| Alloy 43 | B | T1 | 769 | 1387 | 8.20 | Class 2 |
| | | T3 | 1174 | 1549 | 4.49 | Class 3 |
| | | | 1038 | 1502 | 2.44 | Class 3 |
| | | | 1223 | 1549 | 5.71 | Class 3 |
| | D | T3 | 1104 | 1716 | 2.95 | Class 3 |
| Alloy 44 | B | T3 | 1067 | 1400 | 2.40 | Class 3 |
| | | | 939 | 1457 | 4.90 | Class 3 |
| Alloy 45 | B | T1 | 859 | 1231 | 6.21 | Class 2 |
| | | T3 | 941 | 1527 | 3.94 | Class 3 |
| | | | 961 | 1477 | 2.33 | Class 3 |
| | | | 945 | 1423 | 3.76 | Class 3 |
| | D | T1 | 773 | 1268 | 4.57 | Class 2 |
| | | T3 | 1011 | 1568 | 5.44 | Class 3 |
| | | | 968 | 1333 | 1.37 | Class 3 |
| | | | 1089 | 1528 | 4.12 | Class 3 |
| Alloy 46 | B | T3 | 1106 | 1549 | 3.15 | Class 3 |
| | | | 1004 | 1427 | 1.94 | Class 3 |
| | D | T1 | 652 | 1284 | 6.42 | Class 2 |
| | | | 630 | 1418 | 8.03 | Class 2 |
| | | T3 | 1135 | 1443 | 2.30 | Class 3 |
| | | | 1081 | 1497 | 3.46 | Class 3 |
| | | | 1221 | 1448 | 6.85 | Class 3 |
| Alloy 47 | B | T1 | 609 | 1398 | 5.74 | Class 2 |
| | | T3 | 1057 | 1394 | 3.31 | Class 3 |
| | | | 1124 | 1436 | 2.98 | Class 3 |
| | | | 1149 | 1445 | 4.41 | Class 3 |
| | D | T1 | 662 | 1323 | 4.28 | Class 3 |
| | | T3 | 1061 | 1443 | 1.93 | Class 3 |
| | | | 1156 | 1528 | 6.73 | Class 3 |
| | | | 1044 | 1538 | 3.27 | Class 3 |
| Alloy 48 | B | T1 | 504 | 1359 | 5.77 | Class 2 |
| | | | 469 | 1465 | 5.39 | Class 2 |
| | | T3 | 1035 | 1491 | 5.15 | Class 3 |
| | | | 1017 | 1489 | 5.95 | Class 3 |
| | | | 912 | 1482 | 4.82 | Class 3 |
| | | | 848 | 1507 | 6.04 | Class 3 |
| | D | T1 | 441 | 1484 | 4.44 | Class 3 |
| | | | 391 | 1428 | 4.60 | Class 3 |
| | | T3 | 947 | 1468 | 9.90 | Class 3 |
| | | | 890 | 1319 | 1.61 | Class 3 |
| | | | 970 | 1462 | 3.71 | Class 3 |
| Alloy 49 | B | T1 | 536 | 1444 | 8.54 | Class 2 |
| | | | 531 | 1366 | 6.99 | Class 2 |
| | | T3 | 703 | 1450 | 6.54 | Class 3 |
| | | | 622 | 1452 | 6.17 | Class 3 |
| | | T3 | 368 | 1552 | 4.68 | Class 3 |
| Alloy 50 | B | T3 | 486 | 1488 | 2.61 | Class 3 |
| | D | T3 | 847 | 1544 | 2.91 | Class 3 |
| | | | 842 | 1547 | 2.65 | Class 3 |
| Alloy 51 | B | T1 | 410 | 1296 | 15.50 | Class 2 |
| | | | 363 | 1275 | 13.10 | Class 2 |
| | | | 369 | 1368 | 21.50 | Class 2 |
| | | | 368 | 1367 | 18.10 | Class 2 |
| | | | 336 | 1232 | 12.90 | Class 2 |
| | | T2 | 437 | 1244 | 12.40 | Class 2 |
| | | T3 | 359 | 1361 | 22.90 | Class 2 |
| | | | 360 | 1317 | 14.10 | Class 2 |
| | D | T1 | 374 | 1367 | 16.70 | Class 2 |
| | | | 323 | 1383 | 18.50 | Class 2 |
| | | | 338 | 1394 | 19.00 | Class 2 |
| | | | 359 | 1331 | 16.10 | Class 2 |
| | | | 314 | 1302 | 15.00 | Class 2 |
| | | | 356 | 1409 | 22.70 | Class 2 |
| | | | 374 | 1266 | 14.60 | Class 2 |
| | | T2 | 336 | 1332 | 15.60 | Class 2 |
| | | | 376 | 1294 | 16.10 | Class 2 |
| | | | 428 | 1215 | 16.10 | Class 2 |

TABLE 10-continued

Summary on Tensile Test Results for Cast Plates after HIP Cycle and Heat Treatment

| Alloy | HIP Cycle | Heat Treatment | Yield Stress (MPa) | Ultimate Strength (MPa) | Tensile Elongation (%) | Curve Type |
|---|---|---|---|---|---|---|
| | | | 361 | 1294 | 16.10 | Class 2 |
| | | T3 | 372 | 1207 | 14.10 | Class 2 |
| | | | 346 | 1356 | 18.60 | Class 2 |
| | | | 337 | 1343 | 20.40 | Class 2 |
| | | | 323 | 1311 | 18.80 | Class 2 |
| | | | 330 | 1217 | 15.00 | Class 2 |
| Alloy 52 | B | T1 | 393 | 1390 | 15.10 | Class 2 |
| | | | 406 | 1373 | 12.90 | Class 2 |
| | | | 376 | 1418 | 9.80 | Class 2 |
| | | | 400 | 1382 | 11.10 | Class 2 |
| | | | 380 | 1264 | 8.20 | Class 2 |
| | | | 388 | 1298 | 8.80 | Class 2 |
| | | T3 | 373 | 1345 | 11.70 | Class 2 |
| | | | 359 | 1326 | 10.80 | Class 2 |
| | | | 307 | 1372 | 15.10 | Class 2 |
| | | | 364 | 1387 | 14.40 | Class 2 |
| | D | T1 | 375 | 1489 | 9.60 | Class 2 |
| | | | 443 | 1475 | 13.00 | Class 2 |
| | | | 353 | 1427 | 11.40 | Class 2 |
| | | | 394 | 1441 | 16.50 | Class 2 |
| | | | 356 | 1473 | 13.00 | Class 2 |
| | | T2 | 345 | 1378 | 17.90 | Class 2 |
| | | | 333 | 1372 | 19.60 | Class 2 |
| | | | 324 | 1359 | 9.90 | Class 2 |
| | | | 428 | 1222 | 9.40 | Class 2 |
| | | T3 | 328 | 1289 | 10.10 | Class 2 |
| | | | 365 | 1409 | 14.20 | Class 2 |
| Alloy 53 | B | T1 | 749 | 1360 | 2.00 | Class 3 |
| | | | 775 | 1406 | 2.20 | Class 3 |
| | | T2 | 1275 | 1353 | 1.40 | Class 3 |
| | | | 1299 | 1322 | 1.10 | Class 3 |
| | | T3 | 1027 | 1479 | 3.40 | Class 3 |
| | | | 1190 | 1480 | 6.70 | Class 3 |
| | | | 1057 | 1505 | 8.60 | Class 3 |
| | D | T1 | 733 | 1460 | 4.20 | Class 3 |
| | | | 705 | 1418 | 4.90 | Class 3 |
| | | | 472 | 1465 | 3.80 | Class 3 |
| | | | 752 | 1523 | 6.00 | Class 3 |
| | | | 798 | 1431 | 3.30 | Class 3 |
| | | T2 | 1189 | 1310 | 1.10 | Class 3 |
| | | | 1252 | 1363 | 1.80 | Class 3 |
| | | T3 | 511 | 1411 | 6.10 | Class 3 |
| | | | 743 | 1418 | 8.40 | Class 3 |
| | | | 1283 | 1418 | 9.60 | Class 3 |
| | | | 1007 | 1419 | 6.80 | Class 3 |
| | | | 1006 | 1426 | 5.30 | Class 3 |
| Alloy 54 | B | T1 | 678 | 1436 | 2.40 | Class 3 |
| | | | 698 | 1464 | 2.70 | Class 3 |
| | | | 866 | 1494 | 3.80 | Class 3 |
| | | | 900 | 1480 | 5.50 | Class 3 |
| | | T3 | 962 | 1438 | 4.00 | Class 3 |
| | | | 1015 | 1434 | 6.70 | Class 3 |
| | | | 881 | 1433 | 6.50 | Class 3 |
| | | | 1094 | 1474 | 7.40 | Class 3 |
| | D | T1 | 763 | 1504 | 4.40 | Class 3 |
| | | | 743 | 1500 | 4.30 | Class 3 |
| | | | 791 | 1444 | 3.70 | Class 3 |
| | | | 730 | 1456 | 4.00 | Class 3 |
| | | T3 | 1057 | 1419 | 4.90 | Class 3 |
| | | | 1003 | 1419 | 2.90 | Class 3 |
| | | | 1229 | 1427 | 10.10 | Class 3 |
| | | | 933 | 1432 | 8.80 | Class 3 |
| Alloy 55 | B | T3 | 1105 | 1428 | 8.10 | Class 3 |
| | | | 826 | 1372 | 1.70 | Class 3 |
| | | | 844 | 1438 | 7.80 | Class 3 |
| | | | 1005 | 1409 | 9.70 | Class 3 |
| | | | 1060 | 1411 | 8.40 | Class 3 |
| | D | T1 | 786 | 1345 | 2.60 | Class 3 |
| | | T3 | 966 | 1354 | 8.90 | Class 3 |
| | | | 1071 | 1411 | 3.20 | Class 3 |
| | | | 1033 | 1372 | 8.70 | Class 3 |
| | | | 1013 | 1383 | 5.30 | Class 3 |
| | | | 857 | 1396 | 3.60 | Class 3 |

TABLE 10-continued

Summary on Tensile Test Results for Cast Plates after HIP Cycle and Heat Treatment

| Alloy | HIP Cycle | Heat Treatment | Yield Stress (MPa) | Ultimate Strength (MPa) | Tensile Elongation (%) | Curve Type |
|---|---|---|---|---|---|---|
| Alloy 56 | B | T1 | 742 | 1514 | 5.30 | Class 3 |
| | | | 734 | 1497 | 4.60 | Class 3 |
| | | | 695 | 1414 | 2.50 | Class 3 |
| | | T2 | 1040 | 1506 | 5.30 | Class 3 |
| | | T3 | 1049 | 1425 | 2.80 | Class 3 |
| | D | T1 | 668 | 1414 | 4.60 | Class 3 |
| | | | 687 | 1414 | 5.40 | Class 3 |
| | | | 677 | 1381 | 2.90 | Class 3 |
| | | T2 | 583 | 1331 | 3.60 | Class 3 |
| | | T3 | 952 | 1369 | 5.70 | Class 3 |
| | | | 1095 | 1368 | 8.50 | Class 3 |
| | | | 977 | 1360 | 6.60 | Class 3 |
| Alloy 57 | B | T1 | 606 | 1478 | 3.80 | Class 3 |
| | | T3 | 1117 | 1485 | 3.70 | Class 3 |
| | | | 994 | 1467 | 3.30 | Class 3 |
| | | | 1052 | 1368 | 1.80 | Class 3 |
| | | | 1127 | 1487 | 4.10 | Class 3 |
| | D | T1 | 550 | 1345 | 2.80 | Class 3 |
| | | | 627 | 1470 | 4.10 | Class 3 |
| | | T3 | 958 | 1441 | 3.90 | Class 3 |
| | | | 1043 | 1448 | 8.50 | Class 3 |
| | | | 1013 | 1423 | 7.10 | Class 3 |
| Alloy 58 | B | T1 | 540 | 1407 | 6.60 | Class 2 |
| | | | 493 | 1333 | 6.10 | Class 2 |
| | | T3 | 592 | 1538 | 4.70 | Class 3 |
| | | | 602 | 1545 | 8.00 | Class 3 |
| | D | T1 | 371 | 1373 | 6.20 | Class 2 |
| | | | 368 | 1400 | 6.60 | Class 2 |
| | | | 398 | 1452 | 7.50 | Class 2 |
| | | T3 | 622 | 1351 | 6.30 | Class 3 |
| | | | 584 | 1394 | 6.90 | Class 3 |
| | | | 563 | 1388 | 8.70 | Class 3 |
| Alloy 59 | B | T1 | 402 | 1354 | 5.70 | Class 2 |
| | | | 398 | 1395 | 5.10 | Class 2 |
| | | | 396 | 1260 | 6.10 | Class 2 |
| | D | T1 | 342 | 1448 | 6.40 | Class 2 |
| | | | 342 | 1331 | 5.80 | Class 2 |
| | | T3 | 727 | 1356 | 4.70 | Class 3 |
| | | | 733 | 1386 | 10.40 | Class 3 |
| | | | 665 | 1394 | 3.70 | Class 3 |
| | | | 700 | 1419 | 5.80 | Class 3 |
| Alloy 60 | B | T1 | 391 | 1322 | 6.00 | Class 2 |
| | | | 372 | 1253 | 6.10 | Class 2 |
| | | | 433 | 1353 | 5.90 | Class 2 |
| | | T3 | 748 | 1362 | 6.80 | Class 3 |
| | | | 816 | 1352 | 4.50 | Class 3 |
| | | | 631 | 1450 | 3.40 | Class 3 |
| | D | T1 | 561 | 1393 | 5.50 | Class 3 |
| | | T3 | 686 | 1317 | 9.70 | Class 3 |
| Alloy 61 | B | T1 | 369 | 1372 | 16.20 | Class 2 |
| | | T2 | 353 | 1260 | 11.70 | Class 2 |
| | | | 374 | 1220 | 11.10 | Class 2 |
| | D | T1 | 323 | 1207 | 12.50 | Class 2 |
| | | | 327 | 1265 | 13.60 | Class 2 |
| | | T2 | 313 | 1219 | 11.80 | Class 2 |
| | | | 342 | 1313 | 15.60 | Class 2 |
| | | | 328 | 1328 | 16.80 | Class 2 |
| | | T3 | 334 | 1351 | 18.20 | Class 2 |
| | | | 325 | 1203 | 11.20 | Class 2 |
| | | | 328 | 1260 | 12.40 | Class 2 |
| Alloy 62 | B | T1 | 326 | 1266 | 10.10 | Class 2 |
| | | | 368 | 1333 | 14.40 | Class 2 |
| | | T2 | 398 | 1296 | 13.10 | Class 2 |
| | | | 377 | 1346 | 13.20 | Class 2 |
| | | | 345 | 1290 | 11.80 | Class 2 |
| | | T3 | 342 | 1321 | 12.50 | Class 2 |
| | | | 313 | 1332 | 13.30 | Class 2 |
| | | | 320 | 1311 | 12.50 | Class 2 |
| | D | T1 | 309 | 1357 | 14.50 | Class 2 |
| | | | 316 | 1329 | 16.70 | Class 2 |
| | | T2 | 314 | 1318 | 14.40 | Class 2 |
| | | | 322 | 1319 | 17.20 | Class 2 |
| | | | 305 | 1321 | 14.40 | Class 2 |

TABLE 10-continued

Summary on Tensile Test Results for Cast Plates after HIP Cycle and Heat Treatment

| Alloy | HIP Cycle | Heat Treatment | Yield Stress (MPa) | Ultimate Strength (MPa) | Tensile Elongation (%) | Curve Type |
|---|---|---|---|---|---|---|
| | | T3 | 272 | 1340 | 19.70 | Class 2 |
| | | | 308 | 1342 | 16.80 | Class 2 |
| | | | 318 | 1342 | 14.00 | Class 2 |
| Alloy 63 | B | T1 | 317 | 1321 | 16.90 | Class 2 |
| | | | 321 | 1217 | 9.10 | Class 2 |
| | | | 317 | 1328 | 15.30 | Class 2 |
| | | T3 | 318 | 1310 | 14.40 | Class 2 |
| | | | 312 | 1316 | 15.30 | Class 2 |
| | D | T1 | 312 | 1363 | 15.50 | Class 2 |
| | | | 302 | 1293 | 10.80 | Class 2 |
| | | | 287 | 1355 | 16.30 | Class 2 |
| | | T2 | 368 | 1217 | 9.80 | Class 2 |
| | | | 344 | 1283 | 10.70 | Class 2 |
| | | T3 | 292 | 1365 | 10.90 | Class 2 |
| | | | 270 | 1317 | 14.10 | Class 2 |
| Alloy 64 | B | T1 | 375 | 1338 | 17.60 | Class 2 |
| | | | 387 | 1336 | 18.80 | Class 2 |
| | | | 388 | 1256 | 13.80 | Class 2 |
| | | T2 | 390 | 1336 | 17.30 | Class 2 |
| | | | 368 | 1312 | 14.70 | Class 2 |
| | | | 390 | 1324 | 16.20 | Class 2 |
| | D | T1 | 359 | 1226 | 14.40 | Class 2 |
| | | T2 | 369 | 1297 | 14.70 | Class 2 |
| | | T3 | 386 | 1324 | 25.50 | Class 2 |
| | | | 347 | 1321 | 25.20 | Class 2 |
| | | | 363 | 1322 | 23.50 | Class 2 |
| Alloy 65 | B | T2 | 395 | 1240 | 14.80 | Class 2 |
| | | | 389 | 1253 | 14.40 | Class 2 |
| | | | 403 | 1302 | 16.20 | Class 2 |
| | | T3 | 394 | 1246 | 15.10 | Class 2 |
| | | | 403 | 1275 | 15.30 | Class 2 |
| | D | T1 | 341 | 1263 | 14.60 | Class 2 |
| | | | 313 | 1308 | 18.20 | Class 2 |
| | | | 322 | 1322 | 19.00 | Class 2 |
| | | T2 | 338 | 1347 | 19.20 | Class 2 |
| | | | 344 | 1295 | 15.30 | Class 2 |
| | | | 323 | 1287 | 15.70 | Class 2 |
| | | | 338 | 1321 | 19.70 | Class 2 |
| | | T3 | 313 | 1290 | 20.00 | Class 2 |
| | | | 340 | 1247 | 14.40 | Class 2 |
| | | | 337 | 1307 | 23.50 | Class 2 |
| | | | 329 | 1300 | 17.70 | Class 2 |
| Alloy 66 | B | T1 | 358 | 1371 | 21.50 | Class 2 |
| | | T2 | 349 | 1263 | 12.00 | Class 2 |
| | | T3 | 348 | 1297 | 16.00 | Class 2 |
| | | | 322 | 1275 | 15.00 | Class 2 |
| | D | T1 | 300 | 1254 | 15.80 | Class 2 |
| | | | 303 | 1288 | 18.80 | Class 2 |
| | | T2 | 314 | 1244 | 14.70 | Class 2 |
| | | | 317 | 1311 | 17.30 | Class 2 |
| | | T3 | 295 | 1265 | 15.80 | Class 2 |
| | | | 287 | 1215 | 18.60 | Class 2 |
| Alloy 67 | B | T2 | 362 | 1323 | 12.10 | Class 2 |
| | | | 386 | 1245 | 11.30 | Class 2 |
| | D | T1 | 355 | 1291 | 13.60 | Class 2 |
| | | | 365 | 1390 | 17.90 | Class 2 |
| | | T2 | 356 | 1407 | 17.50 | Class 2 |
| | | | 368 | 1235 | 12.40 | Class 2 |
| | | | 342 | 1413 | 16.40 | Class 2 |
| | | | 350 | 1398 | 15.60 | Class 2 |
| Alloy 68 | B | T3 | 342 | 1370 | 20.40 | Class 2 |
| | | | 326 | 1245 | 12.60 | Class 2 |
| | | | 345 | 1263 | 13.40 | Class 2 |
| | | T2 | 364 | 1205 | 11.30 | Class 2 |
| | | T3 | 351 | 1403 | 18.10 | Class 2 |
| | | | 359 | 1261 | 12.10 | Class 2 |
| | D | T1 | 326 | 1359 | 14.50 | Class 2 |
| | | | 334 | 1387 | 22.20 | Class 2 |
| | | | 326 | 1375 | 19.60 | Class 2 |
| | | | 314 | 1306 | 12.70 | Class 2 |
| | | T2 | 313 | 1366 | 16.20 | Class 2 |
| | | | 308 | 1376 | 16.90 | Class 2 |
| | | | 329 | 1383 | 19.90 | Class 2 |

TABLE 10-continued

Summary on Tensile Test Results for Cast Plates after HIP Cycle and Heat Treatment

| Alloy | HIP Cycle | Heat Treatment | Yield Stress (MPa) | Ultimate Strength (MPa) | Tensile Elongation (%) | Curve Type |
|---|---|---|---|---|---|---|
| | | T3 | 327 | 1397 | 15.50 | Class 2 |
| | | | 342 | 1399 | 16.40 | Class 2 |
| | | | 302 | 1333 | 21.50 | Class 2 |
| | | | 306 | 1369 | 21.00 | Class 2 |
| Alloy 69 | B | T1 | 324 | 1367 | 17.00 | Class 2 |
| | | | 330 | 1370 | 18.00 | Class 2 |
| | | T2 | 317 | 1379 | 16.60 | Class 2 |
| | | | 322 | 1371 | 16.10 | Class 2 |
| | | T3 | 300 | 1332 | 17.00 | Class 2 |
| | | | 334 | 1357 | 19.90 | Class 2 |
| | D | T1 | 318 | 1385 | 14.30 | Class 2 |
| | | T2 | 345 | 1277 | 10.10 | Class 2 |
| | | T3 | 302 | 1381 | 16.00 | Class 2 |
| | | | 309 | 1338 | 11.80 | Class 2 |
| | | | 314 | 1381 | 18.70 | Class 2 |
| Alloy 70 | B | T1 | 370 | 1290 | 13.50 | Class 2 |
| | | | 367 | 1328 | 13.50 | Class 2 |
| | | T2 | 379 | 1370 | 21.50 | Class 2 |
| | | T3 | 348 | 1338 | 15.30 | Class 2 |
| | | | 392 | 1375 | 15.10 | Class 2 |
| | D | T1 | 345 | 1368 | 16.70 | Class 2 |
| | | | 375 | 1366 | 17.40 | Class 2 |
| | | T2 | 370 | 1225 | 12.10 | Class 2 |
| | | | 353 | 1267 | 11.80 | Class 2 |
| | | | 343 | 1247 | 12.40 | Class 2 |
| | | T3 | 363 | 1334 | 16.50 | Class 2 |
| | | | 361 | 1351 | 21.60 | Class 2 |
| | | | 333 | 1286 | 14.00 | Class 2 |
| Alloy 71 | B | T3 | 364 | 1364 | 18.00 | Class 2 |
| | D | T3 | 376 | 1404 | 19.20 | Class 2 |
| Alloy 72 | B | T2 | 445 | 917 | 13.43 | Class 2 |
| | | | 487 | 1117 | 21.05 | Class 2 |
| | | T3 | 456 | 875 | 10.30 | Class 2 |
| | | | 449 | 1057 | 19.24 | Class 2 |
| | | | 436 | 894 | 13.47 | Class 2 |
| | D | T2 | 390 | 934 | 15.50 | Class 2 |
| | | | 361 | 998 | 18.96 | Class 2 |
| | | T3 | 390 | 937 | 15.28 | Class 2 |
| | | | 388 | 1125 | 25.00 | Class 2 |
| | | T4 | 373 | 987 | 17.76 | Class 2 |
| Alloy 74 | B | T4 | 459 | 971 | 9.41 | Class 2 |
| Alloy 75 | B | T2 | 464 | 902 | 11.54 | Class 2 |
| | | T3 | 450 | 1051 | 14.37 | Class 2 |
| | | T4 | 449 | 1007 | 13.90 | Class 2 |
| | D | T2 | 400 | 1251 | 19.73 | Class 2 |
| | | | 413 | 1241 | 19.56 | Class 2 |
| | | | 374 | 1194 | 18.29 | Class 2 |
| | | | 384 | 1209 | 18.65 | Class 2 |
| | | T3 | 331 | 1042 | 16.08 | Class 2 |
| | | T4 | 415 | 933 | 13.29 | Class 2 |
| | | | 394 | 980 | 14.03 | Class 2 |
| Alloy 78 | B | T2 | 479 | 1004 | 9.20 | Class 2 |
| | | T3 | 461 | 1124 | 10.78 | Class 2 |
| | D | T2 | 362 | 1093 | 11.96 | Class 2 |
| | | | 360 | 1218 | 13.41 | Class 2 |
| | | T3 | 399 | 1362 | 15.43 | Class 2 |
| | | T4 | 394 | 1117 | 12.59 | Class 2 |
| | | | 409 | 1258 | 13.95 | Class 2 |
| | E | T2 | 387 | 1079 | 11.93 | Class 2 |
| | | | 404 | 1245 | 14.05 | Class 2 |
| | | T3 | 362 | 1055 | 12.13 | Class 2 |
| | | T4 | 374 | 962 | 11.03 | Class 2 |
| Alloy 79 | B | T2 | 505 | 922 | 7.88 | Class 2 |
| | | T3 | 510 | 1019 | 11.40 | Class 2 |
| | | T4 | 472 | 917 | 8.32 | Class 2 |
| | D | T3 | 420 | 1177 | 19.57 | Class 2 |
| | | T4 | 439 | 1160 | 19.47 | Class 2 |
| | | | 425 | 1171 | 21.24 | Class 2 |
| | | | 430 | 1235 | 23.39 | Class 2 |
| | E | T4 | 378 | 1132 | 20.86 | Class 2 |
| Alloy 81 | D | T2 | 399 | 1482 | 6.29 | Class 2 |
| | | T3 | 326 | 1340 | 8.92 | Class 2 |
| | | | 327 | 1424 | 9.41 | Class 2 |

TABLE 10-continued

Summary on Tensile Test Results for Cast Plates after HIP Cycle and Heat Treatment

| Alloy | HIP Cycle | Heat Treatment | Yield Stress (MPa) | Ultimate Strength (MPa) | Tensile Elongation (%) | Curve Type |
|---|---|---|---|---|---|---|
| | | T4 | 321 | 1559 | 15.07 | Class 2 |
| | | | 294 | 1339 | 6.13 | Class 2 |
| | | | 289 | 1479 | 7.02 | Class 2 |
| | E | T2 | 319 | 1355 | 5.51 | Class 2 |
| | | | 309 | 1551 | 10.95 | Class 2 |
| | | | 310 | 1528 | 10.60 | Class 2 |
| | | T3 | 329 | 1288 | 7.11 | Class 2 |
| | | | 326 | 1513 | 9.91 | Class 2 |
| | | T4 | 440 | 1430 | 6.38 | Class 2 |
| Alloy 82 | B | T2 | 455 | 948 | 7.15 | Class 2 |
| | | | 424 | 1054 | 8.54 | Class 2 |
| | | T3 | 445 | 1191 | 12.10 | Class 2 |
| | | T4 | 429 | 1047 | 8.86 | Class 2 |
| | D | T2 | 381 | 1123 | 9.70 | Class 2 |
| | | | 362 | 1083 | 10.01 | Class 2 |
| | | | 392 | 1241 | 12.78 | Class 2 |
| | | T3 | 387 | 948 | 8.24 | Class 2 |
| | | | 348 | 913 | 7.49 | Class 2 |
| | | | 372 | 1188 | 11.41 | Class 2 |
| | | T4 | 401 | 1193 | 12.18 | Class 2 |
| | E | T2 | 373 | 1091 | 11.24 | Class 2 |
| | | | 362 | 1085 | 11.00 | Class 2 |
| | | T3 | 413 | 1283 | 16.31 | Class 2 |
| | | | 402 | 1382 | 18.45 | Class 2 |
| | | T4 | 371 | 986 | 9.54 | Class 2 |
| | | | 431 | 1347 | 18.39 | Class 2 |
| Alloy 84 | B | T3 | 557 | 1544 | 4.31 | Class 3 |
| | D | T3 | 503 | 1642 | 7.76 | Class 3 |
| | | T4 | 503 | 1605 | 7.65 | Class 3 |
| | | | 576 | 1312 | 2.28 | Class 3 |
| | E | T2 | 779 | 1432 | 4.51 | Class 3 |
| | | T4 | 478 | 1543 | 4.54 | Class 3 |
| Alloy 85 | B | T3 | 450 | 1154 | 7.59 | Class 2 |
| | | | 431 | 1248 | 7.69 | Class 2 |
| | | T4 | 476 | 1185 | 9.07 | Class 2 |
| | D | T2 | 369 | 1094 | 8.47 | Class 2 |
| | | | 369 | 1230 | 10.39 | Class 2 |
| | E | T3 | 595 | 1038 | 5.67 | Class 2 |

Comparative Examples

Case Example #1

Tensile Properties Comparison with Existing Steel Grades

Tensile properties of selected alloy were compared with tensile properties of existing steel grades. The selected alloys and corresponding treatment parameters are listed in Table 11. Tensile stress-strain curves are compared to that of existing Dual Phase (DP) steels (FIG. 9); Complex Phase (CP) steels (FIG. 10); Transformation Induced Plasticity (TRIP) steels (FIG. 11); and Martensitic (MS) steels (FIG. 12). A Dual Phase Steel may be understood as a steel type consisting of a ferritic matrix containing hard martensitic second phases in the form of islands, a Complex Phase Steel may be understood as a steel type consisting of a matrix consisting of ferrite and bainite containing small amounts of martensite, retained austenite, and pearlite, a Transformation Induced Plasticity steel may be understood as a steel type which consists of austenite embedded in a ferrite matrix which additionally contains hard bainitic and martensitic second phases and a Martensitic steel may be understood as a steel type consisting of a martensitic matrix which may contain small amounts of ferrite and/or bainite. As it can be seen, the alloys claimed in this disclosure have superior properties as compared to existing advanced high strength (AHSS) steel grades.

TABLE 11

Downselected Representative Tensile Curves Labels and Identity

| Curve Label | Alloy | HIP | HT | Class of Behavior |
|---|---|---|---|---|
| A | Alloy 19 | 1000° C. for 1 hour | 700° C. with slow cooling | Class 3 |
| B | Alloy 24 | 1000° C. for 1 hour | 700° C. for 1 hour | Class 3 |
| C | Alloy 51 | 1100° C. for 1 hour | 700° C. for 1 hour | Class 2 |
| D | Alloy 52 | 1100° C. for 1 hour | 700° C. with slow cooling | Transition behavior from Class 3 to Class 2 |
| E | Alloy 64 | 1100° C. for 1 hour | 850° C. for 1 hour | Class 2 |
| F | Alloy 81 | 1100° C. for 1 hour | 900° C. for 1 hour | Class 2 |

Case Example #2

Structure Development in Class 2 Alloy

According to the alloy stoichiometries in Table 3, the Alloy 51 was weighed out using high purity elemental charges. It should be noted that Alloy 51 has demonstrated Class 2 behavior with high tensile ductility at high strength. The resulting charges were arc-melted into several (usually 4) thirty-five gram ingots and flipped and re-melted several times to ensure homogeneity. The resulting ingots were then re-melted and cast into 3 plates under identical processing conditions with nominal dimensions of 65 mm by 75 mm by 1.8 mm thick. Two of the plates were then HIPed at 1100° C. for 1 hour. One of the HIPed plates was then subsequently heat treated at 700° C. for 1 hour with air cooling to room temperature. The plates in the as-cast, HIPed and HIPed/heat treated states were then cut up using a wire-EDM to produce samples for various studies including tensile testing, SEM microscopy, TEM microscopy, and X-ray diffraction.

Samples that were cut out of the Alloy 51 plates were metallography polished in stages down to 0.02 μm grit to ensure smooth samples for scanning electron microscopy (SEM) analysis. SEM was done using a Zeiss EVO-MA10 model with the maximum operating voltage of 30 kV. Example SEM backscattered electron micrographs of the Alloy 51 plate sample in the as-cast, HIPed and HIPed/heat treated conditions are shown in FIG. 13. The Alloy 51 plate has a Modal Structure in as-cast state (FIG. 13*a*) where micron sized matrix dendritic grains are separated by intragranular fine structure. After HIP cycle, the dendrites completely disappeared with fine precipitates homogeneously distributed in the sample volume such that the matrix grain boundaries cannot be readily identified (FIG. 13*b*). Lamella-like structural features can be also observed in the matrix. Similar structure was detected by SEM in the sample after the heat treatment (FIG. 13*c*) while structural features in the matrix become less pronounced.

Additional details of the Alloy 51 plate structure are revealed using X-ray diffraction. X-ray diffraction was done using a Panalytical X'Pert MPD diffractometer with a Cu Kα x-ray tube and operated at 45 kV with a filament current of 40 mA. Scans were run with a step size of 0.01° and from 25° to 95° two-theta with silicon incorporated to adjust for instrument zero angle shift. The resulting scans were then subsequently analyzed using Rietveld analysis using Siroquant software. In FIGS. 14-16, X-ray diffraction scans are shown including the measured/experimental pattern and the Rietveld refined pattern for the Alloy 51 plates in the as-cast, HIPed, and HIPed/heat treated conditions, respectively. As can be seen, good fit of the experimental data was obtained in all cases. Analysis of the X-ray patterns including specific phases found, their space groups and lattice parameters is shown in Table 12. Note that in complex multicomponent crystals, the atoms are not often situated at the lattice points. Additionally, each lattice point will not correlate necessarily to a singular atom but instead to a group of atoms. Space group theory, thus expands on the relationship of symmetry in a unit cell and relates all of the possible combinations of atoms in space. Mathematically then there are a total of 230 different space groups which are made from combinations of the 32 Crystallographic Point Groups with the 14 Bravais Lattices, with each Bravais Lattice belonging to one of 7 Lattice Systems. The 230 unique space groups describe all possible crystal symmetries arising from periodic arrangements of atoms in space with the total number arising from various combinations of symmetry operations including various combinations of translational symmetry operations in the unit cell including lattice centering, reflection, rotation, rotoinversion, screw axis and glide plane operations. For hexagonal crystal structures, there are a total of 27 hexagonal space groups which are identified by space group numbers #168 through #194.

In the as-cast plate, two phases were identified, cubic γ-Fe (austenite) and a complex mixed transitional metal boride phase with the $M_2B_1$ stoichiometry. Note that the lattice parameters of the identified phases are different than that found for pure phases clearly indicating the dissolution of the alloying elements. For example, γ-Fe would exhibit a lattice parameter equal to a=3.575 Å, and $Fe_2B_1$ pure phase would exhibit lattice parameters equal to a=5.099 Å and c=4.240 Å. Note that based on the significant change in lattice parameters in the $M_2B$ phase it is likely that silicon is also dissolved into this structure so it is not a pure boride phase. Additionally, as can be seen in Table 12, while the phases do not change, the lattice parameters do change as a function of the plate condition (i.e. as-cast, HIPed, HIPed/heat treated), which indicates that redistribution of alloying elements is occurring.

As can be seen in Table 12, after the HIP exposure (1100° C. for 1 hour at 15 ksi) three phases are found which are α-Fe (ferrite), $M_2B_1$ phase, and γ-Fe (austenite). Note that α-Fe is believed to be formed from the γ-Fe (austenite) phase. Note also that the lattice parameters of the $M_2B_1$ and γ-Fe phases are different indicating that elemental redistribution/diffusion is occurring. As can be seen in Table 12, after the heat treatment at 700° C. for 1 hour, four phases are present which are α-Fe (ferrite), $M_2B_1$ phase, and two newly identified hexagonal phases. Note that γ-Fe is not found in the sample after heat treatment indicating that this phase transformed into the newly found phases. The $M_2B_1$ phase is still present in the X-ray diffraction scan but its lattice parameters have changed significantly indicating that atomic diffusion has occurred at elevated temperature. One identified new hexagonal phase is representative of a ditrigonal dipyramidal class and has a hexagonal P6bar2C space group (#190) and the other newly identified hexagonal phase is representative of a dihexagonal pyramidal class and has a hexagonal $P6_3mc$ space group (#186). It is theorized based on the small crystal unit cell size that the ditrigonal dipyramidal phase is likely a silicon based phase possibly a previously unknown Si—B phase which may be stabilized by the presence of the additional alloying elements in the stoichiometry. Also note that based on the ratio of peak intensities it appears that the dihexagonal pyramidal may be forming with specific orientation relationships since the diffracted intensity from the (002) planes is much higher than expected and the diffracted intensity from the (103) and (112) planes is much lower. Based on the ratio of peak intensities, it seems that one of the major differences of the heat treatment is the creation of a lot more of the ditrigonal dipyramidal hexagonal phase.

TABLE 12

Rietveld Phase Analysis of Alloy 51 Plate

| Condition | Phase 1 | Phase 2 | Phase 3 | Phase 4 |
|---|---|---|---|---|
| As-Cast Plate | γ-Fe<br>Structure: Cubic<br>Space group #: 225<br>Space group: Fm3m<br>LP: a = 3.583 Å | $M_2B$<br>Structure: Tetragonal<br>Space group #: 140<br>Space group: I4/mcm<br>LP: a = 5.118 Å<br>c = 4.226 Å | | |
| HIPed at 1100° C. for 1 hour | α-Fe<br>Structure: Cubic<br>Space group #: #229<br>Space group: Im3m<br>LP: a = 2.863 Å | γ-Fe<br>Structure: Cubic<br>Space group #: 225<br>Space group: Fm3m<br>LP: a = 3.579 Å | $M_2B$<br>Structure: Tetragonal<br>Space group #: #140<br>Space group: I4/mcm<br>LP: a = 5.113 Å<br>c = 4.240 Å | |
| HIPed at 1100° C. for 1 hour, Heat treated at 700° C. for 1 hour | α-Fe<br>Structure: Cubic<br>Space group #: #229<br>Space group: Im3m<br>LP: a = 2.872 Å | $M_2B$<br>Structure: Tetragonal<br>Space group #: #140<br>Space group: I4/mcm<br>LP: a = 4.467 Å<br>c = 4.184 Å | Hexagonal<br>Phase 1 (new)<br>Structure: Hexagonal<br>Space group #: #190<br>Space group: P6bar2C<br>LP: a = 4.978 Å<br>c = 11.328 Å | Hexagonal<br>Phase 2 (new)<br>Structure: Hexagonal<br>Space group #: #186<br>Space group: P63mc<br>LP: a = 2.861 Å<br>c = 6.066 Å |

To examine the structural features of the Alloy 51 plates in more detail, high resolution transmission electron microscopy (TEM) was utilized. To prepare TEM samples, specimens were cut from the as-cast, HIPed, and HIPed/heat-treated plates, and then ground and polished to a thickness of ~30 to ~40 μm. Discs of 3 mm in diameter were then punched from these polished thin samples, and then finally thinned by twin-jet electropolishing for TEM observation. The microstructure examination was conducted in a JEOL JEM-2100 HR Analytical Transmission Electron Microscope operated at 200 kV.

In FIG. 17, TEM micrographs of the microstructure of the Alloy 51 plate in the as-cast, HIPed, and HIPed/heat treated states are shown. In as-cast sample of Alloy 51, dendritic structure is formed as was revealed by SEM (FIG. 13*a*). The dendrite arms constituent the matrix grains, while the intergranular regions contain precipitate phases forming a Modal Structure, as shown in FIG. 17*a*. These precipitates are less than 1 μm, and show the faulted structure that is the characteristic of $M_2B$ boride phase, as also confirmed by X-ray diffraction studies. After the HIPing process, the dendritic structure was not observed in the sample and larger $M_2B$ precipitates up to 2 μm in size are uniformly distributed in the sample volume as shown by SEM and TEM in FIG. 13*b* and FIG. 17*b*. These $M_2B$ phase contains mainly Fe and some Mn (the atomic ratio of Fe/Mn is approx. 9:1), but low in Ni and Si, as suggested by EDS studies. In the as-HIPed samples, the matrix shows annealed microstructure in which grains with few defects can be seen. At the same time, Static Nanophase Refinement takes place in the matrix, particularly near the precipitate phase, as shown in FIG. 17*b*. After heat treatment cycle, Static Nanophase Refinement continues to a higher level where more refined grains in size of ~200 nm formed as shown in FIG. 17*c*, while the $M_2B$ boride phase shows no significant change in size. Also, additional nanoscale precipitates were found by TEM in Alloy 51 after heat treatment. Fine precipitates, mostly ~10 nm in size, were formed in the matrix grain. These nanoscale precipitates are likely the new Hexagonal phases detected by x-ray analysis that are formed during the heat treatment process. Due to their extremely small size, the nano-precipitates are better resolved by TEM in places where the Static Nanophase Refinement and structural defects do not severely interfere with the electron beam. In other words, in locations where the Static Nanophase Refinement is predominant, in spite of their existence, the nano-precipitates may be concealed by the refined grains and their boundaries. Compared to the boride phase formed in the Modal Structure (Structure #1), the nano-precipitates are much smaller, and but also distributed homogeneously in the matrix grain favorably for dislocation pinning that would provide additional strain hardening.

Case Example #3

Structure Development in Class 3 Alloy

According to the alloy stoichiometries in Table 3, the Alloy 6 that represents Class 3 alloy was weighed out from high purity elemental charges. It should be noted that Alloy 6 has demonstrated Class 3 behavior with very high strength characteristics. The resulting charges were arc-melted into 4 thirty-five gram ingots and flipped and re-melted several times to ensure homogeneity. The resulting ingots were then re-melted and cast into 3 plates under identical processing conditions with nominal dimensions of 65 mm by 75 mm by 1.8 mm thick. Two of the plates were then HIPed at 1100° C. for 1 hour. One of the HIPed plates was then subsequently heat treated at 700° C. for 1 hour with slow cooling to room temperature (670 minutes total time). The plates in the as-cast, HIPed and HIPed/heat treated states were then cut by using a wire-EDM to produce samples for various studies including tensile testing, SEM microscopy, TEM microscopy, and X-ray diffraction.

Samples that were cut out of the Alloy 6 plates were metallographically polished in stages down to 0.02 μm grit to ensure smooth samples for scanning electron microscopy (SEM) analysis. SEM was done using a Zeiss EVO-MA10 model with the maximum operating voltage of 30 kV manufactured by Carl Zeiss SMT Inc. Example SEM backscattered electron micrographs of the plate microstructure in the as-cast, HIPed and HIPed and heat treated conditions are shown in FIG. 18 to FIG. 20.

Similar to Class 2 alloy, in the as-cast sample from Class 3 alloy, the microstructure contains two basic components, i.e., the matrix dendrite grains and an intergranular area, as marked by A and B in FIG. 18. Some of the dendritic arms form isolated matrix grains, while others remain as a part of the dendrite configuration. Most of the matrix grains are in the range of 5~10 μm. The intergranular component surrounding the matrix grains appears in irregular shape and forms a continuous network structure. Close examination shows that the intergranular phase region is made up of very fine precipitates that can be revealed by TEM. Modal Structure #1 was formed at solidification of the alloy. FIG. 19 shows the backscattered SEM image of the Alloy 6 plate after HIPing. As shown, the microstructure of the as-HIPed sample changed dramatically from that in the as-cast plate. The dendritic structure is homogenized during HIP cycle. As a result, the dendritic matrix grains disappear and precipitates are homogeneously distributed in the HIPed plate. The size of precipitates ranges from 50 nm to 2.5 μm and are believed to be complex boride phases. More structural details were revealed at TEM studies described below. After the heat treatment, the boride precipitates remain, but the matrix shows a great change as shown in FIG. 20 which shows the backscattered SEM image of the plate sample after HIP cycle and heat treatment. While the large precipitates formed at HIPing retain the similar size and geometry, a large number of fine precipitates are formed. Additionally, a unique microstructure can be found in the matrix which shows alternating lamellas. In FIG. 21, a backscattered SEM image of a chemically-etched Alloy 6 sample is shown. The alternate bright/dark lamellas are very clear and both types of phases are less than 1 μm in width. The lamellas appear to prefer a specific orientation in local areas, but are random over the whole sample surface. Thus, a formation of the Lamellae Nano-Modal Structure #3 occurred in Alloy 6 after thermal mechanical treatment of the cast plate that mimic sheet production at twin roll or thin slab casting production.

Additional details of the Alloy 6 plate structure are revealed using X-ray diffraction. X-ray diffraction was done using a Panalytical X'Pert MPD diffractometer with a Cu Kα x-ray tube and operated at 45 kV with a filament current of 40 mA. Scans were run with a step size of 0.01° and from 25° to 95° two-theta with silicon incorporated to adjust for instrument zero angle shift. The resulting scans were then subsequently analyzed using Rietveld analysis using Siroquant software. In FIG. 22 through FIG. 24, X-ray diffraction scans are shown including the measured/experimental pattern and the Rietveld refined pattern for the Alloy 6 plates in the as-cast, HIPed, and HIPed/heat treated conditions, respectively. As can be seen, good fits of the experimental data were obtained in all cases. Analysis of the X-ray patterns including specific phases found, their space groups and lattice parameters is shown in Table 13.

TABLE 13

Rietveld Phase Analysis of Alloy 6 Plate

| Condition | Phase 1 | Phase 2 | Phase 3 | Phase 4 |
|---|---|---|---|---|
| As-Cast Plate | α-Fe<br>Structure: Cubic<br>Space group #:<br>#229<br>Space group:<br>Im3m<br>LP: a = 2.861 Å | $M_2B$<br>Structure:<br>Tetragonal<br>Space group #:<br>#140<br>Space group:<br>I4/mcm<br>LP: a = 5.109 Å<br>c = 4.247 Å | | |
| HIPed at 1100° C. for 1 hour | α-Fe<br>Structure: Cubic<br>Space group #:<br>#229<br>Space group:<br>Im3m<br>LP: a = 2.866 Å | $M_2B$<br>Structure:<br>Tetragonal<br>Space group #:<br>#140<br>Space group:<br>I4/mcm<br>LP: a = 5.115 Å<br>c = 4.249 Å | | |
| HIPed at 1100° C. for 1 hour, Heat treated at 700° C. slow cool to room temperature (670 minute total time). | α-Fe<br>Structure: Cubic<br>Space group #:<br>#229<br>Space group:<br>Im3m<br>LP: a = 2.870 Å | $M_2B$<br>Structure:<br>Tetragonal<br>Space group #:<br>#140<br>Space group:<br>I4/mcm<br>LP: a = 5.110 Å<br>c = 4.230 Å | γ-Fe<br>Structure: Cubic<br>Space group #:<br>#225<br>Space group:<br>Fm3m<br>LP: a = 3.577 Å | Hexagonal<br>Phase 1 (new)<br>Structure:<br>Hexagonal<br>Space group #:<br>#186<br>Space group:<br>P63mc<br>LP: a = 3.117 Å<br>c = 6.373 Å |

In the as-cast plate and HIPed (1100° C. for 1 hour) plate, two phases were identified, cubic α-Fe (ferrite) and a complex mixed transitional metal boride phase with the $M_2B_1$ stoichiometry. Note that the lattice parameters of the identified phases are different from that found for pure phases clearly indicating the dissolution of the alloying elements. For example, α-Fe would exhibit a lattice parameter equal to a=2.866 Å, and $Fe_2B_1$ pure phase would exhibit lattice parameters equal to a=5.099 Å and c=4.240 Å. This is consistent with the SEM studies which did not show new phases present but homogenization of the structure. After the heat treatment (700° C. slow cool to room temperature (670 minute total time)) as can be seen in Table 13, the α-Fe (ferrite) and $M_2B_1$ phases are all present although the lattice parameters change indicating diffusion and redistribution of the alloying elements. Additionally, γ-Fe (not a pure phase since it exhibits a lattice parameter of a=3.577 Å which is slightly larger than that of a pure phase at (a=3.575 Å)) and a newly identified hexagonal phase is representative of a dihexagonal pyramidal class and has a hexagonal $P6_3mc$ space group (#186) are found in the X-ray diffraction pattern. The presence of these new phases is consistent with the new precipitates found in the SEM studies and contributes to the formation of the lath matrix structure.

To examine the structural details of the Alloy 6 plates in more detail, high resolution transmission electron microscopy (TEM) was utilized. To prepare TEM specimens, samples were cut from the as-cast, HIPed, and HIPed/heat-treated plates. The samples were then ground and polished to a thickness of 30~40 μm. Discs of 3 mm in diameter were punched from these thin samples, and the final thinning was done by twin-jet electropolishing using a 30% $HNO_3$ in methanol solution. The prepared specimens were examined in a JEOL JEM-2100 HR Analytical Transmission Electron Microscope (TEM) operated at 200 kV.

TEM analysis was conducted at both the intergranular region and the matrix grains. As shown in FIG. 25*a*, the intergranular region (corresponding to the region B in FIG. 18) contains fine precipitates of few microns in size, forming a continuous "network" around the matrix grains in the as-cast sample confirming the formation of the Modal Structure #1 previously observed in SEM. Detailed TEM in FIG. 25*b* shows that the precipitates exhibit irregular geometry. The size of the precipitates is mostly less than 500 nm, and the irregular precipitates seem to be embedded in the matrix. FIG. 25*c* shows the microstructure of the matrix grains. Although the matrix grains display uniform contrast in SEM analysis, TEM reveals the lath structure aligned along some specific direction and the orientated laths are composed of finer substructure that appears to have discontinuous character. In Alloy 6, Modal Lath Phase Structure #2 formed directly at solidification inside large dendrites that related to Stage 1 of twin roll or thin slab casting production.

FIG. 26 shows the TEM micrographs of the Alloy 6 sample after HIP cycle at 1100° C. for 1 hour. In agreement with SEM analysis in FIG. 19, TEM reveals that the dendritic structure in the as-cast sample is homogenized during HIP cycle. As a result, the intergranular region and the dendritic matrix grains are not detected in the sample. Instead, precipitates form homogeneously, as shown in FIG. 26*a*. The size of precipitates ranges from 50 nm to 2.5 p.m. In addition, lath structure was found in the matrix. The elongated laths are aligned in a specific direction locally, but appear random globally. FIG. 26*b* shows the detailed structure of the lath structure region around a precipitate. Close examination shows that the laths are composed of smaller blocks, many of which are of several hundreds of nanometers. FIG. 26*c* is the dark-field image of the area shown in FIG. 26*b*. One can see that the bright areas representing grains are in the range from 100 nm to 500 nm in size, although the grain geometry is irregular. Modal Lath Phase Structure #2 in Alloy 6 was stable through HIP cycle with additional homogenization through the process.

During heat treatment, the boride precipitates grow slightly, but the lath structure in the matrix experiences great changes. FIG. 27 shows the TEM images of the sample after HIPing and heat treatment. Except the precipitates inherited from the HIPed microstructure, a unique structure is formed consisting of alternating bright/dark lamellas. The bright lamellas correspond to the gray phase in FIG. 21, and the dark lamellas correspond to the white phase in FIG. 21 based on EDS data. The width of lamellas is less than 500 nm. In FIG. 27, the contrast between the bright lamellae and the dark lamellae is due to their thickness difference. Formation of Lamellae NanoModal Structure #3 in Alloy 6 is clearly evident after thermal mechanical treatment.

Case Example #4

Tensile Properties and Structural Changes in Class 2 Alloy

The tensile properties of the steel plate produced in this application will be sensitive to the specific structure and specific processing conditions that the plate experiences. In FIG. 28, the tensile properties of Alloy 51 plate representing a Class 2 steel are shown in the as-cast, HIPed (1100° C. for 1 hour) and HIPed (1100° C. for 1 hour)/heat treated (700° C. for 1 hour with air cooling) conditions. As can be seen, the as-cast plate shows brittle behavior while the HIPed and the HIPed/heat treated samples demonstrated high strength at high ductility. This improvement in properties can be attributed to both the reduction of macrodefects in the HIPed plates and microstructural changes occurring in the Modal Structures of the HIPed or HIPed/heat treated plate as discussed earlier in Case Example #2. Additionally, during the application of a stress during tensile testing it will be shown the structural changes occur leading to formation of High Strength NanoModal Structure.

Samples that were cut out of the Alloy 51 tensile gage and grip section were metallographically polished in stages down to 0.02 μm grit to ensure smooth samples for scanning electron microscopy (SEM) analysis. SEM was done using a Zeiss EVO-MA10 model with the maximum operating voltage of 30 kV manufactured by Carl Zeiss SMT Inc. Example SEM backscattered electron micrographs from tensile gage section and grip section are shown in FIG. 29. The boride phase remained the similar size and distribution before and after the tensile deformation, while the deformation is mainly carried out by the matrix. Although great microstructure change such as new phase formation happened in the matrix, the details cannot be resolved by SEM for that TEM is utilized.

For the Alloy 51 plate HIPed at 1100° C. for 1 hour and heat treated at 700° C. for 1 hour with air cooling, additional structural details were obtained through using X-ray diffraction which was done on both the undeformed plate samples and the gage sections of the deformed tensile specimens. X-ray diffraction was specifically done using a Panalytical X'Pert MPD diffractometer with a Cu Kα X-ray tube and operated at 45 kV with a filament current of 40 mA. Scans were run with a step size of 0.01° and from 25° to 95° two-theta with silicon incorporated to adjust for instrument zero angle shift. In FIG. 30, X-ray diffractions patterns are shown for the Alloy 51 plate HIPed at 1100° C. for 1 hour and heat treated at 700° C. for 1 hour with air cooling in both the undeformed plate condition and the gage section of the tensile tested specimen cut out from the plate. As can be readily seen, there are significant structural changes occurring during deformation with new phases formation as indicated by new peaks in the X-ray pattern. Peak shifts indicate that redistribution of alloying elements is occurring between the phases present in both samples.

The X-ray pattern for the deformed Alloy 51 tensile tested specimen (HIPed at 1100° C. for 1 hour and heat treated at 700° C. for 1 hour with air cooling) was subsequently analyzed using Rietveld analysis using Siroquant software. As shown in FIG. 31, a close agreement was found between the measured and calculated patterns. In Table 14, the phases identified in Alloy 51 undeformed plate and in a gage section of tensile specimens are compared. As can be seen, the α-Fe and $M_2B_1$, ditrigonal dipyramidal hexagonal phase, and dihexagonal pyramidal hexagonal phases are found in the plate before and after tensile testing although the lattice parameters change indicates that the amount of solute elements dissolved in these phases changed. As shown in Table 14, after deformation, one new phase has been created which is a face centered cubic phase nominally with the stoichiometry $M_3Si$. Additionally, based on the ratios of intensities it appears that the total amount of hexagonal phases, especially the ditrigonal dipyramidal phase has increased significantly during the deformation. Rietveld analysis of the undeformed plate and tensile tested specimen indicates that the volume fraction of $M_2B$ phase content increases according to the peak intensity changes. This would indicate that phase transformations are induced by elements redistribution under the applied stress.

TABLE 14

Rietveld Phase Analysis of Alloy 51 Plate; Before and After Tensile Testing

| Phase 1 | Phase 2 | Phase 3 | Phase 4 | Phase 5 |
|---|---|---|---|---|
| | Plate -HIPed at 1100° C. for 1 hour and heat treating at 700° C. for 1 hour- Prior to tensile testing | | | |
| α-Fe<br>Structure: Cubic<br>Space group #: #229<br>Space group: Im3m<br>LP: a = 2.872 Å | $M_2B$<br>Structure: Tetragonal<br>Space group #: #140<br>Space group: I4/mcm<br>LP: a = 4.467 Å<br>c = 4.184 Å | Hexagonal<br>Phase 1 (new)<br>Structure: Hexagonal<br>Space group #: #190<br>Space group: P6bar2C<br>LP: a = 4.978 Å<br>c = 11.328 Å | Hexagonal<br>Phase 2 (new)<br>Structure: Hexagonal<br>Space group #: #186<br>Space group: P63mc<br>LP: a = 2.861 Å<br>c = 6.066 Å | |
| | Plate -HIPed at 1100° C. for 1 hour and heat treating at 700° C. for 1 hour- After tensile testing | | | |
| α-Fe<br>Structure: Cubic<br>Space group #: #229<br>Space group: | $M_2B$<br>Structure: Tetragonal<br>Space group #: #140<br>Space group: I4/mcm<br>LP: a = 4.448 Å | Hexagonal<br>Phase 1 (new)<br>Structure: Hexagonal<br>Space group #: #190<br>Space group: P6bar2C | Hexagonal<br>Phase 2 (new)<br>Structure: Hexagonal<br>Space group #: #186<br>Space group: P63mc | $M_3Si$<br>Structure: Cubic<br>Space group #: 225 |

TABLE 14-continued

| Rietveld Phase Analysis of Alloy 51 Plate; Before and After Tensile Testing | | | | |
|---|---|---|---|---|
| Phase 1 | Phase 2 | Phase 3 | Phase 4 | Phase 5 |
| Im3m<br>LP: a = 2.868 Å | c = 4.138 Å | LP: a = 4.981 Å<br>c = 11.333 Å | LP: a = 2.862 Å<br>c = 6.052 Å | Space group:<br>Fm3m<br>LP: a = 5.908 Å |

To examine the structural changes of the Alloy 51 plates induced by tensile deformation, high resolution transmission electron microscopy (TEM) was utilized. To prepare TEM samples, they were cut from the gage section of the tensile tested specimens and polished to a thickness of ~30 to ~40 μm. Discs were punched from these polished thin samples, and then finally thinned by twin-jet electropolishing for TEM observation. These specimens were examined in a JEOL JEM-2100 HR Analytical Transmission Electron Microscope operated at 200 kV.

In FIG. 32, the microstructure of the gage section of the Alloy 51 plate in HIPed conditions before and after the tensile deformation is shown. In the undeformed sample, refined grains can be found as a result of Static Nanophase Refinement during HIPing and heat treatment, FIG. 32*a*. After the tensile testing, grain refinement occurred through the stress induced phase transformation, namely, the Dynamic Nanophase Strengthening mechanism. The refined grains are typically of 100~300 nm in size. At the same time, dislocations are found to contribute greatly to the strain hardening. As shown in FIG. 33*a*, in the sample after HIPing and heat treatment, the matrix grains are relatively free of dislocations due to the high temperature annealing effect. But a number of nano-precipitates are formed in matrix grains during the heat treatment. These precipitates are extremely fine, mostly of 10 nm in size, and distributed in the matrix homogeneously. After tensile test, a high density of dislocations that were pinned by the precipitates was observed in the matrix grains, FIG. 33*b*. Additionally, more fine precipitates appear (i.e. Dynamic Nanophase Formation) within the matrix grains after the tensile testing, and provide additional sites for dislocation pinning during tests, as shown in FIG. 33*b*. Considering the high local stress in the intergranular region where an extensive deformation may take place, the new hexagonal phases form in the refined grains and the boundaries.

The very fine precipitates observed by TEM would include the new hexagonal phases produced by heat treatment and by deformation, identified by X-ray diffraction (see section above). Due to the pinning effect by the precipitates, the matrix grains are refined to a higher level thanks to the dislocation accumulation that increases the grain lattice misorientation during the tensile deformation. While the deformation-induced nanoscale phase formation may contribute to the hardening in the Alloy 51 plate, the work-hardening of Alloy 51 is strengthened by dislocation based mechanisms including dislocation pinning by precipitates.

As it was shown, the Alloy 51 plate has demonstrated Structure #1 Modal Structure (Step #1) in as-cast state (FIG. 17*a*). High strength with high ductility in this material was measured after HIP cycle (FIG. 28), which provides the Static Nanophase Refinement (Step #2) and the formation of the NanoModal Structure (Step #3) in the material prior deformation. The strain hardening behavior of the Alloy 51 during tensile deformation is also contributed by grain refinement corresponding to Mechanism #2 Dynamic Nanophase Strengthening (Step #4) with subsequent creation of the High Strength NanoModal Structure (Step #5). Additional hardening may occur by dislocation-pinning mechanism in newly formed grains. The Alloy 51 plate is an example of Class 2 steel with High Strength NanoModal Structure formation leading to high ductility at high strength.

Case Example #5

Tensile Properties and Structural Changes in Class 3 Alloy

The tensile properties of the steel plate produced in this application will be sensitive to the specific structure and specific processing conditions that the plate experiences. In FIG. 34, the tensile properties of Alloy 6 plate representing Class 3 steel are shown in the as-cast, HIPed (1100° C. for 1 hour) and HIPed (1100° C. for 1 hour)/heat treated (heated to 700° C. with slow cooling to room temperature with 670 minutes total time) conditions. As can be seen, the as-cast plate shows the lowest strength and ductility (Curve a, FIG. 34). High strength achieved in the alloy after HIP cycle (Curve b, FIG. 34) and additional heat treatment leads to significant increase in ductility (Curve c, FIG. 34). These property changes can be attributed to both the reduction of macrodefects in the HIPed plates as well as to microstructural changes occurring in the Modal Lath Phase Structure #2 created in this alloy at solidification during the HIP cycle and additional heat treatments towards formation of desired Lamellae NanoModal Structure #3. Additionally, during the application of a stress during tensile testing additional structural changes occur as it will be shown below.

For the Alloy 6 plate HIPed at 1100° C. for 1 hour, additional structural details were obtained through using X-ray diffraction which was done on both the undeformed plate samples and the gage sections of the deformed tensile specimens. X-ray diffraction was specifically done using a Panalytical X'Pert MPD diffractometer with a Cu Kα X-ray tube and operated at 45 kV with a filament current of 40 mA. Scans were run with a step size of 0.01° and from 25° to 95° two-theta with silicon incorporated to adjust for instrument zero angle shift. In FIG. 35, X-ray diffraction patterns are shown for the Alloy 6 plate HIPed at 1100° C. for 1 hour in both the undeformed plate condition and the gage section of the tensile tested specimen cut out from the plate. As can be readily seen, there are significant structural changes occurring during deformation with new phases forming as indicated by new peaks in the X-ray pattern. Additionally, peak shifts indicated that redistribution of alloying elements is occurring between the phases present in both samples.

The X-ray pattern for the deformed Alloy 6 tensile tested specimen (HIPed (1100° C. for 1 hour) was subsequently analyzed using Rietveld analysis using Siroquant software. As shown in FIG. 36, a close agreement was found between the measured and calculated patterns. In Table 15, the phases identified in the Alloy 6 undeformed plate and in a gage section of tensile specimens are compared. As can be seen, the α-Fe and $M_2B_1$ phases exist in the plate before and after tensile testing although the lattice parameters change indicating that the amount of solute elements dissolved in these phases changed. Additionally, the γ-Fe phase existing in the undeformed Alloy 6 plate no longer exists in the gage section of tensile tested specimen indicating that a phase transformation took place. As shown in Table 15, after deformation, two new previously unknown hexagonal phases have been identified. One hexagonal phase is representative of a ditrigonal dipyramidal class and has a hexagonal P6bar2C space group (#190) and the calculated diffraction pattern with the diffracting planes listed is shown in FIG. 37. It is theorized based on the small crystal unit cell size that this phase is likely a silicon based phase possibly a previously unknown Si—B phase. The other newly identified hexagonal phase is representative of a dihexagonal pyramidal class and has a hexagonal $P6_3mc$ space group (#186) and the calculated diffraction pattern with the diffracting planes listed is shown in FIG. 38. Note also, that at least one additional unknown phase is yet identified and has main peak(s) at 29.2° and possibly 47.0°.

TABLE 15

Rietveld Phase Analysis of Alloy 6 Plate Before and After Tensile Testing

| Phase 1 | Phase 2 | Phase 3 | Phase 4 | Phase 5 |
|---|---|---|---|---|
| Plate -HIPed at 1100° C. for 1 hour and heat treating at 700° C. slow cool to room temperature (670 minute total time)-Prior to tensile testing | | | | |
| α-Fe<br>Structure: Cubic<br>Space group #: #229<br>Space group: Im3m<br>LP: a = 2.870 Å | $M_2B$<br>Structure: Tetragonal<br>Space group #: #140<br>Space group: I4/mcm<br>LP: a = 5.110 Å<br>c = 4.230 Å | γ-Fe<br>Structure: Cubic<br>Space group #: #225<br>Space group: Fm3m<br>LP: a = 3.577 Å | Hexagonal<br>Phase 1 (new)<br>Structure: Hexagonal<br>Space group #: #186<br>Space group: P63mc<br>LP: a = 3.117 Å<br>c = 6.373 Å | |
| Plate -HIPed at 1100° C. for 1 hour and heat treating at 700° C. slow cool to room temperature (670 minute total time)-After tensile testing | | | | |
| α-Fe<br>Structure: Cubic<br>Space group #: #229<br>Space group: Im3m<br>LP: a = 2.866 Å | $M_2B$<br>Structure: Tetragonal<br>Space group #: #140<br>Space group: I4/mcm<br>LP: a = 5.206 Å<br>C = 4.211 Å | Hexagonal<br>Phase 1 (new)<br>Structure: Hexagonal<br>Space group #: #186<br>Space group: P63mc<br>LP: a = 2.846 Å<br>c = 6.362 Å | Hexagonal<br>Phase 2 (new)<br>Structure: Hexagonal<br>Space group #: #190<br>Space group: P6bar2C<br>LP: a = 5.012 Å<br>c = 11.398 Å | Unidentified |

To focus on structural changes occurring during tensile testing, the Alloy 6 plate HIPed at 1100° C. for 1 hour, and heat treated at 700° C. for 60 minutes with slow furnace cooling was examined by TEM. TEM specimens were prepared from HIPed and heat treated plate both in the undeformed state and after tensile testing until failure. TEM specimens were made from the plate first by mechanical grinding/polishing, and then electrochemical polishing. TEM specimens of deformed tensile specimens were cut directly from the gage section and then prepared in an analogous manner to the undeformed plate specimens. These specimens were examined in a JEOL JEM-2100 HR Analytical Transmission Electron Microscope operated at 200 kV.

FIG. 39 shows the TEM micrographs of Alloy 6 microstructure before and after tensile test. The samples were subjected to HIP cycle at 1100° C. for 1 hour and heat treatment at 700° C. with slow furnace cooling. Before tension, the alternate bright/dark bands of Lamellae NanoModal Structure #2 are very clear and in sharp contrast, and the bright band area is clean with very few defects (FIG. 39*a*). After tensile test, defects like dislocations can be found, and some fine precipitates observed in the bright area (FIG. 39*b*). Changes also took place in the dark lamellas and very small precipitates can be found in these lamellas (FIG. 39*b*). The Alloy 6 plate is an example of Class 3 steel with High Strength Lamellae NanoModal Structure formation leading to very high strength characteristics.

Case Example #6

Alloying Effect on Mechanical Behavior of the Alloys

Using high purity elements, 35 g alloy feedstocks of the Alloy 17 and Alloy 27 were weighed out according to the atomic ratios provided in Table 3. The only difference between these two alloys is that ½ of Ni in Alloy 17 is substituted by Mn in Alloy 27. The feedstock material was then placed into the copper hearth of an arc-melting system. The feedstock was arc-melted into ingots using high purity argon as a shielding gas. The ingots were flipped several times and re-melted to ensure homogeneity. The resulting ingots were then placed in a PVC chamber, melted using RF induction and then ejected onto a copper die designed for casting a 3×4 inches plate with thickness of 1.8 mm. The resultant plates from the Alloy 17 and Alloy 27 were subjected to a HIP cycle C (at 1100° C. for 1 hour) using an American Isostatic Press Model 645 machine with a molybdenum furnace with furnace chamber size of 4 inch diameter by 5 inch height. The plates were heated at 10° C./min until the target temperature of 1100° C. was reached and were exposed to an isostatic pressure of 30 ksi for 1 hour. After HIP cycle, the plates were heat treated at 700° C. for 1 h with air cooling. Tensile specimens were cut from the treated plates.

The tensile testing was done on an Instron mechanical testing frame (Model 3369), utilizing Instron's Bluehill control and analysis software. All tests were run at room temperature in displacement control with the bottom fixture held ridged and the top fixture moving with the load cell attached to the top fixture. Representative curves for both alloys are shown in FIG. 40. As it can be seen, the mechanical response of the Alloy 17 was dramatically changed in a case of Ni substitution by Mn in Alloy 27 leading to transition from Class 3 behavior to Class 2, respectively. Such change in the mechanical response related to a difference in structural formation in the alloys at casting and post-treatment prior deformation is affected by Mn presence.

Samples from both alloys after tensile testing were examined by SEM. Samples were cut from the gage section and then metallographically polished in stages down to 0.02 μm grit to ensure smooth samples for scanning electron microscopy (SEM) analysis. SEM was done using a Zeiss EVO-MA10 model with the maximum operating voltage of 30 kV manufactured by Carl Zeiss SMT Inc. SEM backscattered images of the sample microstructure are shown in FIG. 41 and FIG. 42 for Alloy 17 and Alloy 27, respectively.

In the Alloy 17 sample, the dark boride pinning phase (mostly 1~2 μm in diameter) is homogeneously distributed in the matrix (FIG. 41). Other than the boride phase, the subtle microstructure in the matrix can be barely seen by SEM. In the Alloy 27 sample containing Mn, the boride phase has the similar size as in the Alloy 17 and is also homogeneously distributed in the matrix (FIG. 42). However, obvious structural features can be seen in the matrix of Alloy 27 that are not seen in Alloy 17 matrix. Formation of different structure in Alloy 27 as a result of Ni substitution by Mn leads to a change from Class 3 to Class 2 mechanical behavior of the alloy with extensive phase transformation process upon deformation.

Case Example #7

Non-Stainless Alloys with Transition Behavior

According to the alloy stoichiometries in Table 3, the Alloy 2, Alloy 5 and Alloy 52 were weighed out from high purity elemental charges. The resulting charges were arc-melted into 4 thirty-five gram ingots and flipped and re-melted several times to ensure homogeneity. The resulting ingots were then re-melted and cast into 2 plates for each alloy under identical processing conditions with nominal dimensions of 65 mm by 75 mm by 1.8 mm thick. The resultant plates were subjected to HIP cycle with subsequent heat treatment. Corresponding HIP cycle and heat treatment for each alloys are listed in Table 16. In a case of air cooling, the specimens were held at the target temperature for a target period of time, removed from the furnace and cooled down in air. In a case of slow cooling, the specimens were heated to the target temperature and then cooled with the furnace at cooling rate of 1° C./min.

TABLE 16

HIP Cycle and Heat Treatment Parameters

| Alloy | HIP Cycle | Heat treatment |
|---|---|---|
| Alloy 2 | 1150° C. for 1 hour | 700° C. for 1 hour with air cooling |
| | | 700° C. for 1 hour with slow cooling |
| Alloy 5 | 1100° C. for 1 hour | 700° C. for 1 hour with air cooling |
| | | 700° C. for 1 hour with slow cooling |
| Alloy 52 | 1100° C. for 1 hour | 850° C. for 1 hour with air cooling |
| | | 700° C. for 1 hour with slow cooling |

Tensile specimens were cut out from each plate that were tested in tension on an Instron mechanical testing frame (Model 3369). The tensile stress-strain curves for Alloy 2, Alloy 5 and Alloy 52 after different annealing are shown in FIG. 43 through FIG. 45. As can be seen, all three alloys show a Class 2 behavior in a case of heat treatment with slow cooling to room temperature (Curve b in FIG. 43 through FIG. 45) while the plate from the same alloys after heat treatment with air cooling to room temperature shows a Class 3 behavior (Curve a in FIG. 43 through FIG. 45). These results demonstrate that class of behavior in new non-stainless steel alloys depends not only on alloy chemistry but also on the thermal mechanical treatment history.

Case Example #8

Elastic Modulus of Selected Alloys

Using modified tensile specimens with extended grip area, elastic modulus was measured for selected alloy listed in Table 17 in different conditions. Elastic modulus in Table 17 is reported as an average value of 5 separate measurements. As it can be seen, modulus values vary in a range from 192 to 201 GPa depending on alloys chemistry and thermal mechanical treatment.

TABLE 17

Elastic Modulus of Selected Alloys

| Alloy | Hip Cycle | Heat Treatment | Elastic Modulus, GPa | Class Of Behavior |
|---|---|---|---|---|
| Alloy 20 | D | T3 | 201 | Class 3 |
| Alloy 21 | A | T2 | 195 | Class 3 |
| Alloy 22 | A | — | 198 | Class 3 |
| Alloy 29 | A | — | 194 | Class 3 |
| Alloy 51 | D | T1 | 192 | Class 2 |

Case Example #9

Strain Hardening Behavior in Class 2 Alloy

Using high purity elements, 35 g alloy feedstocks of the Alloy 51 representing Class 2 steel was weighed out according to the atomic ratios provided in Table 3. The feedstock material was then placed into the copper hearth of an arc-melting system. The feedstock was arc-melted into ingots using high purity argon as a shielding gas. The ingots were flipped several times and re-melted to ensure homogeneity. The resulting ingots were then placed in a PVC chamber, melted using RF induction and then ejected onto a copper die designed for casting a 3×4 inches plate with thickness of 1.8 mm. The resultant plates were subjected to HIP cycle of 1100° C. for 1 hour using an American Isostatic Press Model 645 machine with a molybdenum furnace with furnace chamber size of 4 inch diameter by 5 inch height. The plates were heated at 10° C./min until the target temperature was reached and were exposed to gas pressure for specified time.

Tensile specimens were cut out of the plates from the selected alloy which were annealed at 700° C. for 1 hour with air cooling. Annealed specimens were tested in tension on an Instron mechanical testing frame (Model 3369) with recording strain hardening coefficient (n) values as a function of straining during testing utilizing Instron's Bluehill control and analysis software. The results are summarized in FIG. 46*a* where the strain hardening coefficient values are plotted versus corresponding plastic strain as a percentage of total elongation of the specimen. As it can be seen, the alloy demonstrated very high strain hardening at the elongation value of about 12% with subsequent strain hardening coefficient values decreasing up to specimen failure. This plate sample has high strength/high ductility combination (FIG. 46*b*) and represents Class 2 steels. Phase transformation under straining in Class 2 alloys is a continuous process that contributes to the hardening process. This phase transformation is specified as Dynamic Nanophase Strengthening that leads to formation of High Strength NanoModal Structure. Thus, a strain hardening exponent was determined for the alloy in a strain range from 12% to 22% that is believed to correspond to deformation of mostly new High Strength NanoModal Structure with a high value of strain hardening exponent.

Case Example #10

Strain Hardening Behavior in Class 3 Alloy

Using high purity elements, 35 g alloy feedstocks of the Alloy 6 representing Class 3 steel were weighed out according to the atomic ratios provided in Table 3. The feedstock material was then placed into the copper hearth of an arc-melting system. The feedstock was arc-melted into ingots using high purity argon as a shielding gas. The ingots were flipped several times and re-melted to ensure homogeneity. The resulting ingots were then placed in a PVC chamber, melted using RF induction and then ejected onto a copper die designed for casting a 3×4 inches plate with thickness of 1.8 mm. The resultant plates were subjected to HIP cycle of 1100° C. for 1 hour using an American Isostatic Press Model 645 machine with a molybdenum furnace with furnace chamber size of 4 inch diameter by 5 inch height. The plates were heated at 10° C./min until the target temperature was reached and were exposed to gas pressure for specified time. Annealing at 700° C. for 1 hour with slow cooling was applied to plates after HIP cycle. In a case of slow cooling, the specimens were heated to the target temperature and then cooled with the furnace at cooling rate of 1° C./min.

Tensile specimens were cut out of the plates from the selected alloy which were annealed at 700° C. for 1 hour with slow cooling. Annealed specimens were tested in tension on an Instron mechanical testing frame (Model 3369) with recording strain hardening coefficient (n) values during testing utilizing Instron's Bluehill control and analysis software. A dependence of strain hardening coefficient on tensile strain (elongation) is illustrated in FIG. 47. As it can be seen, very high n-value of about 0.9 was measured for the alloy at the beginning of the test right after yielding. This value is gradually decreases as the testing progresses up to the specimen failure, however, high n-value at initial yielding indicates alloy ability for uniform deformation and alloys to achieve moderate ductility in the high strength alloys.

Case Example #11

Class 2 Alloy Behavior at Incremental Straining

Using high purity elements, 35 g alloy feedstocks of the Alloy 51 representing Class 2 steel were weighed out according to the atomic ratios provided in Table 3. The feedstock material was then placed into the copper hearth of an arc-melting system. The feedstock was arc-melted into ingots using high purity argon as a shielding gas. The ingots were flipped several times and re-melted to ensure homogeneity. The resulting ingots were then placed in a PVC chamber, melted using RF induction and then ejected onto a copper die designed for casting a 3×4 inches plate with thickness of 1.8 mm.

The resultant plate from the Alloy 51 was subjected to HIP cycle at 1100° C. for 1 hour using an American Isostatic Press Model 645 machine with a molybdenum furnace with furnace chamber size of 4 inch diameter by 5 inch height. The plate was heated at 10° C./min until the target temperature was reached and were exposed to gas pressure for 1 hour before cooling down to room temperature while in the machine.

Tensile specimens were cut out of the plates which were annealed at 850° C. for 1 hour with air cooling. The incremental tensile testing was done on an Instron mechanical testing frame (Model 3369), utilizing Instron's Bluehill control and analysis software. All tests were run at room temperature in displacement control with the bottom fixture held ridged and the top fixture moving while the load cell is attached to the top fixture. Each loading-unloading cycle was done at incremental strain of about 3%. The resultant stress-strain curves are shown in FIG. 48. As it can be seen, Class 2 alloy has demonstrated strengthening at each loading-unloading cycle confirming Dynamic Nanophase Strengthening in the alloy during deformation at each cycle. The yield stress increases from 410 MPa at initial straining to more than 1400 MPa at last straining.

Case Example #12

Class 3 Alloy Behavior at Incremental Straining

Using high purity elements, 35 g alloy feedstocks of the Alloy 6 representing Class 3 steel were weighed out according to the atomic ratios provided in Table 3. The feedstock material was then placed into the copper hearth of an arc-melting system. The feedstock was arc-melted into ingots using high purity argon as a shielding gas. The ingots were flipped several times and re-melted to ensure homogeneity. The resulting ingots were then placed in a PVC chamber, melted using RF induction and then ejected onto a copper die designed for casting a 3×4 inches plate with thickness of 1.8 mm.

The resultant plates from the alloy were subjected to HIP cycle at 1100° C. for 1 hour using an American Isostatic Press Model 645 machine with a molybdenum furnace with furnace chamber size of 4 inch diameter by 5 inch height. The plates were heated at 10° C./min until the target temperature was reached and were exposed to gas pressure for 1 hour before cooling down to room temperature while in the machine.

Tensile specimens were cut out of the plates from the selected alloy which were annealed at 700° C. for 1 hour with slow cooling. The incremental tensile testing was done on an Instron mechanical testing frame (Model 3369), utilizing Instron's Bluehill control and analysis software. All tests were run at room temperature in displacement control with the bottom fixture held ridged and the top fixture moving while the load cell is attached to the top fixture. Each loading-unloading cycle was done at incremental strain of about 1%. The resultant stress-strain curves are shown in FIG. 49. As it can be seen, Alloy 6 has demonstrated strengthening at each loading-unloading cycle confirming Dynamic Nanophase Strengthening in the alloy during deformation at each cycle. As a result of Dynamic Nanophase Strengthening, the yield stress of the alloy can be controlled in a wide range by the level of the introduced deformation broadening up the potential areas of practical application of the plate materials.

Case Example #13

Pre-Straining Effect on Mechanical Behavior of Class 2 Alloy

Using high purity elements, 35 g alloy feedstocks of the Alloy 51 representing Class 2 steel were weighed out according to the atomic ratios provided in Table 3. The feedstock material was then placed into the copper hearth of an arc-melting system. The feedstock was arc-melted into ingots using high purity argon as a shielding gas. The ingots were flipped several times and re-melted to ensure homogeneity. The resulting ingots were then placed in a PVC chamber, melted using RF induction and then ejected onto a copper die designed for casting a 3×4 inches plate with thickness of 1.8 mm.

The resultant plate from the Alloy 51 was subjected to a HIP cycle using an American Isostatic Press Model 645 machine with a molybdenum furnace with furnace chamber size of 4 inch diameter by 5 inch height. The plate was heated at 10° C./min until the target temperature of 1100° C. was reached and was exposed to an isostatic pressure of 30 ksi for 1 hour.

Tensile specimens were cut out of the plates which were annealed at 850° C. for 1 hour with air cooling. The tensile testing was done on an Instron mechanical testing frame (Model 3369), utilizing Instron's Bluehill control and analysis software. All tests were run at room temperature in displacement control with the bottom fixture held ridged and the top fixture moving with the load cell attached to the top fixture. Tensile specimen was pre-strained to 10% with subsequent unloading and then tested again up to failure. The resultant stress-strain curves are shown in FIG. 50. As it can be seen, the Alloy 51 plate after pre-straining has demonstrated limited ductility (~2.4%) but high ultimate strength of 1238 MPa and high yield stress of 1065 MPa. These high strength characteristics are a result of Dynamic Nanophase Strengthening in the specimen at straining with formation High Strength NanoModal Structure.

SEM images of microstructure in the specimen before and after pre-straining to 10% are shown in FIG. 51. Before pre-straining, the microstructure was featured with $M_2B$ boride phase distributed homogeneously in the matrix. As can be seen, the $M_2B$ boride phase is less than ~2.5 μm in diameter. After 10% pre-strain, the size and distribution of $M_2B$ boride phase do not show obvious change. In addition, the hard boride phase stays in the original location regardless of the straining. The local stress in the vicinity of the boride phase induces phase transformation in the matrix. Although small cracks are developed in some of $M_2B$ boride phase, the deformation is mainly undertaken by the matrix which is supported by the Dynamic Nanophase Strengthening.

Case Example #14

Pre-Straining Effect on Mechanical Behavior of Class 3 Alloy

Using high purity elements, 35 g alloy feedstocks of the Alloy 6 representing Class 3 steel were weighed out according to the atomic ratios provided in Table 3. The feedstock material was then placed into the copper hearth of an arc-melting system. The feedstock was arc-melted into ingots using high purity argon as a shielding gas. The ingots were flipped several times and re-melted to ensure homogeneity. The resulting ingots were then placed in a PVC chamber, melted using RF induction and then ejected onto a copper die designed for casting a 3×4 inches plate with thickness of 1.8 mm.

The resultant plate from the Alloy 6 was subjected to a HIP cycle C (at 1100° C. for 1 hour) using an American Isostatic Press Model 645 machine with a molybdenum furnace with furnace chamber size of 4 inch diameter by 5 inch height. The plates were heated at 10° C./min until the target temperature of 1100° C. was reached and were exposed to an isostatic pressure of 30 ksi for 1 hour. Tensile specimens were cut from the treated plate.

The tensile testing was done on an Instron mechanical testing frame (Model 3369), utilizing Instron's Bluehill control and analysis software. All tests were run at room temperature in displacement control with the bottom fixture held ridged and the top fixture moving with the load cell attached to the top fixture. One specimen of the Alloy 6 after HIP cycle at 1100° C. for 1 hour was tested to failure. Another specimen from the same plate was pre-strained to 3%, unloaded and then tested again to failure. The resultant stress-strain curves are shown in FIG. 52. As it can be seen, the Alloy 6 specimen after pre-straining has demonstrated much higher yield stress as-compared to non-deformed specimen confirming Dynamic Nanophase Strengthening process in the alloy upon deformation. Also, the strain hardening behavior changed dramatically and represents the properties on High Strength Lamellae NanoModal Structure #4 formed in the specimen at pre-straining.

Case Example #15

Annealing Effect on Property Recovering in Class 2 Alloy

Using high purity elements, 35 g alloy feedstocks of the Alloy 51 representing Class 2 steel were weighed out according to the atomic ratios provided in Table 3. The feedstock material was then placed into the copper hearth of an arc-melting system. The feedstock was arc-melted into ingots using high purity argon as a shielding gas. The ingots were flipped several times and re-melted to ensure homogeneity. The resulting ingots were then placed in a PVC chamber, melted using RF induction and then ejected onto a copper die designed for casting a 3×4 inches plate with thickness of 1.8 mm.

The resultant plate from the Alloy 51 was subjected to a HIP cycle using an American Isostatic Press Model 645 machine with a molybdenum furnace with furnace chamber size of 4 inch diameter by 5 inch height. The plates were heated at 10° C./min until the target temperature of 1100° C. was reached and were exposed to an isostatic pressure of 30 ksi for 1 hour. The tensile testing was done on an Instron mechanical testing frame (Model 3369), utilizing Instron's Bluehill control and analysis software. All tests were run at room temperature in displacement control with the bottom fixture held ridged and the top fixture moving with the load cell attached to the top fixture. One specimen of the Alloy 51 after HIP cycle at 1100° C. for 1 hour was tested to failure. Another specimen from the same plate was pre-strained to 10%, unloaded, annealed at 1100° C. for 1 hour and then tested again to failure. The resultant stress-strain curves are shown in FIG. 53. As it can be seen, the Alloy 51 plate after pre-straining and annealing has demonstrated a different behavior as compared to that without annealing (see Case Example #13, FIG. 50). Annealing after pre-straining leads to property recovery in the Alloy 51 plate with mechanical response similar to that for the specimens without pre-straining. A SEM image of microstructure of the gage section of the tensile specimens from Alloy 51 plate (HIPed at 1100° C. for 1 hour and heat treated at 700° C. for 1 hour with air cooling) tested to failure after pre-straining to 10% and annealing at 1100° C. for 1 hour is shown in FIG. 54. Except slight growth of the $M_2B$ boride phase, the microstructure after annealing is similar to these before pre-straining and after pre-straining shown in FIG. 51. However, the small cracks developed during the pre-straining shown in FIG. 51*b* cannot be found in the boride phase after annealing. It suggests that structural changes at straining seem to be reversed by annealing. The reversed microstructure by annealing is supported by the repeatable tensile behavior shown in FIG. 53.

Case Example #16

Annealing Effect on Property Recovering in Class 3 Alloy

Using high purity elements, 35 g alloy feedstocks of the Alloy 6 representing Class 3 steel were weighed out according to the atomic ratios provided in Table 3. The feedstock material was then placed into the copper hearth of an arc-melting system. The feedstock was arc-melted into ingots using high purity argon as a shielding gas. The ingots were flipped several times and re-melted to ensure homogeneity. The resulting ingots were then placed in a PVC chamber, melted using RF induction and then ejected onto a copper die designed for casting a 3×4 inches plate with thickness of 1.8 mm.

The resultant plate from the Alloy 6 was subjected to a HIP cycle using an American Isostatic Press Model 645 machine with a molybdenum furnace with furnace chamber size of 4 inch diameter by 5 inch height. The plates were heated at 10° C./min until the target temperature of 1100° C. was reached and were exposed to an isostatic pressure of 30 ksi for 1 hour. Tensile specimens were cut from the plate. The tensile testing was done on an Instron mechanical testing frame (Model 3369), utilizing Instron's Bluehill control and analysis software. All tests were run at room temperature in displacement control with the bottom fixture held ridged and the top fixture moving with the load cell attached to the top fixture. One specimen of the Alloy 6 after HIP cycle at 1100° C. for 1 hour was tested to failure. Another specimen from the same plate was pre-strained to 3%, unloaded, annealed at 1100° C. for 1 hour and then tested again to failure. The resultant stress-strain curves are shown in FIG. 55. As it can be seen, the Alloy 6 plate after pre-straining and annealing has demonstrated similar strength and ductility as-compared to non-deformed specimen.

SEM images of microstructure of the gage section of the tensile specimens from Alloy 6 plate (HIPed at 1100° C. for 1 hour and heat treated at 700° C. for 1 hour with slow furnace cooling) tested to failure after pre-straining to 3% and annealing at 1100° C. for 1 hour are shown in FIG. 56. Structural changes at straining (see Case Example #5) seem to be reversible by annealing with property restoration in the alloy suggesting that main strengthening at the deformation is caused by dislocation strengthening in the lamellae grains and not just by nano-precipitations.

Case Example #17

High Elongation in Class 2 Alloy from Cyclic Deformation

Using high purity elements, 35 g alloy feedstocks of the Alloy 51 representing Class 2 steel were weighed out according to the atomic ratios provided in Table 3. The feedstock material was then placed into the copper hearth of an arc-melting system. The feedstock was arc-melted into ingots using high purity argon as a shielding gas. The ingots were flipped several times and re-melted to ensure homogeneity. The resulting ingots were then placed in a PVC chamber, melted using RF induction and then ejected onto a copper die designed for casting a 3×4 inches plate with thickness of 1.8 mm.

The resultant plate from the Alloy 51 was subjected to a HIP cycle using an American Isostatic Press Model 645 machine with a molybdenum furnace with furnace chamber size of 4 inch diameter by 5 inch height. The plate was heated at 10° C./min until the target temperature of 1100° C. was reached and was exposed to an isostatic pressure of 30 ksi for 1 hour.

Tensile specimens were cut out of the plates which were annealed at 850° C. for 1 hour with air cooling. The tensile testing was done on an Instron mechanical testing frame (Model 3369), utilizing Instron's Bluehill control and analysis software. All tests were run at room temperature in displacement control with the bottom fixture held ridged and the top fixture moving with the load cell attached to the top fixture. The specimen was pre-strained to 10% with subsequent annealing at 1100° C. for 1 hour. Then it was deformed to 10% again twice with subsequent unloading and annealed at 1100° C. for 1 hour. The tensile curves for 3 rounds of pre-straining and testing to failure are shown in FIG. 57. An increase in strength was observed in the specimen after 3 rounds of pre-straining that is a result of Dynamic Nanophase Strengthening and annealing between the deformation leads to just partial recovery of the properties. The elongation at final test decreased as compared to that of the specimen tested to failure without pre-straining in the same conditions but the total elongation of more than 30% achieved through straining/annealing rounds. The image of the specimen after 3 rounds of pre-straining to 10% with annealing between rounds is shown in FIG. 58. Note that no necking observed in the specimen confirming uniform deformation of the Alloy 51. Higher ductility is expected through optimization of the annealing parameters between deformation rounds. SEM image of microstructure in the gage section of the tensile specimens from Alloy 51 after cycling deformation to 10% and annealing at 1100° C. for 1 hour (3 times), then tested to failure is shown in FIG. 59. It can be seen that the $M_2B$ phase grew to a larger size after cycling deformation.

For more detailed structural analysis, TEM specimens were prepared from the grip and from the gage sections of the specimen after cycling deformation. TEM specimens were made first by mechanical grinding/polishing, and then electrochemical polishing. These specimens were examined in a JEOL JEM-2100 HR Analytical Transmission Electron Microscope operated at 200 kV. TEM images are presented in FIG. 60. TEM study shows that the $M_2B$ phase grew to a larger size after annealing 3 times in the specimen, consistent with the observation by SEM in FIG. 59. TEM also suggests that this $M_2B$ phase is harder than the matrix and does not plastically deform. Moreover, Static Nanophase Refinement can be found in the specimen after annealing although its extent is not as effective as the dynamic nanophase strengthening. In the specimen tested to final failure, more fine grains are found due to the dynamic nanophase strengthening mechanism, as shown by TEM. Particularly, the refinement takes place effectively in the vicinity of the $M_2B$ phase where the local stress level is much higher. It contributes to the property by increasing the strain hardening rate through the activating the dynamic nanophase refinement and pinning effect. Additionally, nanoscale precipitates are revealed by TEM in the matrix grains. These nano-precipitates are similar to what were found in the Alloy 51 after tensile deformation shown in FIG. 33*b*, which are believed to be the new hexagonal phases confirmed by X-ray studies.

Case Example #18

Enhanced Elongation in Class 3 Alloy from Cyclic Deformation

Using high purity elements, 35 g alloy feedstocks of the Alloy 6 representing Class 3 steel were weighed out according to the atomic ratios provided in Table 3. The feedstock material was then placed into the copper hearth of an arc-melting system. The feedstock was arc-melted into ingots using high purity argon as a shielding gas. The ingots were flipped several times and re-melted to ensure homogeneity. The resulting ingots were then placed in a PVC chamber, melted using RF induction and then ejected onto a copper die designed for casting a 3×4 inches plate with thickness of 1.8 mm.

The resultant plate from the Alloy 6 was subjected to a HIP cycle using an American Isostatic Press Model 645 machine with a molybdenum furnace with furnace chamber size of 4 inch diameter by 5 inch height. The plates were heated at 10° C./min until the target temperature of 1100° C. was reached and were exposed to an isostatic pressure of 30 ksi for 1 hour. Tensile specimen was cut from the plate and heat treated at 700° C. for 1 hour with slow furnace cooling. The tensile specimen was pre-strained to 3% with subsequent annealing at 1100° C. for 1 hour. Then it was deformed to 3% again twice with subsequent unloading and annealed at 1100° C. for 1 hour. The tensile curves for 3 rounds of pre-straining and testing to failure are shown in FIG. 61. A decrease in strength was observed in the specimen after 3 rounds of pre-straining and annealing while the total elongation increased as compared to that of the specimen tested to failure right after HIP cycle (FIG. 52, curve a).

Case Example #19

Hot Formability of Class 3 Alloys

The study was performed to evaluate formability of the alloys described in this application at elevated temperatures. In a case of plate production by Twin Roll Casting or Thin Slab Casting, utilized alloys should have good formability to be processed by hot rolling as a step at production process. Moreover, hot forming ability is a critical feature of the high strength alloys in terms of their usage for part production with different configuration by such methods as hot pressing, hot stamping, etc.

Using high purity elements, 35 g alloy feedstocks of the Alloy 20 and Alloy 22 representing Class 3 steel were weighed out according to the atomic ratios provided in Table 3. The feedstock material was then placed into the copper hearth of an arc-melting system. The feedstock was arc-melted into an ingot using high purity argon as a shielding gas. The ingots were flipped several times and re-melted to ensure homogeneity. The resulting ingots were then placed in a PVC chamber, melted using RF induction and then ejected onto a copper die designed for casting a 3×4 inches plates with thickness of 1.8 mm.

Each resultant plate from the selected alloys was subjected to a HIP cycle specified in Table 18 using an American Isostatic Press Model 645 machine with a molybdenum furnace with furnace chamber size of 4 inch diameter by 5 inch height. The plates were heated at 10° C./min until the target temperature specified for each plate in Table 18 was reached and were exposed to an isostatic pressure of 30 ksi for 1 hour. Heat treatment specified in Table 18 for each plate was applied after HIP cycle. Tensile specimens with a gage length of 12 mm and a width of 3 mm were cut from the treated plates.

The tensile measurements were done at strain rate of 0.001 $s^{-1}$ at temperatures specified in Table 18. In Table 19, a summary of the tensile test results including total tensile elongation (strain), yield stress, ultimate tensile strength, and location of the failure are shown for the treated plates from Alloy 20 and Alloy 22. Room temperature tensile property ranges for the same alloy after the same treatments are listed for comparison. As can be seen, high strength alloys with ultimate strength up to 1650 MPa at room temperature show high ductility at elevated temperatures (up to 88.5%) demonstrating high hot forming ability. High temperature ductility of the alloys strongly depends on alloy chemistry, thermal mechanical treatment parameters and testing temperature. An example of tested specimen is shown in FIG. 62.

TABLE 18

Plate Treatment and Test Temperatures

| Alloy | HIP Cycle | Heat Treatment | Test Temperature [° C.] |
|---|---|---|---|
| Alloy 20 | B | T3 | 850 |
| | | | 700 |
| | D | T3 | 700 |
| Alloy 22 | B | T3 | 700 |
| | D | T3 | 850 |

TABLE 19

Elevated Temperature Tensile Test Results

| Alloy | Treatment | Test Temperature [° C.] | Elongation at Fracture [%] | Yield Stress [MPa] | Ultimate Strength [MPa] | Location of Failure |
|---|---|---|---|---|---|---|
| Alloy 20 | HIP B & D T3 | RT | 3.4-7.4 | 850-1145 | 1525-1653 | G |
| | HIP B T3 | 700 | 17.5 | 92.4 | 153.1 | G |
| | HIP D T3 | 700 | 57.5 | 66.9 | 157.9 | G |
| | | | 88.5 | 68.3 | 157.9 | G |
| | HIP D T3 | 850 | 27 | 36.5 | 72.4 | G |
| | | | 23 | 40.0 | 71.7 | G |
| | | | 23 | 41.4 | 73.1 | G |
| Alloy 22 | HIP B & D T3 | RT | 5.2-9.8 | 844-990 | 1423-1528 | G |
| | HIP B T3 | 700 | 34.5 | 145.5 | 195.8 | E |
| | | | 7.5 | 151.7 | 194.4 | H |
| | HIP D T3 | 850 | 13.5 | 43.4 | 64.8 | G |
| | | | 6 | 32.4 | 68.9 | G |
| | | | 4 | 13.8 | 20.0 | G |

G—Fracture within gage length
E—Fracture at fillet
H—Fractured outside gage length Case Example #20

Copper Effect on Structural Formation in Hot Formable Class 3 Alloys

Microstructure of the gage of selected specimens from Alloy 20 and Alloy 22 representing Class 3 steel and tested in tension at elevated temperatures as described in Case Example #19, were examined both by SEM and TEM. Samples that were cut out from the gage of the tested specimens were metallographically polished in stages down to 0.02 μm Grit to ensure smooth samples for scanning electron microscopy (SEM) analysis. SEM was done using a Zeiss EVO-MA10 model with the maximum operating voltage of 30 kV manufactured by Carl Zeiss SMT Inc. Example SEM backscattered electron micrographs taken from the gages of tested specimens are shown in FIG. 63 through FIG. 66.

FIG. 63 and FIG. 64 show the backscattered SEM micrographs of the gage microstructure in the tensile specimen from Alloy 20 after the same treatment but tested at different temperatures. In the Alloy 20 specimens, cavity (the black areas in the figures) is found after high temperature tests at both 850° C. and 700° C. The grey boride pinning phase (~1 μm in size) is homogeneously distributed in the matrix. The boride phase grew larger (up to 2 μm in diameter) after tension at 700° C. In addition, after test at 700° C., lamellae structure is present in the specimen, which was not seen in the specimens after test at 850° C. It is obvious that mechanical behavior of this alloy is strongly affected by testing temperature.

Much less cavitation was observed in the Alloy 22 gage specimens (FIG. 65 and FIG. 66) as compared to Alloy 20. Moreover, the boride phase (the grey phase in Figures) is smaller in the specimen tested at 700° C. (mostly less than 2 μm) but has higher density. In the specimen tested at 850° C., the boride phase is isolated and ranges from 0.2 μm to 2 μm in size. The different morphology after tension at 700° C. can be related to the microstructure change in the matrix.

TEM was used to characterize the detailed microstructure after the high temperature deformation in the specimens from both alloys. TEM specimens were prepared from the gage of the specimens after high temperature tests until failure. The samples were cut from the tensile gage, then ground and polished to a thickness of 30~40 μm. Discs of 3 mm in diameter were punched from these thin samples, and the final thinning was done by twin-jet electropolishing using a 30% $HNO_3$ in methanol base. These specimens were examined in a JEOL JEM-2100 HR Analytical Transmission Electron Microscope operated at 200 kV.

FIG. 67 and FIG. 68 show the bright-field TEM micrographs of the microstructure in the gage of the Alloy 20 specimen tested at 700° C. and 850° C., respectively. The large black phase of 1~2 μm in size is a boride phase corresponding to gray phase on SEM micrograph (FIG. 63 and FIG. 64). In addition, high density of nano-precipitates was found in the Alloy 20 specimen after high temperature tension at both 700° C. and 850° C. The size of the nano-precipitates ranges typically between 10 and 20 nm and dispersed in the matrix grains, as revealed by high magnification images. The size of nano-precipitates in the specimen tested at 700° C. is smaller and the density of nano-precipitates is higher as compared to that tested at 850° C. that can be a reason for higher ductility (88.5%).

Energy dispersive spectrometry (EDS) was utilized to characterize the composition in the nano-precipitates. To compare the difference, both the nano-precipitates and matrix are probed by EDS. In FIG. 69 the composition of the nano-precipitate and the matrix in Alloy 20 specimen after test at 700° C. High content of Cu but low content of Fe is found in the nano-precipitate. By contrast, the chemical composition in the matrix is high in Fe and low in Cu. Also, higher concentrations of Si and Ni are found in the matrix. In addition, oxygen was detected in both matrix and precipitates. Similar results were obtained for the Alloy 20 specimen tested at 850° C.

In Alloy 22 specimens, no nano-precipitates were found as compared to that in Alloy 20 specimens. Alloy 22 does not contain copper. However, grain refinement through phase transformation occurred in Alloy 22 specimens tested at both 700° C. and 850° C. The extent of grain refinement is much larger at 700° C. than at 850° C. FIG. 70 and FIG. 71 show the TEM images of Alloy 22 gage from the specimens tested at 700° C. and 850° C., respectively. In both cases, refined grains were observed. At 850° C., the specimen exhibited some extent of grain refinement while other deformation mode such as stacking faults was also observed (FIG. 71). But, at 700° C., grain refinement is much more obvious. As shown in FIG. 70, the microstructure contains mostly refined grains of 50~500 nm in size. This nanophase refinement is confirmed by the selected area electron diffraction and dark-field TEM image shown in FIG. 70*b*. The selected area diffraction was taken from the area shown in FIG. 70*a* and shows ring pattern confirming the fine grained structure. The high extent of grain refinement at 700° C. results in the higher tensile ductility.

Case Example #21

Alloy Casting Using Commercial Feedstock

The chemistries listed in Table 20 have been used for material processing through plate casting in a Pressure Vacuum Caster (PVC). Using ferroadditives and other readily commercially available constituents, 35 g commercial purity (CP) feedstocks were weighed out according to the atomic ratio provided in Table 20. The feedstock material was then placed into the copper hearth of an arc-melting system. The feedstock was arc-melted into an ingot using high purity argon as a shielding gas. The ingots were flipped several times and re-melted to ensure homogeneity. The resulting ingots were then placed in a PVC chamber, melted using RF induction and then ejected into a copper die designed for casting 3 by 4 inches plates with thickness of 1.8 mm mimicking alloy solidification into plate with similar thickness between rolls at Stage 1 of Twin Roll Casting process.

TABLE 20

Chemical Composition of the Alloys

| Alloy | Fe | Ni | Mn | B | Si |
|---|---|---|---|---|---|
| Alloy 64 | 72.15 | 8.59 | 6.76 | 4.70 | 7.80 |
| Alloy 87 | 71.75 | 8.59 | 7.16 | 4.70 | 7.80 |
| Alloy 88 | 71.35 | 8.59 | 7.56 | 4.70 | 7.80 |
| Alloy 89 | 70.95 | 8.59 | 7.96 | 4.70 | 7.80 |
| Alloy 90 | 72.15 | 8.19 | 7.16 | 4.70 | 7.80 |
| Alloy 91 | 72.15 | 7.79 | 7.56 | 4.70 | 7.80 |
| Alloy 92 | 72.15 | 7.39 | 7.96 | 4.70 | 7.80 |
| Alloy 93 | 72.55 | 8.59 | 6.76 | 4.70 | 7.40 |
| Alloy 94 | 71.75 | 8.59 | 6.76 | 5.10 | 7.80 |
| Alloy 95 | 72.15 | 8.59 | 6.76 | 5.10 | 7.40 |
| Alloy 96 | 73.15 | 8.59 | 6.76 | 4.10 | 7.40 |

Thermal analysis was done on the as-solidified cast plate samples on a NETZSCH DSC 404F3 PEGASUS V5 system. Differential thermal analysis (DTA) and differential scanning calorimetry (DSC) were performed at a heating rate of 10° C./minute with samples protected from oxidation through the use of flowing ultra-high purity argon. DTA results are shown in Table 21 indicating the melting behavior for the alloys. As can be seen from the tabulated results in Table 21, the melting occurs in 1 or 2 stages with initial melting observed from ~1114° C. depending on alloy chemistry. Final melting temperature is up to ~1380° C. Variations in melting behavior may also reflect complex phase formation at chill surface processing of the alloys depending on their chemistry.

TABLE 21

Differential Thermal Analysis Data for Melting Behavior

| Alloy | Onset (° C.) | Peak #1 (° C.) | Peak #2 (° C.) |
|---|---|---|---|
| Alloy 64 | 1125 | 1150 | 1342 |
| Alloy 87 | 1115 | 1152 | 1350 |
| Alloy 88 | 1115 | 1143 | 1330 |
| Alloy 89 | 1119 | 1143 | 1353 |
| Alloy 90 | 1122 | 1145 | 1349 |
| Alloy 91 | 1122 | 1150 | 1333 |
| Alloy 92 | 1121 | 1150 | 1344 |
| Alloy 93 | 1120 | 1142 | 1362 |
| Alloy 94 | 1114 | 1140 | 1361 |
| Alloy 95 | 1121 | 1147 | 1336 |
| Alloy 96 | 1127 | 1145 | 1361 |

The density of the alloys was measured on arc-melt ingots using the Archimedes method in a specially constructed balance allowing weighing in both air and distilled water. The density of each alloy is tabulated in Table 22 and was found to vary from 7.63 g/cm$^3$ to 7.66 g/cm$^3$. Experimental results have revealed that the accuracy of this technique is ±0.01 g/cm$^3$.

TABLE 22

Summary of Density Results (g/cm$^3$)

| Alloy | Density (avg) |
|---|---|
| Alloy 64 | 7.64 |
| Alloy 87 | 7.64 |
| Alloy 88 | 7.66 |
| Alloy 89 | 7.66 |
| Alloy 90 | 7.63 |
| Alloy 91 | 7.64 |
| Alloy 92 | 7.65 |
| Alloy 93 | 7.65 |
| Alloy 94 | 7.63 |
| Alloy 95 | 7.63 |
| Alloy 96 | 7.66 |

Each plate from each alloy was subjected to Hot Isostatic Pressing (HIP) using an American Isostatic Press Model 645 machine with a molybdenum furnace and with a furnace chamber size of 4 inch diameter by 5 inch height. The plates were heated at 10° C./min until the target temperature was reached and were exposed to gas pressure for specified time which was held for 1 hour for these studies. HIP cycle parameters are listed in Table 23. The key aspect of the HIP cycle was to remove macrodefects such as pores and small inclusions by mimicking hot rolling at Stage 2 of Twin Roll Casting process or at Stage 1 or Stage 2 of Thin Slab Casting process.

TABLE 23

HIP Cycle Parameters

| HIP Cycle ID | HIP Cycle Temperature [° C.] | HIP Cycle Pressure [psi] | HIP Cycle Time [hr] |
|---|---|---|---|
| B | 1000 | 30,000 | 1 |
| D | 1100 | 30,000 | 1 |

The tensile specimens were cut from the plates after HIP cycle using wire electrical discharge machining (EDM). The tensile properties were measured on an Instron mechanical testing frame (Model 3369), utilizing Instron's Bluehill control and analysis software. All tests were run at room temperature in displacement control with the bottom fixture held ridged and the top fixture moving with the load cell attached to the top fixture. In Table 24, a summary of the tensile test results including total tensile elongation (strain), yield stress, and ultimate tensile strength are shown for the cast plates after HIP cycle. Additional column is added that specifies the alloy mechanical response in correspondence with the class of behavior (FIG. 6). Mechanical characteristic values strongly depend on alloy chemistry and HIP cycle parameters. As can be seen, the tensile strength values varied from 669 to 1236 MPa. The total strain value varied from 7.74 to 20.83%. All alloys have demonstrated Class 2 behavior.

TABLE 24

Summary on Tensile Test Results for Cast Plates after HIP Cycle

| Alloy | HIP Cycle | Yield Stress (MPa) | Ultimate Strength (MPa) | Tensile Elongation (%) | Curve Type |
|---|---|---|---|---|---|
| Alloy 64 | B | 379 | 1124 | 16.49 | Class 2 |
| Alloy 87 | B | 395 | 802 | 12.16 | Class 2 |
| | | 381 | 1041 | 17.95 | Class 2 |
| | | 405 | 874 | 13.87 | Class 2 |
| | D | 375 | 1005 | 18.34 | Class 2 |
| Alloy 88 | B | 383 | 949 | 16.51 | Class 2 |
| | | 370 | 922 | 16.65 | Class 2 |
| | D | 341 | 959 | 20.83 | Class 2 |
| Alloy 89 | B | 409 | 951 | 18.22 | Class 2 |
| | | 388 | 728 | 7.74 | Class 2 |
| | D | 374 | 924 | 18.83 | Class 2 |
| | | 386 | 872 | 16.50 | Class 2 |
| Alloy 90 | B | 384 | 994 | 15.54 | Class 2 |
| | | 392 | 742 | 9.90 | Class 2 |
| Alloy 91 | B | 407 | 709 | 8.19 | Class 2 |
| | | 387 | 932 | 13.11 | Class 2 |
| | | 363 | 768 | 11.18 | Class 2 |
| | D | 371 | 732 | 9.99 | Class 2 |
| | | 388 | 786 | 11.03 | Class 2 |
| Alloy 92 | B | 363 | 825 | 10.67 | Class 2 |
| | | 421 | 939 | 13.23 | Class 2 |
| | | 390 | 849 | 12.16 | Class 2 |
| Alloy 93 | B | 412 | 1236 | 16.89 | Class 2 |
| | | 373 | 721 | 9.16 | Class 2 |
| | | 329 | 669 | 9.17 | Class 2 |
| | D | 308 | 707 | 11.08 | Class 2 |
| | | 352 | 960 | 15.32 | Class 2 |
| | | 329 | 985 | 15.73 | Class 2 |
| Alloy 94 | B | 415 | 997 | 14.18 | Class 2 |
| | D | 377 | 975 | 15.93 | Class 2 |
| | | 365 | 881 | 13.57 | Class 2 |
| | D | 397 | 1014 | 16.42 | Class 2 |
| | | 374 | 852 | 12.86 | Class 2 |
| Alloy 96 | B | 372 | 1124 | 14.88 | Class 2 |
| | D | 365 | 793 | 10.16 | Class 2 |
| | | 352 | 845 | 11.95 | Class 2 |

After HIP cycle, the plate material was heat treated in a box furnace at parameters specified in Table 25. The key aspect of the heat treatment after HIP cycle was to estimate thermal stability and property changes of the alloys by mimicking Stage 3 of the Twin Roll Casting process and also Stage 3 of the Thin Slab Casting process. In a case of air cooling, the specimens were held at the target temperature for a target period of time, removed from the furnace and cooled down in air. In a case of slow cooling, the specimens were heated to the target temperature and then cooled with the furnace at cooling rate of 1° C./min.

TABLE 25

| Heat Treatment Parameters | | | |
|---|---|---|---|
| Heat Treatment (ID) | Temperature (° C.) | Dwell Time (min) | Cooling |
| T1 | 700 | 60 | In air |
| T2 | 700 | N/A | Slow cooling |
| T3 | 850 | 60 | In air |
| T4 | 900 | 60 | In air |

The tensile specimens were cut from the plates after HIP cycle and heat treatment using wire electrical discharge machining (EDM). Tensile properties were measured on an Instron mechanical testing frame (Model 3369), utilizing Instron's Bluehill control and analysis software. All tests were run at room temperature in displacement control with the bottom fixture held ridged and the top fixture moving; the load cell is attached to the top fixture. In Table 26, a summary of the tensile test results including total tensile elongation (strain), yield stress, and ultimate tensile strength are shown for the cast plates after HIP cycle and heat treatment. Additional column is added that specifies the alloy mechanical response in correspondence with the class of behavior (FIG. 6). All alloys in Table 26 have demonstrated Class 2 with tensile strength of the alloys in a range from 835 to 1336 MPa. The total strain value varies from 11.64 to 21.88% providing high strength/high ductility property combination.

High strength/high ductility property combination in the alloys with Class 2 behavior related to the formation of Nano-Modal Structure (Structure #2, FIG. 3) prior the tensile testing that can occur at any stage of twin roll production or thin slab casting production but mainly at Stage 3 for most alloys in this application. Tensile deformation of Structure #2 leads to its transformation into Structure #3 specified as High Strength NanoModal Structure through Dynamic Nanophase Strengthening resulting in high strength/high ductility combination recorded.

TABLE 26

Summary on Tensile Test Results for Cast Plates after HIP Cycle and Heat Treatment

| Alloy | HIP Cycle | Heat Treatment | Yield Stress (MPa) | Ultimate Strength (MPa) | Tensile Elongation (%) | Curve Type |
|---|---|---|---|---|---|---|
| Alloy 64 | B | T2 | 399 | 953 | 12.83 | Class 2 |
| | | T3 | 362 | 998 | 13.05 | Class 2 |
| | D | T3 | 370 | 1256 | 20.57 | Class 2 |
| | | | 390 | 1135 | 15.69 | Class 2 |
| Alloy 87 | B | T1 | 382 | 948 | 15.02 | Class 2 |
| | | | 368 | 930 | 15.27 | Class 2 |
| | | T2 | 409 | 933 | 14.87 | Class 2 |
| | | | 395 | 1019 | 17.03 | Class 2 |
| | | T3 | 384 | 967 | 16.02 | Class 2 |
| | D | T1 | 373 | 1212 | 21.36 | Class 2 |
| | | | 370 | 1022 | 17.51 | Class 2 |
| | | T2 | 377 | 1024 | 17.59 | Class 2 |
| | | T3 | 368 | 1007 | 15.81 | Class 2 |
| Alloy 88 | B | T1 | 375 | 1167 | 21.47 | Class 2 |
| | | T2 | 397 | 910 | 14.81 | Class 2 |
| | | T3 | 373 | 999 | 20.52 | Class 2 |
| | | T4 | 351 | 931 | 16.83 | Class 2 |
| | D | T1 | 378 | 900 | 17.17 | Class 2 |
| | | T2 | 354 | 843 | 16.28 | Class 2 |
| | | | 385 | 887 | 16.78 | Class 2 |
| | | T3 | 361 | 835 | 15.31 | Class 2 |

TABLE 26-continued

Summary on Tensile Test Results for Cast Plates after HIP Cycle and Heat Treatment

| Alloy | HIP Cycle | Heat Treatment | Yield Stress (MPa) | Ultimate Strength (MPa) | Tensile Elongation (%) | Curve Type |
|---|---|---|---|---|---|---|
| Alloy 89 | B | T1 | 400 | 842 | 13.87 | Class 2 |
| | | T3 | 401 | 929 | 17.21 | Class 2 |
| | | T4 | 356 | 1014 | 20.48 | Class 2 |
| | | | 413 | 970 | 18.40 | Class 2 |
| | D | T2 | 354 | 949 | 18.18 | Class 2 |
| | | | 375 | 849 | 15.27 | Class 2 |
| | | T3 | 366 | 1041 | 21.50 | Class 2 |
| | | T4 | 350 | 960 | 20.28 | Class 2 |
| Alloy 90 | B | T1 | 408 | 1120 | 16.57 | Class 2 |
| | | T2 | 391 | 1046 | 14.84 | Class 2 |
| | | | 405 | 912 | 14.89 | Class 2 |
| | | | 390 | 855 | 11.64 | Class 2 |
| | | T3 | 369 | 988 | 13.98 | Class 2 |
| | | | 369 | 940 | 13.87 | Class 2 |
| | | | 388 | 915 | 12.66 | Class 2 |
| | | T4 | 351 | 1111 | 15.67 | Class 2 |
| | D | T2 | 389 | 1102 | 15.96 | Class 2 |
| | | | 384 | 1077 | 14.16 | Class 2 |
| | | | 387 | 862 | 11.91 | Class 2 |
| | | T3 | 371 | 1170 | 17.49 | Class 2 |
| | | | 375 | 1113 | 16.21 | Class 2 |
| | | | 383 | 1265 | 18.51 | Class 2 |
| | | T4 | 364 | 1083 | 15.61 | Class 2 |
| | | | 356 | 1024 | 15.35 | Class 2 |
| Alloy 91 | B | T4 | 398 | 933 | 12.59 | Class 2 |
| | | | 397 | 1025 | 14.18 | Class 2 |
| | | | 397 | 958 | 13.19 | Class 2 |
| | D | T1 | 369 | 859 | 12.85 | Class 2 |
| | | T2 | 374 | 947 | 14.45 | Class 2 |
| | | T3 | 377 | 1268 | 20.89 | Class 2 |
| | | | 364 | 928 | 13.92 | Class 2 |
| | | | 371 | 1129 | 17.49 | Class 2 |
| Alloy 92 | B | T2 | 400 | 956 | 13.88 | Class 2 |
| | | T3 | 372 | 1007 | 15.30 | Class 2 |
| | | | 383 | 889 | 12.63 | Class 2 |
| | | | 389 | 1105 | 16.43 | Class 2 |
| | | T4 | 363 | 1005 | 14.70 | Class 2 |
| | | | 319 | 949 | 14.31 | Class 2 |
| | | | 353 | 1074 | 15.76 | Class 2 |
| | D | T2 | 376 | 853 | 12.20 | Class 2 |
| | | T3 | 383 | 1192 | 19.72 | Class 2 |
| | | T4 | 345 | 1052 | 16.71 | Class 2 |
| Alloy 93 | B | T1 | 385 | 1084 | 14.92 | Class 2 |
| | | | 372 | 1010 | 13.92 | Class 2 |
| | | T2 | 361 | 990 | 13.00 | Class 2 |
| | | | 380 | 1080 | 14.79 | Class 2 |
| | | | 399 | 1083 | 14.25 | Class 2 |
| | | T3 | 379 | 1065 | 14.71 | Class 2 |
| | | T4 | 367 | 1096 | 15.22 | Class 2 |
| | | | 376 | 1145 | 15.81 | Class 2 |
| | D | T1 | 362 | 1082 | 17.10 | Class 2 |
| | | | 362 | 1093 | 18.07 | Class 2 |
| | | T2 | 360 | 1044 | 15.84 | Class 2 |
| | | | 369 | 1053 | 17.04 | Class 2 |
| | | | 353 | 1031 | 15.62 | Class 2 |
| | | T3 | 360 | 1137 | 17.78 | Class 2 |
| | | | 351 | 892 | 14.26 | Class 2 |
| | | T4 | 348 | 1012 | 15.87 | Class 2 |
| | | | 362 | 1080 | 16.01 | Class 2 |
| Alloy 94 | B | T3 | 397 | 891 | 11/97 | Class 2 |
| | D | T1 | 375 | 1054 | 16.26 | Class 2 |
| | | | 375 | 1086 | 16.63 | Class 2 |
| | | T2 | 384 | 926 | 12.72 | Class 2 |
| | | | 400 | 881 | 12.70 | Class 2 |
| | | T3 | 377 | 1233 | 17.89 | Class 2 |
| | | | 377 | 1205 | 17.34 | Class 2 |
| | | T4 | 368 | 1120 | 15.97 | Class 2 |
| | | | 392 | 1122 | 15.98 | Class 2 |
| | | | 364 | 1164 | 16.95 | Class 2 |
| Alloy 95 | B | T2 | 389 | 1002 | 14.42 | Class 2 |
| | | T7 | 375 | 1156 | 16.26 | Class 2 |
| | | | 362 | 1018 | 14.07 | Class 2 |
| | | | 364 | 890 | 12.02 | Class 2 |

TABLE 26-continued

Summary on Tensile Test Results for Cast Plates after HIP Cycle and Heat Treatment

| Alloy | HIP Cycle | Heat Treatment | Yield Stress (MPa) | Ultimate Strength (MPa) | Tensile Elongation (%) | Curve Type |
|---|---|---|---|---|---|---|
| | D | T1 | 359 | 1248 | 21.88 | Class 2 |
| | | | 351 | 879 | 13.17 | Class 2 |
| | | T2 | 370 | 1075 | 16.42 | Class 2 |
| | | T3 | 382 | 1084 | 16.83 | Class 2 |
| | | | 374 | 1102 | 19.50 | Class 2 |
| | | | 373 | 1090 | 17.08 | Class 2 |
| | | T4 | 374 | 926 | 13.29 | Class 2 |
| | | | 357 | 1203 | 16.94 | Class 2 |
| Alloy 96 | B | T2 | 381 | 835 | 11.18 | Class 2 |
| | | T3 | 328 | 951 | 12.52 | Class 2 |
| | | | 365 | 1273 | 18.51 | Class 2 |
| | D | T2 | 354 | 917 | 12.42 | Class 2 |
| | | | 349 | 1141 | 15.59 | Class 2 |
| | | T3 | 333 | 1126 | 17.20 | Class 2 |
| | | T4 | 351 | 1275 | 18.25 | Class 2 |
| | | | 346 | 1336 | 20.25 | Class 2 |
| | | | 320 | 929 | 12.95 | Class 2 |

Case Example #22

Thick Plate Casting

Using high purity elements, feedstocks with different mass of the Alloy 6 were weighed out according to the atomic ratios provided in Table 3. The feedstock material was then placed into the crucible of a custom-made vacuum casting system. The feedstock was melted using RF induction and then ejected onto a copper die designed for casting a 4×5 inches plate with thickness of 1 inch. Note that the plate that was cast was much thicker than the previous 1.8 mm plates and illustrate the potential for the chemistries in Table 3 to be processed by the Thin Slab Casting process.

The thick plate was cut in half. One part was held in as-cast state. The second part was subjected to HIP cycle at 1000° C. using an American Isostatic Press Model 645 machine with a molybdenum furnace with furnace chamber size of 4 inch diameter by 5 inch height. The plate was heated at 10° C./min until the target temperature of 1000° C. was reached and was exposed to an isostatic pressure of 30 ksi for 1 hour. Thin plates with thickness of 2 mm were cut from the thick plate in as-cast and HIPed conditions. Three thin plates were cut from the plate after the HIP cycle, which were heat treated at different parameters specified in Table 27. Tensile specimens then were cut from these thin plates in as-cast and HIPed/heat treated conditions. Examples of the partial plate (A), a thin plate from the plate (B) and tensile specimens (C) are shown in FIG. 72.

The tensile specimens were cut from the plate using wire electrical discharge machining (EDM). The tensile properties were measured on an Instron mechanical testing frame (Model 3369), utilizing Instron's Bluehill control and analysis software. All tests were run at room temperature in displacement control with the bottom fixture held ridged and the top fixture moving with the load cell attached to the top fixture. In Table 27, a summary of the tensile test results including total tensile elongation (strain), yield stress and, ultimate tensile strength is shown for 1 inch thick plate in as-cast state and after HIP cycle with subsequent heat treatments. As can be seen, the tensile strength values vary from 729 to 1175 MPa. The total elongation value varies from 0.49 to 1.05%. Tensile strength and ductility are also illustrated in FIG. 73. Note that these properties are not optimized at the much greater cast thickness but represent clear indications of the promise of the new steel type, enabling structures and mechanisms for large scale production through Thin Slab Casting.

TABLE 27

Summary of Tensile Test Results for 1 inch Thick Plate from Alloy 6

| Plate Thickness (inches) | Yield Stress (MPa) | Ultimate Strength (MPa) | Tensile Elongation (%) |
|---|---|---|---|
| As-Cast | 935 | 990 | 0.80 |
| | 847 | 851 | 0.60 |
| | 635 | 729 | 0.49 |
| HIP cycle at 1000° C.; heat treatment at 700° C. for 1 hr with air cooling | 995 | 1052 | 0.74 |
| | 863 | 1036 | 0.78 |
| HIP cycle at 1000° C.; heat treatment at 700° C. for 1 hr with slow cooling | 969 | 1066 | 0.57 |
| | 928 | 1086 | 0.68 |
| HIP cycle at 1000° C.; heat treatment at 850° C. for 1 hr with air cooling | 1057 | 1175 | 1.05 |

Applications

The alloys herein in either forms as Class 2 or Class 3 Steel have a variety of applications. These include but are not limited to structural components in vehicles, including but not limited to parts and components in the vehicular frame, front end structures, floor panels, body side interior, body side outer, rear structures, as well as roof and side rails. While not all encompassing, specific parts and components would include B-pillar major reinforcement, B-pillar belt reinforcement, front rails, rear rails, front roof header, rear roof header, A-pillar, roof rail, C-pillar, roof panel inners, and roof bow. The Class 2 and/or Class 3 steel will therefore be particular useful in optimizing crash worthiness management in vehicular design and allow for optimization of key energy management zones, including engine compartment, passenger and/or trunk regions where the strength and ductility of the disclosed steels will be particular advantageous.

The alloys herein may also provide for use in additional non-vehicular applications, such as for drilling applications, which therefore may include use as a drill collars (a component that provides weight on a bit for drilling), drill pipe (hollow wall pipe used on drilling rigs to facilitate drilling), pipe casing, tool joints (i.e. the threaded ends of drill pipe) and wellheads (i.e. the component of a surface or an oil or gas well that provides the structural and pressure-containing interface for drilling and production equipment) including but not limited to ultra-deep and ultra-deep water and extended reach (ERD) well exploration. The alloys herein may also be used for a compressed gas storage tank and liquefied natural gas canisters.

Class 2 alloys have demonstrated relatively high ductility (up to 25%) at room temperature confirming their cold formability and with further development are expected to reach ductilities up to 40%. Class 3 steels are applicable for various hot forming processes and with further development cold forming applications as well.

What is claimed is:

1. A method comprising:

(a) supplying a metal alloy comprising Fe at a level of 65.5 to 80.9 atomic percent, Ni at 1.7 to 15.1 atomic percent, B at 3.5 to 5.9 atomic percent, Si at 4.4 to 8.6 atomic percent;

(b) melting said alloy and solidifying to provide a crystalline and non-glassy morphology having dendritic morphology and a matrix grain size of 500 nm to 20,000 nm and a boride grain size of 100 nm to 2500 nm; and (c) heating said alloy and forming lath structure including grains of 100 nm to 10,000 nm and boride grain size of 100 nm to 2500 nm and said alloy has a yield strength of 300 MPa to 1400 MPa, tensile strength of 350 MPa to 1600 MPa and elongation of 0-12% wherein said alloy formed in (a) or (b) is in the form of sheet at a thickness of 0.3 mm to 150 mm and width of 100 mm to 5000 mm.

2. The method of claim 1 wherein said alloy includes one or more of the following:

Cr at 0 to 8.8 atomic percent

Cu at 0 to 2.0 atomic percent

Mn at 0 to 18.8 atomic percent.

3. The method of claim 1 wherein said melting is achieved at temperatures in the range of 1100° C. to 2000° C. and solidification is achieved by cooling in the range of $11\times10^{3}$ to $4\times10^{-2}$ K/s.

4. The method of claim 1 including heating the alloy after step (c) and forming lamellae grains 100 nm to 10,000 nm thick, 0.1-5.0 microns in length and 100 nm to 1000 nm in width along with boride grains of 100 nm to 2500 nm and precipitation grains of 1 nm to 100 nm, wherein said alloy indicates a yield strength of 350 MPa to 1400 MPa.

5. The method of claim 4 wherein the alloy is stressed and forms an alloy having grains of 100 nm to 5000 nm, boride grains of 100 nm to 2500 nm, precipitation grains of 1 nm to 100 nm and said alloy has a yield strength of 350 MPa to 1400 MPa, a tensile strength of 1000 MPa to 1750 MPa and elongation of 0.5% to 15.0%.

6. The method of claim 5 wherein said alloy indicates a strain hardening coefficient of 0.1 to 0.9.

7. The method of claim 1 wherein said alloy formed in (a) or (b) is in the form of sheet.

8. The method of claim 4 wherein said alloy formed is in the form of sheet.

9. The method of claim 5 wherein said alloy formed is in the form of sheet.

10. The method of claim 4 wherein said alloy formed is positioned in a vehicle.

11. The method of claim 5 wherein said alloy formed is positioned in a vehicle.

12. The method of claim 1 wherein said alloy formed in (a) or (b) is positioned in one of a drill collar, drill pipe, tool joint, wellhead, compressed gas storage tank or liquefied natural gas canister.

13. The method of claim 4 wherein said alloy is positioned in one of a drill collar, drill pipe, pipe casing tool joint, wellhead, compressed gas storage tank or liquefied natural gas canister.

14. The method of claim 5 wherein said alloy is positioned in one of a drill collar, drill pipe, pipe casing, tool joint, wellhead, compressed gas storage tank or liquefied natural gas canister.

* * * * *